US006949729B1

(12) United States Patent
Ishikawa et al.

(10) Patent No.: US 6,949,729 B1
(45) Date of Patent: Sep. 27, 2005

(54) METHODS AND APPARATUS FOR CONTROLLING OPERATION OF A MICROWAVE OVEN IN A NETWORK

(75) Inventors: Kazuhiko Ishikawa, Yamatokoriyama (JP); Tooru Fujikawa, Kaizuka (JP); Tomoko Ota, Neyagawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/538,282

(22) Filed: Mar. 30, 2000

(30) Foreign Application Priority Data

| | | |
|---|---|---|
| Mar. 31, 1999 | (JP) | 11-093524 |
| Jun. 15, 1999 | (JP) | 11-168470 |
| Jun. 15, 1999 | (JP) | 11-168471 |
| Nov. 8, 1999 | (JP) | 11-317223 |
| Dec. 9, 1999 | (JP) | 11-345216 |

(51) Int. Cl.[7] ..... H05B 6/68

(52) U.S. Cl. ..... 219/702; 219/704; 219/714; 219/720; 99/325; 700/211

(58) Field of Search ..... 219/702, 704, 219/720, 714; 99/325; 700/211, 207

(56) References Cited

U.S. PATENT DOCUMENTS

| | | | | |
|---|---|---|---|---|
| 4,816,635 A | | 3/1989 | Edamura | |
| 5,913,210 A | * | 6/1999 | Call | 707/4 |
| 6,014,634 A | * | 1/2000 | Scroggie et al. | 705/14 |
| 6,359,270 B1 | * | 3/2002 | Bridson | 219/702 |

FOREIGN PATENT DOCUMENTS

| | | |
|---|---|---|
| JP | 56-103102 | 8/1981 |
| JP | 58-110922 A | 7/1983 |
| JP | 3-65856 A | 3/1991 |
| JP | 5-118553 A | 5/1993 |
| JP | 5-312329 | 11/1993 |
| JP | 8-096035 A | 4/1996 |
| JP | 9-60886 | 3/1997 |
| JP | 9-222229 A | 8/1997 |
| JP | 9-296931 A | 11/1997 |
| JP | 9-319687 | 12/1997 |
| JP | 10-154181 | 6/1998 |
| JP | 10-164246 A | 6/1998 |
| JP | 10276478 | 10/1998 |
| JP | 10-336613 | 12/1998 |
| JP | 10-340178 A | 12/1998 |

(Continued)

OTHER PUBLICATIONS

Kristi Essick, "Defrost, cook, send e–mail with this Internet–enabled microwave oven", Sep. 14, 1998; http://www–cgi.cnn.com/TECH/computing/9809/14/microwave.idg/ .*

Stuart, R., "Cutting the Mouse Tail," YInfrared Data Association, Northcon/98 Conference Proceedings, Seattle, WA, USA, Oct. 21–23, 1998, New York, NY, USA, IEEE, US, Oct. 21, 1998, pp. 2–5, XP010313458.

*Primary Examiner*—Philip H. Leung
(74) *Attorney, Agent, or Firm*—Birch, Stewart, Kolasch & Birch, LLP

(57) ABSTRACT

A microwave oven, a relay box communicating with the microwave oven and a personal computer communicating with the relay box are provided in private. The personal computer is connected to a host computer storing home page information, through the public Internet. A home page storing unit of the host computer stores, corresponding to each of a plurality of cooking recipes, recipe data directly recognized by microwave oven including heating control data for heating and cooking the cooking recipe by the microwave oven, a button to be operated for transferring the recipe data through the Internet to personal computer and image display data for displaying information related to the cooking recipe as a home page image display. Therefore, in accordance with the heating control data downloaded and supplied to personal computer, microwave oven is controlled to heat and cook the desired cooking recipe.

14 Claims, 116 Drawing Sheets

FOREIGN PATENT DOCUMENTS

| | | | |
|---|---|---|---|
| JP | 11-14063 | | 1/1999 |
| JP | 11-14065 | A | 1/1999 |
| JP | 11-14066 | | 1/1999 |
| JP | 11-88965 | | 3/1999 |
| JP | 11-134322 | A | 5/1999 |
| JP | 11-243874 | A | 9/1999 |
| JP | 11-266319 | A | 9/1999 |
| JP | 11-304159 | A | 11/1999 |
| JP | 2000-55374 | A | 2/2000 |
| JP | 2001-90953 | A | 4/2001 |
| JP | 2001-508207 | A | 6/2001 |

* cited by examiner

FIG.3

SHARP what's new | new products | news release | Mar.1999 Volum 96

SHORT CUT
- ZAURUS
- ZAURUS for Office Use
- Mebius
- Digital Camera
- Original Software
- Only for NETLEADERS
- Web Letter Welcome to sharp home page japan NEWS
- SHARP SPACE TOWN
- New INTRODUCTION OF Möbius NOTE PJ
- LONG AWAITED 20 inch LIQUID CRYSTAL TV EMERGES AT LAST
- EVA ANIMATOR WORKS COMPETITION Caz net: NET DATING SCHOOL THROUGH communi-pal

25 | 2000

25th ANNIVERSARY CAMPAIGN FOR LIQUID CRYSTAL DEVELOPMENT

TOPICS
- MORE SOFTWARE CONTEST WINNER ANNOUNCEMENT
- HERE COMES Zaurus "I getty" THAT CAN BE FREELY CUSTOMIZED
- NEW PRODUCT INFORMATION COLOR IMAGE SCANNER (JX-370)
- NEW PRODUCT INFORMATION 18 inch LIQUID CRYSTAL MONITOR
- NEW PRODUCT INFORMATION HAND HELD PC "Terios"

Möbius USER SUPPORT CENTER

PRINTER • SCANNER USER SUPPORT CENTER

M A R C H

SMART ENGINE

HOW TO USE SEARCH SYSTEM

TO Global Home Page

LOCAL AREA TELEPHONE NUMBER FOR OSAKA AREA "06", WHERE OUR COMPANY IS LOCATED, HAS BEEN CHANGED. PLEASE NOTE THE NEW AREA NUMBER HAS 4 DIGITS WITH ADDITIONAL 6 AT THE HEAD (06-6xxx-xxxx).

- WHAT'S NEW
- NEWS RELEASE
- TOPICS
- TECHNICAL LIBRARY
- ABOUT OUR COMPANY
- MICROWAVE OVEN
- BUSINESS HEADQUARTERS • LOCAL SITES • LOCAL SELLING GUIDANCE
- NEW PRODUCTS
- INQUIRY
- ELECTRONIC DEVICES
- JOB APPLICATIONS
- INTERNATIONAL PROCUREMENT
- ENVIRONMENTAL PHILOSOPHY
- LIST OF PRODUCTS
- EVENT • PR
- NET LEADER
- ACCOMPLISHMENTS
- QUIZ & GAMES
- PHOTOVOLTAIC GENERATION

A

*FIG.11*

```
        DB    XXX        : TOFU BASED HAMBURGER
 :
 : IMAGE DISPLAY-4
 :
C_4
        DB    412H
D_4
        DB    G_FORM
        DG    F9-1
        DB    G_MIX6   :        CUT TOFU
        DB    00Dh,04Ch,077h,0A5h,013h
        DB    064h,074h
        DB    G_MIX5   :        INTO TWO
        DB    010h,0D2h,00Fh,0B1h
        DB    004h,04Bh,062h
        DB    G_MIX5   :        WITH COOKING PAPER
        DB    00Fh,0B1h,004h,077h,06Fh
        DB    002h,06Dh,010h,02Fh,0CEh
        DB    G_MIX6   :        WRAP EACH AND PUT ON A PLATE
        DB    005h,05Dh,00Eh,0BCh,011h,011h
        DB    0C3h,010h,031h,010h,02Fh,010h
        DB    G_LZ78
        DG     PIC15   :        START HEATING
        DB    G_END
 :
                :
                :
 :
 :
 : HEATING 1
 :
        DB    001H               MICROWAVE OVEN
        DB    002H               200W
        DB    000H               —
        DB    5,0,0              5.00
        DB    C_END
```

DS13

DS14

FIG. 16

31

| | DS13 | | | DS14 |
|---|---|---|---|---|
| MI | MNi : RECIPE NAME | IDi : MATERIAL DATA | JDi : HOW-TO-COOK DATA | KDi : HEATING DATA |
| | MN1 : TOFU BASED HAMBURGER | ID1 | JD1 | KD1 |
| | MN2 : OCTOPUS, CHILI FLAVOR | ID2 | JD2 | KD2 |
| | MN3 : CHINESE STEAMED RICE | ID3 | JD3 | KD3 |
| | MN4 : RICE BASED PIZZA | ID4 | JD4 | KD4 |
| | MN5 : STUFFED EGG PLANT | ID5 | JD5 | KD5 |
| | | | | |

FIG.20A

31

DS13 DS14

| MI | MNi : RECIPE NAME | IDi : MATERIAL DATA | JDi : HOW-TO-COOK DATA | KDi : HEATING DATA |
|---|---|---|---|---|
| | MN1 : TOFU BASED HAMBURGER | ID1 | JD1 | KD1 |
| | MN2 : OCTOPUS, CHILI FLAVOR | ID2 | JD2 | KD2 |
| | MN3 : CHINESE STEAMED RICE | ID3 | JD3 | KD3 |
| | MN4 : RICE BASED PIZZA | ID4 | JD4 | KD4 |
| | MN5 : STUFFED EGG PLANT | ID5 | JD5 | KD5 |
| | | | | |

FIG.20B

31

DS13 DS14

| MI | MNi : RECIPE NAME | IDi : MATERIAL DATA | JDi : HOW-TO-COOK DATA | KDi : HEATING DATA |
|---|---|---|---|---|
| | MN1 : TOFU BASED HAMBURGER | ID1 | JD1 | KD1 |
| | MN2 : OCTOPUS, CHILI FLAVOR | ID2 | JD2 | KD2 |
| | | | | |
| | MN4 : RICE BASED PIZZA | ID4 | JD4 | KD4 |
| | MN5 : STUFFED EGG PLANT | ID5 | JD5 | KD5 |
| | | | | |

FIG.20C

31

DS13 DS14

| MI | MNi : RECIPE NAME | IDi : MATERIAL DATA | JDi : HOW-TO-COOK DATA | KDi : HEATING DATA | |
|---|---|---|---|---|---|
| | MN1 : TOFU BASED HAMBURGER | ID1 | JD1 | KD1 | |
| | MN2 : OCTOPUS, CHILI FLAVOR | ID2 | JD2 | KD2 | |
| | MN3 : POTATO SALAD | ID3 | JD3 | KD3 | ← PNT |
| | MN4 : RICE BASED PIZZA | ID4 | JD4 | KD4 | |
| | MN5 : STUFFED EGG PLANT | ID5 | JD5 | KD5 | |
| | | | | | |

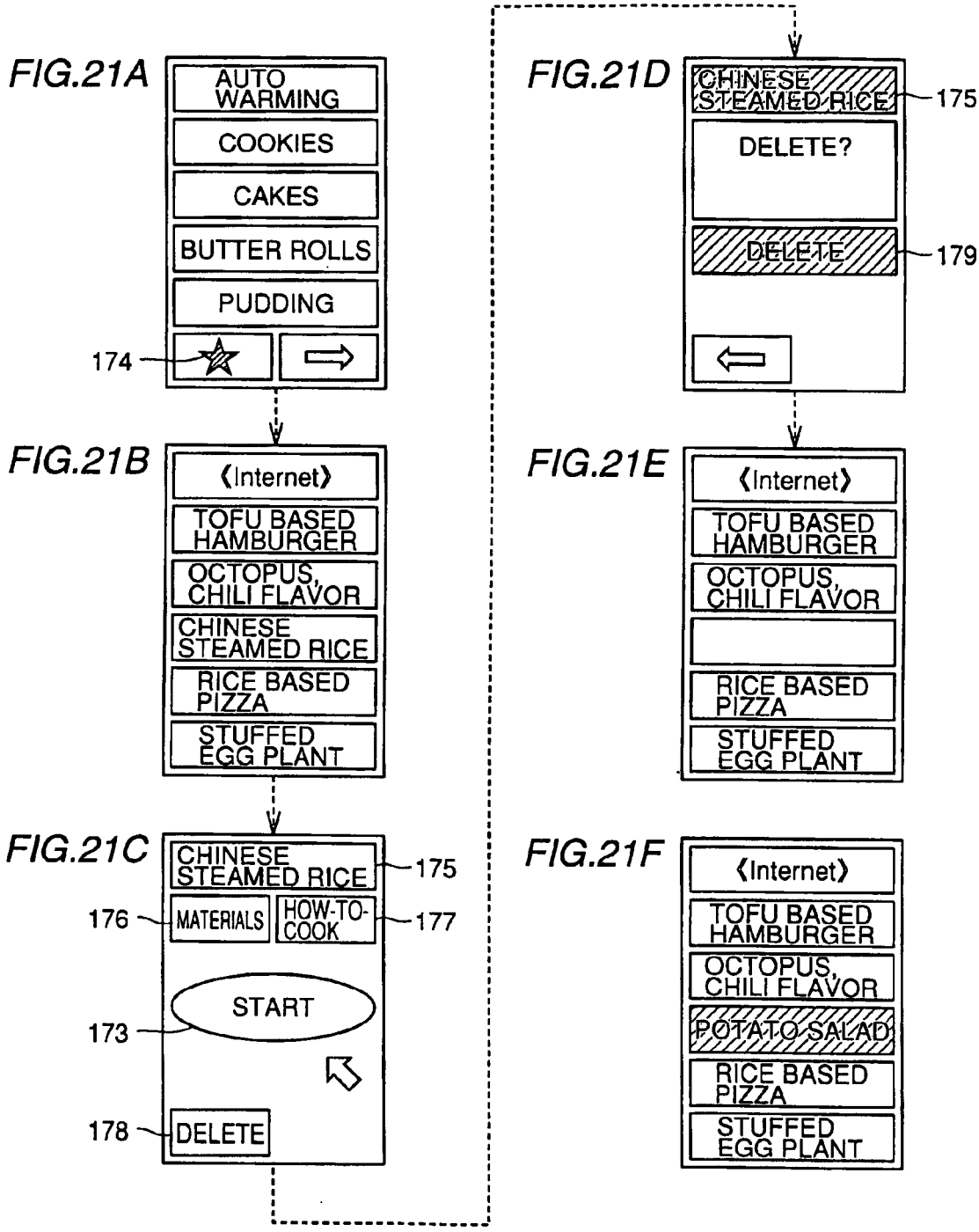
FIG.21A
AUTO WARMING
COOKIES
CAKES
BUTTER ROLLS
PUDDING
174
FIG.21B
《Internet》
TOFU BASED HAMBURGER
OCTOPUS, CHILI FLAVOR
CHINESE STEAMED RICE
RICE BASED PIZZA
STUFFED EGG PLANT
FIG.21C
CHINESE STEAMED RICE
175
176
MATERIALS
HOW-TO-COOK
177
START
173
178
DELETE
FIG.21D
CHINESE STEAMED RICE
175
DELETE?
DELETE
179
FIG.21E
《Internet》
TOFU BASED HAMBURGER
OCTOPUS, CHILI FLAVOR
RICE BASED PIZZA
STUFFED EGG PLANT
FIG.21F
《Internet》
TOFU BASED HAMBURGER
OCTOPUS, CHILI FLAVOR
POTATO SALAD
RICE BASED PIZZA
STUFFED EGG PLANT

FIG.28

MI

| AD : ADDRESS | DC : DATA CONTENTS | CA : CAPACITY (max) |
|---|---|---|
| 0000h-0007h | DC1 : DATA OF DATA CODE, LAST ADDRESS AND EXTENSION CODE | 8 BYTES |
| 0008h-0010h | DC2 : HEAD ADDRESS AND RECIPE NAME OF HEATING DATA | 9 BYTES |
| 0011h-0016h | DC3 : HEAD/LAST ADDRESS OF DISPLAY PAGE ADDRESS INFORMATION | 6 BYTES |
| 0017h-0036h | MNi : RECIPE NAME | 32 BYTES |
| 0037h-0049h | KDi : HEATING DATA | 19 BYTES |
| 004Ah-0125h | DC4 : DISPLAY PAGE ADDRESS INFORMATION | 220 BYTES |
| 0126h-07FFh | DS13 : DISPLAY DATA | 1754 BYTES |

*FIG.30A*

MI1

| AD : ADDRESS | DC : DATA CONTENTS | CA : CAPACITY (max) |
|---|---|---|
| 0000h-0007h | DC11 : DATA OF DATA CODE, LAST ADDRESS AND MACHINE TYPE CODE | 8 BYTES |
| 0008h-0010h | DC2 : HEAD ADDRESS AND RECIPE NAME OF HEATING DATA | 9 BYTES |
| 0011h-0016h | DC3 : HEAD/LAST ADDRESS OF DISPLAY PAGE ADDRESS INFORMATION | 6 BYTES |
| 0017h-0036h | MNi : RECIPE NAME | 32 BYTES |
| 0037h-0049h | KD1i : HEATING DATA | 19 BYTES |
| 004Ah-0125h | DC4 : DISPLAY PAGE ADDRESS INFORMATION | 220 BYTES |
| 0126h-07FFh | DS13 : DISPLAY DATA | 1754 BYTES |

*FIG.30B*

KD1i

| MD1 : MACHINE TYPE CODE | DD : DATA |
|---|---|
| 01 | BY MICROWAVE, 600W, FOR 4 MINUTES |
| 02 | BY MICROWAVE, 600W, FOR 3 MIN. 20 SEC. |
| 03 | BY MICROWAVE, 700W, FOR 2 MIN. 50 SEC. |
| 04 | BY MICROWAVE, 800W, FOR 2 MIN. 30 SEC. |

FIG.32

SHARP

SMART COOKING FOR WORKING MOTHERS

TODAY'S RECIPE

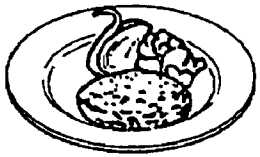

TOFU BASED HAMBURGER

DRAIN TOFU WELL FOR SUCCESSFUL FINISH

| MATERIALS (4 SERVINGS) | | CALORIES/ SERVING ABOUT 260 kcl |
|---|---|---|
| ●TOFU | | 1 (300g) |
| A | MINCED ONION | 50g |
| | CHOPPED BACON ・・・ | 2 |
| ●MINCE MEAT 200g | | AS PREFERRED |
| ●SALT | | |
| B | EGG | 1/2 |
| | CRUMBS OF BREAD | 2 LARGE SPOONS |
| | MILK | ONE LARGE SPOON |
| | PEPPER, NUTMEG | AS PREFERRED |

(HOW-TO-COOK)

1 CUT TOFU INTO TWO, WRAP EACH WITH A COOKING PAPER, PUT ON A PAN, AND HEAT BY MICROWAVE OVEN, 200W, 5 MIN. AFTER HEATING, RE-WRAP WITH NEW COOKING PAPER, PUT A WEIGHT THEREON TO WELL DEHYDRATE.

2 PUT A INTO A BOWL, WRAP, AND HEAT BY MICROWAVE OVEN, 500W, 2 MIN. AFTER HEATING, DEHYDRATE AND COOL.

3 PUT MINCED MEAT AND SALT IN A BOWL, KNEAD, ADD B AND FURTHER KNEAD, ADD ROUGHLY GROUND 1 AND 2, DIVIDE INTO 4 AND SHAPE.

4 PUT ALUMINUM FOIL ON A PAN (BLACK), COAT WITH SALAD OIL, PLACE 3, AND GRILL BY OVEN, 220℃, 20 MIN TO 25 MIN.

Top △ Home

FIG.34

SHARP

●EVENT INFORMATION

COOKING CLASS FOR INTERNET RELAY BOX USERS WILL BE HELD AS DESCRIBED BELOW

DATE AND TIME: * * MONTH * * DATE (SAT) 13:00~17:00
PLACE: OSAKA
DATE AND TIME: * * MONTH * * DATE (SAT) 13:00~17:00
PLACE: TOKYO
DATE AND TIME: * * MONTH * * DATE (SAT) 13:00~17:00
PLACE: NAGOYA
DATE AND TIME: * * MONTH * * DATE (SAT) 13:00~17:00
PLACE: SAPPORO
DATE AND TIME: * * MONTH * * DATE (SAT) 13:00~17:00
PLACE: FUKUOKA

APPLICATION

SEND IN AN APPLICATION BY E MAIL OR FAX AT LEAST 3 DAYS BEFORE THE CLASS, TO THE FOLLOWING ADDRESS. ADMITTANCE WILL BE NOTIFIED BY RETURN.
ACCOMODATAION: 30 FOR EACH CLASS (COOKING CLASS INFORMATION DESK) SHARP CORPORATION COOKING APPLIANCES MARKETING SECTION * *
EMAIL ADDRESS: * * * @ * *.sharp.co.jp
FAX: 06-1234-5678

●NEW RECIPE INFORMATION

THE FOLLOWING RECIPE WILL BE AVAILABLE AT THE RELAY BOX

* * * DATE CHEESE FLAVORED ROAST PUMPKIN
* * * DATE JAM BALL COOKIES
* * * DATE AMERICAN SAUSAGE
* * * DATE SCALLOP ONIGIRI
* * * DATE CURRY RICE WITH SEAFOOD
* * * DATE CHINESE SANDWICH
* * * DATE STEAMED RICE WITH SHRIMP
* * * DATE ROASTED ROLLED CHICKEN WITH OKRA
* * * DATE STEW FRIED EGGS
* * * DATE CHINESE CROQUETTE

Top △ Home ◎

FIG.56

SMART COOKING RECIPE OF THE DAY

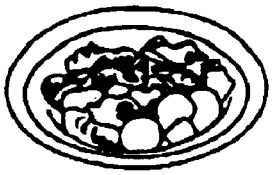

TARO-POTATO AND CHICKEN STEWED WITH SOY SAUCE, CHINESE STYLE

EVEN FROZEN TARO-IMO WILL BE TASTY WITH SPICES AND SEASONINGS

MATERIALS (4 SERVINGS) CALORIES/SERVING ABOUT 350kcal (mL = cc)

- DRIED KIKURAGE ..... 2
- CHICKEN, DARK MEAT ..... 300g
- FROZEN TARO-POTATO ..... 500g

A
- CHICKEN BOUILLON ..... 2 small spoons
- WATER ..... 50mL
- SOY SAUCE ..... 2 large spoons
- SUGAR,SAKE ..... 1 large spoon

- CORN STARCH ..... 1 large spoon
- GREEN ONION (SLICED) ..... AS PREFERRED (HOW TO COOK)

1. PUT KIKURAGE IN A BOWL, ADD WATER (ABOUT 100mL), WRAP AND HEAT FOR ABOUT 1 min WITH 500W.COOL, DRAIN AND SLICE.
2. PUT 1, CHOPPED CHICKEN AND TARO-POTATO INTO A BOWL, ADD A, WRAP, HEAT FOR ABOUT 20 min WITH 500W. MIX ONCE IN THE MIDDLE OF HEATING. AFTER HEATING, ADD CORN STARCH MIXED WITH THE SAME AMOUNT OF WATER, HEAT FOR ABOUT 2 min. WITH 500W. AFTER HEATING, PUT GREEN ONION AS TAPPINGS

→ DOWNLOAD OF COOKING DATA →

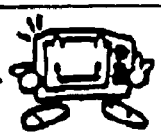

```
MI        81                                  82
01E002010000000017000122000132 00
01D70001000000 08C6E4D0FA68ADF7 07   83
C61B0300050000004005000700800500   84
0600E000000000E90001D70000E00000
0008FF0001FA0001E000082000170101
100101E000084000560101 4F0101F000
85  ⋮                                ⋮
001080002B0201210201E00010810052
0201500201E000108200520201620201
E00010A0006D0201640201E00010C000
9A02018F0201E00010C100B90201B702
86  ⋮                                ⋮
42511403425461 29FF0001100910D4C6
E3D0ADF707C61B10D3155001802FFF00
⋮                                ⋮
510152500140FF0000110BC6E3D0C310
2B102C0F18102C102E102A105A08D0DC
```

FIG.78A

■INTERNET COOKING

END

INTERNET CONNECTION

TRANSMIT TO MICROWAVE OVEN — 76

| | | |
|---|---|---|
| STIR-FRIED EEL AND EGGPLANT | STEWED APPLE | RICE WITH MUSHROOM |
| CHINESE STEAMED RICE | STEWED SEA FOOD, WESTERN STYLE | ONIGIRI |
| BEEF OVER RICE | MARINATED SARDINE WITH PICKLES | RICE WITH SWEET POTATOES |
| PORK APPETIZER | STEWED PUMPKIN, WESTERN STYLE | PUMPKIN AND CHEESE PIE |
| SQUID PILAF WESTERN STYLE | RICE CAKE WITH RED BEAN PASTE | POTATO CAKE |
| GRATED YAM SOUP | ROLLED CABBAGE | CHESTNUT TRIFLE |
| EEL SUSHI | BOILED SCALLOP, PLUM SAUCE | COOKIES WITH ORANGE FLAVOR |
| EGGPLANT WITH SESAME SAUCE | STEAMED TOFU | |
| STEAK SALAD | GRILLED TOFU WITH MISO SAUCE | |
| GRILL WITH JAPANESE PEPPER | MARINATED MACKEREL | |

SELECT DELETION

771

FIG.78B

■INTERNET COOKING

END

INTERNET CONNECTION

TRANSMIT TO MICROWAVE OVEN — 76

| | | |
|---|---|---|
| STIR-FRIED EEL AND EGGPLANT | STEWED APPLE | RICE WITH MUSHROOM |
| CHINESE STEAMED RICE | STEWED SEA FOOD, WESTERN STYLE | ONIGIRI |
| BEEF OVER RICE | MARINATED SARDINE WITH PICKLES | RICE WITH SWEET POTATOES |
| PORK APPETIZER | STEWED PUMPKIN, WESTERN STYLE | PUMPKIN AND CHEESE PIE |
| SQUID PILAF WESTERN STYLE | RICE CAKE WITH RED BEAN PASTE | POTATO CAKE |
| GRATED YAM SOUP | ROLLED CABBAGE | CHESTNUT TRIFLE |
| EEL SUSHI | BOILED SCALLOP, PLUM SAUCE | COOKIES WITH ORANGE FLAVOR |
| EGGPLANT WITH SESAME SAUCE | STEAMED TOFU | |
| STEAK SALAD | GRILLED TOFU WITH MISO SAUCE | |
| GRILL WITH JAPANESE PEPPER | MARINATED MACKEREL | |

SELECT DELETION

771

FIG.82

TOFU BASED HAMBURGER

ITS IMPORTANT TO DEHYDRATE TOFU WELL

WRITTEN IN BLUE CHARACTERS

A1

MATERIALS (4 SERVINGS) — CALORIES/ SERVING ABOUT 260 kcl

| | | |
|---|---|---|
| ●TOFU | | 1 (300g) |
| A | MINCED ONION | 50g |
| | CHOPPED BACON ・・・ | 2 |
| ●MINCE MEAT 200g | | AS PREFERRED |
| ●SALT | | |
| B | EGG | 1/2 |
| | CRUMBS OF BREAD | 2 LARGE SPOONS |
| | MILK | ONE LARGE SPOON |
| | PEPPER, NUTMEG | AS PREFERRED |

(HOW-TO-COOK)

1 CUT TOFU INTO TWO, WRAP EACH WITH A COOKING PAPER, PUT ON A PAN, AND HEAT BY MICROWAVE OVEN, 200W, 5 MIN. AFTER HEATING, RE-WRAP WITH NEW COOKING PAPER, PUT A WEIGHT THEREON TO WELL DEHYDRATE.

2 PUT A INTO A BOWL, WRAP, AND HEAT BY MICROWAVE OVEN, 500W, 2 MIN. AFTER HEATING, DEHYDRATE AND COOL.

3 PUT MINCED MEAT AND SALT IN A BOWL, KNEAD, ADD B AND FURTHER KNEAD, ADD ROUGHLY GROUND 1 AND 2, DIVIDE INTO 4 AND SHAPE.

WRITTEN IN RED CHARACTERS

4 PUT ALUMINUM FOIL ON A PAN (BLACK), COAT WITH SALAD OIL, PLACE 3, AND GRILL BY OVEN, 220℃, 20 MIN.

B11

DOWNLOAD OF COOKING DATA ← A

31

| MI | MNi : RECIPE NAME | IDi : MATERIAL DATA | JDi : HOW-TO-COOK DATA | KDi : HEATING DATA |
|---|---|---|---|---|
| | | DS13 | | DS14 |
| | MN1 : COOKIES | ID1 | JD1 | KD1 |
| | MN2 : SPONGE CAKE | ID2 | JD2 | KD2 |
| | MN3 : CREAM PUFF | ID3 | JD3 | KD3 |
| | MN4 : FRUIT CAKE | ID4 | JD4 | KD4 |
| | MN5 : SWISS ROLL | ID5 | JD5 | KD5 |

FIG.98

11

100J

| 7 | 6 | 5 | 4 | 3 | 2 | 1 | 0 |
|---|---|---|---|---|---|---|---|
| 0 | 0 | 0 | 0 | 0 | 0 | 0 | 0 |

00 : TEMPERATURE SENSOR NORMAL
01 : TEMPERATURE SENSOR ABNORMAL (SHORT)
10 : TEMPERATURE SENSOR ABNORMAL (OPEN)

00 : MOISTURE SENSOR NORMAL
01 : MOISTURE SENSOR ABNORMAL (SHORT)
10 : MOISTURE SENSOR ABNORMAL (OPEN)

0 : WEIGHT SENSOR NORMAL
1 : WEIGHT SENSOR ABNORMAL (ABNORMAL OSCILLATION)

200J

| 201J : FREQUENCY DATA | 202J : HEATING AND COOKING RECIPE NAMES | 203J : RECIPE CODE |
|---|---|---|
| 20 | WARM | 01 |
| 13 | MILK | 02 |
| 05 | SAKE | 03 |
| 01 | COOKIES | 04 |
| 09 | SPONGE CAKE | 05 |
| 02 | CREAM PUFF | 06 |
| ⋮ | | ⋮ |
| 04 | PUDDING | * * |

300J

| 301J : CODE OF FREQUENTLY COOKED RECIPES |
|---|
| 01 |
| 02 |
| 05 |

400J

| 402J : TIME OF USE DATA (HEXADECIMAL) | 401J : HEAT SOURCE DATA |
|---|---|
| 0010 | MAGNETRON |
| 0002 | UPPER HEATER |
| 0005 | LOWER HEATER |

FIG.106

SHARP what's new | new products | news release | Mar.1999 Volum 96

SHORT CUT
- ZAURUS
- ZAURUS for Office Use
- Mebius
- Digital Camera
- Original Software
- Only for NETLEADERS
- Web Letter

25 | 2000

25th ANNIVERSARY CAMPAIGN FOR LIQUID CRYSTAL DEVELOPMENT

Möbius USER SUPPORT CENTER

PRINTER・SCANNER USER SUPPORT CENTER

Welcome to sharp home page japan

NEWS
- SHARP SPACE TOWN
- New INTRODUCTION OF Möbius NOTE PJ
- LONG AWAITED 20 inch LIQUID CRYSTAL TV EMERGES AT LAST
- EVA ANIMATOR WORKS COMPETITION Caz net: NET DATING SCHOOL THROUGH communi-pal TOPICS
- MORE SOFTWARE CONTEST WINNER ANNOUNCEMENT
- HERE COMES Zaurus "I getty" THAT CAN BE FREELY CUSTOMIZED
- NEW PRODUCT INFORMATION COLOR IMAGE SCANNER (JX-370)
- NEW PRODUCT INFORMATION 18 inch LIQUID CRYSTAL MONITOR
- NEW PRODUCT INFORMATION HAND HELD PC "Terios"

M A R C H

SMART ENGINE

HOW TO USE SEARCH SYSTEM

TO Global Home Page

LOCAL AREA TELEPHONE NUMBER FOR OSAKA AREA "06", WHERE OUR COMPANY IS LOCATED, HAS BEEN CHANGED. PLEASE NOTE THE NEW AREA NUMBER HAS 4 DIGITS WITH ADDITIONAL 6 AT THE HEAD (06-6xxx-xxxx).

- WHAT'S NEW
- NEWS RELEASE
- TOPICS
- TECHNICAL LIBRARY
- ABOUT OUR COMPANY
- MICROWAVE OVEN
- BUSINESS HEADQUARTERS・LOCAL SITES・LOCAL SELLING GUIDANCE
- NEW PRODUCTS
- INQUIRY
- ELECTRONIC DEVICES
- JOB APPLICATIONS
- INTERNATIONAL PROCUREMENT
- ENVIRONMENTAL PHILOSOPHY
- LIST OF PRODUCTS
- EVENT・PR
- NET LEADER
- ACCOMPLISHMENTS
- QUIZ & GAMES
- PHOTOVOLTAIC GENERATION
- RECIPE USING ITEM ON SALE ← B

HOW TO USE REGISTRATION SYSTEM

- SHOP INFORMATION REGISTRATION
- USER'S RECIPE REGISTRATION

A C

METHODS AND APPARATUS FOR CONTROLLING OPERATION OF A MICROWAVE OVEN IN A NETWORK

BACKGROUND OF THE INVENTION

1. Field of the Invention

The present invention relates to a microwave oven system allowing control of a microwave oven of each home in accordance with the information supplied from the side of a host computer through a communication network, a microwave oven, a relay apparatus, an information processing apparatus, a host computer and a computer readable recording medium recording home page information. More specifically, the present invention relates to a microwave oven system accessing a host computer having prescribed home page information through the Internet, allowing control of the microwave oven based on the information from the host computer, a microwave oven, a relay apparatus, an information processing apparatus, a host computer and a computer readable recording medium recording home page information.

2. Description of the Background Art

Japanese Patent Laying-Open No. 10-276478 discloses an apparatus controlling household appliances in accordance with the information supplied from an outside communication network. This laid-open application describes a household appliances control apparatus controlling various electrical appliances at home in which each electrical appliance takes in control information of the appliance from a host computer of a home page through a remote controller, a server for the household appliance control and the Internet, and each appliance attains its function in accordance with the control information.

This laid-open application describes an example in which the control information is cooking information related to cooking. The example, however, is not very practical, as specific procedure of how to obtain the cooking information desired by the user from a home page, how to supply the information to a microwave oven as the electrical appliance and how the process for heating and cooking takes place in the microwave oven are not at all described.

SUMMARY OF THE INVENTION

An object of the present invention is to provide a highly practical microwave oven system, a microwave oven, a relay apparatus, an information processing apparatus, a host computer and a computer readable recording medium recording home page information.

The above described object of the present invention is attained by a microwave oven system in accordance with an aspect of the present invention which includes the Internet, an information processing apparatus having an output unit and transmitting/receiving information through the Internet, a microwave oven having at least a function of heating in accordance with heating control data among the information supplied from the Internet through the information processing apparatus, and a host computer connected to the Internet and having an information storing unit storing home page information for a home page.

The home page information includes information related to a plurality of recipes, recipe data including heating control data for heating and cooking of the recipe, recognized by the microwave oven, corresponding to respective ones of the plurality of cooking recipes, and information of a transfer instruction button which is operated for transferring the recipe data through the Internet to the information processing apparatus. These pieces of information of the home page information except for the recipe data are all pieces of image display information to be output through the output unit, as a home page screen.

By the microwave oven system, it becomes possible for the user to directly supply the heating and control data corresponding to a desired cooking recipe provided by the home page through the Internet to the microwave oven to be recognized, simply by operating the transfer instruction button output on the home page screen. In other words, it becomes possible to omit the process of decoding the heating control data to be recognizable by the microwave oven, thus speedy control of the heating operation is possible. Therefore, the system is very practical as the desired cooking recipe can be automatically heated and cooked quickly by the microwave oven.

The recipe data recognized by the microwave oven is not the data displayed on the home page screen. Therefore, visual image displayed on the home page screen is not disturbed by the display of the recipe data, which is the special data to be recognized by the microwave oven. Further, degradation in visibility of the necessary information caused by the display of the recipe data, which is unnecessary for the user, displayed on the home page screen, can be avoided.

In the microwave oven system described above, the microwave oven has a display unit, and the supplied information includes recipe data. The recipe data further includes recipe name data, material data and how-to-cook data displayed on the display unit, representing the name of the recipe, materials and how to cook of the corresponding cooking recipe.

In the microwave oven system described above, the recipe name, material data and the how-to-cook data of the desired cooking recipe are displayed on the display unit of the microwave oven. Therefore, it is possible for the user to prepare and arrange materials of the cooking recipe, while confirming the name of the recipe, materials and how to cook displayed on the display unit, and therefore the system is very much practical.

In the above described microwave oven system, the information processing apparatus and the microwave oven communicate the supplied information via infrared ray. As wireless communication by infrared ray is established between the microwave oven and the information processing apparatus in the microwave oven system, the microwave oven and the information processing apparatus may be arranged at any positions provided that the infrared ray can reach, and hence degree of freedom in positioning the microwave oven and the information processing apparatus is increased.

In the microwave oven system described above, the information processing apparatus and the microwave oven transmit supplied information using a recording medium. As the communication between the microwave oven and the information processing apparatus is performed by using a recording medium in the microwave oven system, there is no restriction in arranging the microwave oven and the information processing apparatus relative to each other, and therefore degree of freedom in positioning the microwave oven and the information processing apparatus is increased.

The microwave oven system further includes a relay apparatus. The microwave oven is detachably connected to one end and the information processing apparatus is connected to the other end of the relay apparatus, and the signal transmitted between the microwave oven and the information processing apparatus are exchanged by the relay apparatus.

In the microwave oven system described above, the relay apparatus relaying communication between the microwave oven and the information processing apparatus is detachably connected to the microwave oven. Therefore, simply by connecting the relay apparatus to the microwave oven as needed, it becomes possible to supply the heating control data corresponding to the desired cooking recipe provided on the home page of the Internet to the microwave oven, to control heating operation and to heat and cook the desired cooking recipe.

The relay apparatus of the microwave oven system described above includes a recipe data storing unit storing one or more recipe data received from the information processing apparatus, and a recipe name transmitting unit responsive to a request for displaying the recipe data on the display unit from the microwave oven, reading only the recipe name data from the one or more recipe data in the recipe data storing unit and transmitting to the microwave oven.

In the above described microwave oven system, recipe names of all the recipe data stored in the recipe data storing unit, transmitted from the recipe name transmitting unit can be displayed on the display unit of the microwave oven, as requested.

Therefore, it is possible for the user to readily recognize what recipe can be cooked by the microwave oven, with the data stored in the recipe data storing unit, simply by checking the recipe names displayed on the display unit of the microwave oven.

The relay apparatus of the microwave oven system described above is detachably connected to the information processing apparatus. The information processing apparatus further has a specific item display unit additionally displaying a specific item on the home page screen output to the output unit, when the relay apparatus is connected to the information processing apparatus.

In the microwave oven system described above, the specific item is displayed on the home page screen appearing on the output unit of the information processing apparatus, so as to notice that the relay apparatus is connected to the information processing apparatus.

Therefore, it is possible for the user to recognize that the information processing apparatus is connected to the relay apparatus so that it is possible to store the recipe data in the recipe data storing unit of the relay apparatus and to supply the recipe data from the relay apparatus to the microwave oven, simply by monitoring the home page screen.

In the microwave oven system described above, the microwave oven further has a connection notifying unit notifying, through the display unit, whether the relay apparatus is connected or not.

In the microwave oven system described above, whether the relay apparatus is connected to the microwave oven or not is notified by the connection notifying unit, through the display unit of the microwave oven.

Therefore, it is possible for the user to know whether the microwave oven is connected to the relay apparatus allowing reception of the recipe data from the relay apparatus, simply by checking the display unit of the microwave oven.

In the connection notifying unit of the microwave oven system described above has an information storage notifying unit notifying whether at least one recipe information has already been stored in the recipe data storing unit of the relay apparatus.

In the microwave oven system described above, the information storage notifying unit notifies whether the relay unit is connected to the microwave oven and whether at least one recipe information has already been stored in the recipe data storing unit, through the display unit of the microwave oven. Therefore, it is possible for the user to know whether the relay apparatus is connected to the microwave oven and whether the recipe data can be received from the relay apparatus or not, simply by checking the display unit of the microwave oven.

The relay apparatus in the above described microwave oven system further has a display unit. The display unit displays information representing the state of storage of recipe information of the recipe data storing unit.

In the above described microwave oven system, the state of storage of recipe information in the recipe data storing unit is displayed on the display unit of the relay apparatus. Therefore, it is possible for the user to confirm whether the recipe data is stored in the recipe data storing unit or to confirm the recipe name of the desired recipe data stored, by the display unit of the relay apparatus.

In the microwave oven system described above, the microwave oven further has a first input unit operated externally for data input, and a first deletion instructing unit responsive to an input of a deletion instruction instructing deletion of a desired recipe data in the recipe data storing unit by the operation of the first input unit, instructing deletion of the desired recipe data to the relay apparatus. The relay apparatus further has a first deletion unit for deleting the recipe data instructed by the first deletion instructing unit, from the recipe data storing unit.

In the above described microwave oven system, when the deletion instruction is input through the first input unit, the desired recipe data designated by the deletion instruction is deleted from the recipe data storing unit by the first deletion instructing unit and the first deletion unit.

Therefore, it is possible for the user to delete unnecessary recipe data from the recipe data storing unit of the relay apparatus, simply by inputting a deletion instruction, by operating the first input unit of the microwave oven. Therefore, it is possible for the user to readily update the contents of the recipe data storing unit, by storing a desired new recipe data in the free area of the recipe data storing unit as desired.

In the microwave oven system described above, the relay apparatus further has a second input unit externally operated for data input, and a second deletion unit responsive to an input of a deletion instruction instructing deletion of a desired recipe data of the recipe data storing unit by the operation of the second input unit, for deleting the recipe data of which deletion is instructed, from the recipe data storing unit.

In the above described microwave oven system, when the deletion instruction is input from the second input unit, the desired recipe data designated by the deletion instruction is deleted from the recipe data storing unit by the second deletion unit.

Therefore, it is possible for the user to delete unnecessary recipe data from the recipe data storing unit of the relay apparatus, simply by inputting the deletion instruction by operating the second input unit of the relay apparatus. Therefore, it is possible for the user to readily update the contents of the recipe data storing unit by storing a desired new recipe data in the free area of the recipe data storing unit as desired.

In the above described microwave oven system, the information processing apparatus further has a third input unit externally operated for data input, and a third deletion instructing unit responsive to an input of a deletion instruction instructing deletion of a desired recipe data in the recipe data storing unit by the operation of the third input unit, for instructing deletion of the desired recipe data to the relay apparatus. The relay apparatus further has a third deletion unit deleting the recipe data instructed by the third deletion instructing unit from the recipe data storing unit.

In the above described microwave oven system, when the deletion instruction is input from the third input unit, the desired recipe data designated by the deletion instruction is deleted from the recipe data storing unit by the third deletion instructing unit and the third deletion unit.

Therefore, it is possible for the user to delete an unnecessary recipe data from the recipe data storing unit of the relay apparatus simply by inputting a deletion instruction by operating the third input unit of the information processing apparatus. Therefore, it is possible for the user to readily update the contents of the recipe data storing unit, by storing a desired new recipe data in a free area of the recipe data storing unit as desired.

In the above described microwave oven system, the microwave oven further has a first search instructing unit responsive to an input of a search instruction instructing searching of a desired recipe data in the recipe data storing unit by the operation of the first input unit, for designating searching of the desired recipe data to the relay apparatus. The relay apparatus further has a first searching unit searching the recipe data designated by the first search instructing unit in the recipe data storing unit, and a first sorting unit sorting one or more recipe data such that the recipe data searched by the first searching unit is positioned at the head of one or more recipe data in the recipe data storing unit.

In the above described microwave oven system, when a search instruction of a desired recipe data in the recipe data storing unit is input from the first input unit of the microwave oven, one or more recipe data in the recipe data storing unit are sorted so that the desired recipe data is positioned at the head of the one or more recipe data, by the first search instructing unit, the first searching unit and the first sorting unit.

Therefore, even if the number of recipe data stored in the recipe data storing unit increases, the data can be sorted such that the recipe data desired by the user can be quickly read from the recipe data storing unit to the microwave oven, improving convenience of use.

In the above described microwave oven system, the information processing apparatus further has a second search instructing unit responsive to an input of a search instruction instructing searching of a desired recipe data in the recipe data storing unit by the operation of the third input unit, for instructing searching of the desired recipe data to the relay apparatus. The relay apparatus further has a second searching unit searching the recipe data instructed by the second search instructing unit in the recipe data storing unit, and a second sorting unit sorting one or more recipe data such that the recipe data searched by the second searching unit is positioned at the head of the one or more recipe data in the recipe data storing unit.

In the above described microwave oven system, when a search instruction of a desired data in the recipe data storing unit is input from the third input unit of the information processing apparatus, one or more recipe data in the recipe data storing unit of the relay apparatus are sorted by the second search instructing unit, the second searching unit and the second sorting unit, so that the desired recipe data is stored positioned at the head of one or more recipe data.

Therefore, even if the number of recipe data stored in the recipe data storing unit increases, the data can be sorted such that the recipe data desired by the user can be quickly read from the recipe data storing unit to the microwave oven, improving convenience of use.

In the above described microwave oven system, the relay apparatus further has a third searching unit responsive to an input of a search instruction instructing searching of a desired recipe data in the recipe data storing unit by the operation of the second input unit for searching the desired recipe data of which searching is instructed in the recipe data storing unit, and a third sorting unit sorting one or more recipe data such that the recipe data searched by the third searching unit is positioned at the head of one or more recipe data in the recipe data storing unit.

In the above described microwave oven system, when the search instruction of a desired data in the recipe data storing unit is input from the second input unit in the relay apparatus, one or more recipe data are sorted in the recipe data storing unit by the third search instructing unit, the third searching unit and the third sorting unit, so that the desired recipe data is stored positioned at the head of one or more recipe data.

Therefore, even if the number of recipe data stored in the recipe data storing unit increases, the data can be sorted such that the recipe data desired by the user can be quickly read from the recipe data storing unit to the microwave oven, improving convenience of use.

In the above described microwave oven system, the heating control data includes one or more machine type codes each representing the type of the microwave oven, and a first heating control data for controlling heating operation of the microwave oven designated by the machine type code, corresponding to each of the at least one machine type code. The microwave oven further has a machine type specific heating unit performing heating operation in accordance with the first heating control data corresponding to the machine type code representing the machine type of the microwave oven, among the supplied heating control data.

In the above described microwave oven system, the heating operation for heating and cooking of the microwave oven is controlled by the first heating control data corresponding to the machine type of the microwave oven, among one or more first heating control data of the supplied heating control data. Therefore, the heating operation can be controlled in accordance with the heating control data suitable for the machine type of the microwave oven, and hence the manner of cooking and the time of cooking dependent on the different machine types of the microwave oven can be optimized, enabling practical performance.

By installing a dedicated program to the information processing apparatus of the above described microwave oven system, a transfer designation button of the home page screen effectively functions.

The microwave oven in accordance with another aspect of the present invention includes a control unit, a data receiving unit receiving recipe data, a display unit controlled by the control unit and a heating unit. The recipe data corresponds to a desired cooking recipe selected in advance on the home page screen supplied through the Internet, including display data to be displayed on the display unit including recipe name data, material data and how-to-cook data representing the recipe name, materials and how to cook of the desired cooling recipe as well as heating control data, directly recognized by the control unit. Heating operation of the heating unit is controlled by the control unit in accordance with the heating control data.

In the above described microwave oven, the recipe data corresponding to a desired cooking recipe provided by the home page can be recognized directly by the control unit of the microwave oven. Namely, the process of decoding the recipe data to be recognizable by the control unit can be omitted, so that the display operation and the heating operation can be controlled quickly. Therefore, the desired cooking recipe provided by the home page can be quickly and automatically heated and cooked by the microwave oven, enabling practical performance.

Further, the recipe name data, material data and how-to-cook data representing the recipe name, the materials and how to cook of the desired cooking recipe are displayed on the display unit of the microwave oven. Therefore, it is possible for the user to readily prepare and arrange the materials to be heated and cooked, while confirming the recipe name, checking the contents displayed on the display unit.

The heating control data of the above described microwave oven includes one or more machine type codes each representing machine type of the microwave oven, and a first heating control data for controlling heating operation of the microwave oven represented by the machine type code, corresponding to respective ones of at least one machine type code. The heating unit has a first heating unit of which heating operation is controlled in accordance with the first heating control data corresponding to the machine type code representing the machine type of the microwave oven, among the heating control data.

In the above described microwave oven system, the heating operation for heating and cooking of the microwave oven is controlled by the first heating control data corresponding to the machine type of the microwave oven, among one or more first heating control data of the supplied heating control data. Therefore, the heating operation can be controlled in accordance with the heating control data suitable for the machine type of the microwave oven, and hence the manner of cooking and the time of cooking dependent on the different machine types of the microwave oven can be optimized, enabling practical performance.

The above described microwave oven further includes a data receiving unit receiving recipe data transferred by using infrared ray.

To the microwave oven described above, the recipe data supplied through the Internet is transferred by wireless communication using infrared ray. Therefore, the microwave oven may be placed at any position within the reach of the infrared ray, and hence degree of freedom in arranging the microwave oven is increased.

The above described microwave oven further includes a data receiving unit receiving recipe data transferred by using a recording medium.

To the microwave oven described above, the recipe data supplied through the Internet is transferred using a recording medium. Therefore, there is no restriction in arranging the microwave oven, and hence degree of freedom in arranging the microwave oven is increased.

The relay apparatus in accordance with a further aspect of the present invention includes a recipe data receiving unit receiving, from an information processing apparatus connected to one end of the relay apparatus receiving home page information through the Internet, recipe data for heating and cooking by a microwave oven connected to the other end of the relay apparatus corresponding to each of at least one cooking recipe among the home page information; a recipe data storing unit storing at least one recipe data received by the recipe data storing unit; and a recipe data transmitting unit transmitting, when a designation data designating a desired recipe data is received from the microwave oven, reading and transmitting to the microwave oven the recipe data designated by the designation data, from the recipe data storing unit. The recipe data is directly recognizable by the microwave oven, and includes heating control data for controlling heating operation of the microwave oven.

In the relay apparatus described above, the recipe data including the heating control data corresponding to the desired cooking recipe provided by the home page is received through the Internet and the information processing apparatus, stored in the recipe data storing unit, and among the recipe data, the heating control data is transmitted to the microwave oven. The recipe data is directly recognized by the microwave oven. Namely, the process of decoding the data to be recognizable can be omitted. Therefore, the desired cooking recipe provided by the home page can be quickly and automatically heated and cooked by the microwave oven, enabling practical performance.

The recipe data in the relay apparatus described above includes recipe name of the corresponding cooking recipe, and the designation data is the recipe name. The relay apparatus further includes an all recipe name transmitting unit reading all the recipe names included in the recipe data of the recipe data storing unit and transmitting to the microwave oven.

By the relay apparatus, the all recipe name transmitting unit transmits all the recipe names corresponding to the recipe data stored in the recipe data storing unit to the microwave oven. Therefore, it is possible for the user to readily designate the desired recipe data, by checking all the recipe names transmitted to the microwave oven, so that convenience of use is improved.

The information processing apparatus in accordance with a still further aspect of the present invention includes a home page information receiving unit receiving home page information including recipe data for heating and cooking by the microwave oven the cooking recipe corresponding to each of the at least one cooking recipe transferred through the Internet, a data supplying unit supplying the recipe data received by the home page information receiving unit to the microwave oven, and a display unit. The home page information further includes a transfer instructing button operated externally for instructing data transfer corresponding to each of the at least one cooking recipe, and image display data to enable display of the information related to the cooking recipe as a home page screen, on the display unit. The recipe data includes heating control data for controlling heating operation of the microwave oven, and is directly recognized by the microwave oven.

By the information processing apparatus described above, it becomes possible for the user to supply the heating control data corresponding to the desired cooking recipe provided by the home page through the Internet directly to the microwave oven simply by operating the transfer instruction button output on the home page screen to quickly control the heating operation, that is, without the process of decoding the heating control data to be recognizable by the microwave oven. Therefore, the desired cooking recipe can be quickly and automatically heated and cooked by the microwave oven, enabling practical performance.

The data supplying unit of the above described information processing apparatus supplies the recipe data to the microwave oven by infrared communication. As the information processing apparatus communicates with the microwave oven by wireless communication using infrared ray, the microwave oven and information processing apparatus may be positioned relative to each other at any position within the reach of the infrared ray, and therefore degree of freedom in arranging the microwave oven and the information processing apparatus is increased.

The data supplying unit of the above described information processing apparatus supplies the recipe data to the microwave oven, using a storage medium. As the information processing apparatus communicates with the microwave oven using a storage medium, there is no restriction in arranging of the microwave oven and the information processing apparatus relative to each other. Therefore, degree of freedom in arranging the microwave oven and the information processing apparatus is increased.

The host computer in accordance with a still further aspect of the present invention includes a home page information storing unit storing home page information, for providing, through the Internet, the home page information including recipe data for cooking each cooking recipe of one or more cooking recipes by a microwave oven, and a downloading unit responsive to a request of downloading for supplying the desired recipe data to the microwave oven, downloading the desired recipe data to the source of request of the downloading through the Internet. The home page information includes a transfer instruction button operated for requesting downloading, corresponding to each of the at least one cooking recipe, and information related to the cooking recipe. The recipe data includes heating control data for controlling the heating operation of the microwave oven for heating and cooking the corresponding cooking recipe by the microwave oven, and is directly recognized by the microwave oven. Of the home page information, information other than the recipe data is for constructing the home page image display screen.

By the host computer described above, it becomes possible for the user to supply the heating control data corresponding to the desired cooking recipe provided by the home page through the Internet directly to the microwave oven simply by operating the transfer instruction button output on the home page screen to quickly control the heating operation, that is, without the process of decoding the heating control data to be recognizable by the microwave oven. Therefore, the desired cooking recipe can be quickly and automatically heated and cooked by the microwave oven, enabling practical performance.

Degradation of the display of the home page screen resulting from display of the recipe data which is to be recognized by the microwave oven, or poor visibility of the necessary information resulting from the display of information not necessary for the user on the home page screen can be avoided.

In the computer readable recording medium recording the home page information in accordance with a still further aspect of the present invention, the home page information includes heating control data for controlling the heating operation of the microwave oven for heating and cooking the cooking recipe by the microwave oven, corresponding to each of a plurality of cooking recipes, a transfer instruction button operated for transferring the recipe data through the Internet to the source of data request requesting supply of the recipe data to the microwave oven, and information related to the cooking recipe. Of the home page information, information other than the recipe data is screen information for constructing the home page image display screen. Therefore, it becomes possible for the user to supply the heating control data corresponding to the desired cooking recipe provided by the home page through the Internet directly to the microwave oven simply by operating the transfer instruction button output on the home page screen to quickly control the heating operation, that is, without the process of decoding the heating control data to be recognizable by the microwave oven. Therefore, the desired cooking recipe can be quickly and automatically heated and cooked by the microwave oven, enabling practical performance.

The recipe data is not the data displayed on the home page screen. Therefore, visual image displayed on the home page screen is not disturbed by the display of the recipe data, which is the special data to be recognized by the microwave oven. Further, degradation in visibility of the necessary information caused by the display of the recipe data, which is unnecessary for the user, displayed on the home page screen, can be avoided.

In the above described microwave oven system, the information processing apparatus is portable, and adapted to be connected for communication to the Internet through a telephone line.

Therefore, when the user goes out with the information processing apparatus with him/her, it is possible for the user to receive the recipe data of the desired cooking recipe from the home page information while he/she is out, and to supply the recipe data to the microwave oven back home to heat and cook the desired cooking recipe in accordance with the recipe data by the microwave oven.

Therefore, convenience of use of the microwave oven system is improved, as the home page information including the recipe data is available at any time, anywhere.

In the above described microwave oven system, the information processing apparatus further has a shared connector unit shared for switching connection of the information processing apparatus with a telephone line to enable communication and with the microwave oven to enable communication.

Therefore, by the shared connector portion, it is possible to switch and connect the telephone line to the Internet or the microwave oven to the information processing apparatus. Therefore, it is unnecessary to provide an extra number of connector units to the information processing apparatus.

In the above described microwave oven system, the information processing apparatus is adapted to additionally have an oven side connector unit for connecting the microwave oven to the information processing apparatus to enable communication, and an Internet side connector unit for connecting the telephone line to the information processing apparatus to enable communication.

By the oven side connector unit and the Internet side connector unit, both the microwave oven and the telephone line can be connected simultaneously to the information processing apparatus. Therefore, the process of switching connection at the connector unit between the telephone line and the microwave oven can be omitted, which is convenient for use.

In the above described microwave oven system, the telephone line is adapted to be connected to the shared connector unit through a portable telephone having a modem function. Further, in the above described microwave oven system, the telephone line is adapted to be connected to the Internet side connector unit through the portable telephone having the modem function.

Therefore, even when the information processing apparatus does not have the mode function, it becomes possible to connect the information processing apparatus to the telephone line to the Internet side to enable communication by using the portable telephone having the modem function, and hence types of the information processing apparatus which can be applicable to the microwave oven system can be expanded.

In the above described microwave oven system, the information processing apparatus and the microwave oven communicate various information including the supply information by infrared ray, and therefore, the process of wiling for communication can be omitted, improving convenience for use.

In the above described microwave oven system, the supply information includes recipe data, and the recipe data includes recipe name data representing recipe name of the corresponding cooking recipe to be displayed on the output unit. The information processing apparatus includes a memory unit for storing information including a plurality of recipe data received through the Internet, and an editing unit for editing recipe name data of the plurality of recipe data in the memory unit while the recipe name data are displayed on the output unit.

The editing unit includes a recipe name editing unit for extracting and editing, while the respective recipe name data of the plurality of recipe data stored in the memory unit are displayed at the output unit, the recipe name data corresponding to at least one cooking recipe of which heating and cooking by the microwave oven is desired, from the displayed plurality of recipe name data.

Therefore, it is possible for the user to extract and edit the recipe name data of at least one cooking recipe of which heating and cooking by the microwave oven side is desired, among the plurality of recipe name data downloaded in advance, through the recipe name editing unit. Therefore, preference of the user can easily be reflected in selecting at least one cooking recipe to be heated and cooked by the microwave oven.

In the above described microwave oven system, the editing unit has a recipe name classifying unit classifying, while the recipe name data corresponding to the plurality of recipe data stored in the memory unit are displayed at the output unit, the displayed plurality of recipe name data into a plurality of groups. The recipe name data corresponding to at least one cooking recipe of which heating and cooking by the microwave oven is desired is adapted to be extracted from the desired group among the plurality of groups classified in advance by the recipe name classifying unit.

Therefore, the recipe name data corresponding to at least one cooking recipe of which heating and cooking by the microwave oven side is desired may be the recipe name data included in a desired group of the plurality of groups classified in advance by the recipe name classifying unit. This facilitates the user to select the recipe name data corresponding to at least one cooking recipe of which heating and cooking by the microwave oven is desired.

In the above described microwave oven system, the editing unit has a recipe name deleting unit deleting a desired recipe name data, among the plurality of recipe name data displayed at the output unit. The recipe data corresponding to the recipe name data deleted by the recipe name deleting unit is adapted to be deleted from the memory unit.

Therefore, when the recipe data which becomes unnecessary is to be deleted from the memory unit, what is necessary is to simply delete the corresponding recipe name data displayed at the output unit by the recipe name deleting unit. Therefore, the memory unit can effectively be used in a simple manner.

In the image processing apparatus of the above described microwave oven system, when a request for processing by the editing unit and the request for communication with microwave oven occur simultaneously, an image for communication standby is displayed at the output unit, so as to wait for the communication with the microwave oven.

Generally, in a portable image processing apparatus, the function for multiple program processings is insufficient. Therefore, when the request for processing by the editing unit and the request for communication with the microwave oven occur simultaneously in the information processing apparatus, the image display for communication standby is displayed on the output unit, so that the communication with the microwave oven is kept standby. Thus, malfunction caused by the multiple program processings can be avoided, ensuring reliability of the operation of the microwave oven system.

In the above described microwave oven system, when the recipe data is stored in the memory unit, the recipe name data is extracted from the recipe data, converted to character sequence data representing a character sequence of a prescribed language, and the converted character sequence data is allotted to the recipe data as a data name specifying the recipe data.

Therefore, in the information processing apparatus, it is possible to search a desired recipe data in the memory unit based on the data name in accordance with the recipe name displayed on the home page, which is convenient for the user.

In the above described microwave oven system, the information processing apparatus includes an access start unit and a telephone line disconnecting unit. The access start unit starts access to the home page information, by connecting the telephone line to the Internet, in response to a generation of a request for receiving at least one recipe data corresponding to at least one cooking recipe. The telephone line disconnecting unit disconnects the connection between the telephone line and the Internet, in response to completion of reception of the at least one recipe data, after the start of accessing by the access start unit.

Therefore, when the user simply requests reception of at least one recipe data through the information processing apparatus, the telephone line is connected to the Internet, the home page information is accessed and after the completion of reception of the recipe data, connection between the telephone line and the Internet is disconnected, by the access start unit and the telephone line disconnecting unit. Therefore, when the user requests reception of the recipe data through the information processing apparatus, the user is free from the procedure of connection and disconnection between the telephone line and the Internet, which improves convenience for use.

The microwave oven system in accordance with a still further aspect of the present invention includes the Internet, a processing unit including an information processing apparatus having an output unit and transmitting/receiving information through the Internet, a microwave oven having at least the function of heating operation in accordance with heating control data among the information supplied through the processing unit from the Internet, and a host computer having an information storing unit storing home page information for a home page screen to be displayed on the output unit, connected to the Internet. The home page information includes recipe data consisting of text data describing a cooking recipe, including one or more procedures for heating for heating and cooking the cooking recipe by using the microwave oven, corresponding to each of a plurality of cooking recipes, and a transfer instruction button operated for transferring the recipe data to the information processing apparatus through the Internet. When the transfer instruction button corresponding to the desired cooking recipe is operated, a process for analyzing heating information takes place either in the processing unit or in the microwave oven, the heating procedure is extracted in accordance with a prescribed rule from the text data corresponding to the cooking recipe, and converted to heating control data for the heating operation of the microwave oven.

In the above described microwave oven system, the process for analyzing heating information is executed by the microwave oven or the processing unit to which information is supplied through the Internet, and hence the heating control data for the microwave oven can be obtained. Therefore, when a new cooking recipe is to be provided on the home page, it is unnecessary for the host computer to take into consideration the structure of the microwave oven system, and what is necessary is simply to prepare the recipe data consisting of general text data describing the cooking recipe. In other words, when a recipe data corresponding to a new cooking recipe is to be added to the home page information, no system change is required, and therefore the system is practical.

The above described microwave oven system further has the following feature. The processing unit further includes a relay apparatus for processing and relaying the information communicated between the information processing apparatus and the microwave oven. When the process of analyzing heating information takes place in the processing unit, the process is executed either in the information processing apparatus or the relay apparatus.

In the above described microwave oven system, the process of analyzing heating information is executed either by the information processing apparatus or the relay apparatus. Therefore, no matter whether the system structure has the information processing apparatus and the microwave oven connected directly for communication or the information processing apparatus and the microwave oven connected with the relay apparatus interposed, no system change is required when a recipe data of a new cooking recipe is to be added to the home page information, and hence the system is practical.

The above described microwave oven system further has the following feature. More specifically, the system includes a heating unit executing the heating operation of the microwave oven, and a control unit having an information processing function and controlling execution of the heating operation in accordance with the heating data. The control unit executes the process of analyzing heating information, using the information processing function.

In the above described microwave oven system, the microwave oven has a control unit, and the control unit executes the process of analyzing heating information using the information processing function. Therefore, even when a system configuration aimed at reducing load on the information processing unit, or a system configuration connected to a processing unit with the function of analyzing heating information uninstalled is applied, it is possible to perform the process of analyzing heating information and to obtain the heating control data on the side of the microwave oven, and hence the system is practical.

The above described microwave oven system further has the following feature. More specifically, each text data of one or more heating procedures include a mode data representing a type of the heating operation to be set in the microwave oven, and at least one of a level data representing a heating level of the heating operation and a time data representing a heating time of the heating operation. The prescribed rule includes a first rule for distinguishing and extracting the text data of one or more heating procedures from other text data, and a second rule for extracting the mode data and at least one of the level data and the time data, for each of the text data of one or more heating procedures extracted in accordance with the first rule.

In the above described microwave oven system, extraction of the heating procedures in accordance with the prescribed rule in the process of analyzing heating information is performed in the following manner. The text data of one or more heating procedures among the text data are distinguished from other text data and extracted in accordance with the first rule, and from each of the text data of one or more heating procedures thus extracted, the mode data and at least one of the level data and the time data are extracted using the second rule.

Therefore, extraction of the text data of the heating procedure in the process of analyzing heating information is a simple process performed stepwise using the first and second rules. Therefore, even when the process of analyzing heating information is executed, increase in load on the microwave oven or the processing unit by this analysis can be suppressed, and hence the system is practical.

The above described microwave oven system further has the following feature. More specifically, the first rule instructs distinction between the text data of one or more heating procedures from other text data, based on the color of each character in the text data, when the text data are displayed as the home page screen image, on the output unit.

In the above described microwave oven system, extraction of the text data of one or more heating procedures from the text data in the process of analyzing heating information is based on the color of display of each character in the text data when displayed on the home page screen.

Therefore, extraction of the text data of one or more heating procedures is a very simple process based on the color of display of each character. Therefore, the load on the processing unit or the microwave oven is not increased by the execution of the process of analyzing heating information, and hence the system is practical.

The above described microwave oven system further has the following feature. Namely, the first rule instructs distinction between the text data of one or more heating procedures from other text data based on the font of each character in the text data.

In the above described microwave oven system, extraction of the text data of one or more heating procedures in the process of analyzing heating information is based on the font of each character in the text data. Therefore, increase in the load on the system caused by the execution of the process of analyzing heating information at the processing unit or the microwave oven can be suppressed, and hence the system is practical.

Further, the first rule may instruct distinction of the text data of one or more heating procedures from other text data based on the size of each character of the text data, allotted sign, presence/absence of a frame or the type of the frame.

The above described microwave oven system further has the following feature. More specifically, the home page information further includes a function updating button operated for updating a prescribed function of the processing unit or the microwave oven. The host computer further has a function storing unit storing various function information used for updating the function. When the function updating button is operated, the processing unit or the microwave oven receives function information corresponding to the prescribed function among various function information through the Internet, and updates the prescribed function using the received function information.

In the above described microwave oven system, simply by the operation of the function updating button on the home page screen displayed at the output unit, the prescribed function of the processing unit or the microwave oven can automatically be updated using the new function information received through the Internet from the host computer.

Therefore, the microwave oven system can cope with every expected changes in the future, along with the development and progress of new technologies. Therefore, switching to the new system is very simple as the function can be updated without causing any trouble in the user, or without causing any necessity of disassembling or newly purchasing the microwave oven or the processing unit.

In the above described microwave oven system, the prescribed function corresponds to the process of analyzing heating information. Therefore, the function corresponding to the process of analyzing heating information by the microwave oven or the processing unit can be performed automatically in a simple manner by simple operation of the function updating button, and hence the system is practical.

The microwave oven system in accordance with a still further aspect of the present invention includes the Internet, an information processing unit including an information processing apparatus having an output unit and transmitting/receiving information through the Internet, a microwave oven having at least the function of heating operation in accordance with heating control data among information supplied from the information processing unit, and a host computer connected to the Internet and having an information storing unit storing home page information corresponding to the home page screen displayed at the output unit. The home page information includes recipe data including description information describing the cooking recipe and the heating control data for heating and cooking the cooking recipe recognized by the microwave oven, corresponding to each of a plurality of cooking recipes, and information of a transfer instruction button operated for transferring the recipe data to the information processing apparatus through the Internet. The microwave oven has an audio output unit for converting contents represented by the description information among the supplied information to an audio signal and providing the signal as an audio output.

The description information may be text data.

By the information processing apparatus described above, it becomes possible for the user to supply the heating control data corresponding to the desired cooking recipe provided by the home page through the Internet directly to the microwave oven simply by operating the transfer instruction button output on the home page screen to quickly control the heating operation, that is, without the process of decoding the heating control data to be recognizable by the microwave oven. Therefore, the desired cooking recipe can be quickly and automatically heated and cooked by the microwave oven, enabling practical performance.

In the microwave oven, the description information corresponding to the desired cooking recipe is output as audio message from the audio output unit. Therefore, as compared with confirmation of the description information while scrolling the display screen, it is more convenient to prepare and arrange materials to be cooked heated and cooked while listening to the message, and hence the system is very practical.

When the description information consist of text data, the audio output unit having the simple text reader function is sufficient. Therefore, increase in cost of the microwave oven can be avoided.

The above described microwave oven system further has the following feature. More specifically, the microwave oven further has a memory storing various information, and an oven processing unit accessing and information-processing the contents of the memory and communicating with the information processing unit. The oven processing unit has an information transmitting unit, responsive to a reception of an information request requesting various information, for reading and transmitting various information from the memory. The information processing unit has a request transmitting unit transmitting the information request to the oven processing unit, and an information output unit outputting the various information transmitted by the information transmitting unit through the output unit.

In the above described microwave oven system, various information on the side of the microwave oven can be output through the output unit of the information processing unit upon request. Therefore, even when it is impossible to output various information on the side of the microwave oven, it is possible for the user to confirm the contents as the various information can be output from the output unit of the information processing unit. Therefore, it is possible for the user to comprehend state of the microwave oven based on the various information, and hence the system is very practical.

The various information of the above described microwave oven system includes self-diagnosis information including at least the information representing presence/absence of a malfunction of the microwave oven.

Therefore, it is possible for the user to analyze malfunction of the microwave oven, by the self-diagnosis information such as presence/absence of a defect of the microwave oven.

The various information in the above described microwave oven system includes recipe information representing a heating and cooking recipe which has been frequently heated and cooked, among one or more heating and cooking recipes, including a cooking recipe heated and cooked by the heating operation in accordance with the heating control data.

Therefore, it is possible to vary or improve the diet, referring to the heating and cooking recipe which has been frequently heated and cooked.

In the above described microwave oven system, the heating operation is in accordance with any of a plurality of different heating modes, and the various information includes time information representing time of heating operation for each of the plurality of different heating modes. Therefore, it is possible for the user to know the tendency of use of the heating mode of the oven and may improve the manner of use, confirming the time information.

In the above described microwave oven system, the information processing unit further includes a memory unit storing at least one recipe data received through the Internet, an input unit externally operated for inputting information related to a special cooking recipe, a recipe data storing unit processing the information input through the input unit to convert the information to recipe data and storing the recipe data in the memory unit, and a supplying unit responsive to a request for supplying the requested recipe data corresponding to the special cooking recipe from the memory unit to the microwave oven.

In the above described microwave oven system, the information processing unit further includes a relay apparatus relaying and processing communication between the information processing apparatus and the microwave oven.

In the above described microwave oven system, the recipe data of the special cooking recipe input by external operation of the input unit of the relay apparatus or the information processing apparatus is stored in the memory unit of the information processing unit and, subsequently, read from the memory unit and supplied to the microwave oven, in response to a request. Therefore, even when a recipe data of a special cooking recipe such as a recipe of an original dish prepared by the user cannot be registered because of a restriction on the microwave oven side, it is possible for the user to once register the data in the memory unit of the relay apparatus or the information processing apparatus on the side of the information processing apparatus and, thereafter, to have the microwave oven automatically heat and cook the special cooking recipe using the recipe data supplied from the side of the information processing unit. Therefore, the system is very practical.

The above described microwave oven system further has the following feature. More specifically, the host computer includes a frozen food heating information storing unit storing, for each of a plurality of different commercially available frozen foods, recipe name data and standard heating control data for heating and cooking the corresponding commercially available frozen food, and a heating control data transmitting unit receiving a data request and reading and transmitting the standard heating control data corresponding to the received data request from the frozen food information storing unit. The information processing apparatus includes a data request transmitting unit for transmitting, when a recipe data name of a desired commercially available frozen food recipe is externally input, a data request including the input recipe data name to the host computer, and a converting/supplying unit receiving the standard heating control data from the host computer after transmission of the data request, converting the received data to be optimal for the capability of heating operation of the microwave oven and supplying the converted data to the microwave oven.

In the above described microwave oven system, when a commercially available frozen food recipe is to be heated and cooked by a microwave oven, the standard heating control data of the frozen food recipe converted to be optimized for the capability of heating operation of the microwave oven is supplied to the microwave oven through the host computer, the Internet and the information processing apparatus. Therefore, when a commercially available frozen food recipe is to be heated and cooked by the microwave oven, the frozen food can be optimally heated and cooked, not limited by the capability of heating operation of the microwave oven.

In the cooking information supplying system in accordance with a still further aspect of the present invention, cooking information is supplied by a host computer having an information storing unit storing cooking information including recipe information of foods to be cooked by a microwave oven, through a communication network to a plurality of terminal devices. At least one of the plurality of terminal devices include an information input unit receiving as an input the cooking information, a requesting unit requesting the cooking information, an information receiving unit receiving the cooking information from the host computer, and an information output unit outputting the cooking information received by the information receiving unit. The host computer includes a storing unit for storing cooking information input through the information input unit to the information storing unit, and an information transmitting unit transmitting the cooking information requested by the requesting unit in the information storing unit to the terminal devices.

Therefore, it is possible on the side of the terminal device to store various pieces of cooking information in the information storing unit of the host computer, and to read, receive and output a desired piece of information from the cooking information stored in the information storing unit. Therefore, it is possible for each terminal device to cook by the microwave oven, using the received various pieces of cooking information.

In the cooking information supplying system, the plurality of terminal devices include a shop terminal device provided in a shop. The cooking information further includes additional information related to cooking. The information input unit of the shop terminal device has a special input unit for inputting a piece of cooking information for a recipe using a prescribed material or item which is on sale or recommended by the shop. The cooking information input by the special input unit includes, as recipe information, at least material information representing materials of the dish, and at least address information representing the address of the shop, as the related information.

Therefore, it is possible by the shop terminal device to store cooking information for a recipe using a prescribed material or item which is specially recommended or on sale at the shop, in the information storing unit of the host computer, and it is possible for other terminal devices to read, receive and output the cooking information stored in the information storing unit. Therefore, on the side of the other terminal devices, the recipe using the prescribed material or item specially recommended or on sale at the shop can be cooked by the microwave oven.

Further, on the side of the other terminal devices, the address information and the material information included in the cooking information are received, so that it is possible to purchase the materials necessary for the recipe, including the special item on sale, at the shop. Therefore, it is possible for the user to purchase the necessary materials for the recipe at a low price, and it is possible for the shop to sell the specific item or material recommended efficiently.

In the recipe information supplying system described above, the terminal device further includes an order input unit and an order transmitting unit. The shop terminal device further includes an order receiving unit and an order output unit. The order input unit receives as an input, order information for placing an order for the desired item with the shop, when the cooling information input through the special input unit is output through the information output unit. The order information input through the order input unit is transmitted by the order transmitting unit through the host computer to the shop. The order information transmitted by the order transmitting unit is received by the order receiving unit. The order output unit outputs the order information received at the order receiving unit.

Therefore, it is possible to transmit the order information for placing an order for the desired item with the shop from the terminal device to the shop terminal device, and it is possible by the shop terminal device to receive and output the order information and confirm the contents. Therefore, on the side of the terminal device, it is possible for the user to directly order and obtain the materials necessary for the recipe including the item on sale from the shop. Therefore, it is possible for the user to readily obtain the materials necessary for cooking at a low price. Further, it is possible for the shop to efficiently sale the specific item which is recommended by the shop.

In the cooking information supplying system, the recipe information includes heating data for heating and cooking the recipe by controlling the microwave oven. The terminal device supplies the heating data in the cooking information received by the information receiving unit to the microwave oven.

Therefore, on the side of each terminal device, it is possible to cook various recipes by the microwave oven using various pieces of cooking information received, in other words, various heating data.

In the above described microwave oven system, the microwave oven has an apparatus side connector unit for communicatively connecting the information processing apparatus, and when a microwave oven side connector unit is inserted to the apparatus side connector unit, communication between the information processing apparatus and the microwave oven becomes possible.

As the communication between the information processing apparatus and the microwave oven becomes possible when the microwave oven side connector unit is inserted to the apparatus side connector unit, a troublesome wiring work for communication is unnecessary, which is convenient for the user.

In the above described microwave oven, the recipe data is transmitted from a portable information processing apparatus transmitting and receiving information through the Internet to the microwave oven. The information processing apparatus has a microwave oven side connector unit for communication with the microwave oven, the data receiving unit includes an apparatus side connector unit for communication with the information processing apparatus, and as the microwave oven side connector unit is inserted to the apparatus side connector unit, the recipe data is transmitted from the information processing apparatus to the microwave oven.

The portable information processing apparatus and the microwave oven described above communicate recipe data when the microwave oven side connector unit is inserted to the apparatus side connector unit. Therefore, a special wiring between the information processing apparatus and the microwave oven is unnecessary, which is convenient for the user.

In the information processing apparatus described above, the data supplying means has an microwave oven side connector unit for communication with the microwave oven, and the microwave oven has an apparatus side connector unit for communication with the information processing apparatus. When the microwave oven side connector unit is inserted to the apparatus side connector unit, the recipe data is supplied from the information processing apparatus to the microwave oven.

Communication between the above described information processing apparatus and the microwave oven becomes possible when the apparatus side connector unit is inserted to the microwave oven side connector unit. Therefore, there is no limit in the arrangement of the microwave oven and the information processing apparatus, and therefore degree of freedom in arranging the microwave oven and the information processing apparatus is improved. Further, wiring for communication is not necessary between the microwave oven and the information processing apparatus, which is convenient for the user.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 3 to 5 are examples of home page screens displayed in accordance with the home page information stored in the home page storing unit of the host computer shown in FIG. 1.

FIG. 11 shows a data list obtained by converting format of the recipe information shown in FIG. 10.

FIG. 16 shows examples of the contents in a flash memory on the side of the relay box in accordance with the flow chart of FIG. 14.

FIGS. 20A to 20C represent changes in the contents of the memory of the relay box in accordance with the flow chart of FIG. 19.

FIGS. 21A to 21F represent changes in the display images of the microwave oven in accordance with the flow chart of FIG. 19.

FIG. 28 shows an example of recipe information in accordance with the fifth embodiment of the present invention.

FIGS. 30A and 30B represent configurations of the recipe information and the heating data in accordance with the sixth embodiment of the present invention.

FIGS. 32 to 34 are illustrations showing examples of display images related to the seventh embodiment of the present invention.

FIGS. 55 to 57 represent examples of images displayed in the process of FIG. 54.

FIGS. 78A and 78B represent examples of the display images for selecting a recipe name to be transferred to the microwave oven, in the mobile equipment in accordance with the twenty-fifth embodiment of the present invention.

FIG. 82 shows an example of a home page screen displayed in accordance with the home page information stored in the home page storing unit of the host computer shown in FIG. 80.

FIG. 98 represents information stored in the memory of the microwave oven in accordance with the twenty-ninth embodiment of the present invention.

FIGS. 106 to 112 show examples of home page images displayed in accordance with the home page information stored in home page storing unit 421A of host computer 4K shown in FIG. 104.

DESCRIPTION OF THE PREFERRED EMBODIMENTS

Embodiments of the present invention will be described in the following. The microwave oven in accordance with each of the embodiments is capable of heating and cooking a plurality of different cooking recipes, in accordance with a plurality of different pieces of heating information stored as standard specification. In addition to such a function, the microwave oven has a function of heating and cooling a desired cooking recipe in accordance with the heating information of the desired cooking recipe received through the Internet.

First Embodiment

Figure 1:
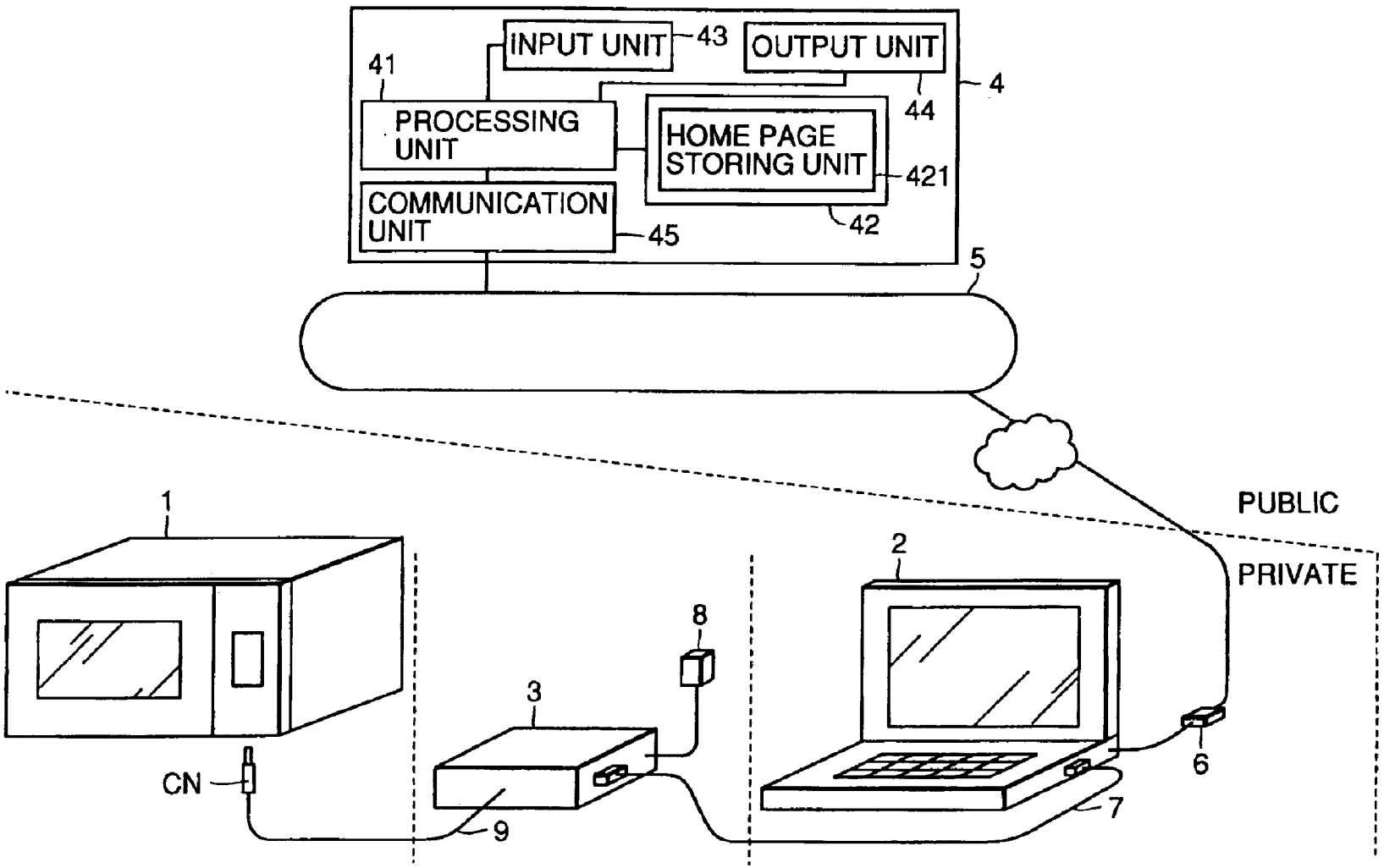
FIG. 1 is a schematic diagram showing configuration of the microwave oven system in accordance with a first embodiment of the present invention.

FIG. 1 is a schematic diagram showing a configuration of the microwave oven system in accordance with the first embodiment of the present invention.

Figure 2:
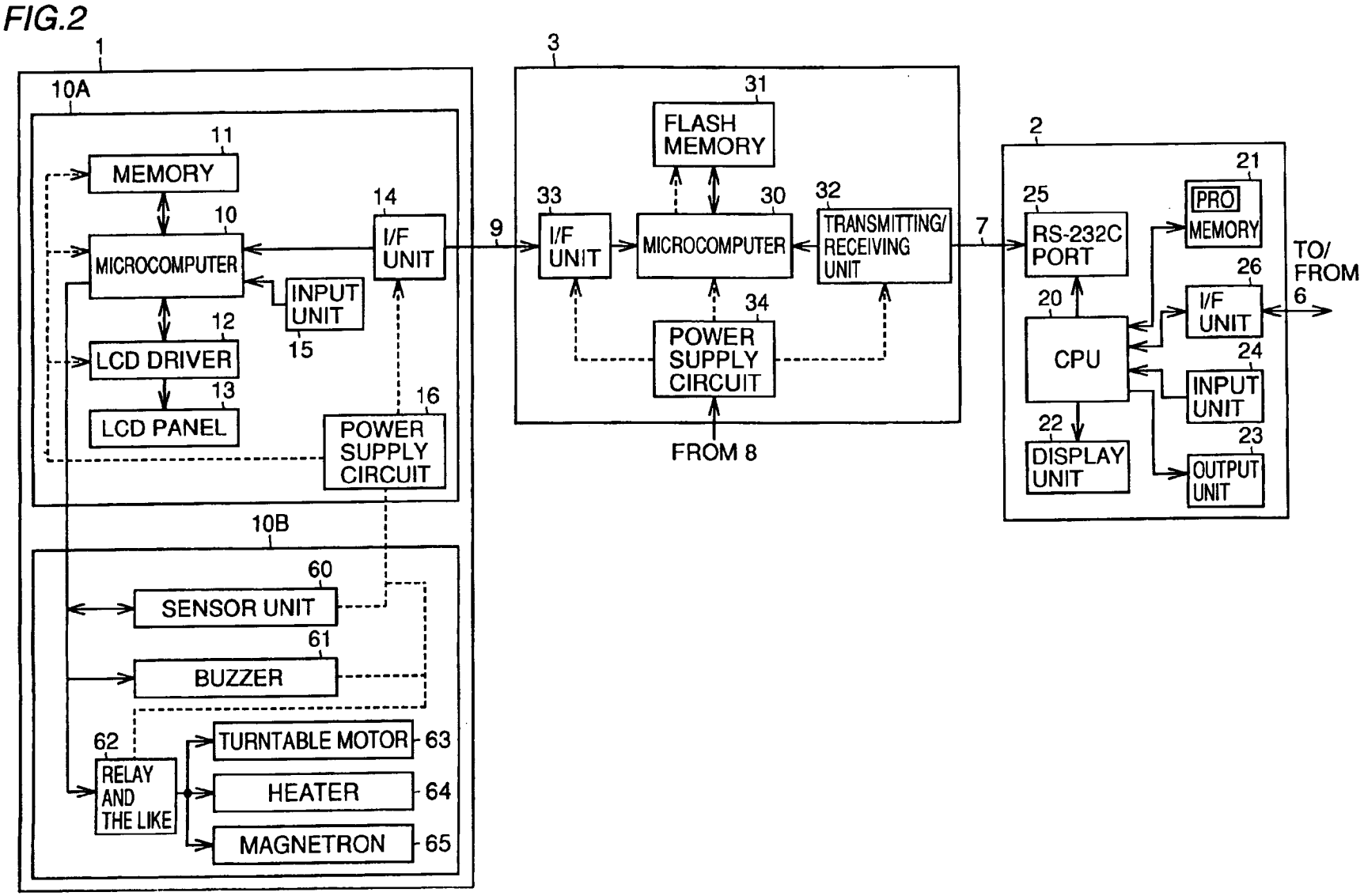
FIG. 2 is a block diagram showing configurations of respective units of FIG. 1.

FIG. 2 is a block diagram showing configurations of respective units of FIG. 1.

Referring to FIG. 1, the microwave oven system includes, in public, the Internet 5 and a host computer 4 connected thereto, and in private, a microwave oven 1, a personal computer 2 connected through a modem 6 to the Internet 5, and a relay box 3 fed from an AC adapter 8, as a relay apparatus for connecting personal computer 2 and microwave oven 1, converting and communicating signals therebetween. In private, microwave oven 1 and relay box 3 are connected by a three-line cable 9. For this connection, a connector CN at one end of the three-line cable 9 is connected to an input/output terminal, not shown, of microwave oven 1. In private, personal computer 2 and relay box 3 are connected by an RS-232C cable 7 for communication in accordance with RS-232C.

In the public host computer 4, information related to various home pages to be accessed through the Internet 5 are registered. Host computer 4 includes a processing unit 41 for centralized control and management of host computer 4 itself, a memory 42 having a home page storing unit 421 as a memory area storing information including information for constructing home page screen (hereinafter refereed to as home page information), an input unit 43, an output unit 44, and a communication unit 45 for communication and connection between the Internet 5 and host computer 4.

Referring to FIG. 2, microwave oven 1 includes a control unit 10A and a heating unit 10B. Control unit 10A includes a microcomputer 10, a memory 11, an LCD (Liquid Crystal Display) panel 13 as a display unit, an LCD driver 12 for driving LCD panel 13, an I/F (Interface) unit 14 including an input/output terminal to which a connector CN is connected, an externally operable input unit 15, and a power supply circuit 16 for supplying power to respective units of microwave oven 1. Input unit 15 and LCD panel 13 are provided integrally, as a touch panel.

Heating unit 10B performs the heating operation for heating and cooking in accordance with various pieces of information including the heating data, which will be described later, stored in memory 11, under the control of microcomputer 10. For the heating operation, heating unit 10B includes a sensor unit 60, a buzzer 61, a relay or the like 62, a turntable motor 63 controlled by microcomputer 10 through relay or the like 62, a heater 64 and a magnetron 65 generating microwaves for heating. The heating operation by the heating unit 10B is in accordance with the known technique, and therefore detailed description will not be given here. In memory 11, heating data related to at least one cooking recipe provided as a standard specification of microwave oven 1 is stored.

Personal computer 2 includes a CPU 20, a memory 21 storing information including a dedicated program PRO, which will be described later, a display unit 22, an output unit 23, an externally operable input unit 24, an RS-232C port 25 for connecting RS-232C cable 7 with the CPU 20, and an I/F unit 26 for connecting modem 6 with CPU 20.

Relay box 3 includes a microcomputer 30, a flash memory 31 as a nonvolatile storing element, a transmitting/receiving unit 32 for connecting RS-232C cable 7 with the microcomputer 30, an I/F unit 33 for connecting the three-line cable 9 with the microcomputer 30, and a power supply circuit 34 for feeding power to respective units.

For the communication through the three-line cable 9, UART (Universal Asynchronous Receiver Transmitter) is adopted.

The procedure of cooking by a private microwave oven 1 using cooking information publicly available through the Internet 5 in the host computer 4 as a home page server will be described in the following.

Figure 4:
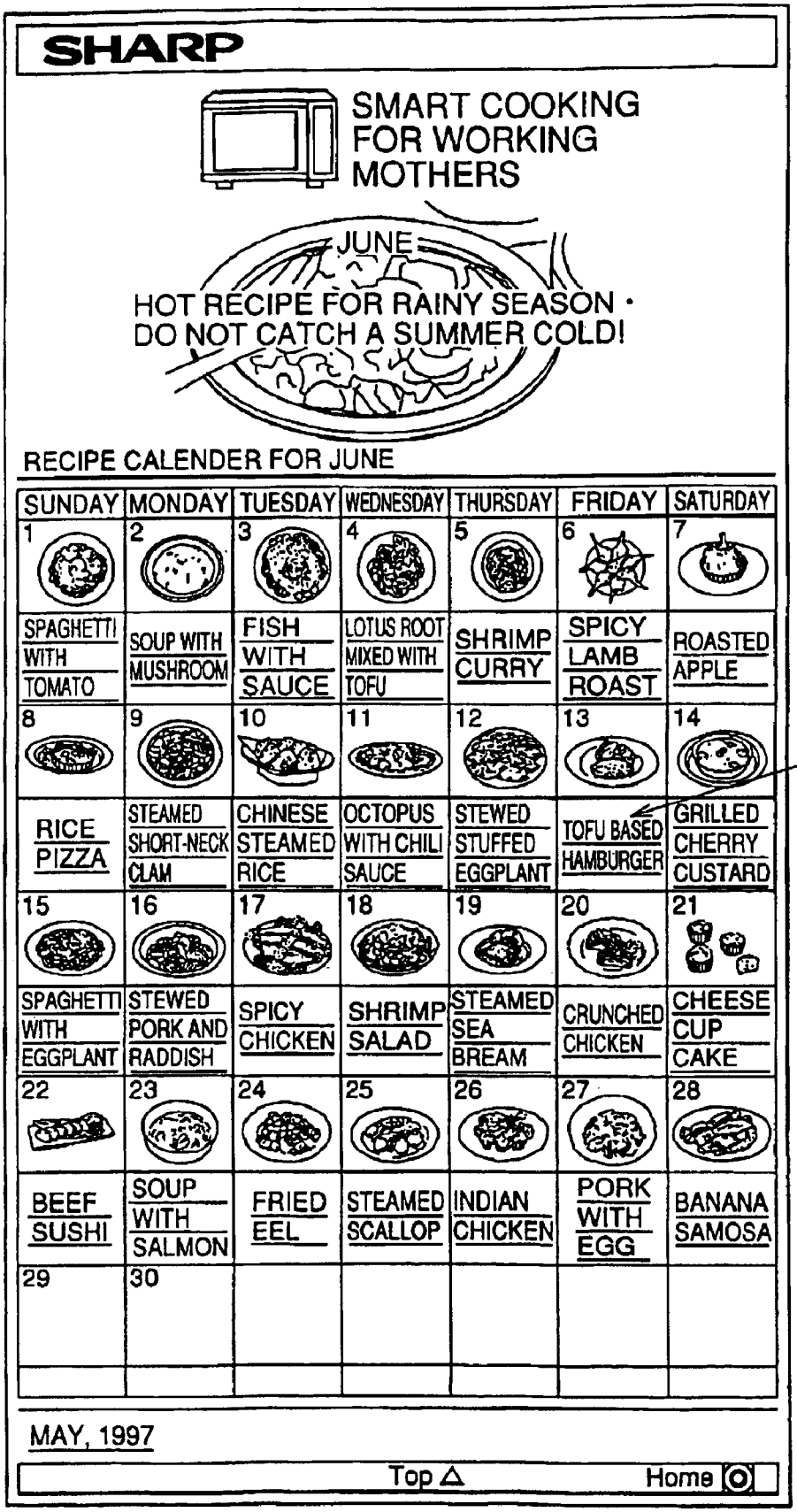
Figure 5:
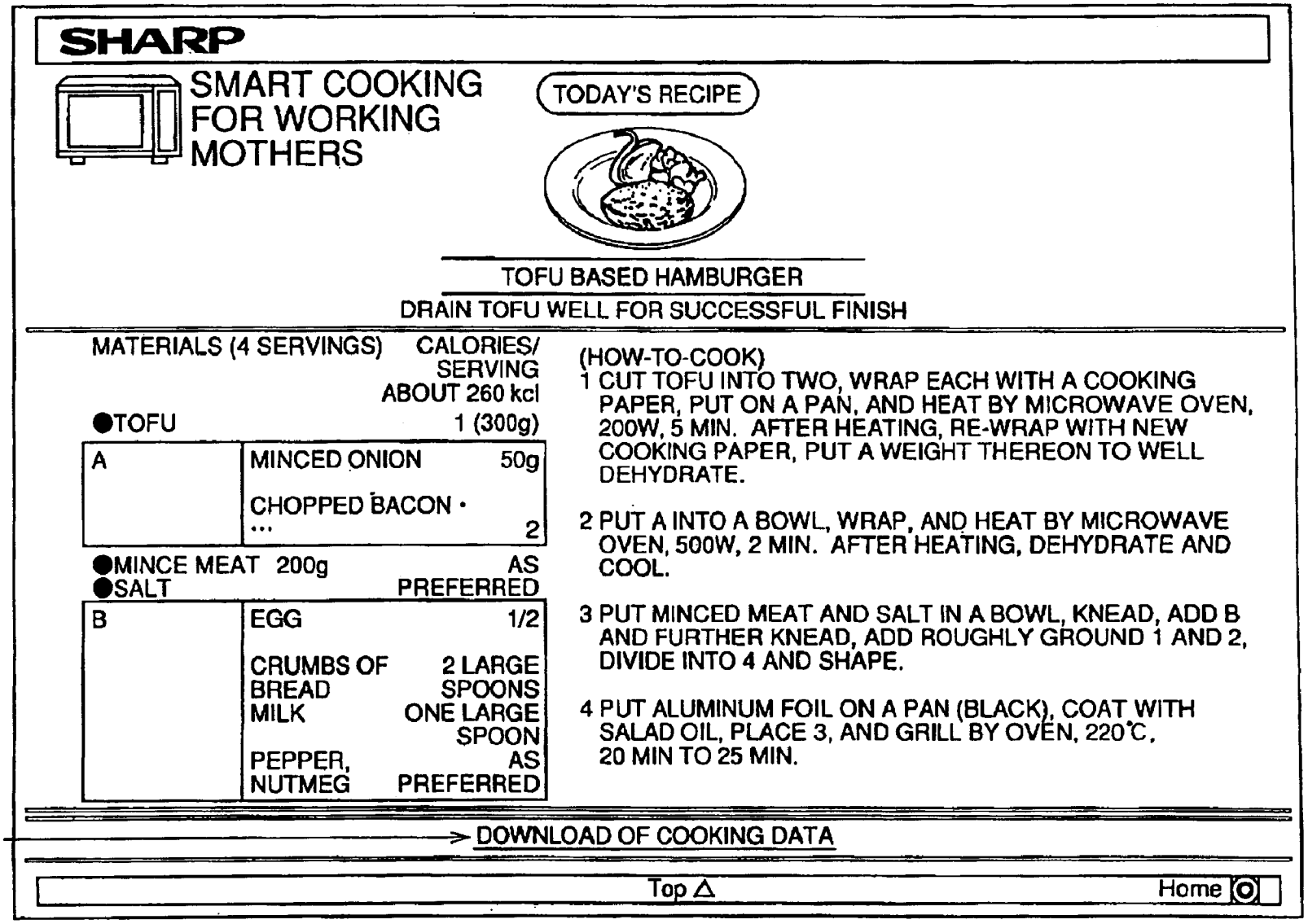

FIGS. 3, 4 and 5 represent examples of home page screen images in Japanese, displayed in accordance with the home page information stored in the home page storing unit 421 of host computer 4 of FIG. 1. FIGS. 3, 4 and 5 represent examples of home page screen images provided by the applicant on the Internet. When a user operates personal computer 2 and accesses a prescribed address corresponding to the host computer 4 through the Internet 5, the home page display of FIG. 3 appears on the output unit 23 of personal computer 2. When the user clicks, by the input unit 24, the item "microwave oven" indicated by an arrow A on the home page screen, the home page screen of FIG. 4 appears. The home page screen of FIG. 4 provides daily menu of June, in the form of a calendar. Here, a home page screen having the title of "menu calendar of June" is shown as an example. By designating the preceding or succeeding screen images, the user can browse monthly menu calendar of one year, for example, on the home page. For simplicity of description, only the portions denoted by the arrow are translated into English in FIGS. 3 to 5.

When the user designates a cooking recipe represented by the arrow A on the home page screen of FIG. 4, the home page screen of FIG. 5 appears, showing a video image of the finished cooking recipe, information of materials and information of how-to-cook. Though only an example of the home page screen is shown in FIG. 5, home page information of the home page screen image of FIG. 4 described above for each recipe of one year, as presented on the home page screen of FIG. 4, are prepared in advance in the home page storing unit 421.

When the user designates and clicks the item "download of cooking data" denoted by the arrow A on the home page screen of FIG. 5, the data to be displayed to the user through the microwave oven 1 and the heating data used for heating and cooking by the heating unit 10B of the microwave oven 1 related to the cooking recipe shown in FIG. 5 are down-loaded from host computer 4 through the Internet 5 to the personal computer 2, in response.

It is noted that a dedicated program PRO to enable the function corresponding to the click of the item denoted by the arrow A is installed in advance in memory 21 of personal computer 2.

Figure 6:
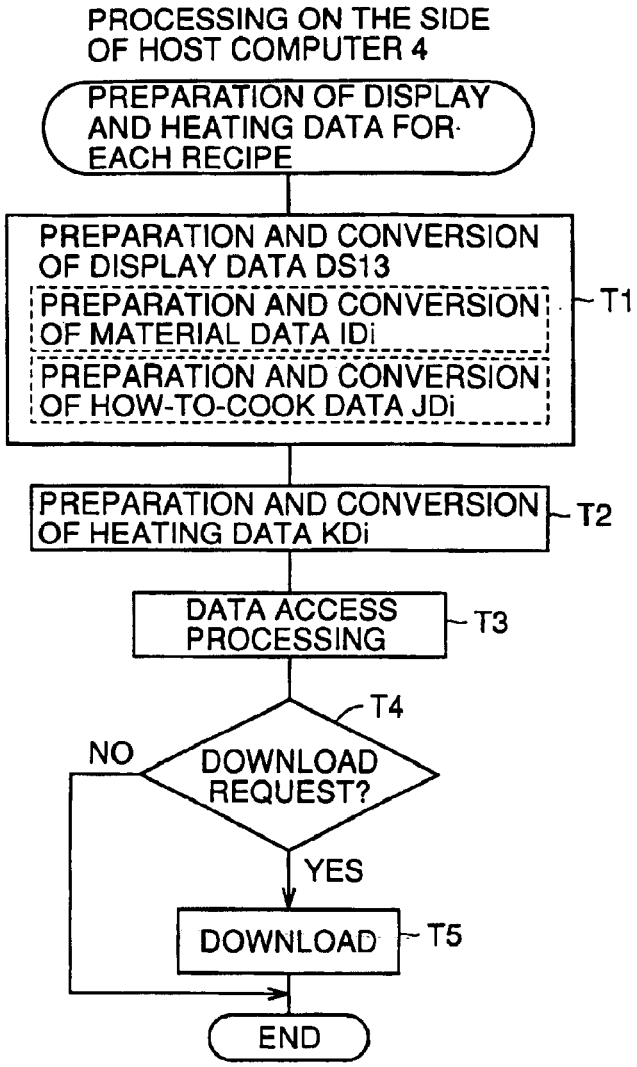
FIG. 6 is a schematic flow chart of recipe information preparing procedure for each cooking recipe when a home page is formed in accordance with an embodiment of the present invention.

FIG. 6 is a schematic flow chart of the procedure for preparing recipe information of cooking recipe when the home page is prepared or authored, in accordance with the present embodiment.

Figure 7:
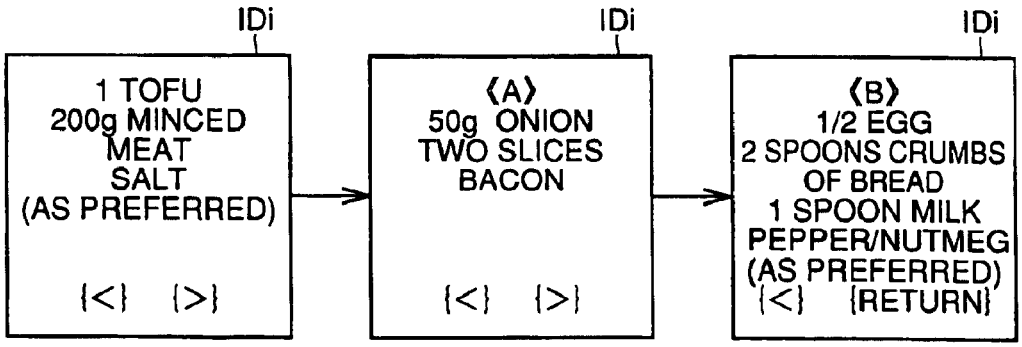
FIG. 7 schematically shows the material data prepared in accordance with the recipe information preparing procedure of FIG. 6.

FIG. 7 is a schematic diagram representing the material data prepared successively in accordance with the procedure of preparing recipe information of FIG. 6. The material data is prepared successively along the direction of the arrows.

Figure 8:
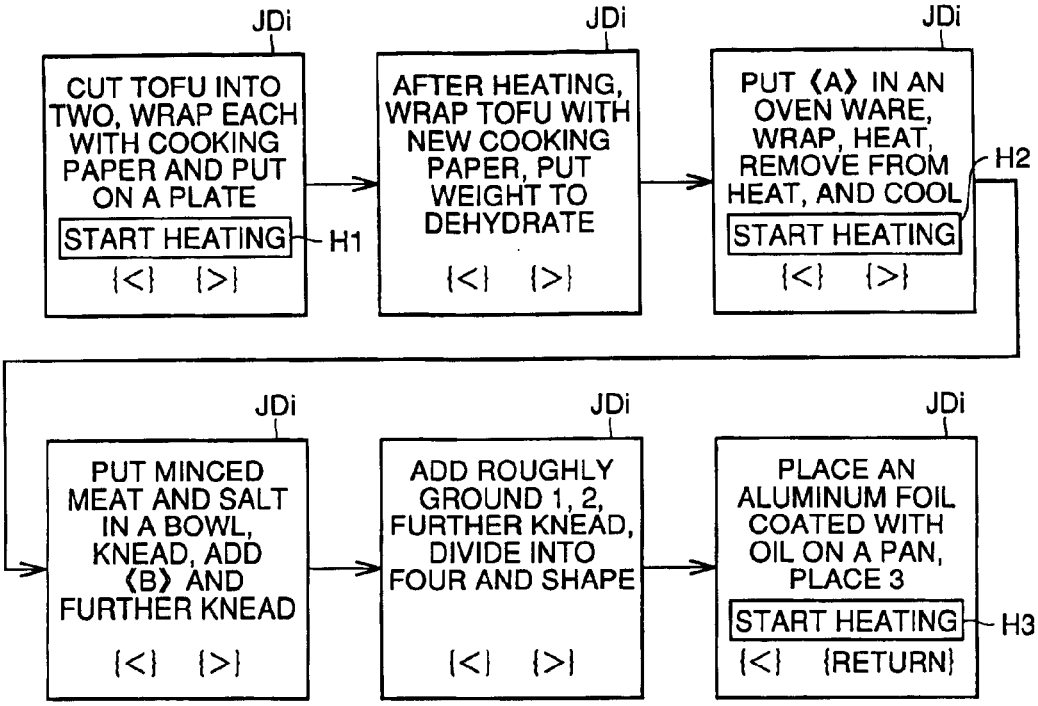
FIG. 8 schematically shows the how-to-cook data prepared in accordance with the recipe information preparing procedure of FIG. 6.

FIG. 8 schematically shows the how-to-cook data prepared successively in accordance with the procedure for preparing recipe information of FIG. 6. The how-to-cook data is prepared successively in the direction of the arrows.

The presenter of the home page prepares home page information corresponding to the home page screens of FIGS. 3 to 5 by using a prescribed program in host computer 4, converts the format of the information, as will be described later, and stores the information in home page storing unit 421. As the technique is well known, detailed description is not given here.

The menu information is prepared for each cooking recipe in accordance with the procedure of FIG. 6. Here, description will be given on a cooking recipe "Tofu-based hamburger" denoted by the arrow A in FIG. 4, as an example.

First, the presenter of the home page prepares display data by operating input unit 43 of host computer 4, converts the format as will be described later, and stores the data in home page storing unit 421 (T1 of FIG. 6). More specifically, the presenter of the home page prepares material data IDi representing materials as shown in FIG. 7 for each cooking recipe, thereafter prepares the how-to-cook data JDi representing the manner of cooking of FIG. 8, converts the data format, and stores in the home page storing unit 421.

Thereafter, the heating data KDi representing data related to control of the heating operation of microwave oven 1 for heating and cooking the cooking recipe is prepared, the format is converted and stored in home page storing unit 421 (T2 of FIG. 6). The prepared data are stored in home page storing unit 421, recipe by recipe of cooking.

Figure 9:
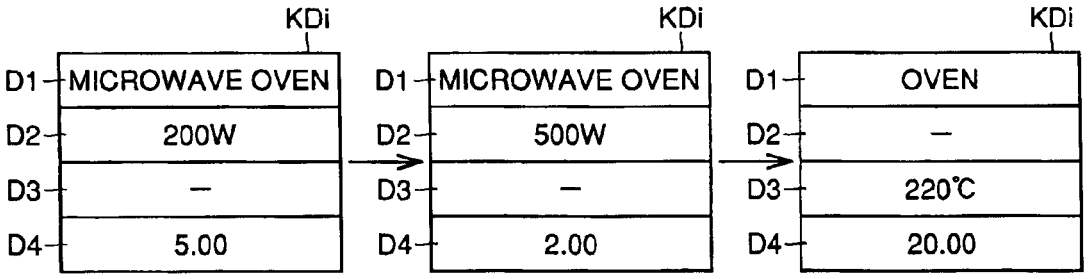
FIG. 9 shows the heating data related to heating control of the microwave oven in accordance with the first embodiment of the present invention.

The heating data KDi of FIG. 9 are respectively prepared successively in the direction of the arrow, in correspondence to items H1 to H3, "start heating" of FIG. 8. Each heating data KDi consists of mode data D1 representing operation mode (microwave oven mode or oven mode) of microwave oven 1, output level data D2 representing an output level (unit:W) of the microwave oven 1 in the operation mode represented by mode data D1, a temperature data D3 representing the set temperature of heating (unit: ° C.), and a time data D4 (unit: minutes and seconds) representing the time necessary for heating.

Figure 10:
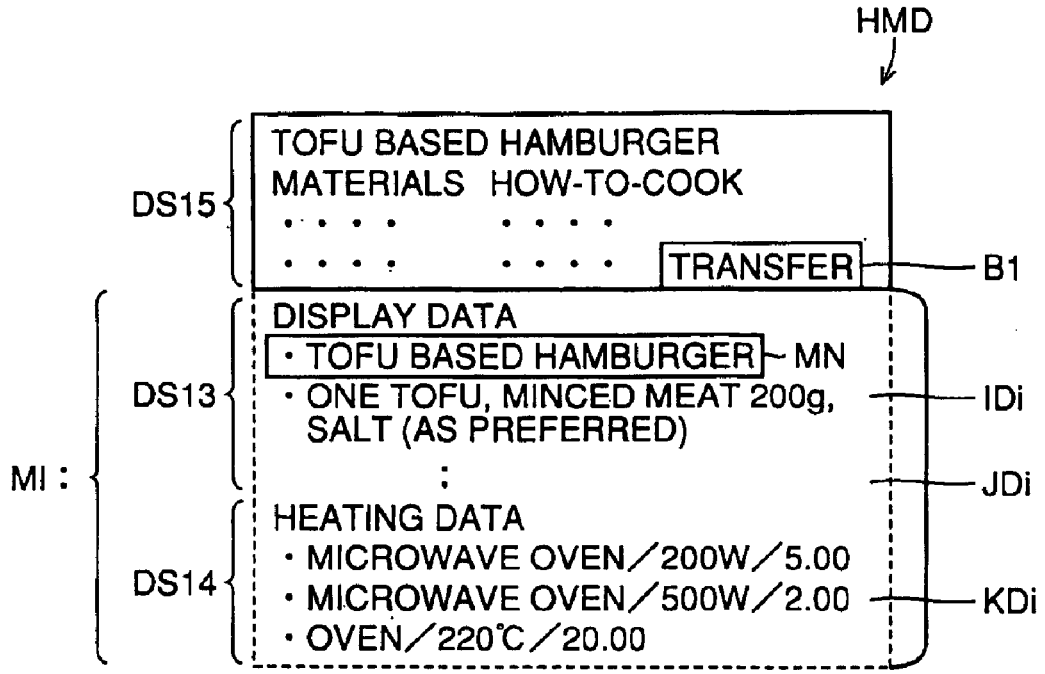
FIG. 10 shows home page information including the recipe information of each recipe prepared in accordance with FIG. 6.

FIG. 10 represents home page information including the recipe information of each recipe prepared in accordance with the procedure of FIG. 6. The home page information HMD shown in the figure corresponds to the home page screen of FIG. 5, and includes image display data DS 15 to be displayed on the home page screen to form the home page screen image, display data DS13 to be displayed on microwave oven 1, and recipe information consisting of heating data DS14 for controlling the heating operation of microwave oven 1.

Image display data DS15 is the data to provide the image to be displayed to the user on the home page screen of FIG. 5, and the item "download of cooking data" denoted by the arrow A corresponds to a transfer button B1 of data DS15 of FIG. 10.

Therefore, when the item "download of cooking data" denoted by the arrow A of FIG. 5 is denoted and clicked by the user, transfer button B1 of FIG. 10 is clicked, and the processing unit 41 of host computer 4 down-loads recipe information MI including the corresponding display data DS13 and heating data DS14 to the personal computer 2 through communication unit 45 and the Internet 5.

The recipe information MI shown in FIG. 10 is a so-called hidden information not visible (not displayed) on the home page screen displayed on the display unit 22 of personal computer 2, which information includes recipe name MN of the corresponding cooking recipe, and the material data IDi and the how-to-cook data JDi prepared in accordance with the procedures of FIGS. 7 to 9.

FIG. 11 is a data list obtained by format-conversion of recipe information MI shown in FIG. 10.

In the processes Ti and T2 of FIG. 6, display data DS13 and heating data DS14 of FIG. 10 are stored in home page storing unit 421 after converted to such data format that can be recognizable by microcomputer 10 of microwave oven 1, in the manner as shown in FIG. 11 by the processing unit 41 of host computer 4.

When the data of FIG. 11 is to be down-loaded to personal computer 2 through the Internet 5, the data is further converted to specific codes by processing unit 41. When the home page information HMD is accessed through the Internet 5 (T3 of FIG. 6), processing unit 41 determines whether there is a download request by a click of transfer button B1 (T4 of FIG. 6), and when the button is clicked, recipe information MI corresponding to the accessed home page information HMD is down-loaded to personal computer 2 (T5).

Figure 12:
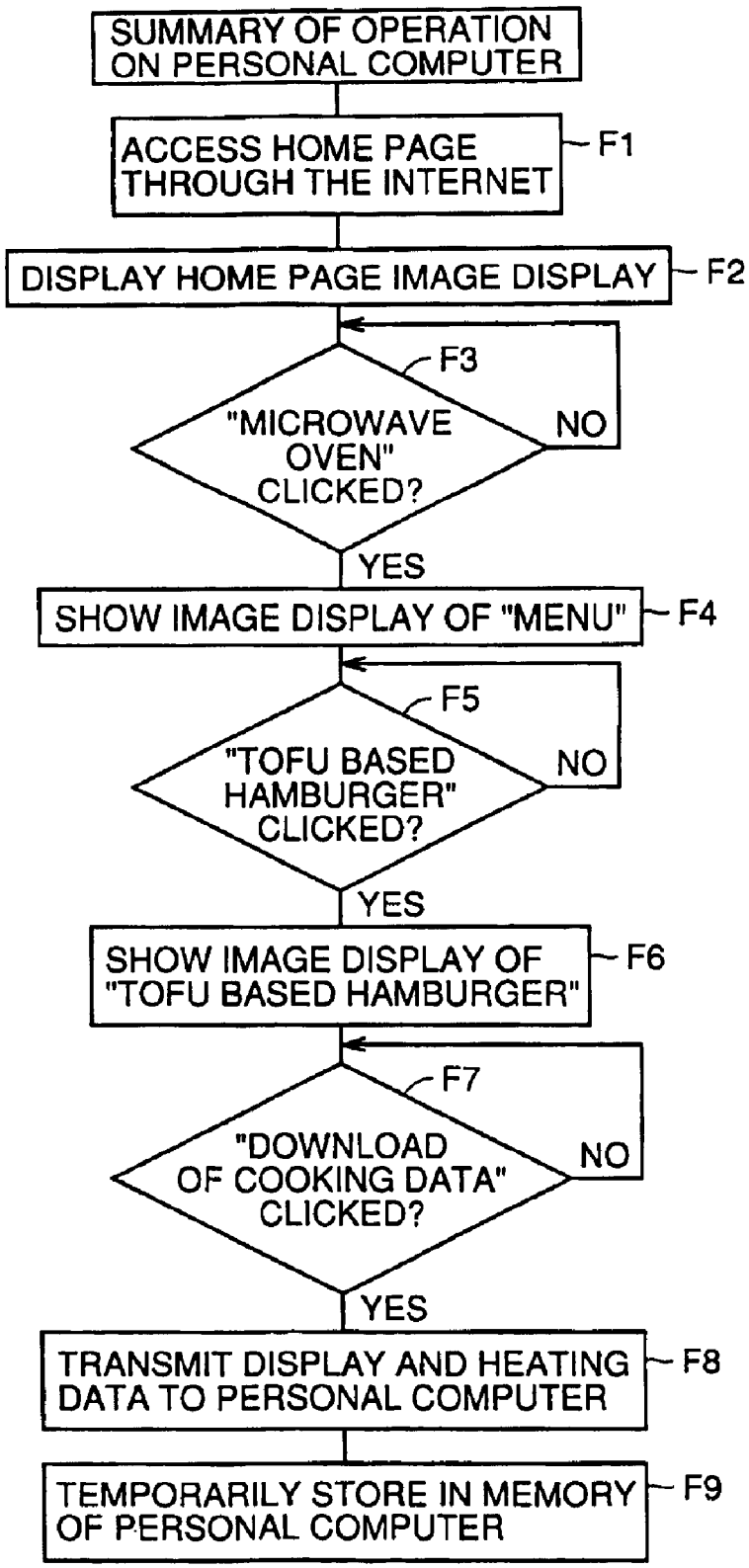
FIG. 12 is a flow chart schematically showing the operation related to downloading of the recipe information by a personal computer of FIG. 1.

FIG. 12 is a flow chart summarizing the operation related to downloading of the recipe information by the personal computer 2 of FIG. 1. Referring to the figure, the private user accesses host computer 4 of the home page through the Internet 5 by operating an input unit 24 of personal computer 2 (F1 of FIG. 12), so that the data for the home page screen including image display data DS15 of the home page information HMD in the home page storing unit 421 of host computer 4 are transmitted to personal computer 2, and the home page image display of FIG. 3 is displayed on output unit 23 (F2). When the item "microwave oven" represented by the arrow A on the home page screen of FIG. 3 is clicked by input unit 24, the screen image is switched to the home page screen image of FIG. 4 showing the monthly menu (F3, F4).

When "Tofu-based hamburger" denoted by the arrow A is clicked by input unit 24 on the home page screen of FIG. 4, the screen image is switched to the cooking recipe image display of "Tofu-based hamburger" of FIG. 5 (F5 and F6).

When the item "download of cooking data" designated by the arrow A of FIG. 5 is clicked by the user at input unit 24, the recipe information MI including corresponding display data and heating data DS13 and DS14 of FIG. 11 in home page storing unit 421 of host computer 4 is transmitted to personal computer 2, and temporarily stored in memory 21 (F8, F9).

A button to be operated to designate "download of cooking data" is provided on each menu screen, so as to enable transmission of the cooking information MI including display data DS13 and heating data DS14 to personal computer 2.

The function corresponding to the operation of transfer button B1 on the home page screen becomes effective when a dedicated program PRO is installed to memory 21 of personal computer 2 from a flexible disk appended to the purchased relay box 3. The dedicated program PRO automatically designates the recipe information MI to be downloaded and automatically designates the destination of storage of the downloaded recipe information MI, so that by a simple click of transfer button B1, the function of downloading recipe information MI and the function of transmitting recipe information MI temporarily stored in personal computer 2 to relay box 3 are attained.

As to the method of installing the dedicated program PRO to the memory 21, the following methods are popular and preferred. Namely, the program may be installed by inserting a flexible disk appended to the relay box 3 to a flexible disk driver, or the control program PRO may be presented on a home page, so that the user inputs an identification number (ID) allotted to the purchaser of relay box 3 through input unit 24, and the program is down-loaded and installed in personal computer 2.

General method of communication must be established between personal computer 2 and microwave oven 1. Therefore, in the present embodiment, RS232-C standard, establish for stable bi-directional communication, is adopted.

Figure 13:
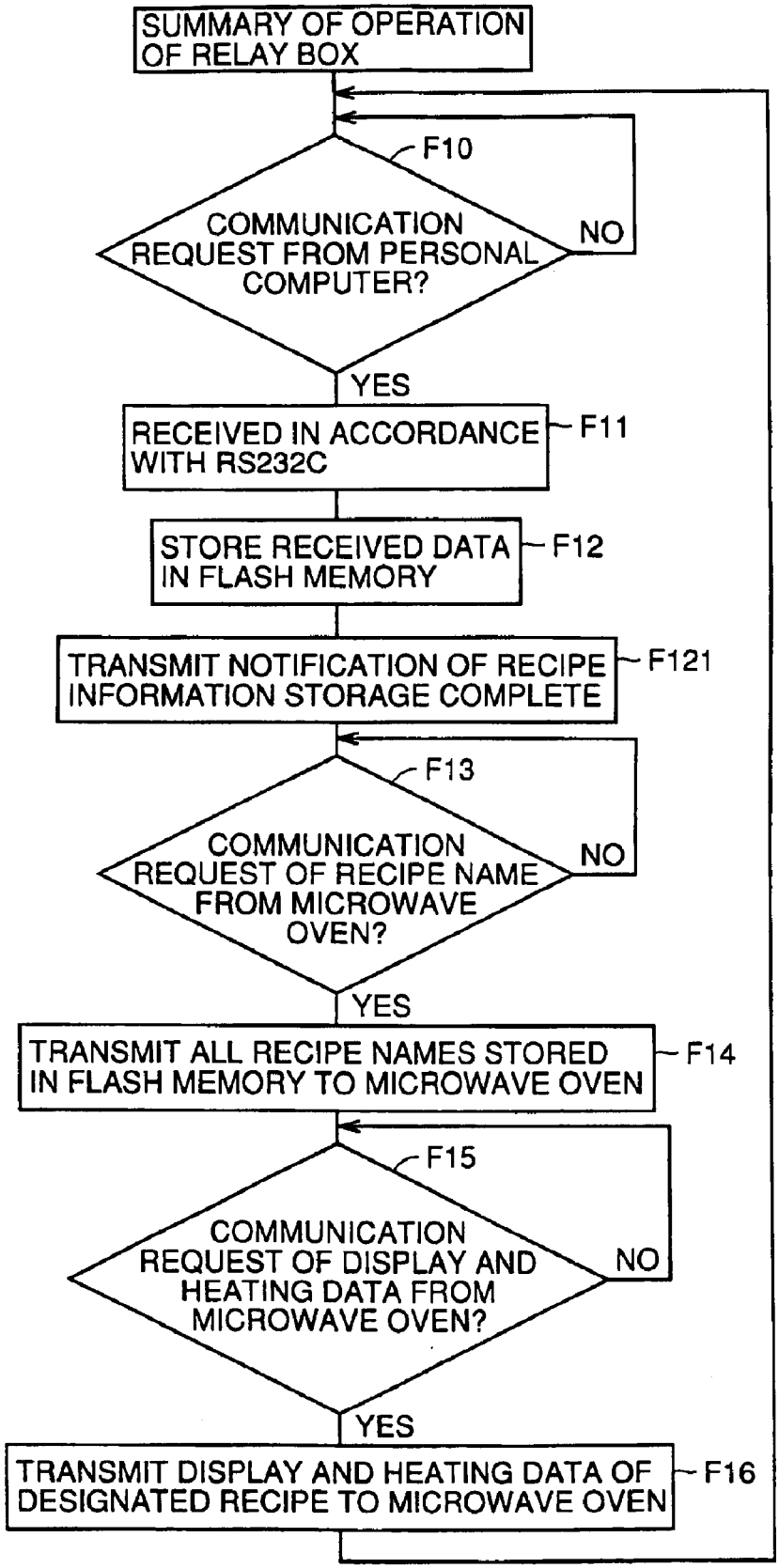
FIG. 13 is a flow chart schematically showing the operation in a relay box of FIG. 1.

FIG. 13 is a flow chart schematically showing the operation of relay box 3.

When there is a download request of recipe information M generated by personal computer 2 in the above described manner, a communication request is transmitted from personal computer 2 to relay box 3, the recipe information MI including display data and heating data DS13 and DS14 are transmitted in accordance with RS-232C standard, and the information is stored in flash memory 31 through transmitting/receiving unit 32 and microcomputer 30 (F10 to F12 of FIG. 13). Thereafter, microcomputer 30 transmits a notification of recipe information storage complete, notifying completion of storage of the recipe information, to the microwave oven 1 (F12 1).

It is possible to store recipe information MI of a plurality of cooking recipes in flash memory 31.

Upon request of microcomputer 10 of microwave oven 1, microcomputer 30 of relay box 3 transmits all the recipe names MN stored in flash memory 31 to microcomputer 10 of microwave oven 1 through a cable 9 (F13 and F14).

Thereafter, in accordance with an instruction from microcomputer 10 of microwave oven 1, microcomputer 30 in relay box 3 transmits, among at least one recipe information MI stored in flash memory 31, the display data and heating data DS13 and DS14 corresponding to the designated recipe name MN to microcomputer 10 of microwave oven 1 (F16).

Figure 14:
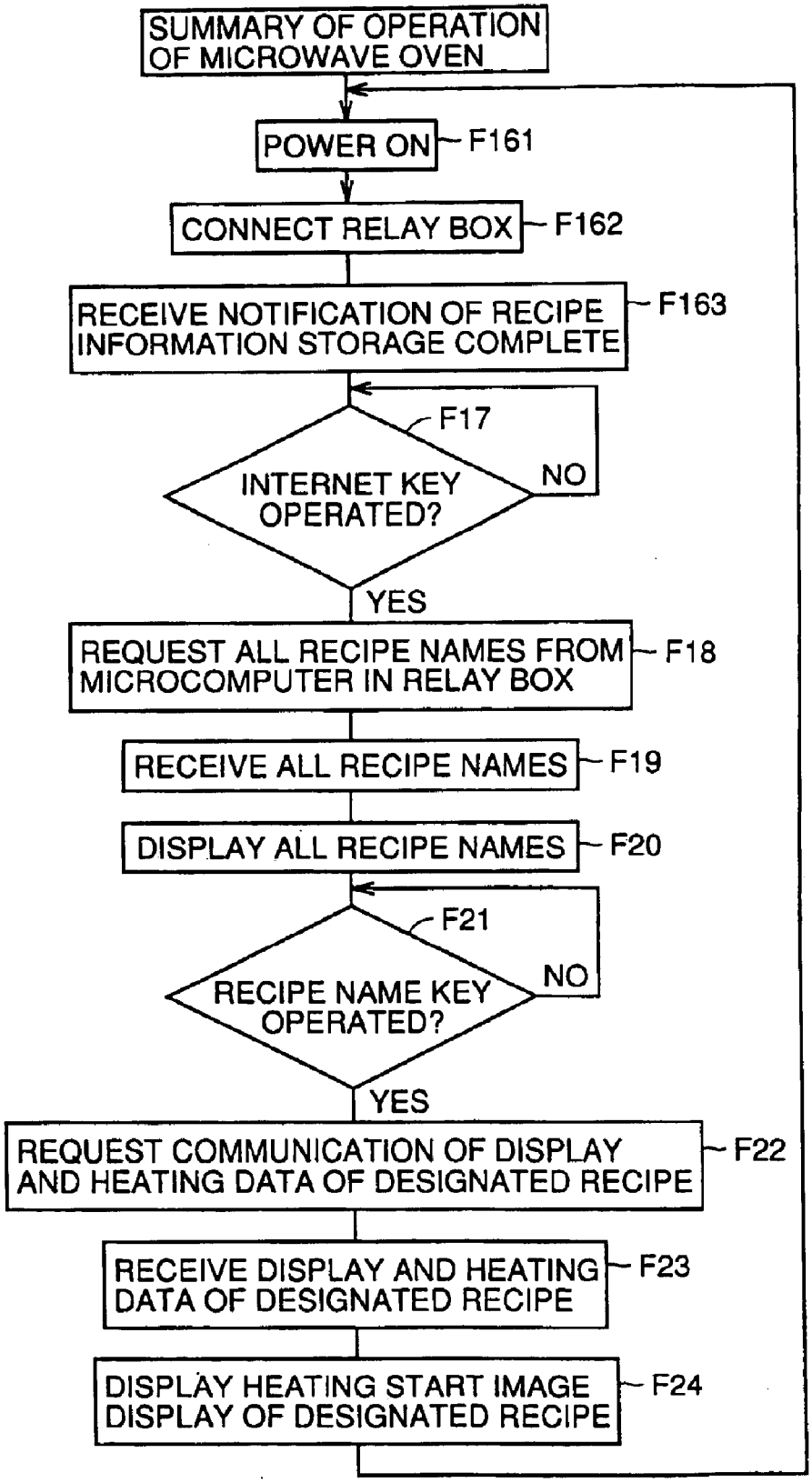
FIG. 14 is a flow chart schematically representing an operation of the microwave oven of FIG. 1.

FIG. 14 is a flow chart schematically showing the operation of the microwave oven shown in FIG. 1. FIGS. 15A to 15D are illustrations of the images displayed on the microwave oven, in the flow chart of FIG. 14. FIG. 16 represents an example of contents stored in flash memory 31 of the relay box of the flow chart of FIG. 14.

Figure 15A:
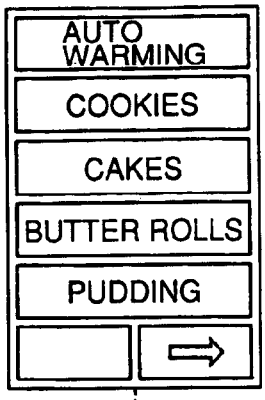
FIGS. 15A to 15D represent examples of display images on the side of the microwave oven, in accordance with the flow chart of FIG. 14.
Figure 15B:
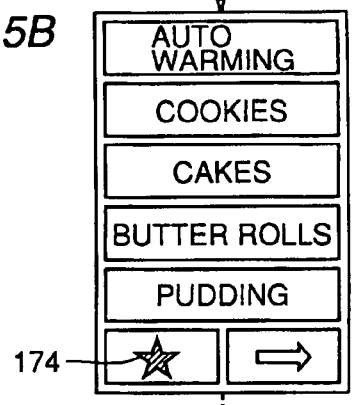
Figure 15C:
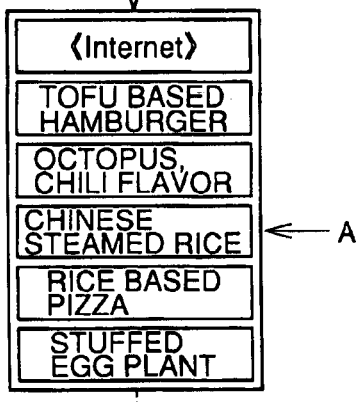
Figure 15D:
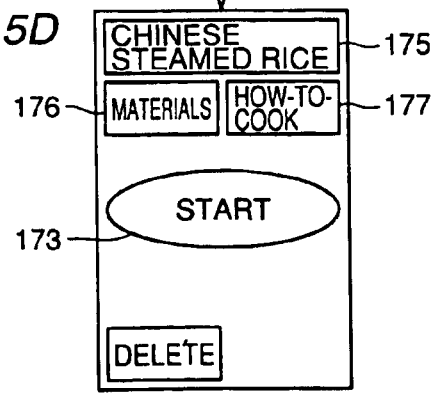

FIGS. 15A to 15D represent examples of display images of a touch panel which is an integration of input unit 15 and LCD panel 13 of FIG. 2. An internet key 174 shown in FIG. 15B of microwave oven 1 is operated to receive and display the recipe information MI from the host computer 4 of the home page through the Internet 5, personal computer 1 and relay box 3. FIG. 15D shows a recipe name display area 175, a material display area 17G and a how-to-cook display area 177 displaying the received recipe name MN, material data IDi and the how-to-cook data JDi, in addition to a start key 173 to be operated to start heating and cooking by microwave oven 1 in accordance with the received heating data KDi.

It is possible to store at most five pieces of recipe information MI, for example, in flash memory 31. In FIG. 16, five pieces of recipe information MI received from the host computer 4 of the home page through the Internet 5 and personal computer 2 are stored in advance in the example of FIG. 16. Each recipe information MI includes recipe name MNi (i: 1, 2, 3 . . . ), material data IDi, how-to-cook data JDi and heating data KDi.

The operation of microwave oven 1 shown in FIG. 14 will be described with reference to FIGS. 15A to 15D and FIG. 16. It is assumed that the contents of FIG. 16 are already stored in flash memory 31 of relay box 3. FIG. 15A shows the display when the power of microwave oven 1 is turned on. FIGS. 15B to 15D show displays given after power on until starting heating and cooking of the desired cooking recipe using the information received through the Internet 5.

First, a power switch, not shown, related to power supply circuit 16 of microwave oven 1 is turned on by the user, so that power is supplied to microwave oven 1, and the display of FIG. 15A is given on LCD panel 13 (F161). When turned on, microwave oven 1 is ready to heat and cook a plurality of cooking recipes set in advance as standard specification, in advance. Here, as can be seen from the figure, cooking recipes such as cookies, cakes, butter rolls and the like are stored as standard setting. These cooking recipes can be heated and cooked by heating unit 10B in accordance with the information for heating and cooking, set in advance in microwave oven 1.

When the user desires to heat and cook using information received through the Internet 5, the user connects the connector CN shown in FIG. 1 to an input/output terminal, not shown, of microwave oven 1, whereby relay box 3 is connected to microwave oven 1. At this time, as one or more recipe information MI such as shown in FIG. 16 is stored in flash memory 31 as described above, the notification of recipe information storage complete is transmitted from microcomputer 30 of relay box 3 to microcomputer 10 of microwave oven 1 through cable 9. When the notification of recipe information storage complete is received by microcomputer 10, the manner of display is changed as shown in FIG. 15B, with the internet key 174 highlighted, for example. It is possible for the user to know that the recipe information MI has already been stored in flash memory 31 of relay box 3, by the change in the manner of display of internet key 174 (F163).

Confirming the manner of display of internet key 174 of FIG. 15B representing that the recipe information MI has already been stored in flash memory 31 of relay box 3, the user operates internet key 174, and microcomputer 10 request all the recipe names MN to microcomputer 30 of relay box 3 through the cable 9 (F17, F18).

In response to the request of all recipe names MN, microcomputer 30 reads all the recipe names MNi from flash memory 31 of FIG. 16, and transmits the recipe names to microwave oven 1 through the cable 9. Therefore, microcomputer 10 of microwave oven 1 receives all the recipe names MNi, and displays the names on LCD panel 13 as shown in FIG. 15C (F19 to F20).

Among the all recipe names MNi displayed as shown in FIG. 15C, when the recipe "Chinese steamed rice" denoted by the arrow A, for example, is operated (touched) and designated by the user, microcomputer 10 request display data DS13 and heating data DS14 of the designated recipe name MN3 ("Chinese steamed rice") to relay box 3 through cable 9 (F21 and F22).

In response to the request of data corresponding to recipe name MN3 ("Chinese steamed rice") from microwave oven 1, microcomputer 30 of relay box 3 reads and transmits display data DS13 (recipe name MN3, material data ID3 and how-to-cook data JD3) and heating data KD3 corresponding to the recipe name MN3 ("Chinese steamed rice") from flash memory 31, so that microcomputer 10 of microwave oven 1 receives the display data DS13 and heating data KD3 and temporarily writes and stores in memory 11 (F22 and F23).

Microcomputer 10 provides the display of FIG. 15D on LCD panel 13 so as to urge the instruction input of the user to start heating and cooking of the designated recipe (F24). When start key 173 of FIG. 15D is operated, heating and cooking by heating unit 10B starts, in accordance with the heating data KDi. As shown in FIG. 15D, recipe name MN3, material data ID3 and how-to-cook data JD3 of the received display data DS13 are displayed in recipe name display area 175, material display area 176 and how-to-cook display area 177, respectively.

Figure 17:
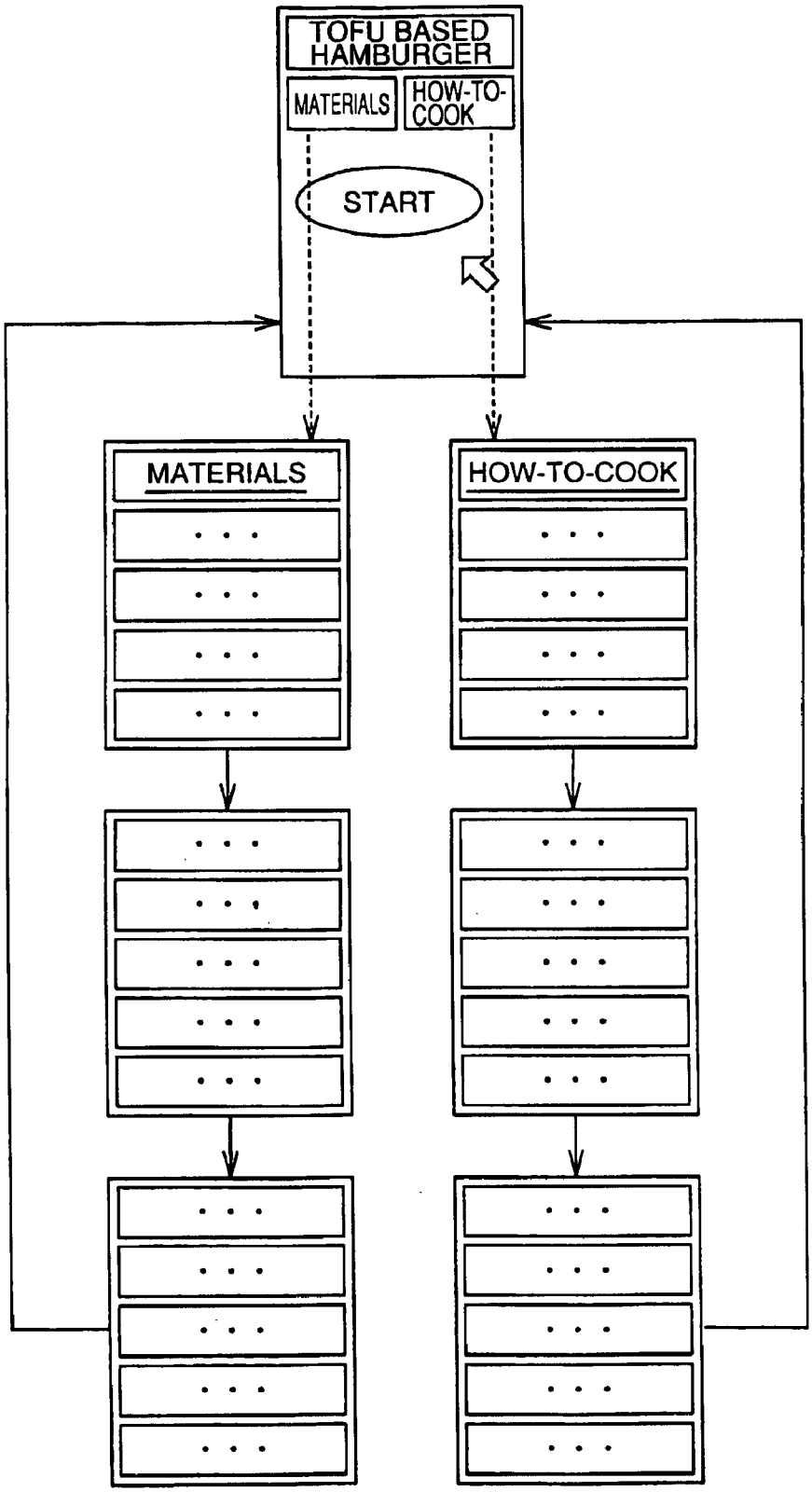
FIG. 17 is an illustration of the manner of image display related to FIG. 15D.

FIG. 17 is an illustration showing, in time-sequential manner in the direction of the arrows, how the displays related to FIG. 15D are given. When the material data IDi and the how-to-cook data JDi to be displayed in the material display area 176 and the how-to-cook display area 177 of FIG. 15D contain too large an amount of data to be fully displayed on areas 176 and 177, display on LCD display 13 is updated as shown in FIG. 17, every time the user operates (touches) the display area 176 or 177, so that the large amount of material data IDi and the how-to-cook data JDi are divided and displayed successively. As the material data IDi and the how-to-cook data JDi are displayed in a plurality of display images as shown in FIG. 17, it becomes possible for the user to prepare and arrange the materials while updating the display.

Figure 18A:
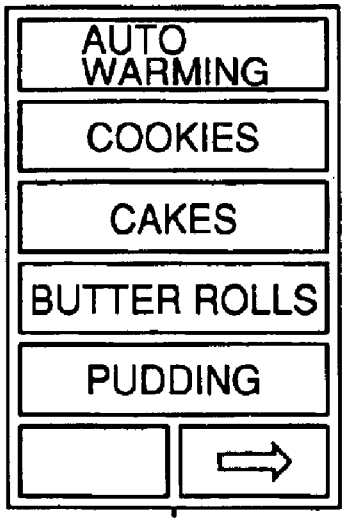
FIGS. 18A to 18C represent examples of display images on the side of the microwave oven, when the recipe information is not stored in the flash memory of the relay box in accordance with the first embodiment.
Figure 18B:
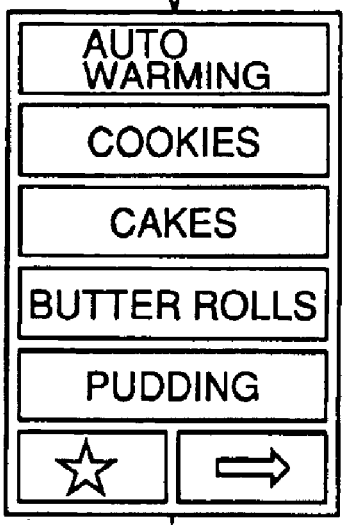
Figure 18C:
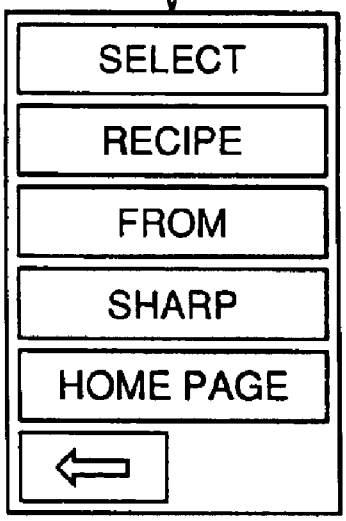

FIGS. 18A to 18C represent examples of the display images on the microwave oven 1, when the recipe information is not stored in flash memory 31 of relay box 3 in accordance with the first embodiment of the present invention.

In the operation of microwave oven 1 in accordance with the flow chart of FIG. 14, it is assumed that one or more recipe information MI is stored in advance in flash memory 31 of relay box 3. When microwave oven 1 is turned on and the connector CN of FIG. 1 is connected to the input/output terminal, not shown, of microwave oven 1 with the recipe information MI not stored in flash memory 31, the notification of recipe information storage complete is not transmitted from relay box 3, and therefore, following the display of FIG. 18A given at the time of power on, the display of FIG. 18B appears on LCD panel 13.

In the display of FIG. 18B, the manner of display of internet key 174 is not highlighted, and hence it is notified that recipe information MI is not at all stored in flash memory 31 of relay box 3.

When the user operates internet key 174, the display of FIG. 18C appears on LCD panel 13, giving a message to the user that the recipe information MI is not at all stored in flash memory 31 of relay box 3, and that a cooking recipe is to be selected from the home page. Confirming the message, the user performs the operation of FIG. 12 described above. Accordingly, processes of the flow charts of FIGS. 13 and 14 take place, whereby heating and cooking of the desired recipe starts by the microwave oven 1 in accordance with the heating data KDi.

Figure 19:
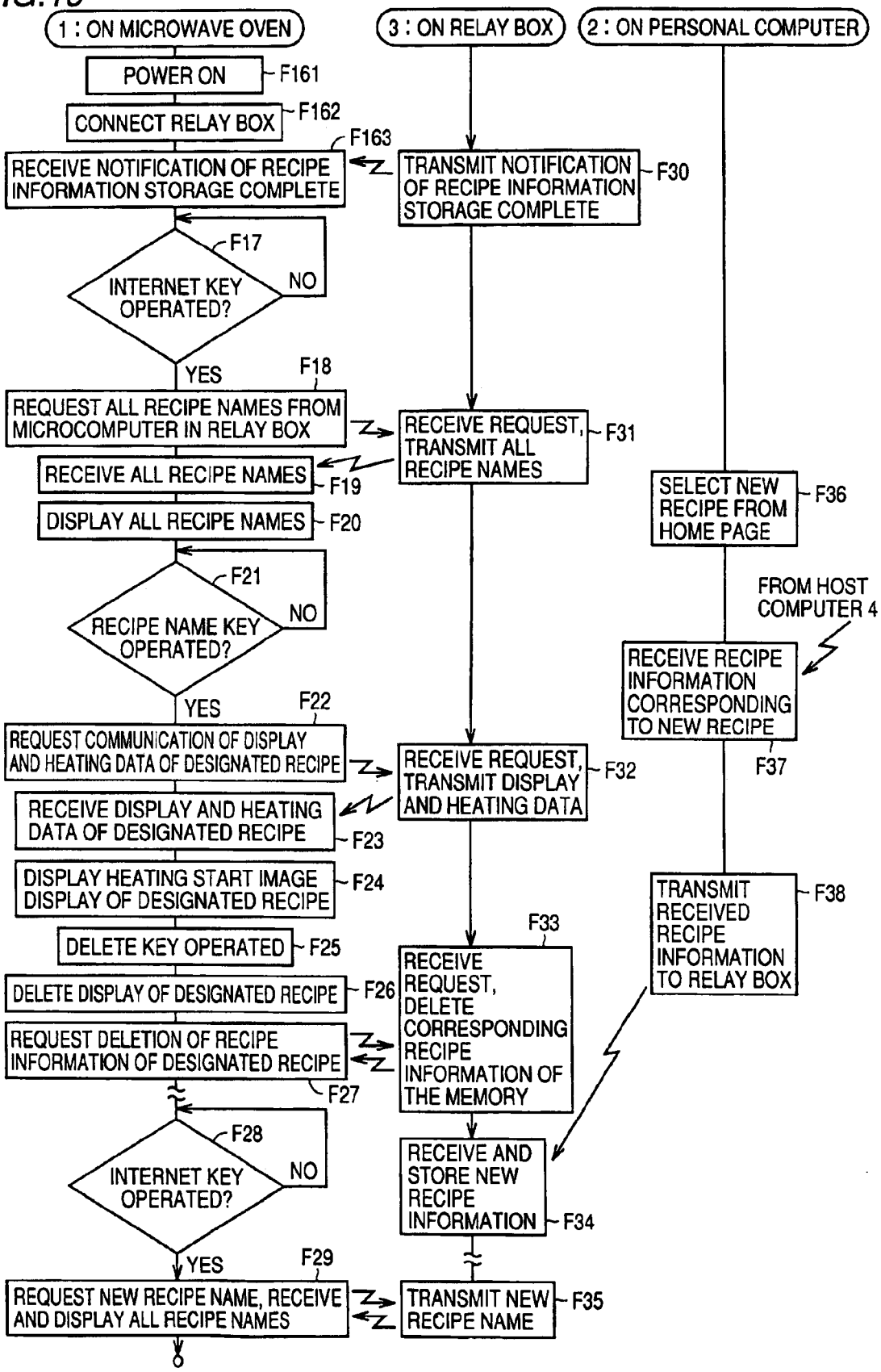
FIG. 19 is a flow chart representing a procedure for replacing a recipe information stored in the memory of the relay box with another recipe information in accordance with an instruction input from the microwave oven in accordance with the first embodiment of the present invention.

FIG. 19 is a flow chart representing a procedure for replacing the recipe information stored in the memory of relay box 3 with other recipe information, by an instruction input from the microwave oven 1 in accordance with the first embodiment of the present invention.

FIGS. 20A to 20C represent changes in the contents of the memory in relay box 3, in accordance with the flow chart of FIG. 19.

FIGS. 21A to 21F represent changes in the display images of the microwave oven 1, in accordance with the flow chart of FIG. 19. Referring to FIGS. 21A to 21F, the images to be displayed are switched successively, in the direction represented by the dotted arrows.

In accordance with the flow chart of FIG. 19, the procedure of replacing the recipe information stored in flash memory 31 of relay box 3 with other recipe information will be described, with reference to FIGS. 20A to 20C and 21A to 21F.

It is assumed that five pieces of recipe information MI have been already stored in flash memory 31, as shown in FIG. 20A.

First, the user operates microwave oven 1 as described with reference to FIG. 14, and hence the images of FIGS. 21A to 21C are successively switched and displayed based on the data received from relay box 3, on LCD panel 13 of the microwave oven 1 (F161 to F24 and F30 to F32 of FIG. 19).

The display of FIG. 21C includes a delete key 178. When the delete key 178 is operated by the user on the display of FIG. 21C (F25), the display of FIG. 21D appears, giving a message asking whether the recipe information MI of flash memory 31 corresponding to the recipe name MN3 ("Chinese steamed rice") displayed on recipe name display area 175 is to be deleted or not. When delete key 179 is pressed, the display of FIG. 21E appears (F26). The display of FIG. 2 1E corresponds to the image display when the recipe name MN3 ("Chinese steamed rice") is deleted in the display of FIG. 21B.

Thereafter, microcomputer 10 of microwave oven 1 issues a request for deleting recipe information MI corresponding to the recipe name MN3 ("Chinese steamed rice") to microcomputer 30 of relay box 3 through cable 9. In response to reception of the deletion request of recipe information, microcomputer 30 deletes the corresponding recipe information MI in the flash memory 31 (F27, F33).

Thus, the contents of flash memory 31 are changed from those of FIGS. 20A to 20B.

Thereafter, the user operates the input unit 24 of personal computer 2, designates a new cooking recipe, for example a cooking recipe of which recipe name MN is "potato salad" from the home page (F36) in accordance with the procedure shown in FIG. 12, CPU 20 receives the recipe information MI corresponding to the new recipe from the host computer 4 of the home page through the Internet 5, and stores temporarily in memory 21 (F37). Thereafter, the received recipe information MI is transmitted to relay box 3 through RS-232C cable 7 (F38).

Microcomputer 30 of relay box 3 receives the new recipe information MI corresponding to the recipe name MN ("potato salad") transmitted from personal compute 2, and stores in a free area of FIG. 20B. Thus the contents of flash memory 31 is changed from that of FIG. 20B to 20C. In order to specify the newly stored recipe information MI in flash memory 31, microcomputer 30 uses a pointer PNT to designate the recipe information MI.

Next, when microwave oven 1 is operated by the user, the internet key 174 of FIG. 21A is operated (F28). As the microcomputer 10 recognizes that recipe information MI has been deleted by delete keys 178 and 179, microcomputer 10 request the new recipe name to relay box 3 through cable 9, in response to the operation of internet key 174 (F29). In response to the request, microcomputer 30 of relay box 3 reads the recipe name MN3 ("potato salad") of recipe information MI denoted by the pointer PNT of flash memory 31, and transmits to microcomputer 10 of the microwave oven 1.

Microcomputer 10 of microwave oven 1 receives recipe name MN3 ("potato salad"), temporarily stores in memory 11, and display all the recipe names MNi including the new recipe name MN3, as shown in FIG. 21F (F29).

In the first embodiment, in order to urge the user to download latest information from the home page constantly, the recipe information MI which can be stored in the flash memory 31 of relay box 3 is set to five at most. The number of pieces of recipe information, however, is not limited to 5.

In this manner, when the cooking recipe introduced on the home page of host computer 4 is to be heated and cooked by heating unit 10B of the private microwave oven 1, the operation of setting various data related to microwave oven 1 for heating and cooking is unnecessary, which is convenient for the user.

Second Embodiment

Figure 22:
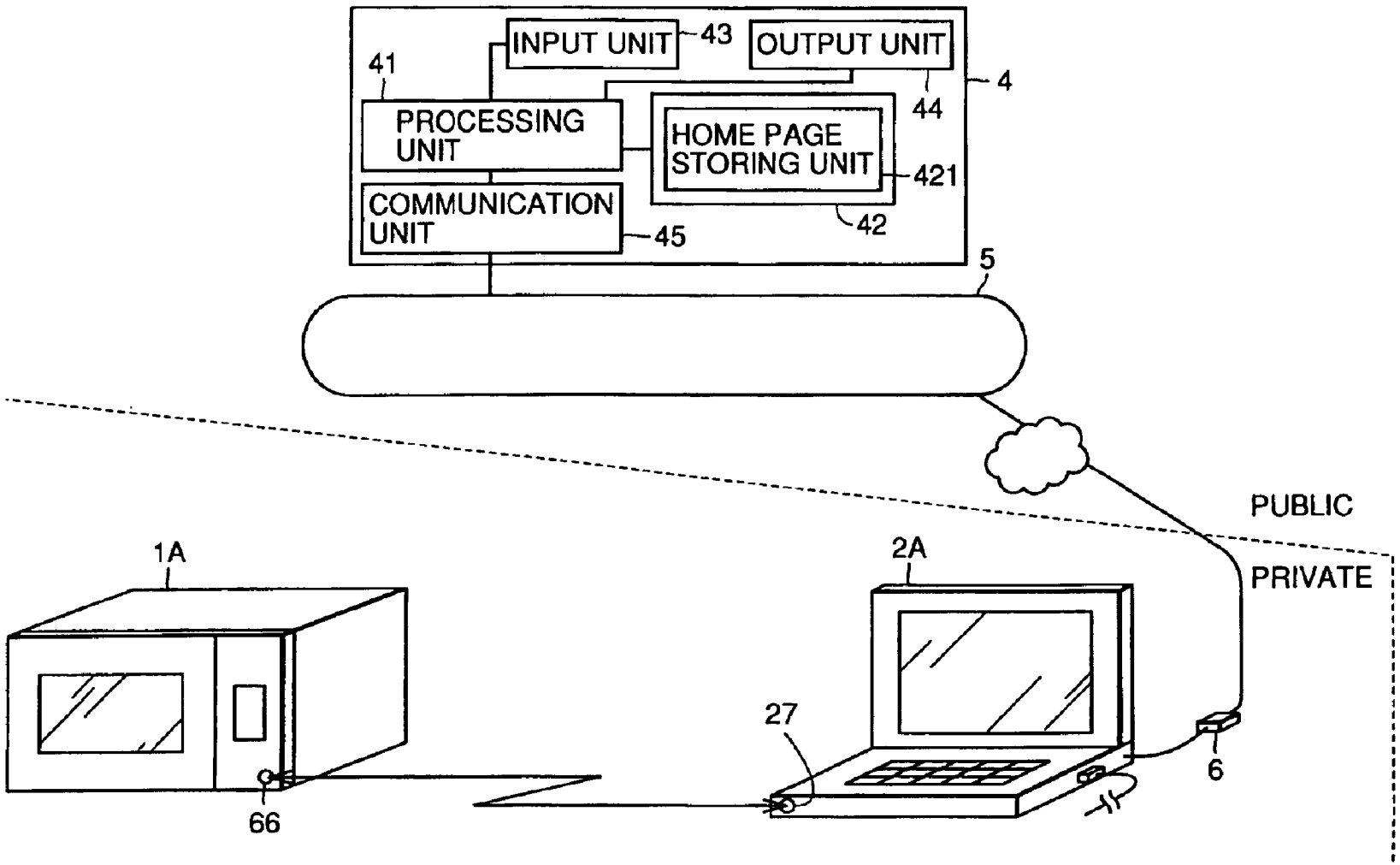
FIG. 22 is a schematic diagram representing configuration of the microwave oven system in accordance with a second embodiment of the present invention.
Figure 23:
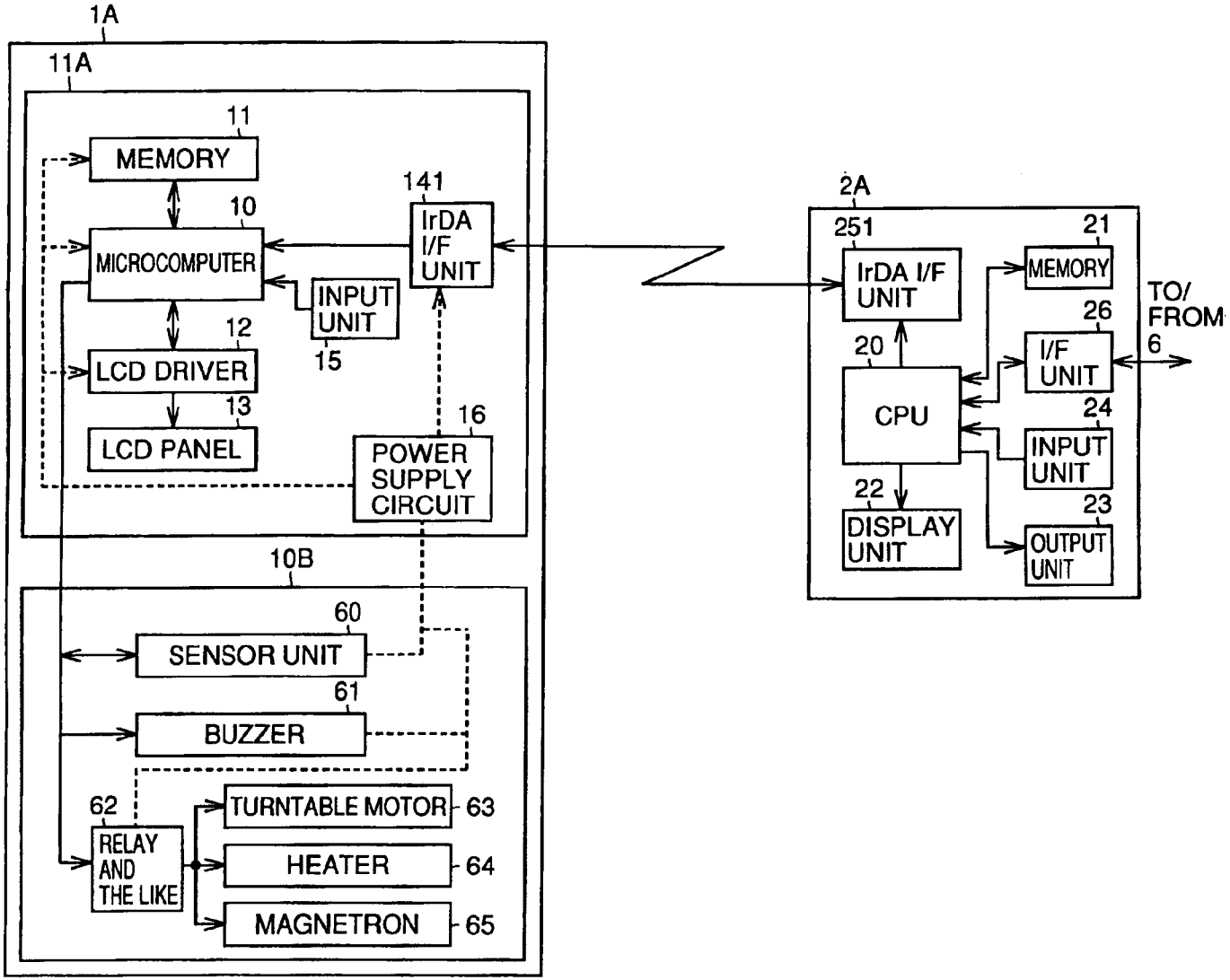
FIG. 23 is a block diagram representing configurations of the microwave oven and the personal computer shown in FIG. 22.

Second embodiment will be described in the following. FIG. 22 is a schematic diagram representing a configuration of a microwave oven system in accordance with the second embodiment of the present invention. FIG. 23 is a block diagram showing configurations of microwave oven 1A and personal computer 2A. In FIG. 22, microwave oven 1A and personal computer 2A have infrared emitting/receiving units 66 and 27 for wireless communication by IRDA (Infrared Data Association) therebetween. When microwave oven 1A and personal computer 2A of FIG. 23 are compared with microwave oven 1 and personal computer 2 of FIG. 2, respectively, there are the following differences. Namely, microwave oven 1A is provided with an IrDAI/F unit 141 related to the infrared emitting/receiving unit 66 in place of I/F unit 14 of FIG. 2, and personal computer 2A is provided with an IrDAI/F unit 251 related to an infrared emitting/receiving unit 27 in place of RS-232C port 25 of FIG. 2. Other structures of microwave oven 1A and personal computer 2A are the same as those of FIG. 2, and hence description thereof is not repeated here.

In the first embodiment described above, connection and communication between microwave oven 1 and personal computer 2 were established by cable, with relay box 3 interposed. In the second embodiment, wireless communication using an infrared ray, for example, using IrDA, is adopted in place of communication using cables, as shown in FIGS. 22 and 23. Therefore, the troublesome wiring of cables for the microwave oven system becomes unnecessary, which facilitates installation of the system.

Third Embodiment

Figure 24:
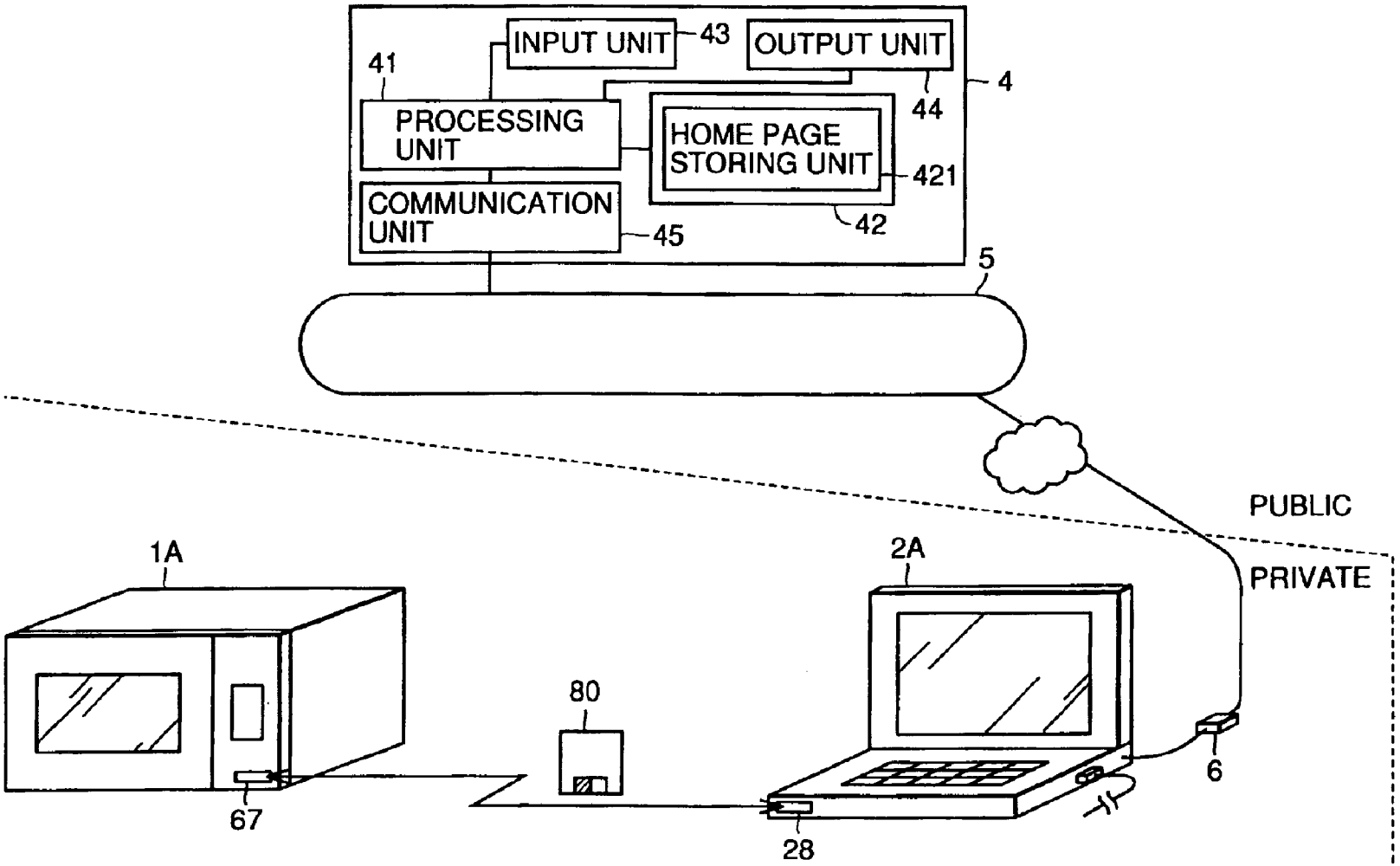
FIG. 24 schematically shows the configuration of the microwave oven system in accordance with the third embodiment of the present invention.
Figure 25:
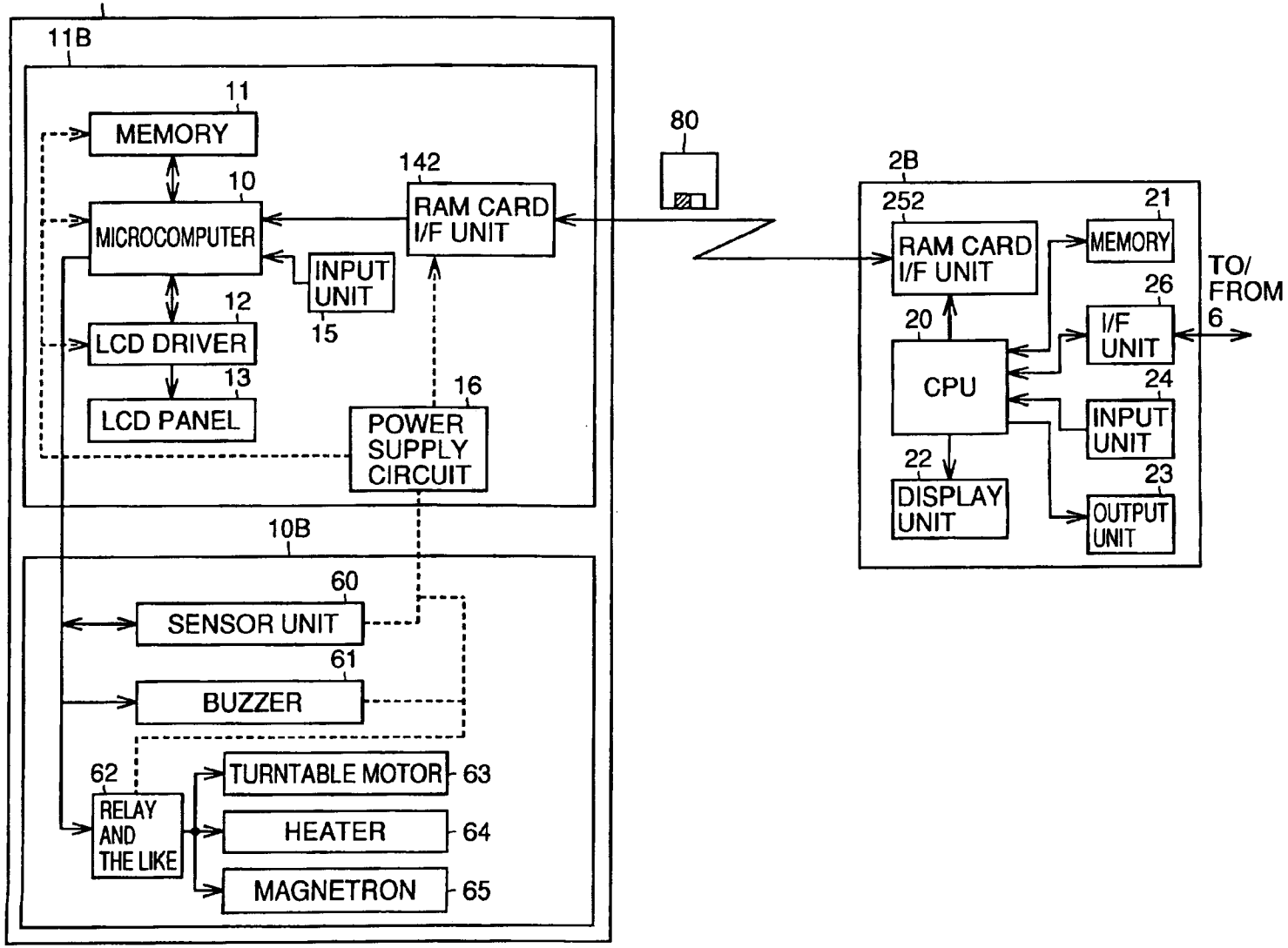
FIG. 25 is a block diagram representing configurations of the microwave oven and the personal computer shown in FIG. 24.

A third embodiment will be described in the following. FIG. 24 is a schematic diagram representing the microwave oven system in accordance with the third embodiment of the present invention. FIG. 25 represents block configurations of microwave oven 1B and personal computer 2B of FIG. 24.

In FIG. 24, microwave oven 1B and personal computer 2B are provided with RAM card inlets 67 and 28, which are card slot interfaces to which an RAM card 80 is inserted, for transferring data therebetween by using a card shaped RAM (Random Access Memory) card 80.

When microwave oven 1B and personal computer 2B are compared with microwave oven 1 and personal computer 2 of FIG. 2, there are the following differences. More specifically, microwave oven 1B is provided with an RAM card I/F unit 142 for accessing the data of RAM card 80 inserted through RAM card inlet 67, in place of I/F unit 14 of FIG. 2, and that personal computer 2B is provided with an RAM card I/F unit 252 for accessing the data of RAM card 80 inserted through RAM card inlet 28 under the control of microcomputer 30, in place of RS-232C port 25 of FIG. 2. Other structures of microwave oven 1B and personal computer 2B are the same as those shown in FIG. 2, and therefore description is not repeated.

In the above described first embodiment, microwave oven 1 and personal computer 2 are communicated and connected by a cable through a relay box 3. In the present embodiment 3, data transfer is performed using an RAM card 80 in place of the cable communication, as can be seen from FIGS. 24 and 25, so that the relay box 3 can be omitted, the trouble of cable wiring for the electronic oven system can be avoided and the system can be readily provided.

Fourth Embodiment

Figure 26:
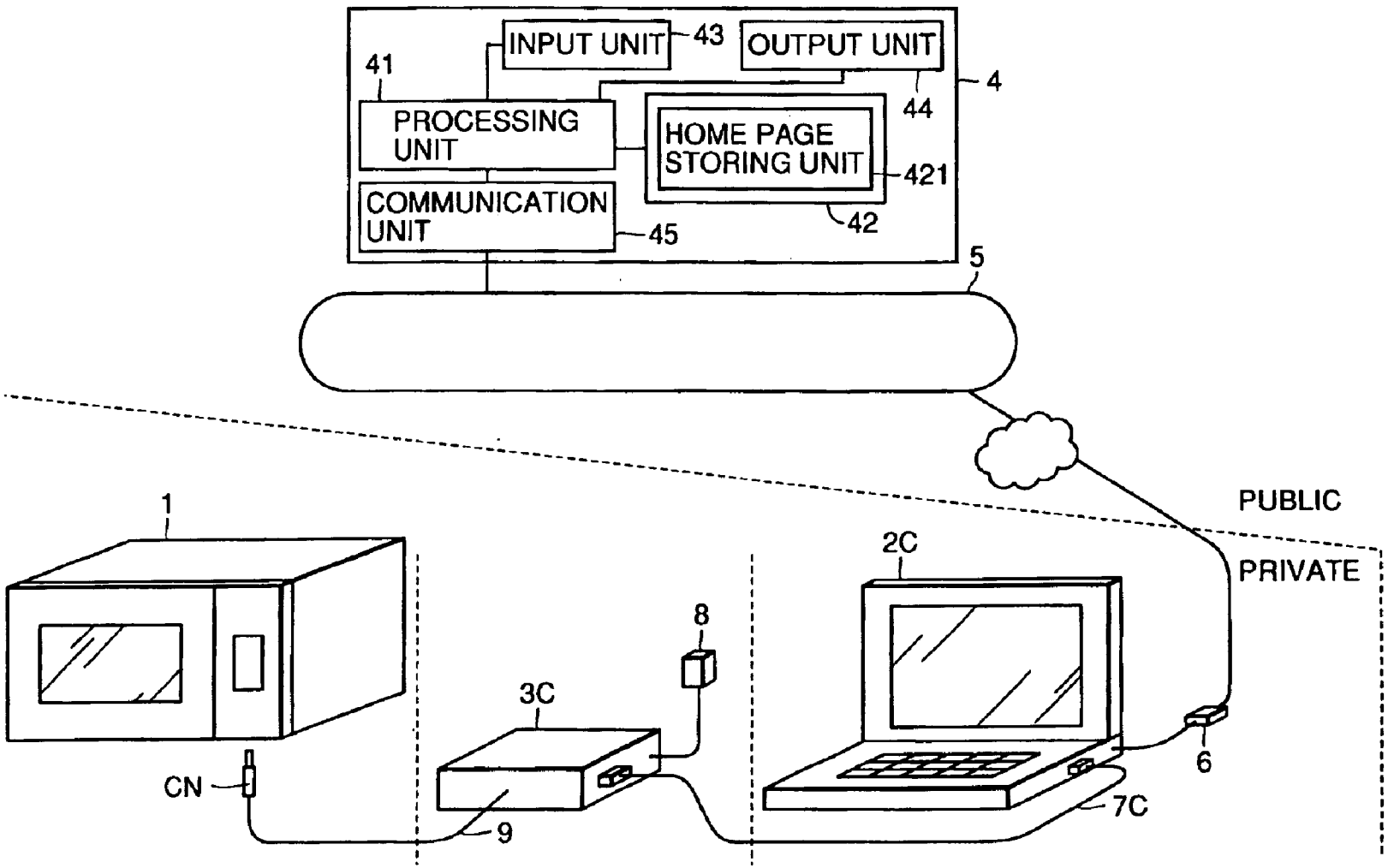
FIG. 26 schematically shows the configuration of the microwave oven system in accordance with the fourth embodiment of the present invention.
Figure 27:
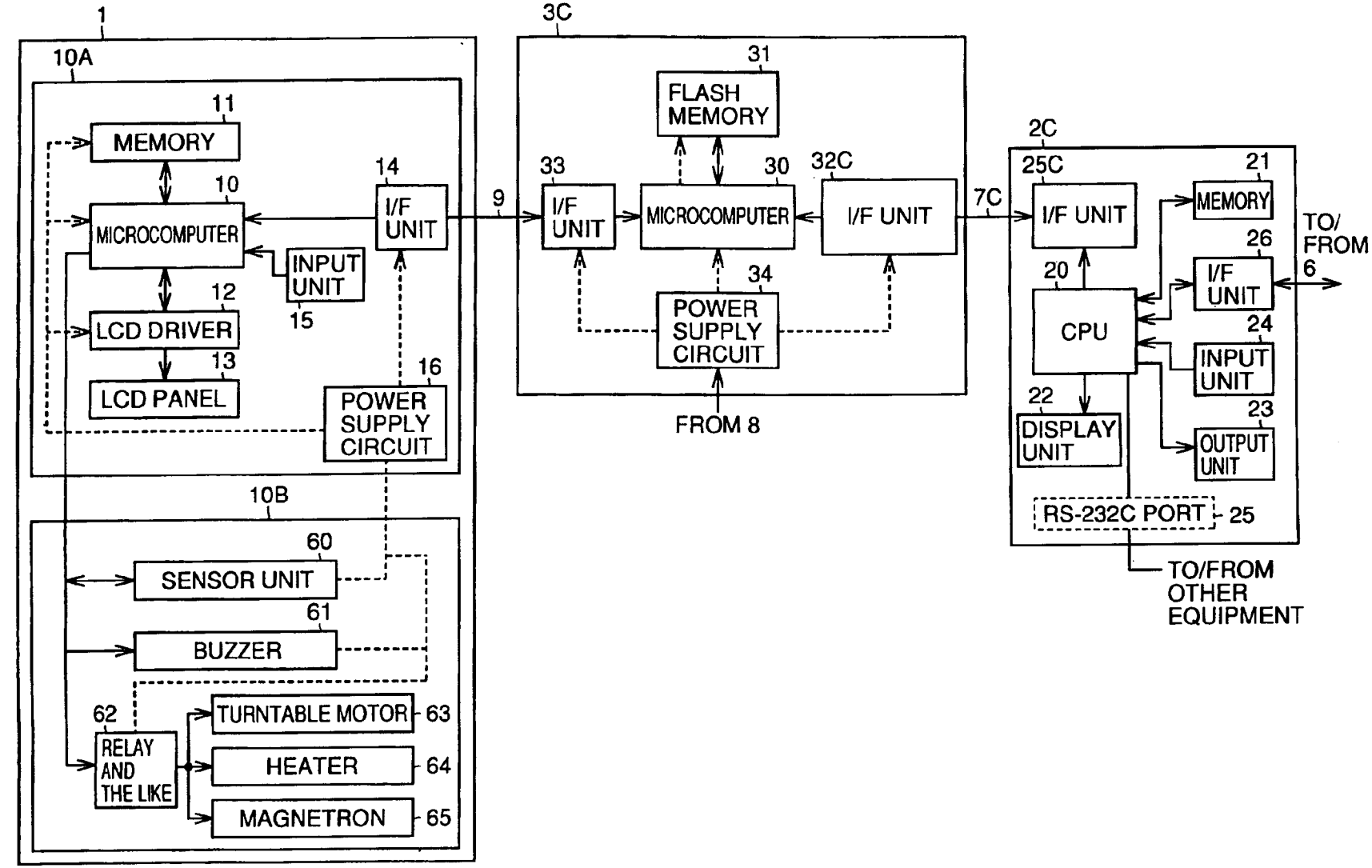
FIG. 27 is a block diagram representing configurations of the microwave oven, the relay box and the personal computer of FIG. 26.

The fourth embodiment will be described in the following. FIG. 26 is a schematic diagram of the microwave oven system in accordance with the fourth embodiment of the present invention. FIG. 27 shows block configurations of microwave oven 1, relay box 3C and personal computer 2C.

In the system of FIG. 26, a cable 7C is provided in place of RS232C cable 7 of the system of FIG. 1. Cable 7C is to provide an interface for the communication and connection between relay box 3C and personal computer 2C, and USB (Universal Serial Bus) or parallel interface is adopted. Other structures of the system shown in FIG. 26 are the same as those of FIG. 1.

In FIG. 27, relay box 3C has an I/F unit 32C in place of the transmitting/receiving unit 32 of FIG. 2, and personal computer 2C has an I/F unit 25C in place of RS232C port 25.

Other structures of relay box 3C and personal computer 2C are the same as those of FIG. 2.

I/F unit 32C and I/F unit 25C connect and communicate between cable 7C and microcomputer 30 and cable 7C and CPU 20, in accordance with the USB interface or parallel interface method corresponding to the interface applied to cable 7C.

In the fourth embodiment, data transfer takes place in accordance with USB or parallel interface between relay box 3C and personal computer 2C, and therefore, compared with data transfer in accordance with RS-232C of the first embodiment, data can be transferred at a higher speed.

Further, when other equipment, not shown, is connected through a cable 7 to RS-232C port 25 of personal computer 2C and RS-232C port 25 is not available as shown in FIG. 27, the system configuration of the fourth embodiment is very effective.

Fifth Embodiment.

The fifth embodiment will be described in the following.

In the fifth embodiment, a data configuration of recipe information MI is described, which can reduce time of transmission of recipe name MNi from relay box 3 to microwave oven 1 of FIG. 1 and which can reduce memory capacity necessary for storing the recipe name MNi received by microwave oven 1. The configuration of microwave oven system and configuration of each unit of the fifth embodiment are the same as those shown in FIGS. 1 and 2, and therefore description is not repeated.

FIG. 28 shows an example of configuration of recipe information MI in accordance with the fifth embodiment. Referring to FIG. 28, recipe information MI includes a plurality of addresses AD, data contents DC representing contents of data stored in the area represented by the corresponding address AD, and capacity CA of data contents DC. The capacity CA represents the maximum value.

Recipe information MI includes data DC1 including a data code, a final address and an extension code; and head address DC2 of an area where heating data KDi and recipe name MNi are stored; head/last address DC3 of image display page address information; recipe name MNi, heating data KDi; image display page address information DC4; and display data DS13 including material data IDi and how-to-cook data JDi, as represented by data contents DC of FIG. 28.

As shown in the figure, in recipe information MI, the first 23 bytes from the head are configured including fixed length data DC1 to DC3, and the data following recipe name MNi are variable length data. Though recipe information M may have different capacity dependent on the cooking recipe, here, each recipe information MI has the maximum capacity of 2048 bytes.

As described with reference to the first embodiment, when internet key 174 is operated, only the recipe name MNi (32 bytes) is read from recipe information MI shown in FIG. 28 of flash memory 31 of relay box 3 and transmitted to microwave oven 1, and therefore, as compared with transmission of the whole recipe information MI (2048 bytes) per one recipe, the time necessary for data transmission and necessary memory capacity of microwave oven 1 can be reduced to 1164.

Sixth Embodiment

Figure 29:
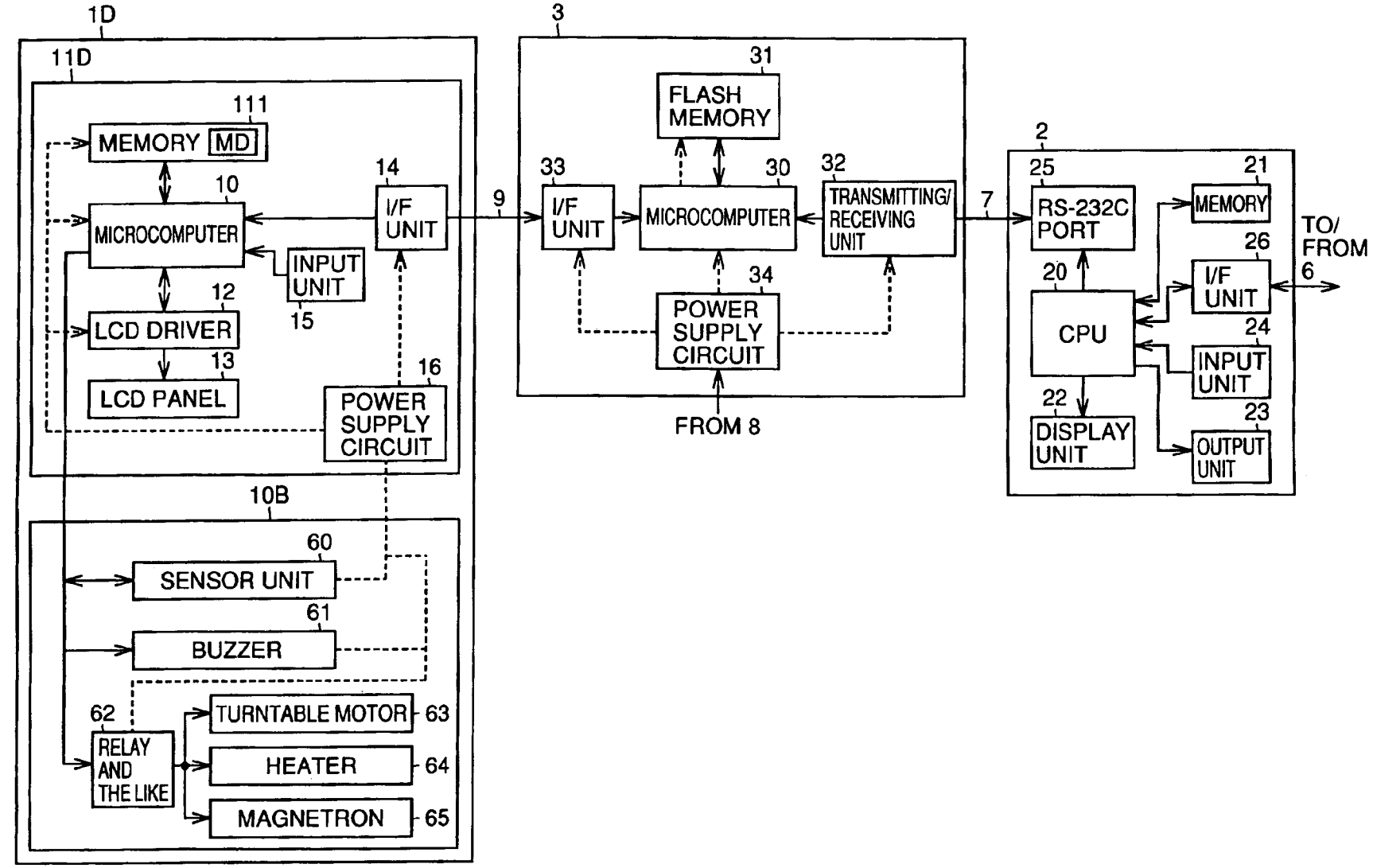
FIG. 29 is a block diagram schematically showing the configuration of the microwave oven system in accordance with the sixth embodiment of the present invention.

The sixth embodiment will be described. FIG. 29 schematically shows the configuration of the microwave oven system in accordance with the sixth embodiment of the present invention. In FIG. 29, a microwave oven 1D is provided in place of microwave oven 1 of FIG. 2. Other structures of FIG. 29 are the same as those of FIG. 2, and hence description is not repeated.

Microwave oven 1D of FIG. 29 includes a control unit 11D. Control unit 11D includes a memory 111 in place of memory 11 of control unit 10A of FIG. 2. A machine type code specifying the machine type of microwave oven 1D is stored in advance in memory 111.

Figure 31:
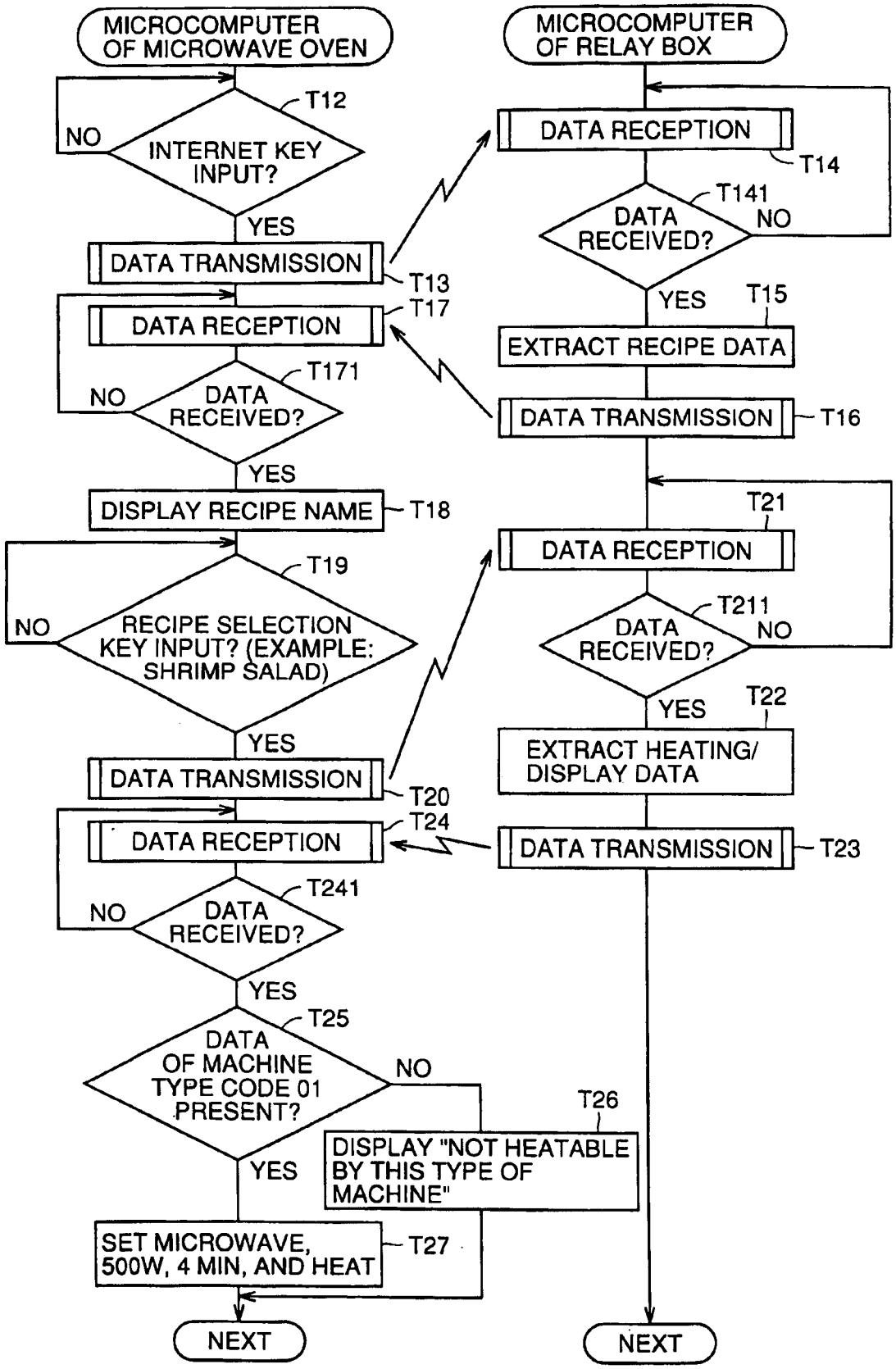
FIG. 31 is a flow chart representing the operation of the microwave oven including the communication operation with the relay box, in accordance with the sixth embodiment of the present invention.

FIGS. 30A and 30B represent configurations of the recipe information and the heating data in accordance with the sixth embodiment of the present invention. FIG. 31 is a flow chart representing the operation of microwave oven 1D, including communication with relay box 3, in accordance with the sixth embodiment.

The recipe information MI1 of FIG. 30A includes data DC11 and heating data KD1*i*, in place of data DC1 and heating data KDi of recipe information MI shown in FIG. 28. Other contents of recipe information MI1 are the same as those of FIG. 28.

Data DC11 includes, in place of the extension code of data DC1, a machine type code for specifying the machine type of the microwave oven which can operate in accordance with recipe information MI1, applicable to the microwave oven system in accordance with the present embodiment.

FIG. 30B shows the configuration of heating data KD1*i*. The performance of heating unit 10B of microwave oven 1D differs dependent on the machine type of microwave oven 1D, as the maximum output of microwaves from magnetron 65 or operation of heater 64 differs. Therefore, unless the heating data KD1*i* optimized for the machine type is used, the finish of cooking will not be satisfactory, or the time of cooking will be longer. Therefore, in the sixth embodiment, using the machine type code MD, whether the heating data KD1*i* received by microcomputer 10 of microwave oven 1D is suitable for use or not is determined.

The heating data KD1*i* includes a plurality of different machine type codes MD1 applicable to the microwave oven system, and data DD for controlling the heating operation of heating unit 10B corresponding to each machine type code MD1.

Microwave oven 1D will be described with reference to the flow chart of FIG. 31. Here, it is assumed that the machine type code MD of microwave oven 1D is "01".

When the internet key 174 is operated on the side of microwave oven ID (T12), a data representing key input is transmitted from microcomputer 10 to microcomputer 30 of relay box 3 (T13). Upon reception of the data (T14, T141), microcomputer 30 of relay box 3 reads recipe name MNi from recipe information MI1 of flash memory 31 (T15) and transmits the read recipe name to microcomputer 10 (T16). Microcomputer 10, receiving the data, display all the received recipe names MNi (T17, T171, T18). Assume that a plurality of recipe names MNi have been transferred and displayed.

When the user selects one of the plurality of displayed recipe names MNi, for example, "shrimp salad" (T19), microcomputer 10 transmits the key input (T20). Microcomputer 30 of relay box 3receives the information (T21, T211), and reads and transmits the heating data and the display data KD1i and DS13 corresponding to the recipe name MNi "shrimp salad" from recipe information MI1 (T22, T23).

Microcomputer 10 of microwave oven 1D receives the data transmitted from microcomputer 30 (T24, T241), and searches the heating data corresponding to the machine type code MD ("01") of microwave oven 1D, among the received heating data KD1*i* T25). If there is no heating data DD corresponding to the machine type code MD ("01"), a display is given, notifying that heating and cooking by microwave oven 1D is not possible (T26). When there is the corresponding heating data DD, the heating data DD is set in the control unit 11D of microwave oven 1D, as the data for controlling the heating operation of heating unit 10B.

Therefore, the heating and cooking operation using the heating data optimized for the machine type of microwave oven 1D is possible.

Seventh Embodiment

The seventh embodiment will be described in the following.

Figure 33:
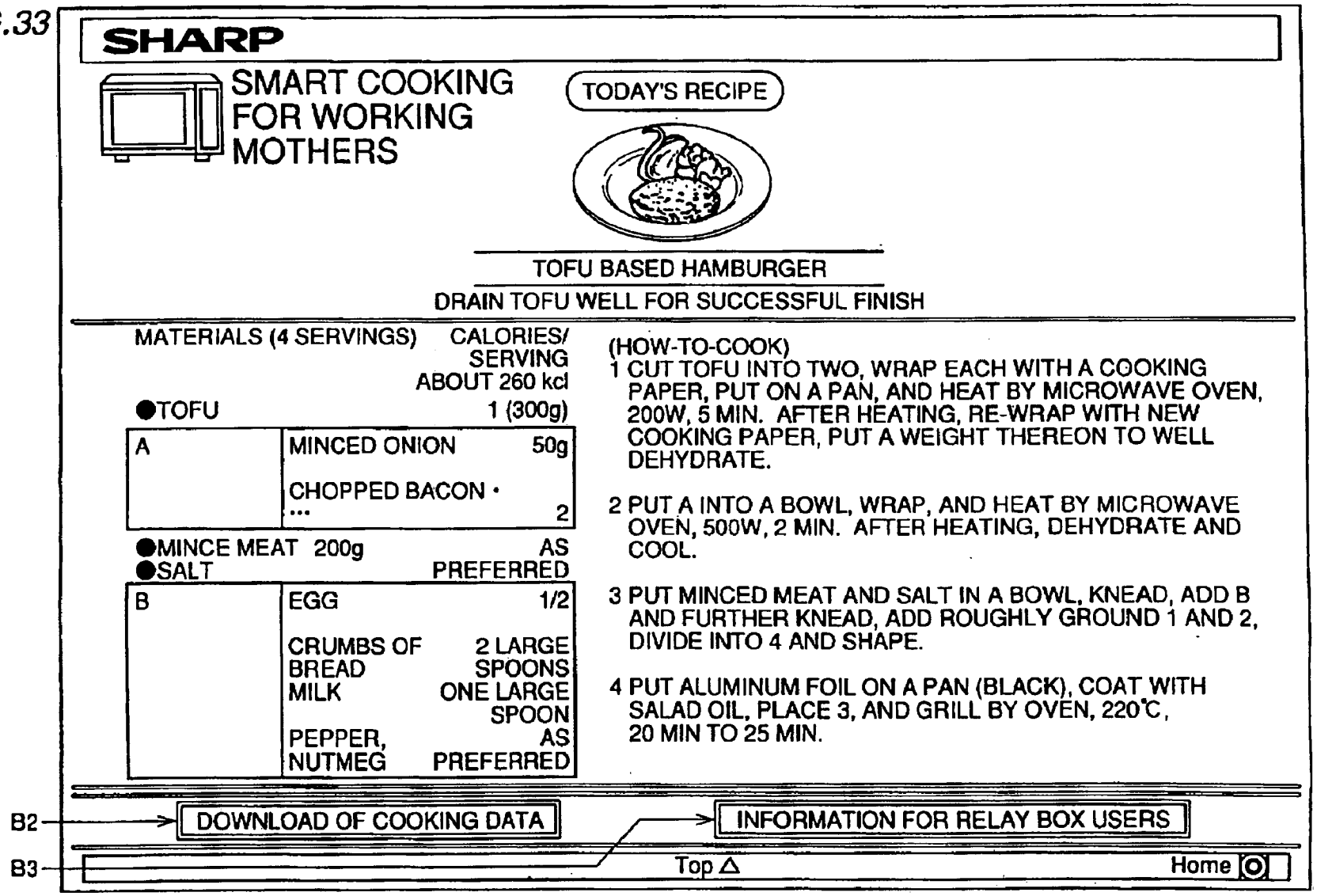
Figure 35:
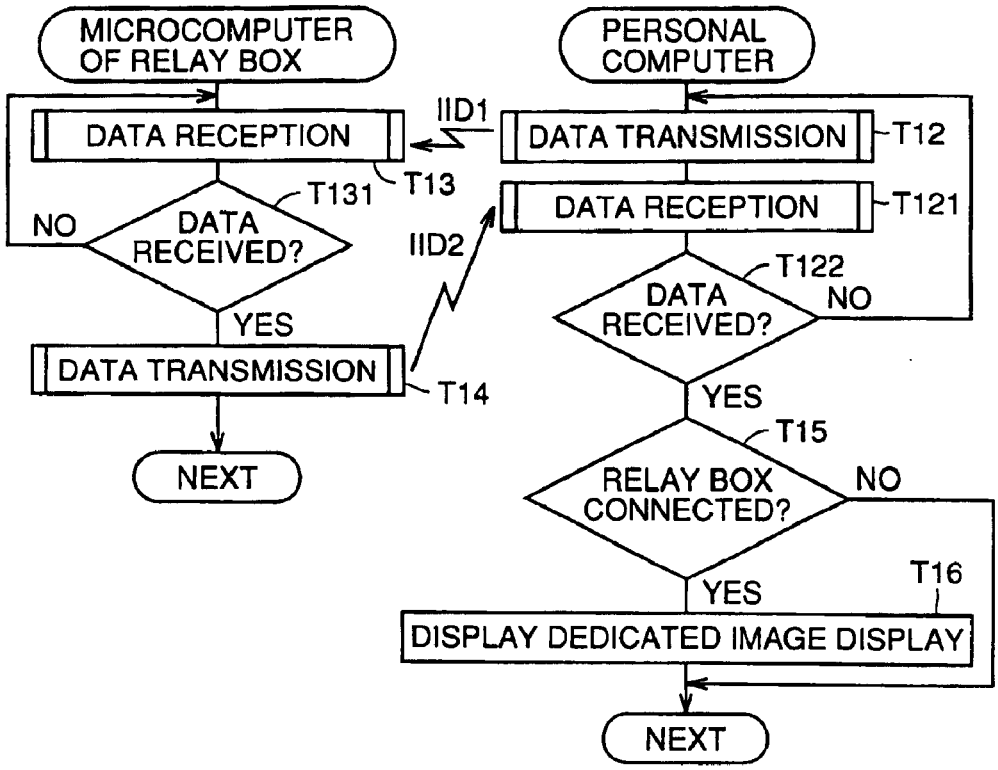
FIG. 35 is a flow chart representing the operations of the personal computer and the relay box in accordance with the seventh embodiment of the present invention.

FIGS. 32 to 34 are examples of image displays related to the seventh embodiment of the present invention. FIG. 35 is a flow chart related to the operation of relay box 3 and personal computer 2 in accordance with the seventh embodiment of the present invention. For simplicity of description, FIGS. 32 and 34 show the screen displays in Japanese as they are, and in FIG. 33, only the portion denoted by the arrow is translated to English, with the remaining portions being in Japanese.

In the seventh embodiment, the system configuration shown in FIGS. 1 and 2 are applied, and relay box 3 is detachably connected to personal computer 2. When connected, an information which is not usually displayed is given on the home page screen displayed on the personal computer 2, so that it is notified that data transfer is possible between personal compute 2 and relay box 3, and information is provided only to the user who connects relay box 3 to personal computer 2.

The operation will be specifically described with reference to the flow chart of FIG. 35. FIG. 32 is an example of a recipe image displayed on personal computer 2 when relay box 3 is not connected to personal computer 2, and FIG. 33 is an example of a recipe image displayed on personal computer 2, when relay box 3 is connected to personal computer 2.

When a host computer 4 of the home page is accessed by a personal computer 2 so that the home page screen is displayed, personal computer 2 transmits a connection confirming data 11D (T12) for confirming connection to relay box 3 through RS-232C cable 7, and waits for the response from microcomputer 30 of relay box 3. Microcomputer 30 of relay box 3 receives the connection confirming data IID1 from personal computer 2 (T13, T131), and transmits a connection confirmation data IID2 confirming connection (T14). In response to the reception of connection confirmation data IID2 (T121, T122), personal computer 2 confirms connection of relay box 3 (YES in T15), and hence the recipe image of FIG. 33 used only when the relay box 3 is connected is displayed as the home page screen (T16).

The recipe image of FIG. 33 indicates that transfer of data from personal computer 2 to relay box 3 is possible, and at the same time, adds information useful for the user using relay box 3. As the recipe image of FIG. 32 is displayed to the user whose personal computer 2 is connected to relay box 3, confusion by the user not having the personal computer 2 connected to relay box 3 by the display of FIG. 33 can be avoided.

A button B2 operated to instruct "download of cooking data" and a button B3 operated to provide information useful for the user whose personal computer 2 is connected to relay box 3 are displayed on the screen image of FIG. 33. When the user clicks button B3, the display of FIG. 34 appears. The contents of FIG. 34 represent an example of the information presented only to the user whose personal computer 2 is connected to relay box 3.

Eighth Embodiment

The eighth embodiment will be described.

Figure 36:
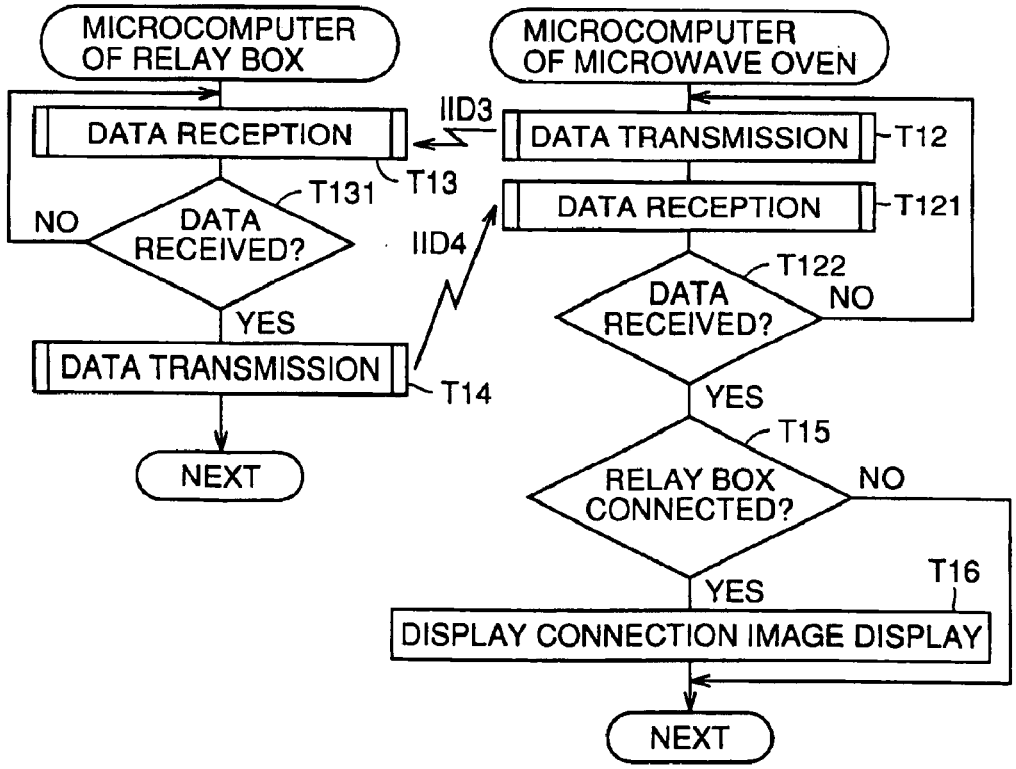
FIG. 36 is a flow chart representing the operations of the microwave oven and the relay box in accordance with the eighth embodiment of the present invention.

FIG. 36 is a flow chart representing the operation of relay box 3 and microwave oven 1 in accordance with the eighth embodiment.

Figure 37A:
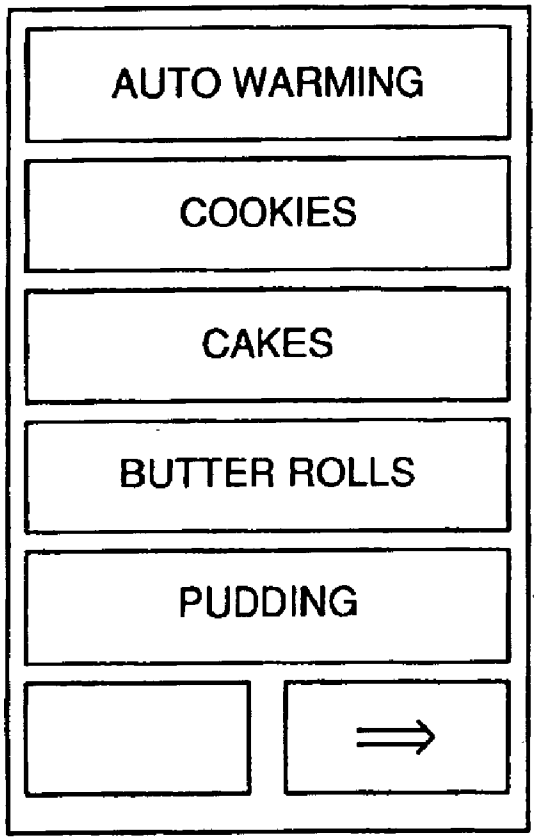
FIGS. 37A to 37C represent examples of display images displayed on the side of the microwave oven, in accordance with the flow chart of FIG. 36.
Figure 37B:
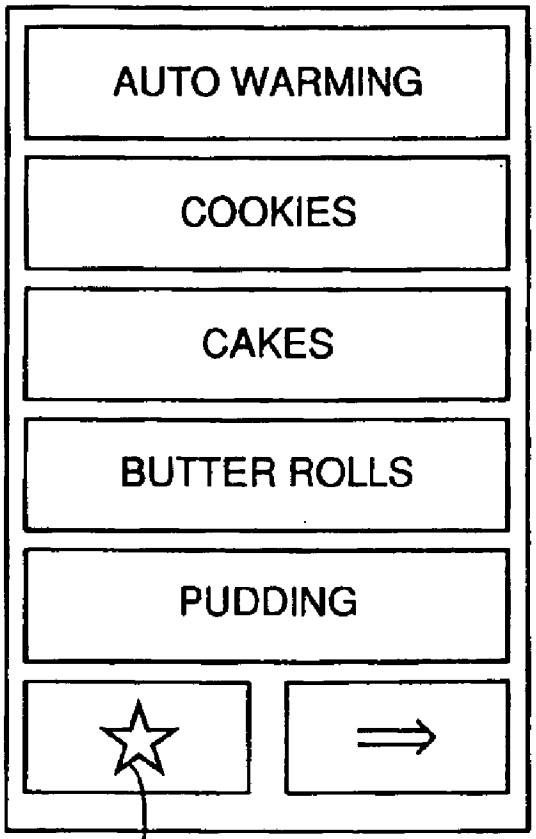
Figure 37C:
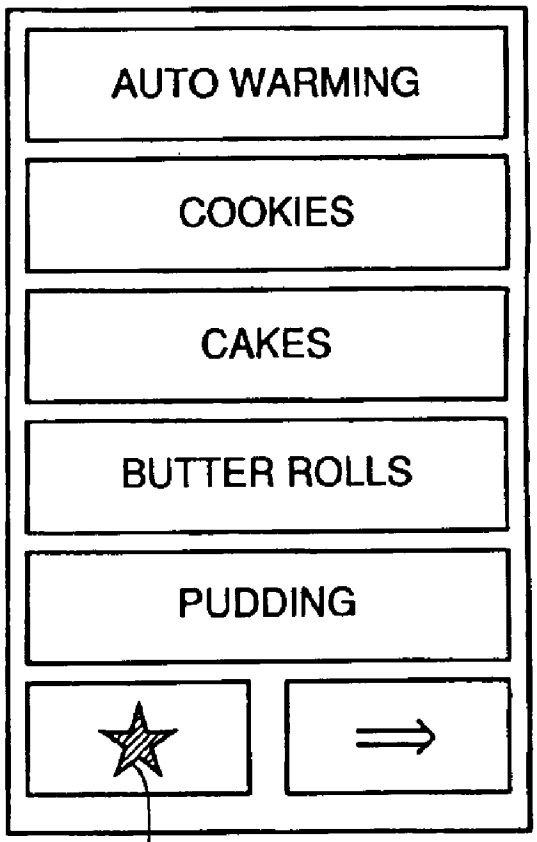

FIGS. 37A to 37C represent examples of displays given on microwave oven 1, in accordance with the flow chart of FIG. 36.

In the eighth embodiment, the system configuration and the configurations of respective unit shown in FIGS. 1 and 2 are applied, and only when the relay box 3 is connected to microwave oven 1, a display is given on LCD panel 13 of microwave oven 1 notifying that the relay box 3 is connected to microwave oven 1. The operation for this will be described with reference to the flow chart of FIG. 36. FIG. 37A represents an example of the image displayed when the relay box 3 is connected to microwave oven 1, FIG. 37B represents an example of the image when recipe information MI is not stored in flash memory 31 of relay box 3, though relay box 3 is connected to microwave oven 1, and FIG. 37C represents an example of an image displayed when relay box 3 is connected to microwave oven 1 and recipe information MI is stored in flash memory 31.

First, microcomputer 10 of microwave oven 1 periodically (for example, at every one second) transmits a connection confirmation data IID3 for confirming connection to relay box 3 after power on (T12), and waits for the response from microcomputer 30 of relay box 3. Microcomputer 30, receiving the connection confirmation data IID3 (T13, T131), transmits a connection confirmation data IID4 indicating connection of relay box 3 in response (T14). Upon reception of the connection confirmation data IID4 (T121, T122), microcomputer 10 of microwave oven 1 confirms that relay box 3 is connected to microwave oven 1 (T15), and either the display of FIG. 37B or 37C appears on the LCD panel 13 (T16). If it is confirmed that the relay box 3 is not connected to microwave oven 1, the display of FIG. 37A is given. In the display of FIG. 37A, the internet key 74 is not displayed.

In the display of FIG. 37B, the manner of display of internet key 174 is not highlighted, notifying that recipe information MI is not stored in flash memory 31 of relay box 3. In the display of FIG. 37C, the display of internet key 174 is highlighted, notifying that recipe information MI is stored in flash memory 31.

The displays of FIGS. 37A to 37C notify that whether the relay box 3 is connected to microwave oven 1 dependent on whether the internet key 174 is displayed or not, notify whether data transfer from relay box 3 to microcomputer 10 of microwave oven 1 is possible or not dependent on whether the internet key 174 is highlighted with the list of recipe names MNi, and notify that the relay box 3 is correctly connected to microwave oven 1 so that normal communication is possible therebetween.

Ninth Embodiment

The ninth embodiment will be described.

Figure 38:
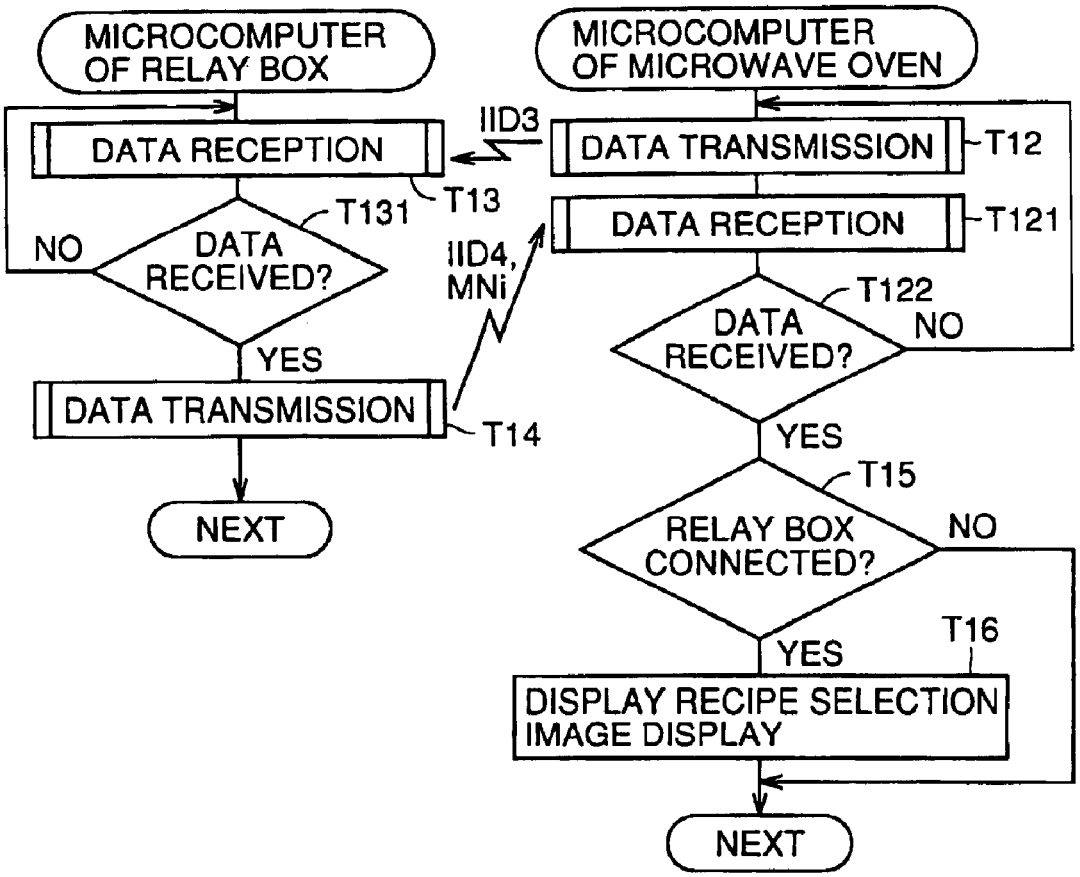
FIG. 38 is a flow chart representing the operations of the microwave oven and the relay box in accordance with the ninth embodiment of the present invention.

FIG. 38 is a flow chart related to the operation of relay box 3 and microwave oven 1 in accordance with the ninth embodiment of the present invention. In the ninth embodiment, the system configuration and the configurations of respective units shown in FIGS. 1 and 2 are applied.

In the ninth embodiment, a recipe selecting image display appears for selecting a recipe by one or more recipe information MI as shown in FIG. 15C on microwave oven 1, only when the relay box 3 is connected to microwave oven 1 of FIG. 2. The details will be described with reference to the flow chart of FIG. 38. It is assumed that one or more pieces of recipe information MI are stored in advance in flash memory 31 of relay box 3.

First, when turned ON, microcomputer 10 of microwave oven 1 periodically transmits (for example, at every one second) the connection confirmation data IID3 to confirm whether the relay box 3 is connected or not (T12), and waits for the response from microcomputer 30 of relay box 3. Microcomputer 30 of relay box 3 receives the connection confirmation data IID3 (T13, T131) from microcomputer 10 of microwave oven 1, and transmits the connection confirmation data IID4 indicating that the relay box 3 is connected to microwave oven 1 as well as recipe name MNi read from one or more pieces of recipe information MI already stored in flash memory 31 to microwave oven 1 (T14).

Microcomputer 10 of microwave oven 1 confirms that relay box 3 is connected to microwave oven 1 upon reception of the connection confirmation data IID4 (T121, T122, T15) and based on the simultaneously received one or more recipe names MNi, displays such a recipe selection image as shown in FIG. 15C (T16).

Display of the recipe selecting screen image of the present embodiment is effective in that it can be confirmed that transmission of data related to recipe information MI from relay box 3 to microcomputer 10 of microwave oven 1 is possible, that the relay box 3 is correctly connected to microwave oven 1 enabling normal communication therebetween, and that the recipe name MNi stored in the flash memory 31 of relay box 3 is confirmed.

Tenth Embodiment

Figure 39:
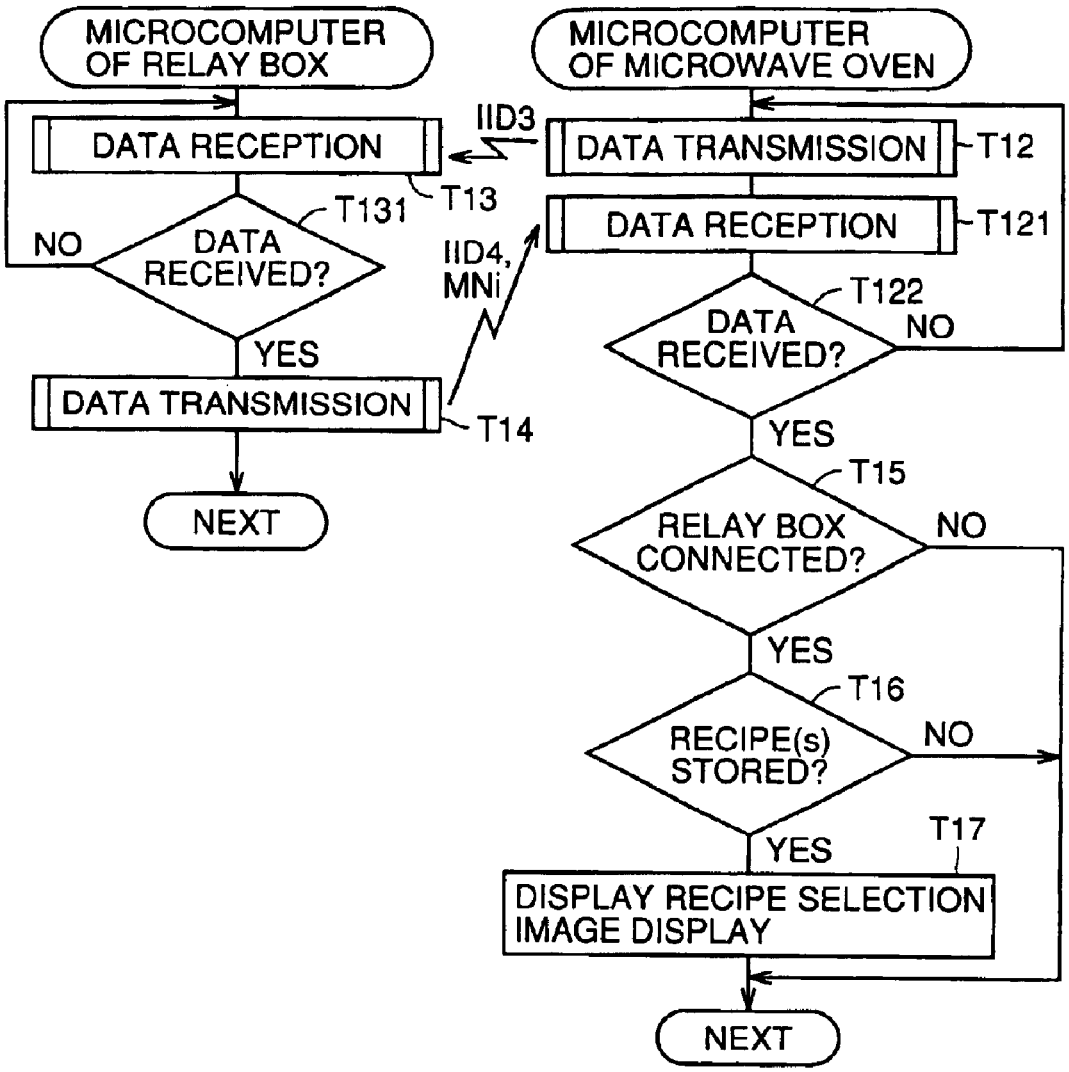
FIG. 39 is a flow chart representing the operations of the microwave oven and the relay box in accordance with the tenth embodiment of the present invention.

The tenth embodiment will be described. FIG. 39 is a flow chart representing the operations of relay box 3 and microwave oven 1 in accordance with the tenth embodiment of the present invention. In the present embodiment, the system configuration and the configurations of respective units shown in FIGS. 1 and 2 are applied.

In the tenth embodiment, when the relay box 3 is connected to microwave oven 1 and one or more pieces of recipe information MI are stored in the flash memory 31 of relay box 3, the recipe selecting image display of FIG. 15C is displayed on microwave oven 1. Details will be described with reference to FIG. 39.

First, when turned ON, microcomputer 10 of microwave oven 1 periodically transmits (for example, at every one second) the connection confirmation data IID3 to confirm whether the relay box 3 is connected or not (T12), and waits for the response from microcomputer 30 of relay box 3. Microcomputer 30 receives the connection confirmation data IID3 (T13, T131) from microcomputer 10 of microwave oven 1, and transmit the connection confirmation data IID4 indicating that the relay box 3 is connected to microwave oven 1 as well as recipe name MNi read from one or more pieces of recipe information MI already stored in flash memory 31 to microwave oven 1 (T14). Microcomputer 10 of microwave oven 1 confirms that relay box 3 is connected to microwave oven 1 upon reception of the connection confirmation data IID4 (121, T122, T15) and based on the simultaneously received one or more recipe names MNi, displays such a recipe selection image as shown in FIG. 15C (T16, T17).

Display of the recipe selecting screen image of the present embodiment is effective in that it can be confirmed that transmission of data related to recipe information MI from relay box 3 to microcomputer 10 of microwave oven 1 is possible, that the relay box 3 is correctly connected to microwave oven 1 enabling normal communication therebetween, and that the recipe name MNi stored in the flash memory 31 of relay box 3 is confirmed.

Eleventh Embodiment

The eleventh embodiment will be described.

Figure 40:
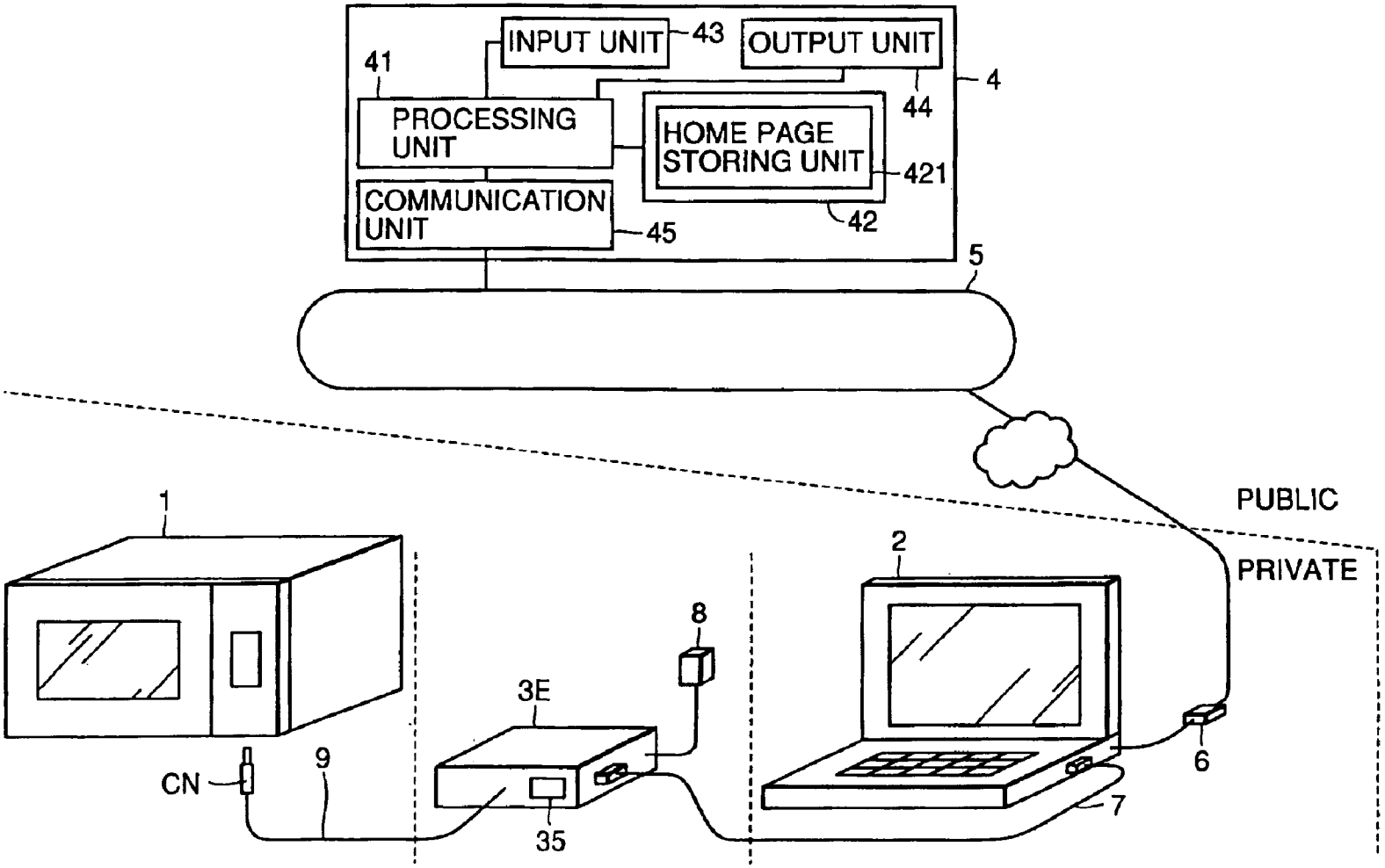
FIG. 40 shows a configuration of the microwave oven system in accordance with the eleventh embodiment of the present invention.
Figure 41:
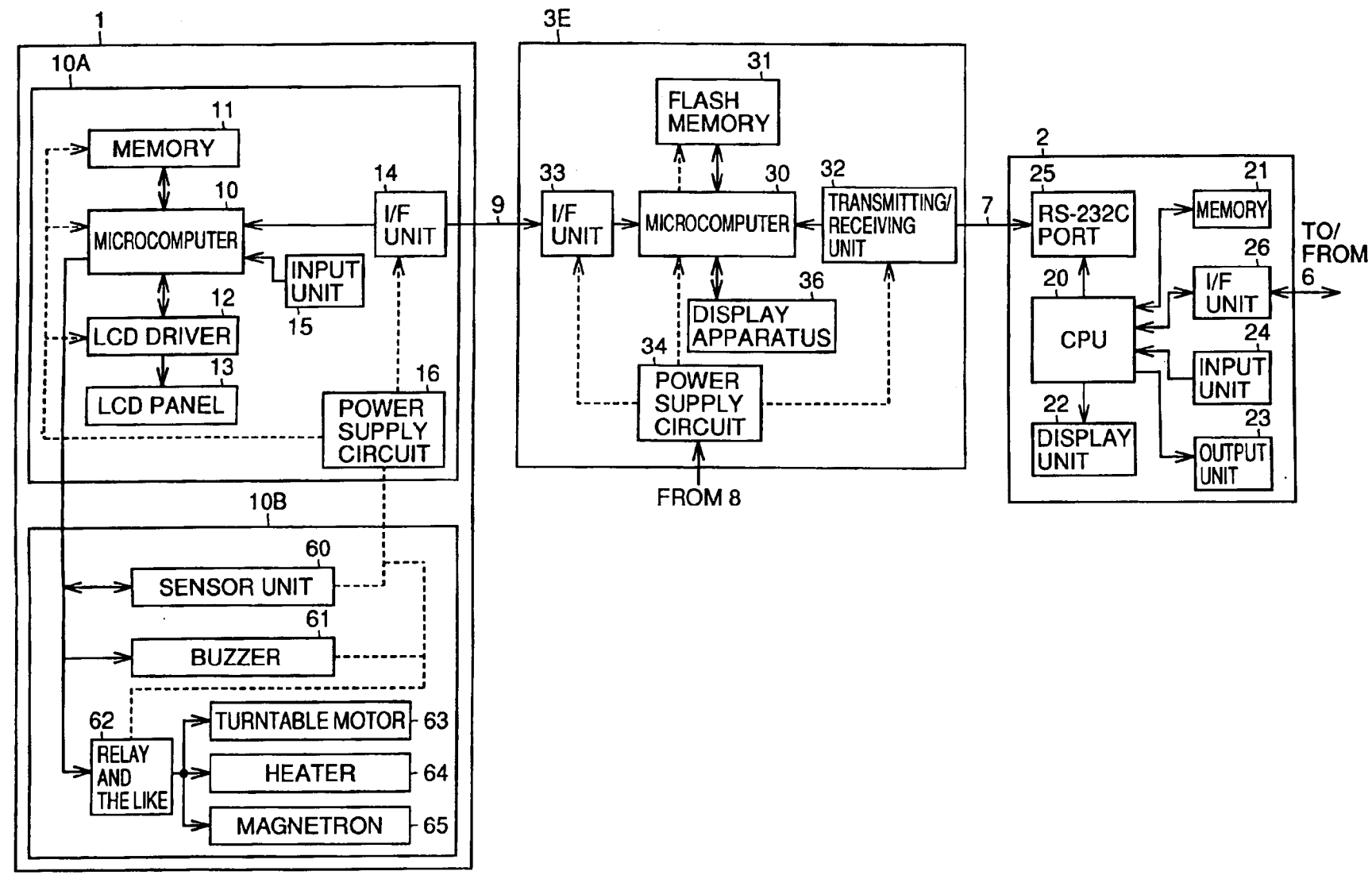
FIG. 41 is a block diagram showing configurations of respective units of FIG. 40.

FIG. 40 represents the configuration of the microwave oven system in accordance with the eleventh embodiment of the present invention. FIG. 41 represents configurations of respective units of FIG. 40.

As compared with the system configuration of FIG. 1, the system configuration of the eleventh embodiment shown in FIG. 40 differs in that relay box 3F of FIG. 40 additionally includes an LED (ight Emitting Diode) for external display of data, or an LCD display 35. Except this point, the configuration is the same as that of FIG. 1.

The configurations of respective units shown in FIG. 41 are different from the configuration shown in FIG. 2 in that the relay box 3E additionally includes a display unit 36 related to display 35 connected to microcomputer 30. Except this point, the configurations are the same as those of FIG. 2.

In the present embodiment, as the system is configured as shown in FIGS. 40 and 41, when relay box 3E is turned ON, the state of storage of recipe information MI in flash memory 31 or the state of operation of relay box 3E is displayed under the control of microcomputer 30, using the display apparatus 36 and display 35 of relay box 3E. The status of operation to be displayed includes, for example, the state in which the box is in communication with microwave oven 1, or in communication with the personal computer 2.

As the information related to the state of operation of relay box 3E or related to the recipe information MI stored in flash memory 31 is displayed on relay box 3E, it is possible to confirm the state of operation of relay box 3 or the recipe information MI stored in the flash memory 31, without the necessity of connecting the relay box to microwave oven 1 or personal computer 2.

Twelfth Embodiment

The twelfth embodiment will be described in the following.

Figure 42:
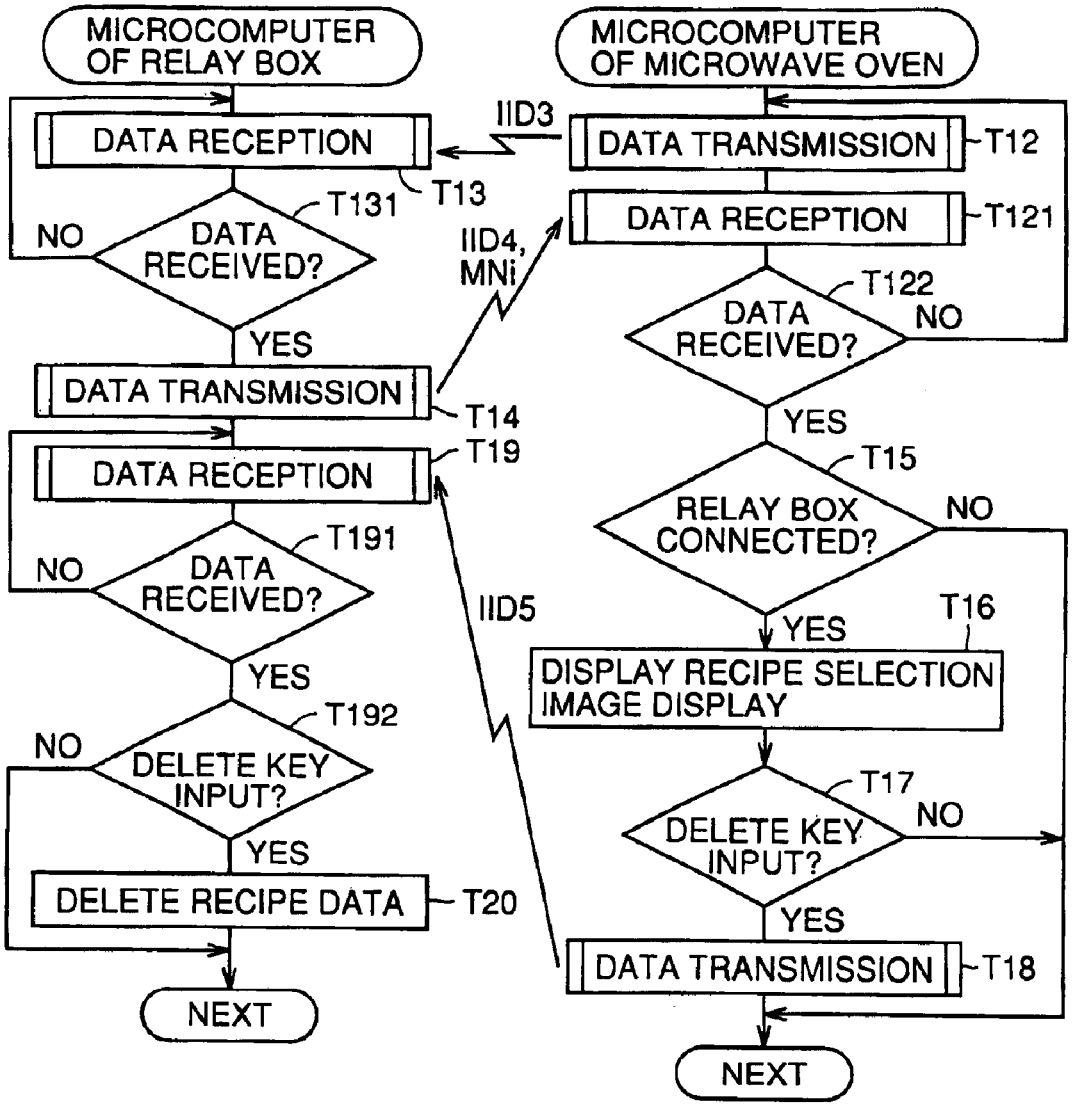
FIG. 42 is a flow chart representing operations of the microwave oven and the relay box in accordance with the twelfth embodiment of the present invention.
Figure 43:
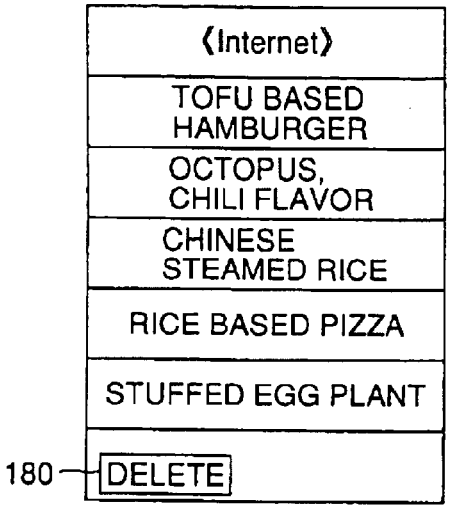
FIG. 43 shows an example of the image displayed on the side of the microwave oven in accordance with the flow chart of FIG. 42.

FIG. 42 is a flow chart related to the operation of the relay box and the microwave oven in accordance with the twelfth embodiment of the present invention. FIG. 43 is an example of an image displayed on microwave oven 1, in accordance with the flow chart of FIG. 42. FIG. 43 is an example of a recipe selection image displayed on microwave oven 1, in which a list of recipe names MNi and a delete key 180 are displayed. When the delete key 180 is externally operated, all pieces of recipe information MI stored in flash memory 31 of relay box 3 are deleted. In the present embodiment, system configuration and configurations of respective units shown in FIGS. 1 and 2 are applied.

In the twelfth embodiment, confirmation of the recipe names MNi represented by the recipe information MI stored in flash memory 31 of relay box 3 and deletion of all pieces of recipe information MI in flash memory 31 are conducted by the operation of input unit 15 on microwave oven 1. The details will be described with reference to the flow chart of FIG. 42.

First, when turned ON, microcomputer 10 of microwave oven 1 periodically (for example, at every one second) transmits the connection confirmation data IID3 to relay box 3 (T12), and waits for the response of microcomputer 30 of relay box 3. Microcomputer 30 of relay box 3 receives the connection confirmation data IID3 (T13, T131), and transmits the connection confirmation data IID4 and one or more recipe names MNi read from one or more pieces of recipe information MI stored in flash memory 31 (T14).

Microcomputer 10 of microwave oven 1 confirms connection of relay box 3 upon reception of data IID4 transmitted from relay box 3 (T121, T122, T15), and displays the recipe selection image display of FIG. 43, using the simultaneously received recipe names MNi (T16). Here, when delete key 180 of FIG. 43 is operated by the user (T17), a delete key data IID5 representing that the delete key 180 is operated, is transmitted to microcomputer 30 of relay box 3 (T18). In response to the reception of delete key data IID5 (T19, T191), microcomputer 30 deletes all pieces of recipe information MI in flash memory 31 (T20).

Generally, relay box 3 is connected to the body of microwave oven 1, and therefore, in accordance with the present embodiment, it is possible to display images related to recipe information MI stored in flash memory 31 and to delete recipe information MI on the side of microwave oven 1.

Thirteenth Embodiment

Thirteenth embodiment will be described in the following.

Figure 44:
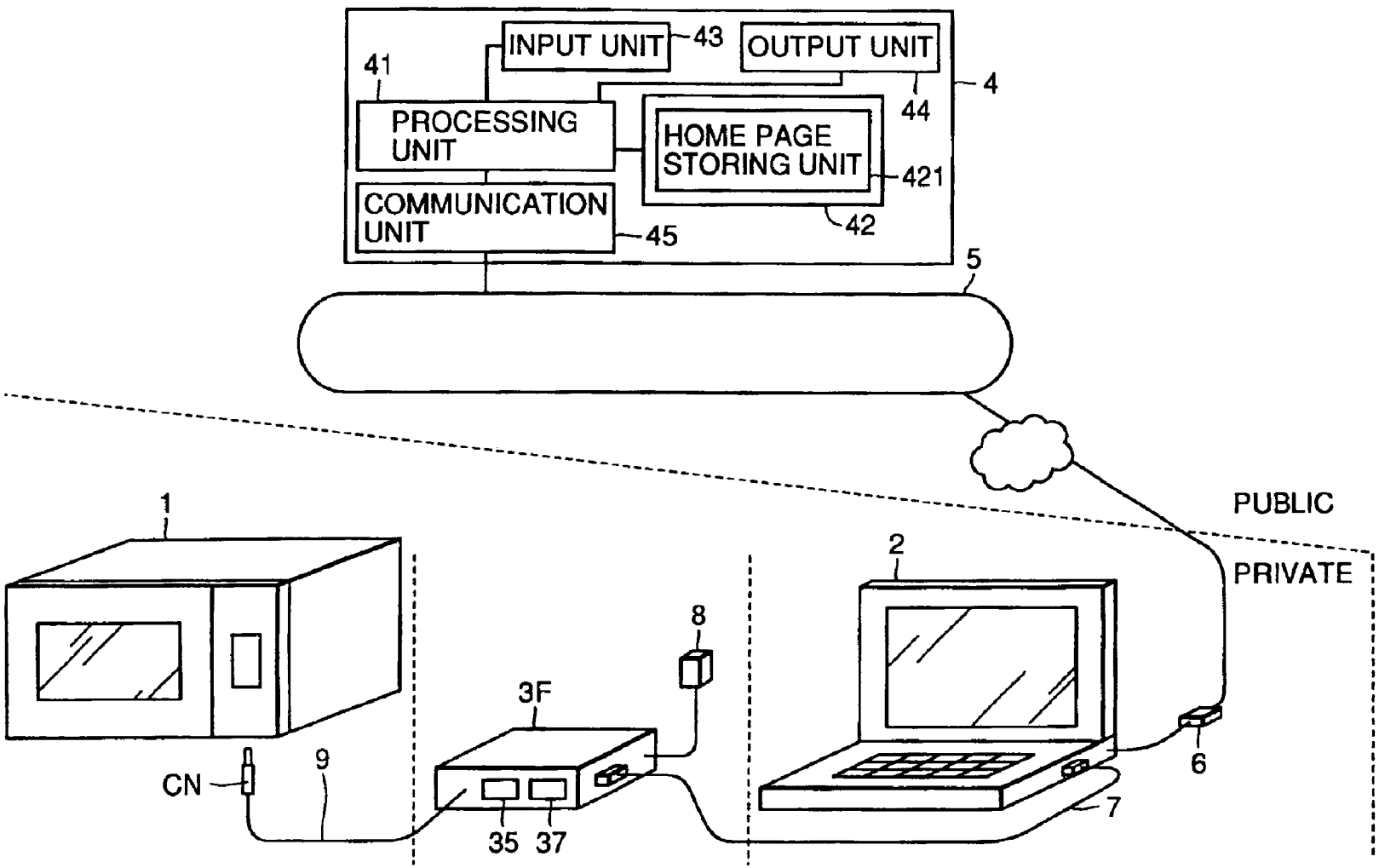
FIG. 44 shows a configuration of the microwave oven system in accordance with the thirteenth embodiment of the present invention.
Figure 45:
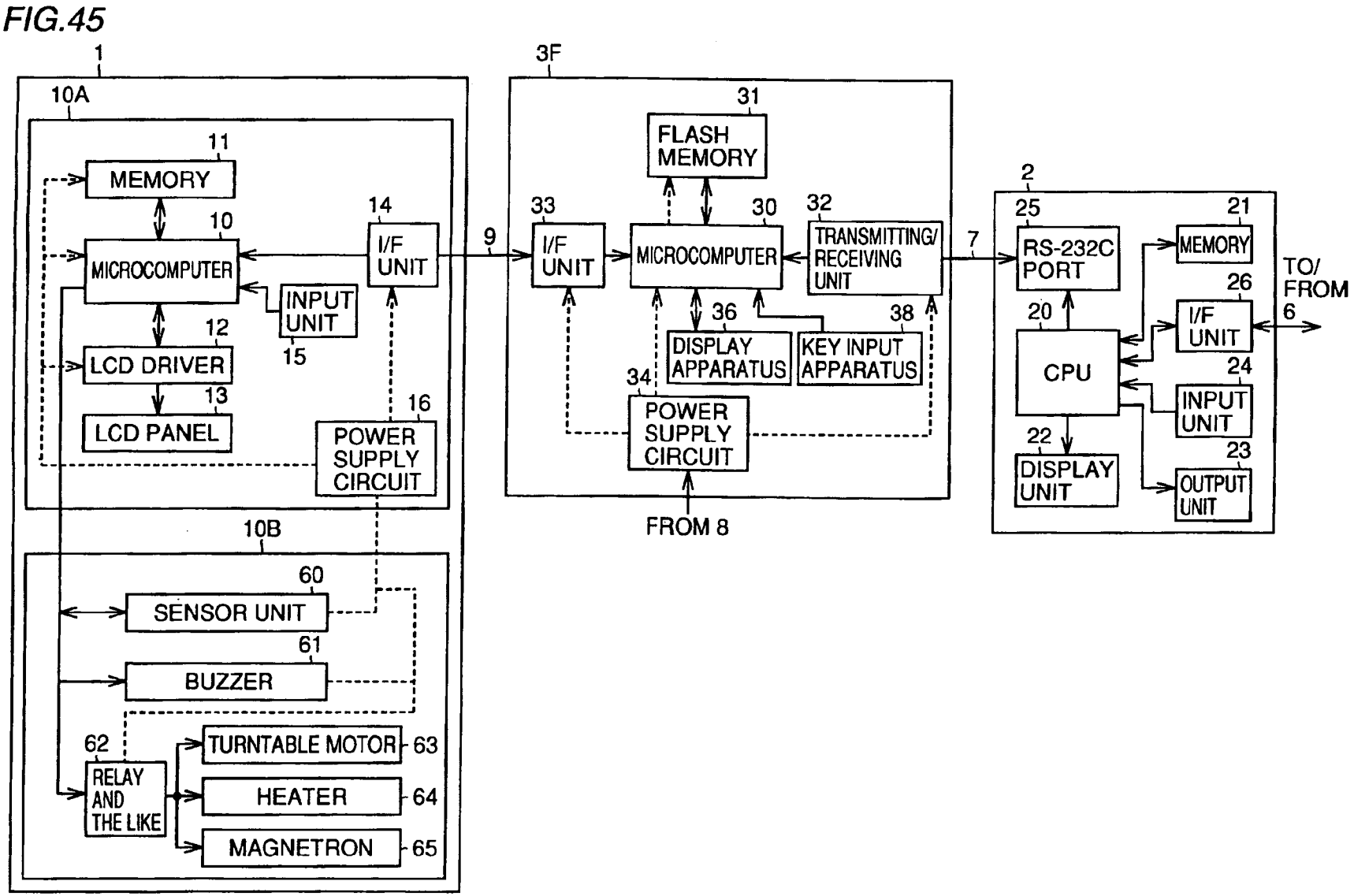
FIG. 45 shows configurations of respective units of FIG. 44.

FIG. 44 shows a configuration of the microwave oven system in accordance with the thirteenth embodiment of the present invention, and FIG. 45 shows configurations of respective units of FIG. 44. The configuration shown in FIGS. 44 and 45 differ from the configuration shown in FIGS. 1 and 2 in that a relay box 3F is provided in place of relay box 3. Relay box 3F includes, in addition to the configuration of relay box 3, a display 35 and a related display apparatus 36, a key operating unit 37 and a related key input apparatus 38, to be controlled by microcomputer 30. Though display 35 and key operating unit 37 are provided separately here, these may be provided as an integrated touch panel.

Figure 46:
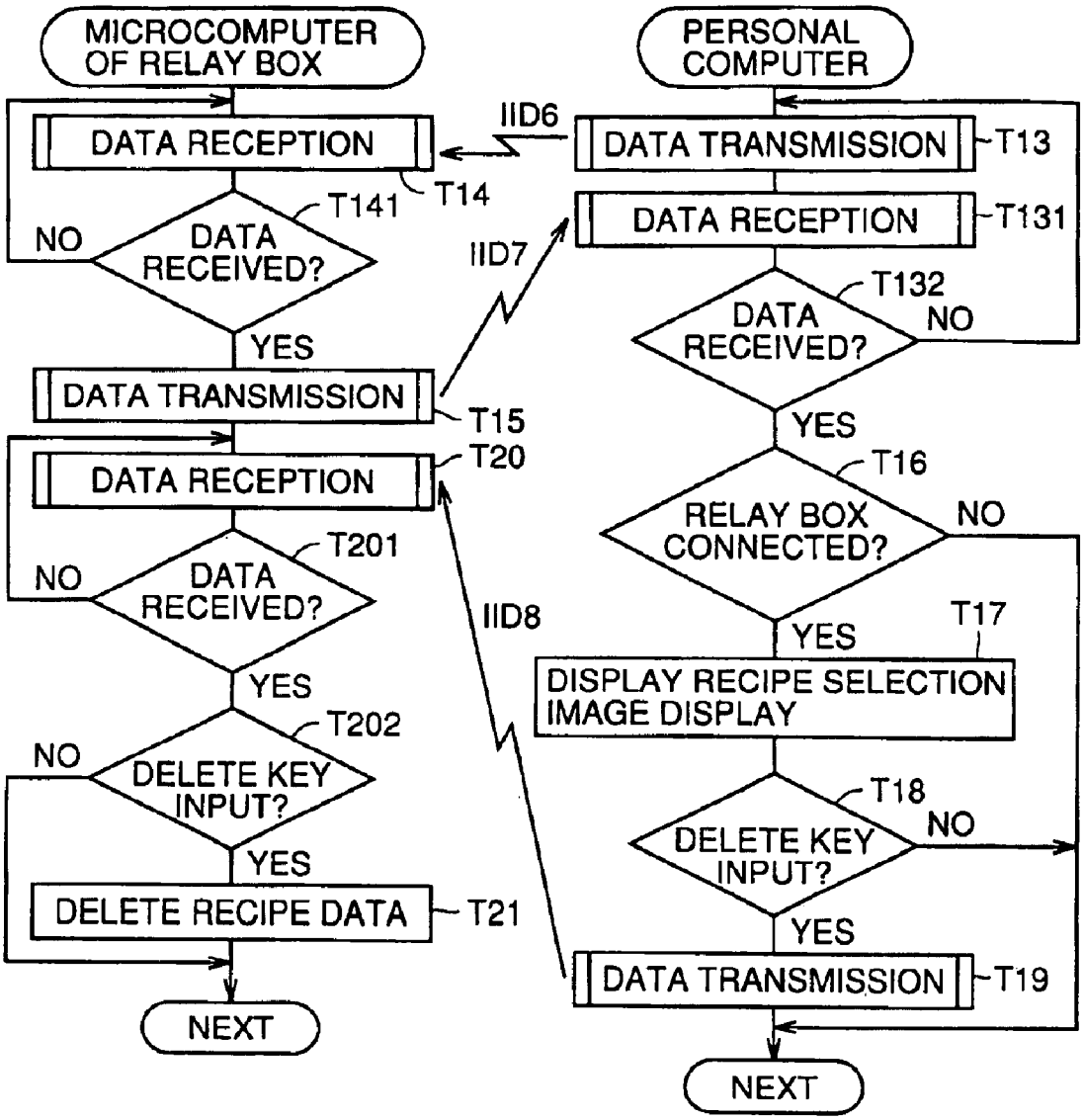
FIG. 46 is a flow chart representing operations of the personal computer and the relay box in accordance with the thirteenth embodiment of the present invention.

FIG. 46 is a flow chart representing operations of the relay box and the personal computer in accordance with the thirteenth embodiment of the present invention. In the present embodiment, confirmation of the contents and deletion of recipe information MI stored in flash memory 31 of relay box 3F are conducted either by personal computer 2 or on relay box 3F. This aspect will be described with reference to the flow chart of FIG. 46.

First, personal computer 2 transmits a connection confirmation data to relay box 3F (T13) to confirm that the relay box 3F is connected to personal computer 2, in accordance with RS-232C, and waits for the response from microcomputer 30 of relay box 3F. Microcomputer 30 receives the connection confirmation data IID6 from personal computer 2 (T14, T141), and transmits a connection confirmation data IID7, acknowledging connection to personal computer 2 (T15).

Acknowledging connection of relay box 3F upon reception of the connection confirmation data IID7 (T131, T132, T16), personal computer 2 displays the recipe selection image of FIG. 15C, for example (T17). When the delete key for deleting data of input unit 24 of personal computer 2 is operated (T18), a deletion instruction data IID8 instructing deletion of recipe information MI is transmitted (T19).

Receiving the deletion instruction data IID8 (T20, T201), microcomputer 30 of relay box 3F deletes all pieces of recipe information MI in flash memory 31 (T202, T21).

Alternatively, recipe information MI may be confirmed and deleted from flash memory 31 by operating display apparatus 36 and key input apparatus 38 provided on relay box 3F. Further, the state of operation of relay box 3F may be displayed on display apparatus 36.

In this manner, it is possible to confirm the state of operation of relay box 3F itself or recipe information MI stored in flash memory 31, using display apparatus 36 of relay box 3F or output unit 23 of personal computer 2. In accordance with the result of confirmation, it is possible to delete recipe information MI stored in flash memory 31 by the key input apparatus 38 of relay box 3F or by key operation of input unit 24 of personal computer 2, and therefore, recipe information MI of flash memory 31 can be deleted without the necessity of connecting relay box 3F to microwave oven 1.

Fourteenth Embodiment

Figure 47:
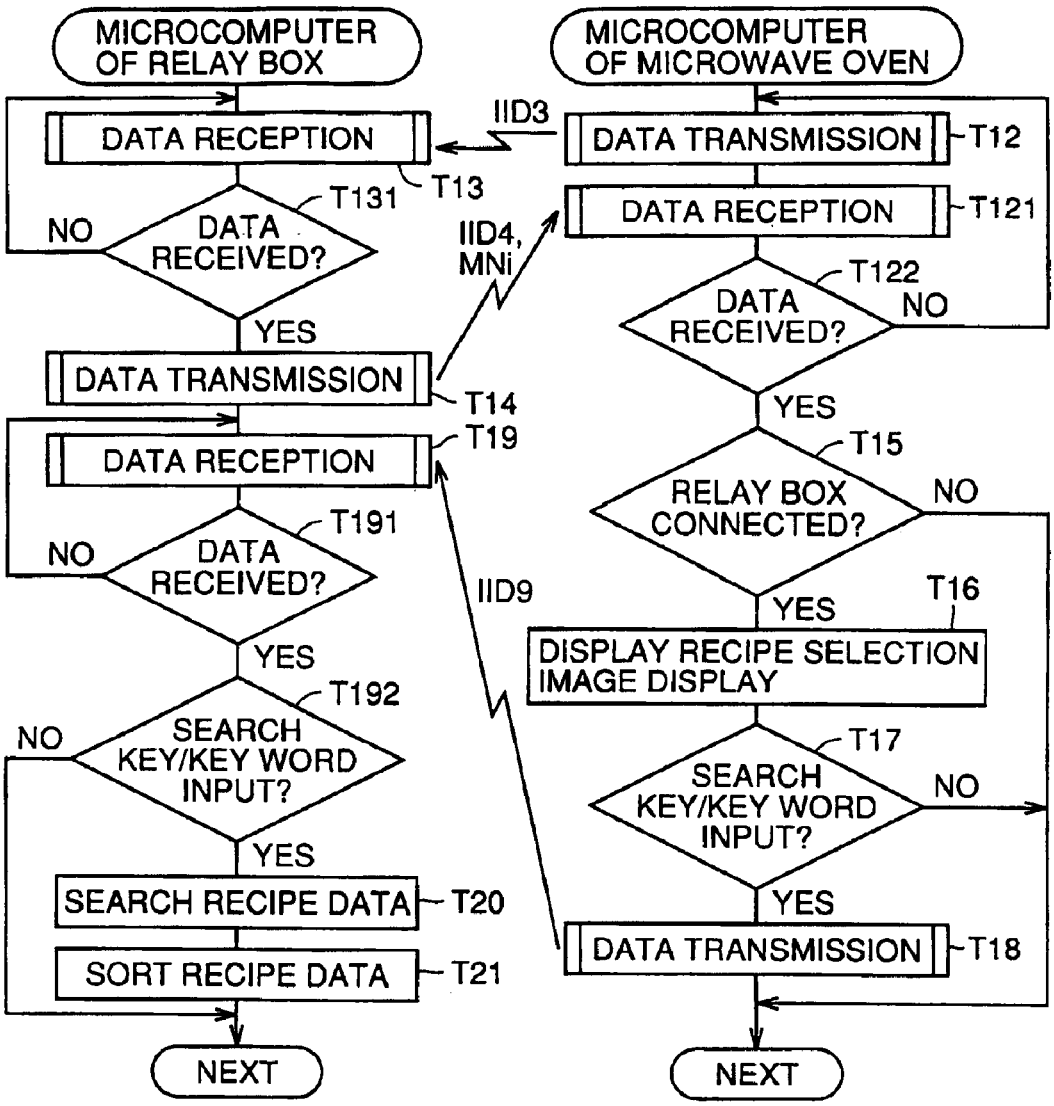
FIG. 47 is a flow chart representing operations of the microwave oven and the relay box in accordance with the fourteenth embodiment of the present invention.

The fourteenth embodiment will be described in the following. FIG. 47 is a flow chart showing operations of the relay box 3 and the microwave oven 1 in accordance with the fourteenth embodiment of the present invention. The system configuration and the configurations of respective units in accordance with the present embodiment are the same as those of FIGS. 1 and 2.

In the present embodiment, it is possible to search and sort the pieces of recipe information MI stored in flash memory 31 of relay box 3, through the input unit 15 of the microwave oven 1. The details will be described with reference to the flow chart of FIG. 47.

First, when turned ON, microcomputer 10 of microwave oven 1 periodically (for example, at every one second) transmits the connection confirmation data IID3 to relay box 3 (T12), and waits for the response of microcomputer 30 of relay box 3. Microcomputer 30 of relay box 3 receives the connection confirmation data IID3 (T13, T131), and transmits the connection confirmation data IID4 and one or more recipe names MNi read from one or more pieces of recipe information MI stored in flash memory 31 (T14).

Microcomputer 10 of microwave oven 1 receives the connection confirmation data IID4 and confirms connection of relay box 3 (T121, T122, T15), and displays such a recipe selection image as shown in FIG. 15C, for example, based on the recipe names MNi received together with the connection confirmation data IID4 (T16). Here, when a search key of input unit 15 is operated and a key word for searching recipe information MI in flash memory 31 is input (Tl7), the input of the search key and a search data IID9 representing the searching key word are transmitted to microcomputer 30 of relay box 3 (T18). Microcomputer 30 of relay box 3 receives the search data IID9 (Tl9, T191, T192), searches the recipe information MI stored in flash memory 31 using the key word in the received search data IID9 (T20), and sorts the pieces of recipe information MI such that the piece of recipe information MI obtained as a result of searching is positioned at the head of flash memory 31 (T21).

When the amount of recipe information MI stored in flash memory 31 of relay box 3 increases, it becomes impossible to provide the recipe selection display on microwave oven 1 in one image plane. Therefore, switching of images becomes necessary. In this respect, the larger the number of pieces of recipe information MI stored in the flash memory 31, the more complicated becomes the operation of switching images for the user. In the present embodiment, however, the relay box 3 is generally connected to microwave oven 1, and therefore it is possible to search and sort the pieces of recipe information MI stored in flash memory 31 by the key operation on microwave oven 1, without the necessity of providing a display apparatus or a key input apparatus on relay box 3. Therefore, even when the recipe selection display includes a plurality of image planes, the display can be adapted such that the desired recipe information MI is given in the first image of the recipe selection display, eliminating the troublesome operation of switching the images.

Fifteenth Embodiment

The fifteenth embodiment will be described in the following.

Figure 48:
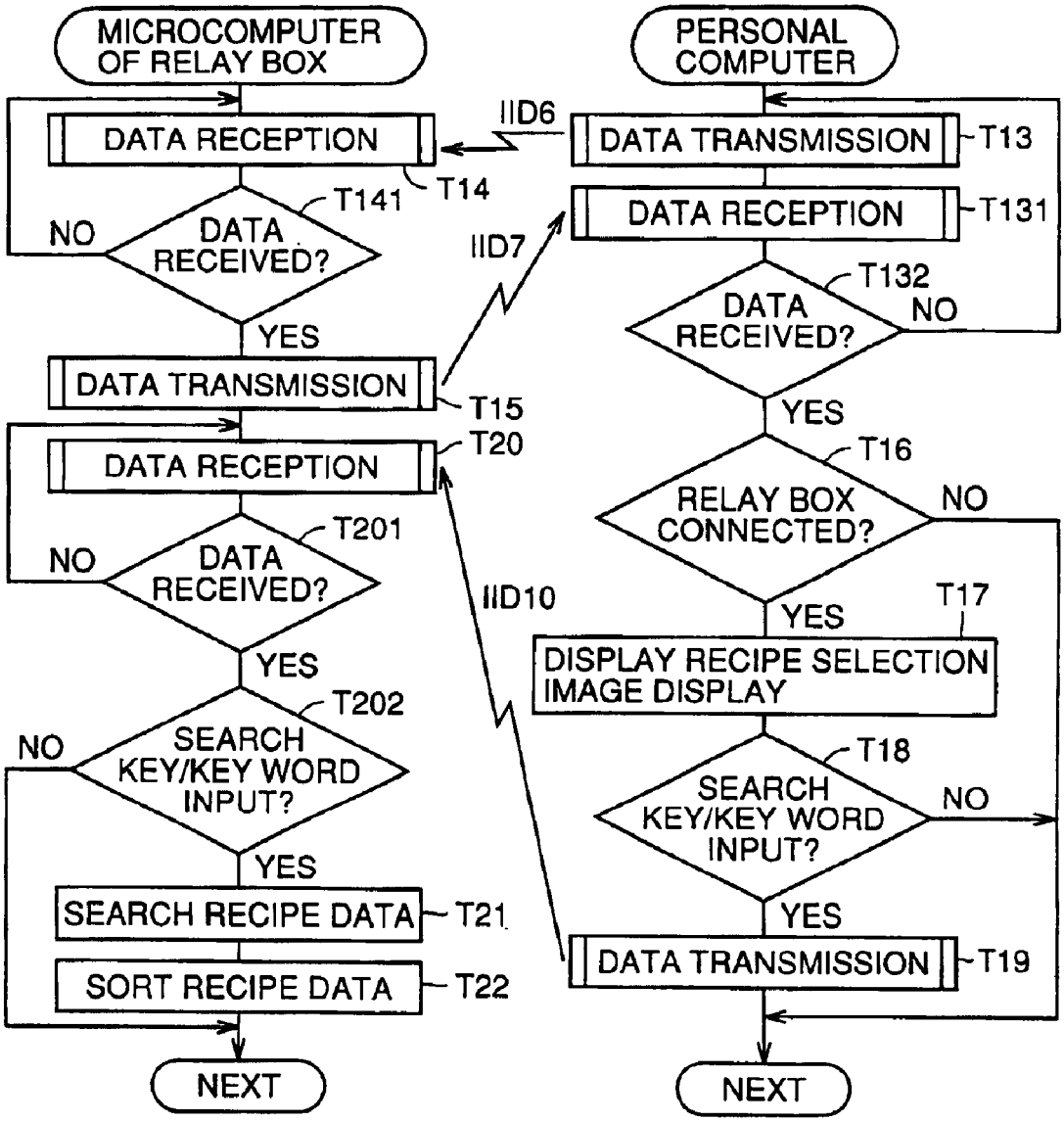
FIG. 48 is a flow chart representing operations of the personal computer and the relay box in accordance with the fifteenth embodiment of the present invention.

FIG. 48 is a flow chart related to the operations of the relay box and the personal computer in accordance with the fifteenth embodiment of the present invention. The system configuration and the configurations of respective unit of the present embodiment are the same as those of FIGS. 44 and 45.

In the present embodiment, the operation of searching and sorting the pieces of recipe information MI stored in flash memory 31 of relay box 3F can be done by personal computer 2 or relay box 3F. This point will be described with reference to the flow chart of FIG. 48. First, personal computer 2 transmits the connection confirmation data IID6 to relay box 3F in accordance with RS232-C (T13), and waits for the response from microcomputer 30 of relay box 3F. Microcomputer 30 receives the connection confirmation data IID6 (T14, T141), and transmits the connection confirmation data IID7 (T15). Receiving the connection confirmation data IID7, the personal computer confirms connection of relay box 3F to personal computer 2 (T131, T132, T16), and displays the recipe selection display of FIG. 15C, for example (T17).

Thereafter, when the user inputs a search key and a key word for searching, instructing searching of recipe information in flash memory 31 through input unit 24 of personal computer 2 (T18), search data IID10 representing the input of the search key and the search key word is transmitted to microcomputer 30 of relay box 3F (T19).

Microcomputer 30 of relay box 3F receives search data IID10 (T20, T201), searches the recipe information MI stored in flash memory 31 based on the received search key word (T202, T21), and sorts the recipe information so that the piece of recipe information MI obtained as a result of searching is positioned at the top of flash memory 31 (T22).

Alternatively, searching and sorting of recipe information M maybe performed by display apparatus 36 and key input apparatus 38 provided on relay box 3F.

When the amount of recipe information MI stored in flash memory 31 of relay box 3F increases, it becomes impossible to provide the recipe selection display displayed on the microwave oven 1 in one image plane. Therefore, it becomes necessary to provide the recipe selection display in a plurality of image planes, which requires an operation of switching images. Therefore, the larger the number of pieces of recipe information MI stored in flash memory 31, the more complicated becomes the operation of switching images for the user.

Therefore, in the present embodiment, information related to the state of operation of relay box 3F itself and information related to recipe information MI stored in flash memory 31 are displayed using the display apparatus of output unit 23 of personal computer 2 or the display apparatus 36 of relay box 3F. Further, searching and sorting of the recipe information MI stored in flash memory 31 can be done by using the key input apparatus 38 of relay box 3F or the key of input unit 24 of personal computer 2, and therefore, it is unnecessary to connect the relay box 3F to microwave oven 1, and hence the troublesome operation of image switching can be eliminated.

Sixteenth Embodiment

The sixteenth embodiment will be described in the following.

In the present invention, information received from the Internet through a portable information processing terminal equipment (hereinafter referred to as a mobile equipment) is supplied to the microwave oven. In other words, the mobile equipment realizes the function of the personal computer and the relay box.

Figures 49A, 49B:
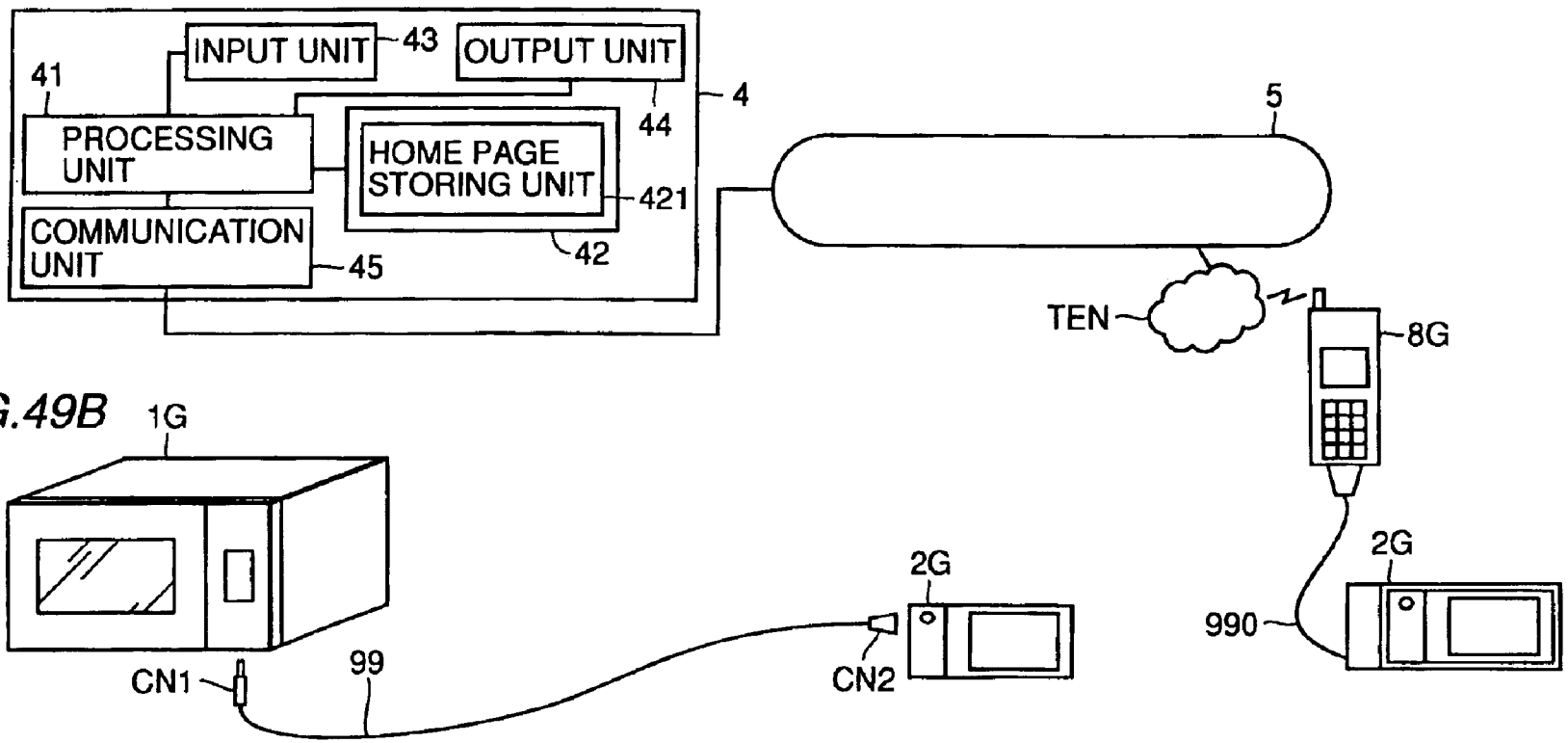
FIGS. 49A and 49B are schematic illustrations representing the configuration of the microwave oven system in accordance with the sixteenth embodiment of the present invention.
Figure 50:
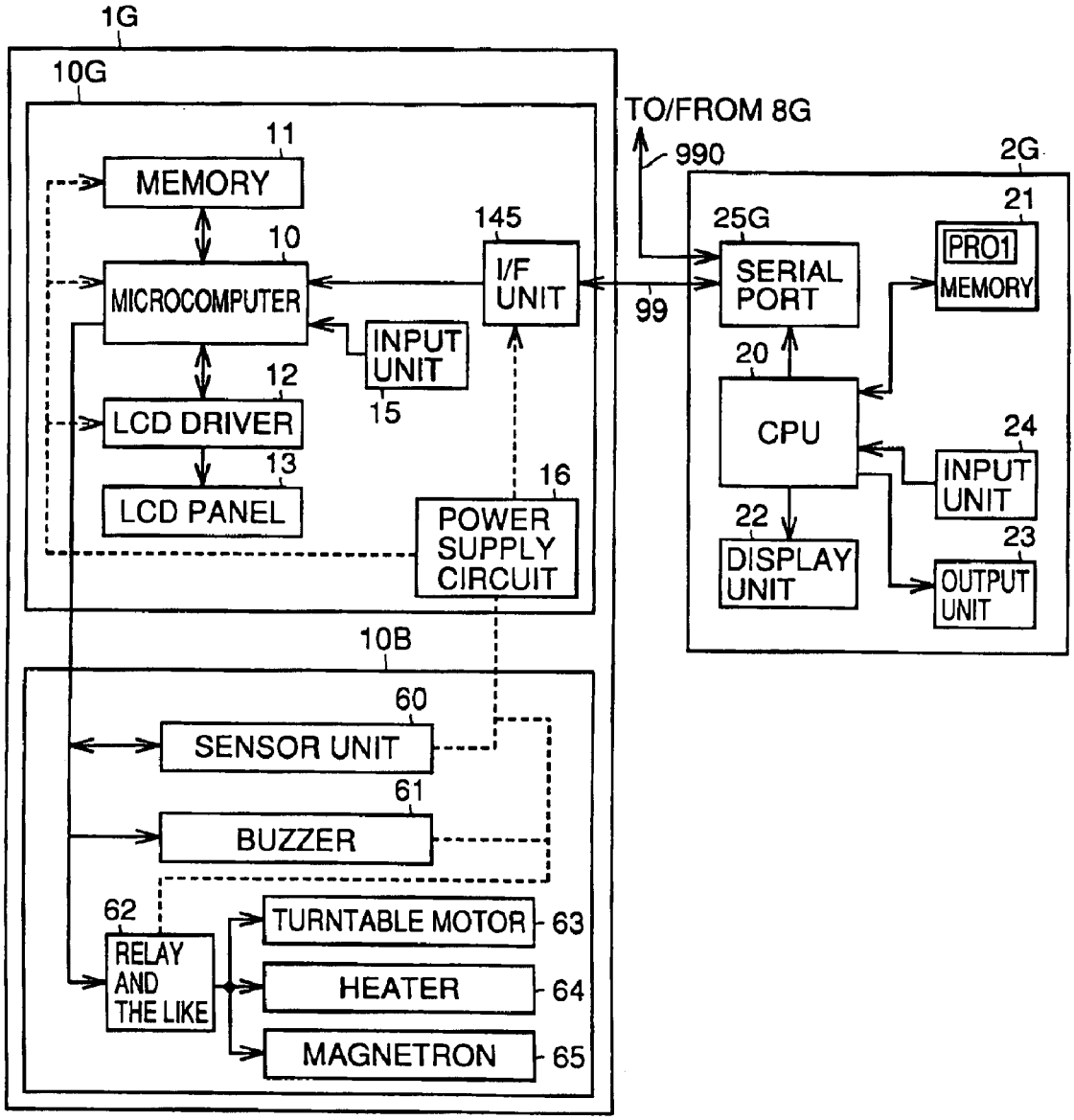
FIG. 50 is a block diagram showing configurations of the microwave oven and a mobile equipment in accordance with the sixteenth embodiment of the present invention.

FIGS. 49A and 49B represent schematic configurations of the microwave oven system in accordance with the sixteenth embodiment of the present invention. FIG. 50 is a block diagram representing configurations of the microwave oven and the mobile equipment in accordance with the present embodiment.

Referring to FIGS. 49A and 49B, the microwave oven system includes, in public, Internet 5 and host computer 4 connected to the Internet 5. On the user's side, the system includes a microwave oven 1G installed in a private kitchen, a mobile equipment 2G connected to microwave oven 1G, and a portable telephone 8G capable of transmitting/receiving digital information for communication and connection between the Internet 5 and the mobile equipment 2G through a telephone line TEN. The line for connecting mobile equipment 2G and the Internet 5 may be an ISDN (Integrated Services Digital Network).

In the private kitchen, microwave oven 1G and mobile equipment 2G are connected through a dedicated cable 99. When microwave oven IG and mobile equipment 2G are connected to each other, a 3-pole terminal connector CN1 and a 16-pole terminal connector CN2 at the opposing ends of dedicated cable 99 are connected to input/output terminals of microwave oven 1G and mobile equipment 2G, not shown, respectively.

Here, a portable telephone 8G having a modem function capable of connecting mobile equipment 2G to a telephone line TEN is used for connecting the mobile equipment 2G to the Internet 5. However, this is not limiting. When the mobile equipment 2G incorporates a modem, the same function can be attained by directly connecting the modem to a telephone line TEN.

In the public host computer 4, information related to various home pages to be accessed through the Internet 5 are registered. Host computer 4 includes a processing unit 41 for centralized control and management of host computer 4 itself, a memory 42 having a home page storing unit 421 as a memory area storing information including home page information for constructing home page screen, an input unit 43, an output unit 44, and a communication unit 45 for communication and connection between the Internet 5 and host computer 4.

Referring to FIG. 50, microwave oven 1 includes a control unit 10A and a heating unit 10B. Control unit 10A includes a microcomputer 10, a memory 11, an LCD (Liquid Crystal Display) panel 13 as a display unit, an LCD driver 12 for driving LCD panel 13, an I/F (Interface) unit 145 including an input/output terminal to which connector CN1 is connected, an externally operable input unit 15, and a power supply circuit 16 for supplying power to respective units of microwave oven 1. Input unit 15 and LCD panel 13 are provided integrally, as a touch panel.

Heating unit 10B performs the heating operation for heating and cooking in accordance with various pieces of information including the heating data, which will be described later, stored in memory 11, under the control of microcomputer 10. For the heating operation, heating unit 10B includes a sensor unit 60, a buzzer 61, a relay or the like 62, a turntable motor 63 controlled by microcomputer 10 through relay or the like 62, a heater 64 and a magnetron 65 generating microwaves for heating. The heating operation by the heating unit 10B is in accordance with the known technique, and therefore detailed description will not be given here. In memory 11, heating data related to at least one cooking recipe provided as a standard specification of microwave oven 1 is stored.

Mobile equipment 2G includes a memory 21 storing information including a program PRO 1 down-loaded from host computer 4 in the manner as will be described later, a display unit 22, an output unit 23, an input unit 24 consisting of an externally operable pen or the like, and a serial port 25G to be connected to either one of dedicated cable 99 or a cable 990 on the side of a portable telephone 8G for establishing communication with CPU 20 and either one of portable telephone 8G and microwave oven 1G.

Figure 51:
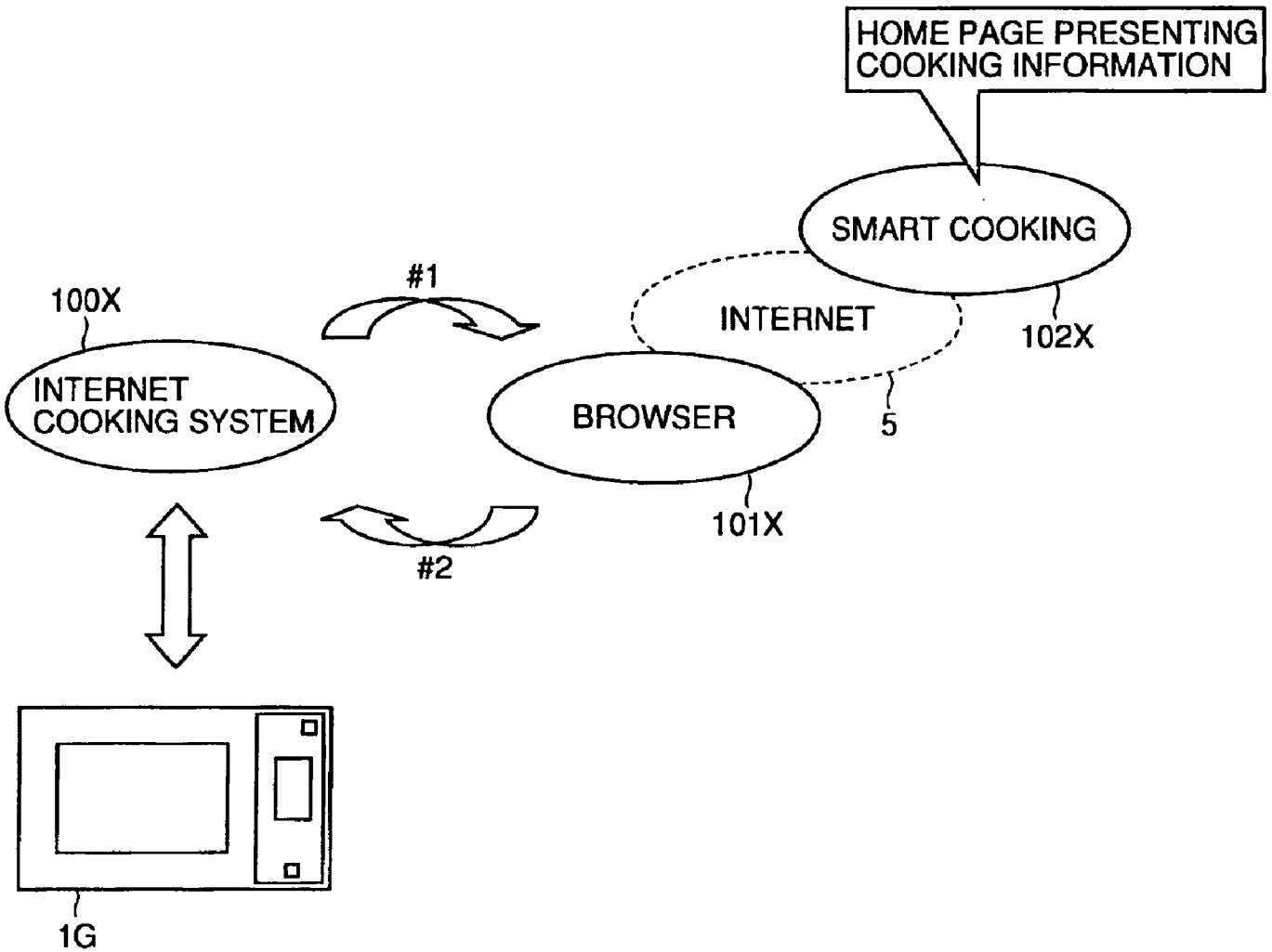
FIG. 51 schematically shows functional blocks and the switching of functions of the software in the microwave oven system in accordance with each of the embodiments of the present invention.

FIG. 51 is a schematic diagram representing functional blocks of the software and switching of functions, in the microwave oven system in accordance with the present embodiment. Mobile equipment 2G is inferior in memory capacity and processing speed to a personal computer in general. Therefore, it is not possible to execute a large scale program or to execute a plurality of programs concurrently. More specifically, it is impossible for mobile equipment 2G to execute the program for accessing the Internet 5 and down-loading the recipe information MI to mobile equipment 2G (browser 101X) and a program for editing the down-loaded recipe names and transmitting the recipe information of the stored recipe to microwave oven 1G (Internet cooking system 100X). In other words, it is necessary to execute programs while switching the browser 101X and the Internet cooking system 100X on the side of mobile equipment 2G.

In designing mobile equipment 2G, minimum necessary program should be developed while maintaining the basic system of the mobile equipment 2G including the OS (Operating System) and the browser 101X, so that the time and cost in developing the present system can be reduced.

Even when the specification of the OS or the browser 101X is modified, the contents of the modification can be absorbed by the basic system of mobile equipment 2G. Therefore, the dedicated program PRO1 developed for the present microwave oven system can be used without any modification.

When the Internet 5 is accessed by the internet cooking system 100X including mobile equipment 2G and microwave oven 1G, browser 101X of mobile equipment 2G is activated. When activated, browser 101X automatically connects to a provider (not shown) through a telephone line TEN and accesses the Internet 5 through the provider, accesses a prescribed home page, and sets the mobile equipment 2G to be assessable to the prescribed home page. More specifically, in FIG. 51, the program operation switches at timing #1 from internet cooking system 100X to browser 101X, and switches at timing #2 from browser 101X to internet cooking system 100X.

Figure 52A:
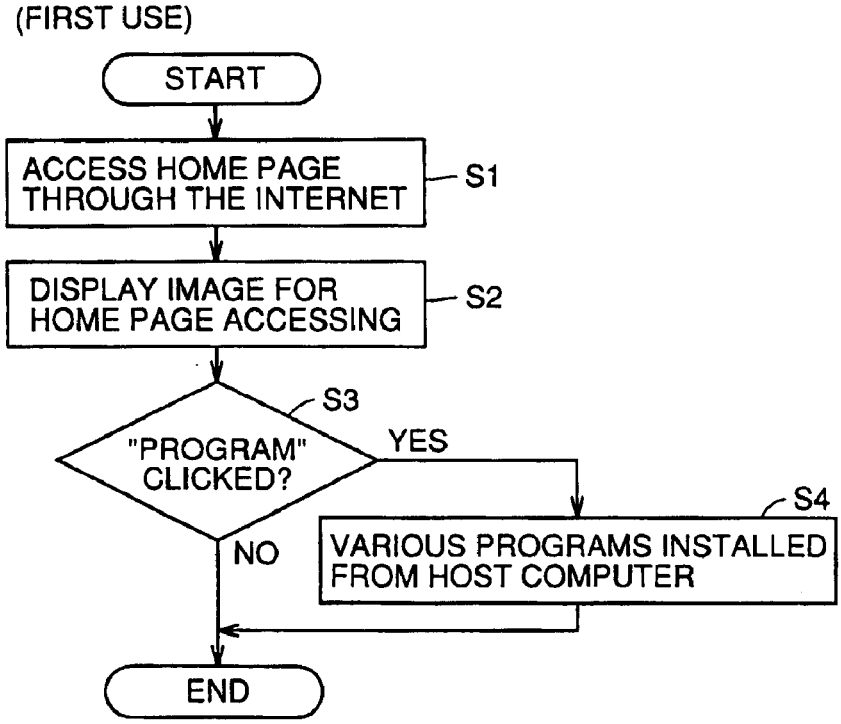
FIGS. 52A and 52B are flow charts representing the procedure of accessing from the mobile equipment to the home page, in the system of FIG. 49A.
Figure 52B:
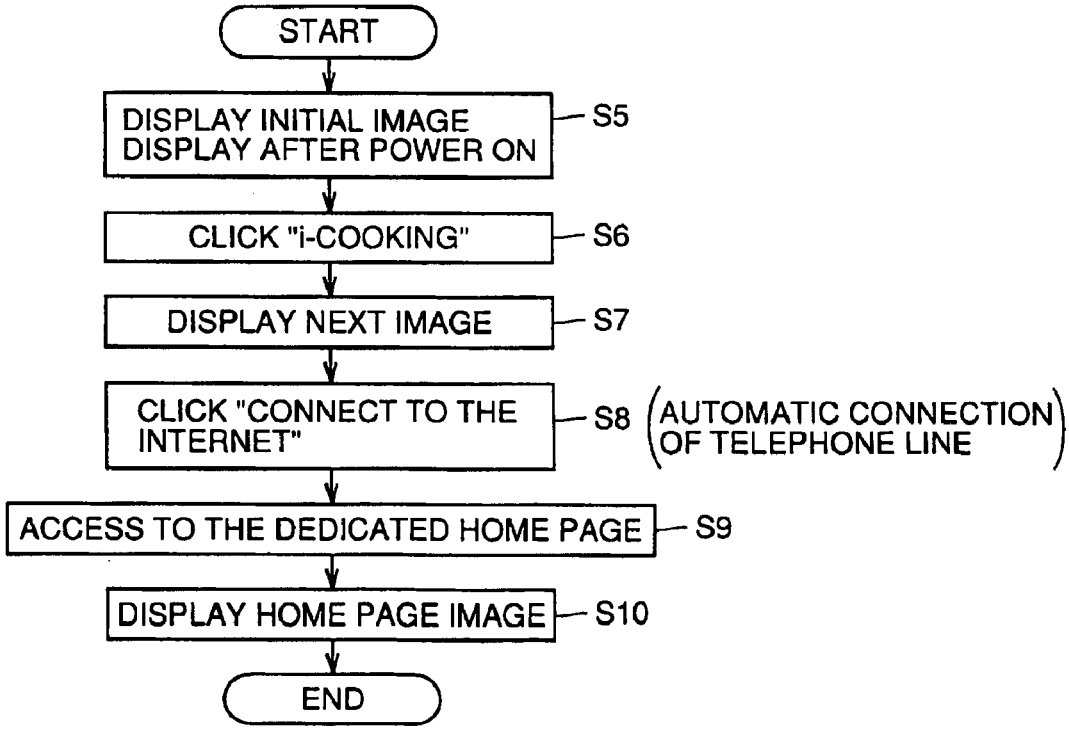
Figure 53A:
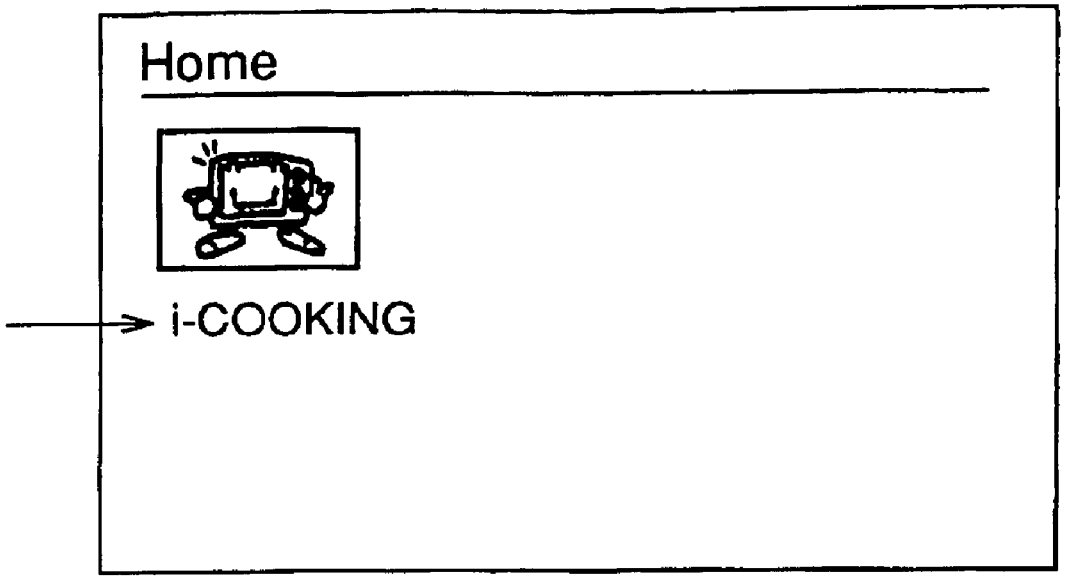
FIGS. 53A to 53C represent examples of the images displayed in the process shown in FIGS. 52A and 52B.
Figure 53B:
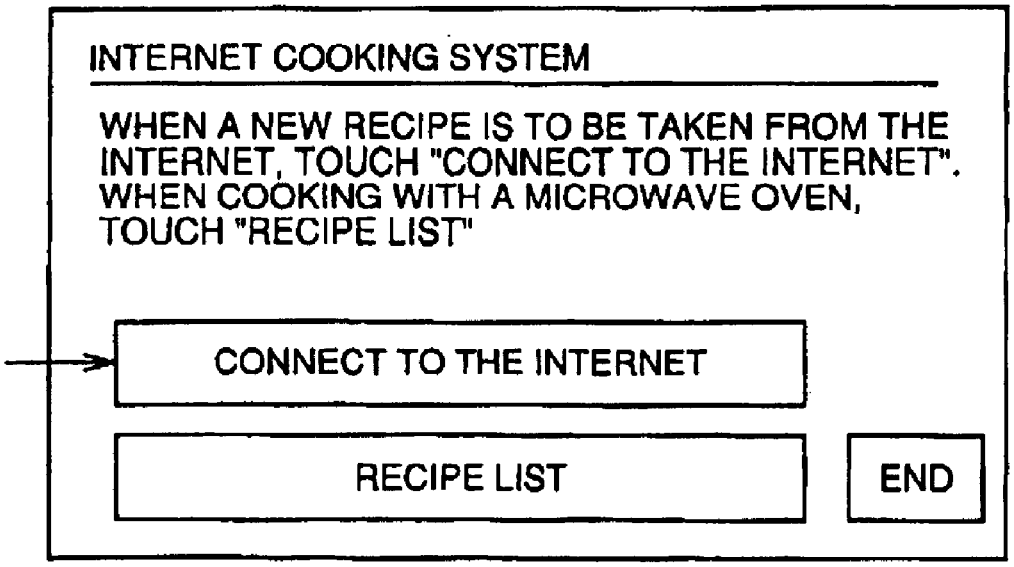
Figure 53C:
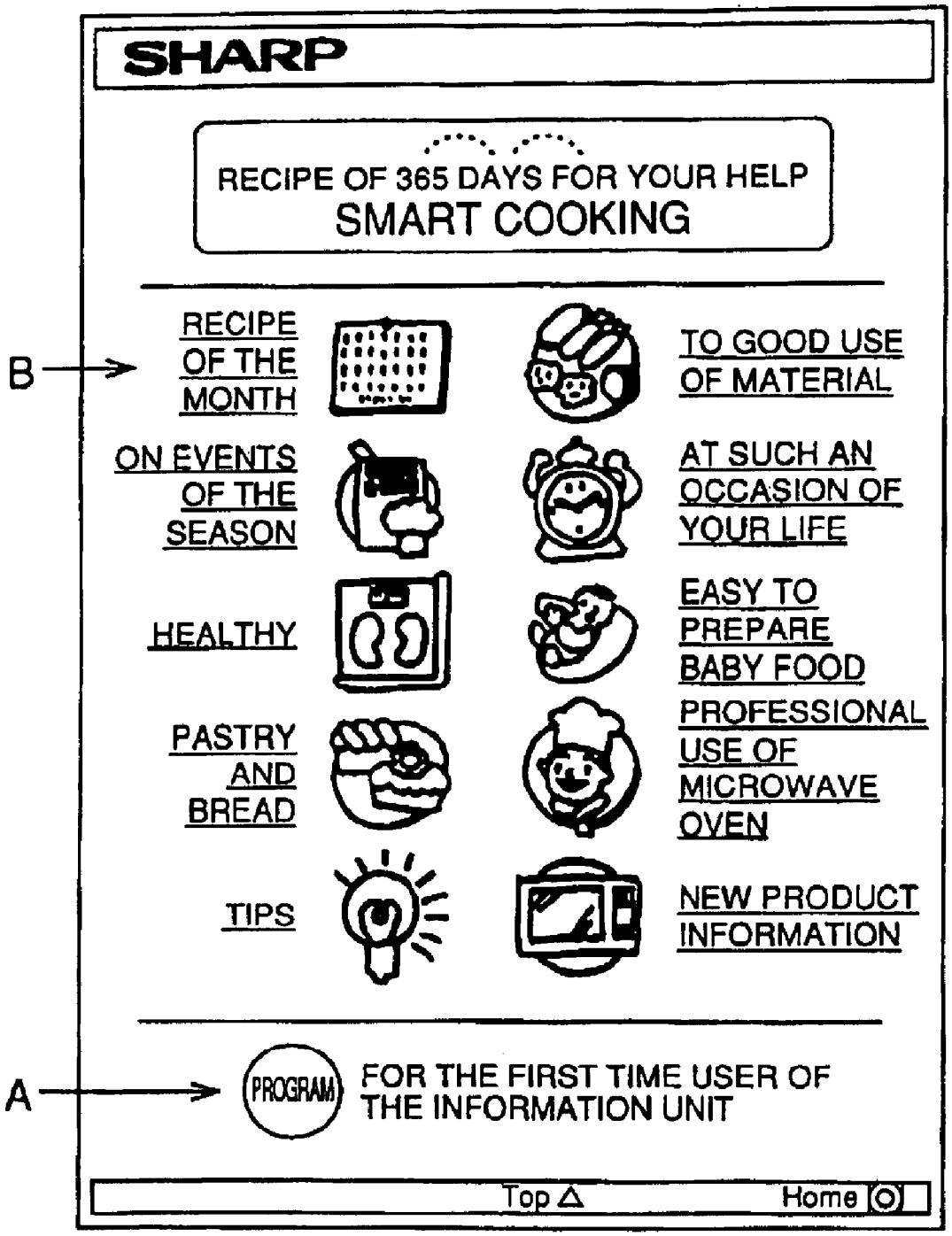

FIGS. 52A and 52B are flow charts representing the access procedure from the mobile equipment to the home page of FIG. 49A. FIGS. 53A to 53C represent examples of the screen images displayed in the process of FIGS. 52A and 52B. Referring to FIGS. 49A to 53C, the procedure of accessing the home page "smart cooking" will be described. For simplicity of description, only the portions denoted by the arrows in FIGS. 53A to 53C are translated to English, with the remaining portions kept in Japanese.

When the user uses the system for the first time, portable telephone 8G is connected to serial port 25G of mobile equipment 2G by cable 990. When mobile equipment 2G is turned on and the home page "smart cooking" is accessed, the image of FIG. 53C appears on the display unit 22 of mobile equipment 2G (S1 and S2 of FIG. 52A). The displayed image here is to facilitate access to the contents of the home page "smart cooking" 102X of home page storing unit 421 of host computer 4.

The home page "smart cooking" 102X stores recipe information MI of cooking recipes which can be heated and cooked by microwave oven 1G and dedicated program information.

When the microwave oven system is used for the first time, the user clicks "program" denoted by the arrow A in the display of FIG. 53C (YES in S3), and various programs for the microwave oven system are down-loaded from host computer 4 to mobile equipment 2G. The various programs include, for example, a program for transmitting the recipe information MI down-loaded from home page storing unit 421 to microwave oven 1G, and a program for editing cooking recipes. When down-loaded from host computer 4 to mobile equipment 2G, the various dedicated programs are stored as program PRO1 in memory 21 of mobile equipment 2G (S4).

When the microwave oven system is used for the second time and thereafter, that is, after the program PRO1 is down-loaded and stored in mobile equipment 2G, the image of FIG. 53A appears at the display unit 22 (S5) when mobile equipment 2G is turned on, as shown in FIG. 52B. Here, when the user clicks "i-cooking" denoted by the arrow in FIG. 53A, internet cooking system 100X is activated, and the display is switched to the image of FIG. 53B (S6, S7). When the user clicks "connect to the Internet" denoted by the arrow in FIG. 53B, browser 101X is activated at the timing #1 of FIG. 51, communication and connection to the provider, not shown, is automatically established through portable telephone 8G and, further, the home page "smart cooking" 102X of home page storing unit 421 of host computer 4 is automatically accessed (S8, S9). After the access is complete, the screen image of "smart cooking" of FIG. 53C appears on the display unit 22 of mobile equipment 2G (S10).

Thereafter, the information of cooking recipe is searched. Though there are various methods of searching, here, one example of searching "recipe of the month" will be described.

Figure 54:
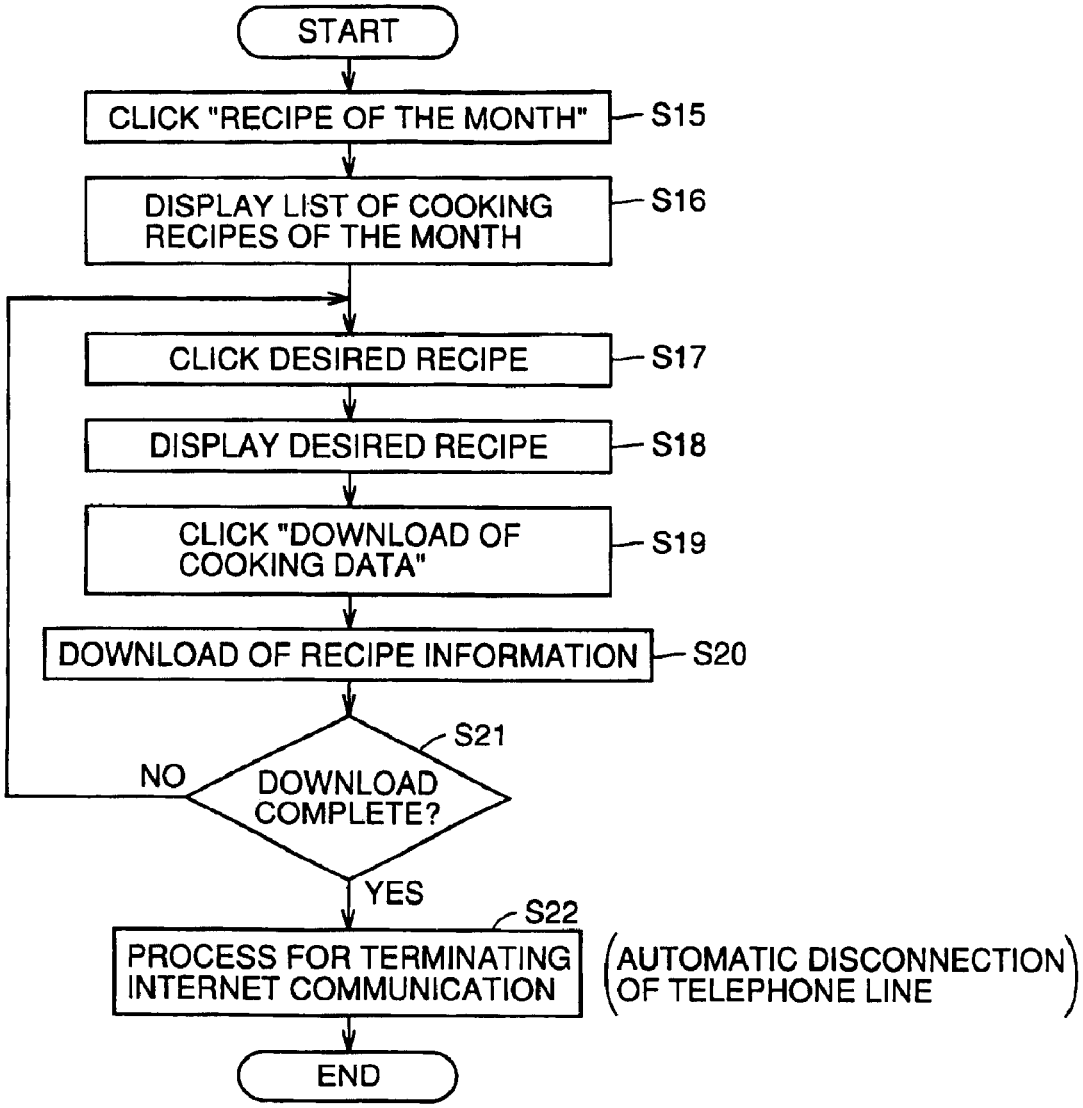
FIG. 54 is a process flow chart of searching cooking recipe information on the side of the host computer and loading the information to the mobile equipment, in accordance with the sixteenth embodiment of the present invention.
Figure 55:
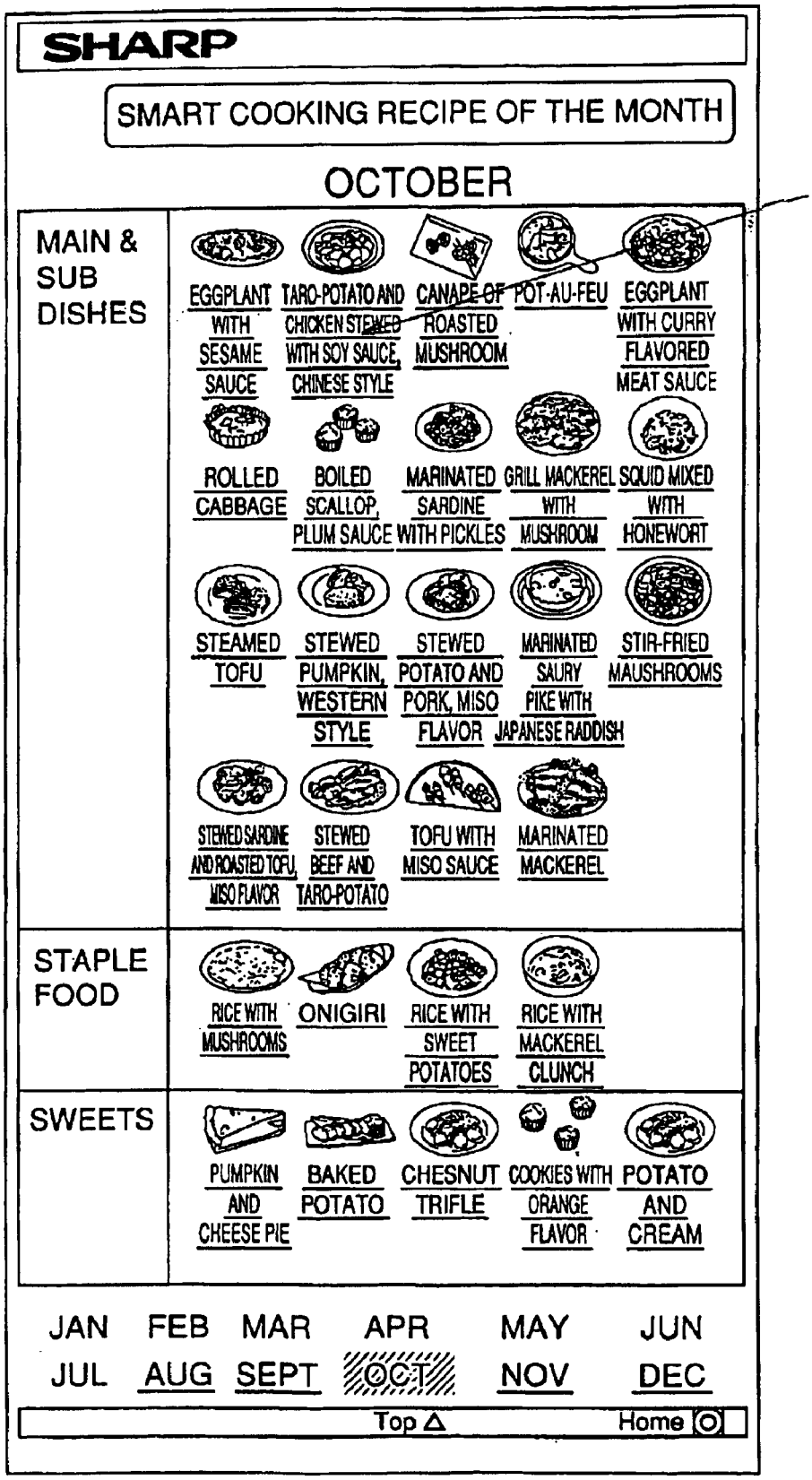
Figure 57:
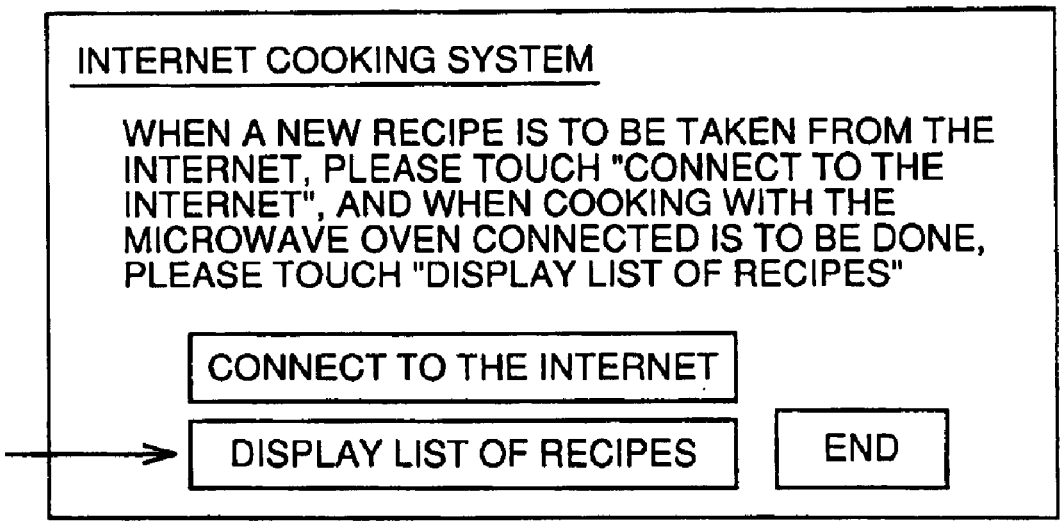

FIG. 54 is a flow chart of a process of searching and loading to the mobile equipment the cooking recipe information on the side of the host computer, in accordance with the sixteenth embodiment of the present invention. FIGS. 55 to 57 represent examples of the images displayed in the process of FIG. 54. For simplicity of description, in FIGS. 55 and 56, only the portions denoted by the arrows are translated to English, and other portions are in Japanese.

First, on the image display of "smart cooking" of FIG. 53C appearing on display unit 22 of mobile equipment 2G, when "recipe of the month" denoted by the arrow B is clicked by the operation of input unit 24 by the user (S15 of FIG. 54), a list of cooking recipes preferable in October, for example, is displayed (S 16). Thereafter, the user clicks a desired cooking recipe, for example "Taro-potato and chicken stewed with soy sauce, Chinese style" denoted by the arrow in FIG. 55 (S17), and hence information based on the recipe information MI of "Taro-potato and chicken stewed with soy sauce, Chinese style" appears on the display unit 22 of mobile equipment 2G as shown in FIG. 56 (S18).

When the user checks the contents displayed on display unit 22 and request recipe information MI, the user clicks the illustration of "down load of cooking data" and therefore, pieces of recipe information MI of the desired cooking recipe of the home page "smart cooking" of host computer 4 are down-loaded one by one to the memory 21 of mobile equipment 2, through the Internet 5 and the portable telephone 8 (loop process of S17 to S21). When downloading of the pieces of recipe information MI for all the desired cooking recipes is complete (YES in S21), the access to the home page "smart cooking" 102X is terminated by browser 101X, and the Internet communication is terminated.

When the Internet communication ends, the process is switched from browser 101X to internet cooking system 100X at the timing #2 of FIG. 51, and by the internet cooking system 100X, the image of FIG. 57 is displayed on display unit 22 (S22).

Figure 58:
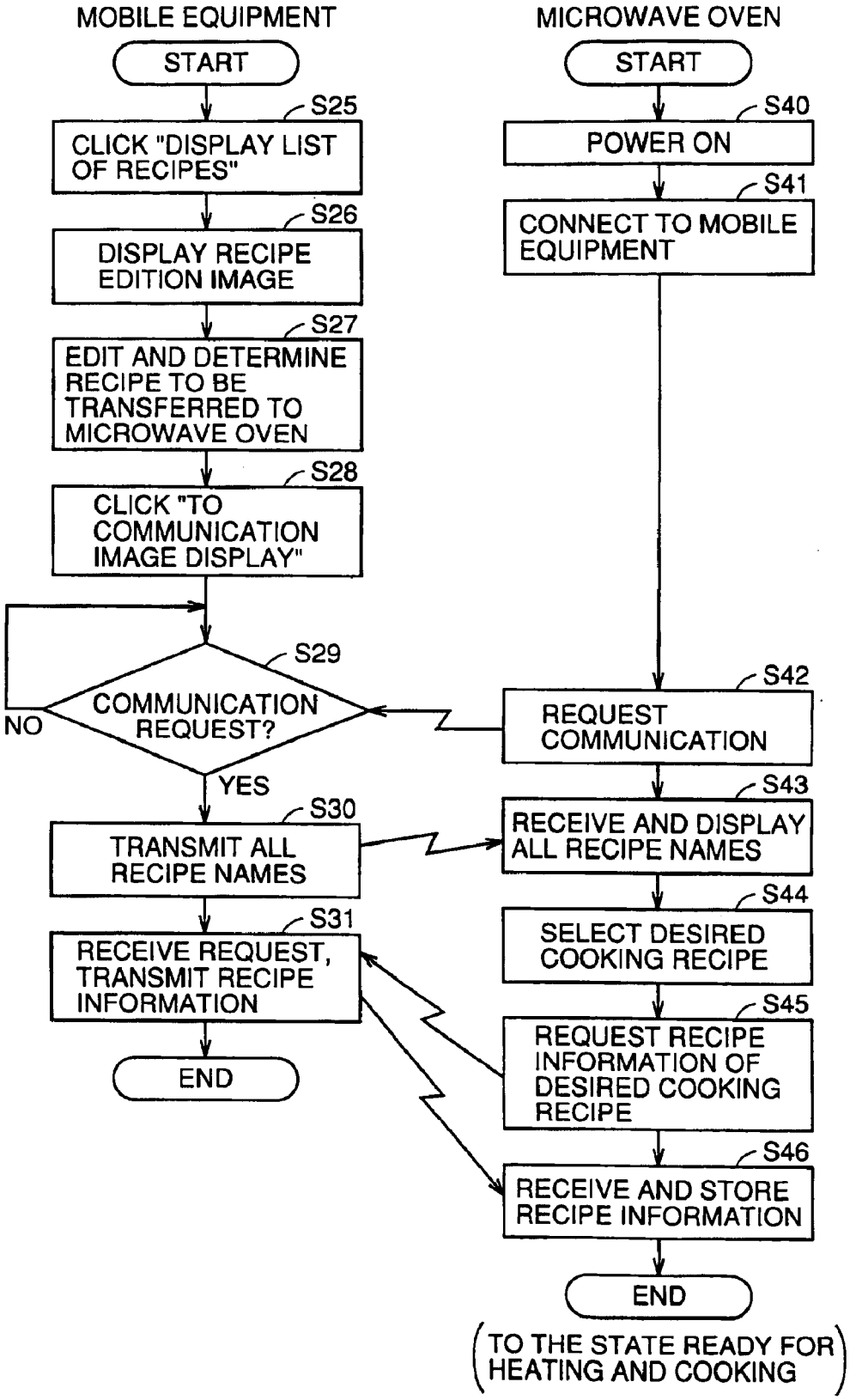
FIG. 58 is a flow chart representing a procedure of transferring the recipe information downloaded to the mobile equipment shown in FIG. 49 to the microwave oven and storing the information therein.
Figure 59:
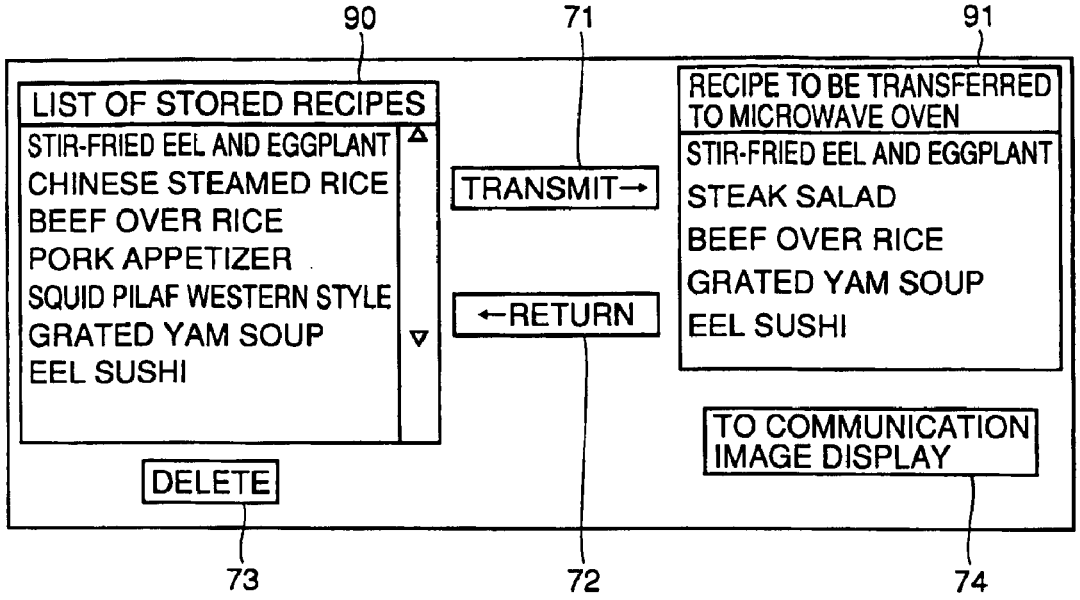
FIGS. 59 and 60 show examples of the images displayed on the mobile equipment at the time of communication between the microwave oven and the mobile equipment, in the process of FIG. 58.
Figure 60:
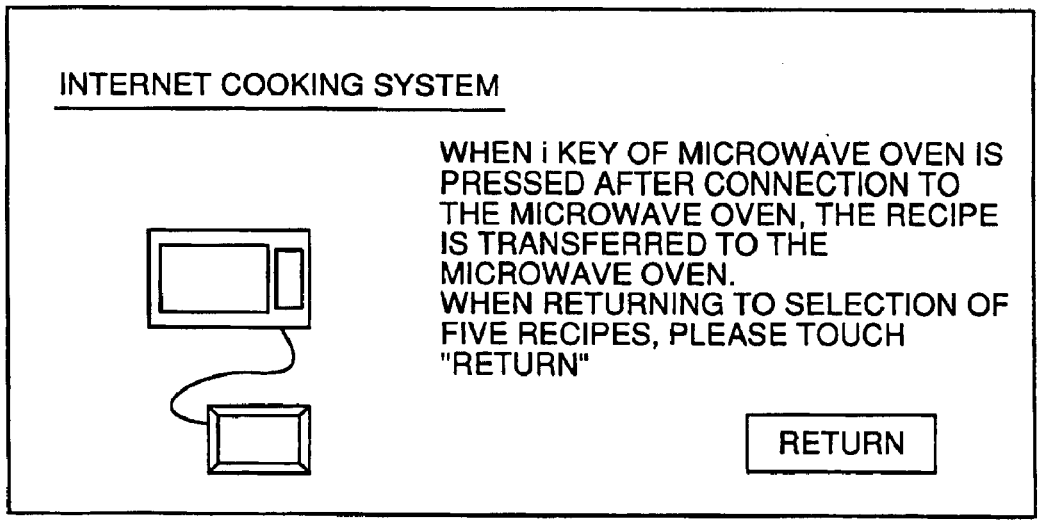

FIG. 58 is a flow chart representing the procedure of transferring the recipe information MI downloaded to mobile equipment 2G of FIG. 49 to microwave oven 1G to be stored therein. FIGS. 59 and 60 represent examples of the images displayed on the mobile equipment 2G at the time of communication between the microwave oven 1G and mobile equipment 2G, in the process shown in FIG. 58. Buttons 71 to 74 are externally operable input buttons.

The recipe information MI of the cooking recipes downloaded from host computer 4 to memory 21 of mobile equipment 2G in the manner as described above are thereafter transferred from the mobile equipment 2G to microwave oven 1G and stored in memory 11. Thus, microwave oven 1G is set to a state ready for heating and cooking in accordance with recipe information MI. When recipe information M is to be transferred from mobile equipment 2G to microwave oven 1G, cable 990 on the side of portable telephone 8G is disconnected from serial port 25G of mobile equipment 2G, and dedicated cable 99 of microwave oven 1G is connected to serial port 25G, as shown in FIG. 49B. Subsequent specific procedure will be described in the following.

As the image of FIG. 57 is displayed on mobile equipment 2G, when the user clicks "display list of recipes" denoted by the arrow of FIG. 57, a recipe edition image for editing cooking recipe names such as shown in FIG. 59 is displayed (S25, S26). When the number of recipe names MNi which can be stored in memory 11 of microwave oven 1G is five, desired five recipe names MNi are transmitted from the display area 90 of "list of stored recipes" displaying the cooking recipe names MNi corresponding to respective pieces of recipe information MI downloaded and stored in memory 21 of mobile equipment 2G to the display area 91 of "recipe to be transferred to microwave oven", by the recipe edition image of FIG. 59.

On the display area 91, recipe names MNi of five recipes which can be stored in memory 11 of microwave oven 1G are displayed. When the recipe name MNi to be stored in memory 11 of microwave oven IG is determined (S27), the button 74 of "to communication image display" of FIG. 59 is clicked (S28). Therefore, the display of mobile equipment 2G is switched to the image of FIG. 60, which represents a communication request standby state from the microwave oven 1G (S29).

When the power of the microwave oven 1G is turned on and mobile equipment 2G is connected through dedicated cable 99 (S40, S41), the user presses the "i" key (not shown) on the operating unit consisting of LCD panel 13 and input unit 15 provided on a front face of microwave oven 1G, and therefore a communication request is made to mobile equipment 2G (S42). Thereafter, in microwave oven 1G, five recipe names MNi which have been selected by the image display of FIG. 59 and displayed on display area 91 are received from mobile equipment 2G, and the received five recipe names MNi are displayed in a list on LCD panel 13 (S30, S43).

Thereafter, the user presses the recipe name MNi of the desired cooking recipe, for example, "stir-fried eel and eggplant" from the displayed list of recipe names MNi on LCD panel 13 (S44), and microwave oven 1G requests and receives from mobile equipment 2G the recipe information MI of the desired cooking recipe (S45, S31). The received recipe information MI is stored in memory 11 of microwave oven 1G (S46). Thus, microwave oven IG is set to the state ready for automatic heating and cooking of the desired cooking recipe in accordance with the recipe information MI received from mobile equipment 2G.

In FIG. 49, mobile equipment 2G is connected to a portable telephone 8G capable of communicating digital information through a dedicated cable 990. The same process as described above can be attained when the mobile equipment is connected to PHS telephone through a PHS (Personal Handy Phone System) connection cable.

Seventeenth Embodiment

The seventeenth embodiment will be described.

In the above sixteenth embodiment, serial port 25G of mobile equipment 2G is shared by cable 990 for connecting the portable telephone 8G and dedicated cable 99 for connecting microwave oven IG. Therefore, a switching operation for connecting the cables to serial port 25G is necessary. The seventeenth embodiment is adapted to allow operation of the system while the PHS telephone and the dedicated cable 99 are both connected to the mobile equipment at the same time.

Figure 61:
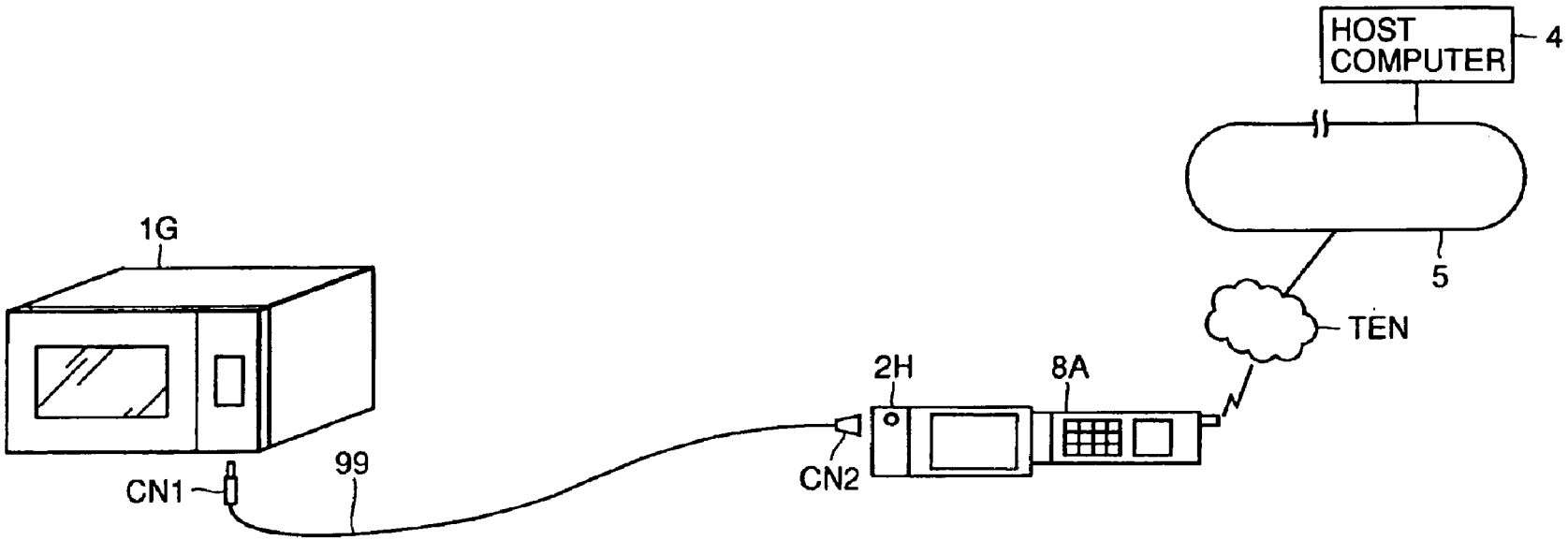
FIG. 61 shows a state where a PHS telephone and a dedicated cable on the side of the microwave oven are simultaneously connected to the mobile equipment in accordance with the seventeenth embodiment of the present invention.
Figure 62:
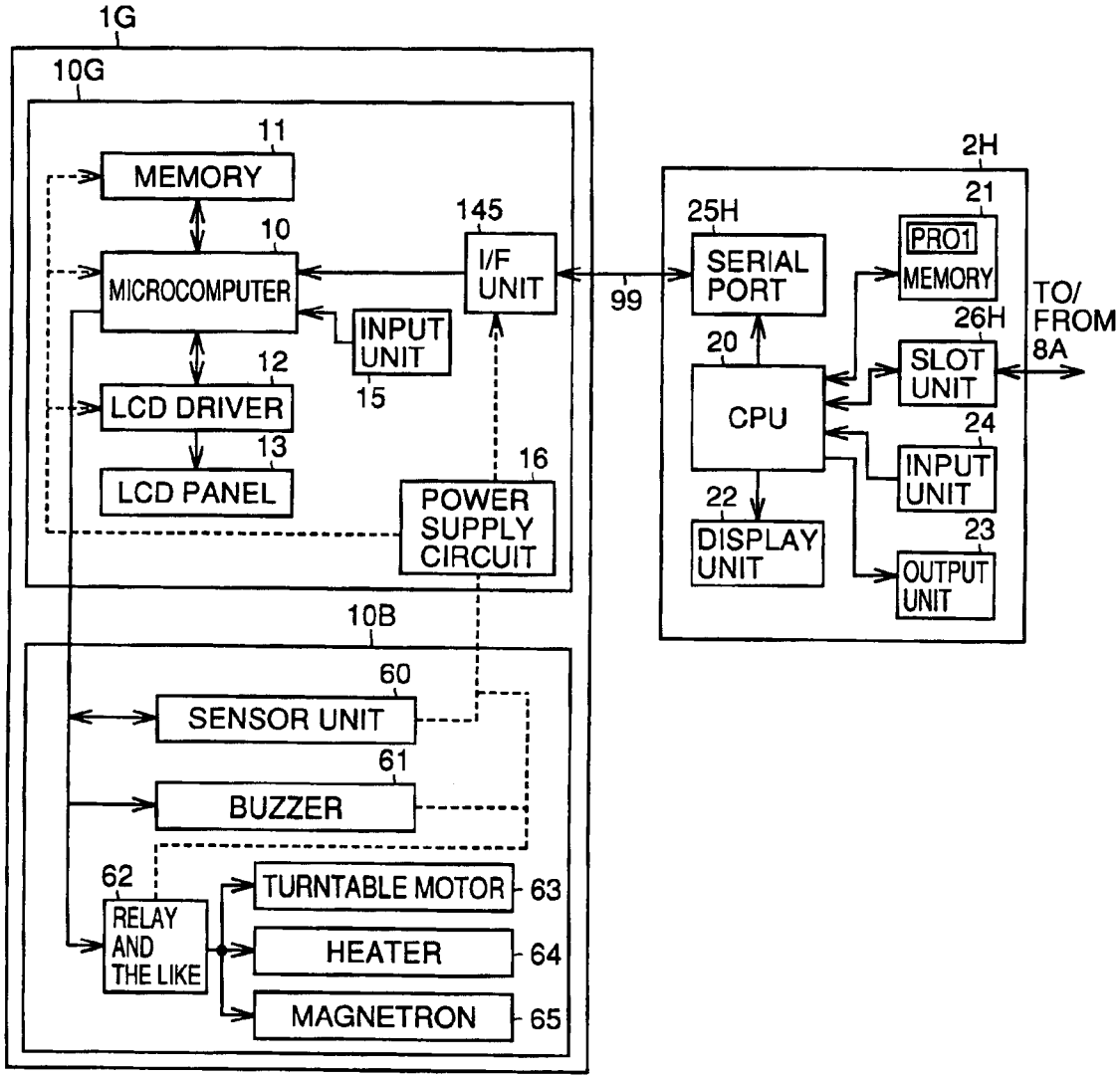
FIG. 62 is a block diagram showing configurations of the microwave oven and the mobile equipment of FIG. 61.

FIG. 61 shows simultaneous connection of PHS telephone and the dedicated cable for the microwave oven to the mobile equipment, in accordance with the seventeenth embodiment. It can be seen from FIG. 61 that mobile equipment 2H is connected to a PHS telephone 8A as well as to a microwave oven IG through a dedicated cable 99, at one time. FIG. 62 shows configurations of the microwave oven and the mobile equipment. In FIG. 62, the configuration of microwave oven 1G is the same as that of FIG. 50. The configuration of the mobile equipment 2H is different from the mobile equipment 2G shown in FIG. 50 in that the mobile equipment 2H additionally has a slot unit 26H for connection with PHS telephone 8A, and that a serial port 25H to which dedicated cable 99 only is connected, in place of serial port 25G. Except this point, the configuration of mobile equipment 2H is the same as that of mobile equipment 2G.

PHS telephone 8A is formed with a terminal portion, not shown, for direct connection to the slot unit 26H of mobile equipment 2H. As the PHS telephone 8A is directly connected to the slot unit 26H, communication therebetween is established.

The operation of the configuration shown in FIG. 61 is the same as that described with reference to the sixteenth embodiment. Further, the telephone is not limited to the PHS telephone 8A, and any portable telephone capable of transmitting/receiving digital information through the Internet may be used.

Eighteenth Embodiment

The eighteenth embodiment will be described in the following.

Figure 63A:
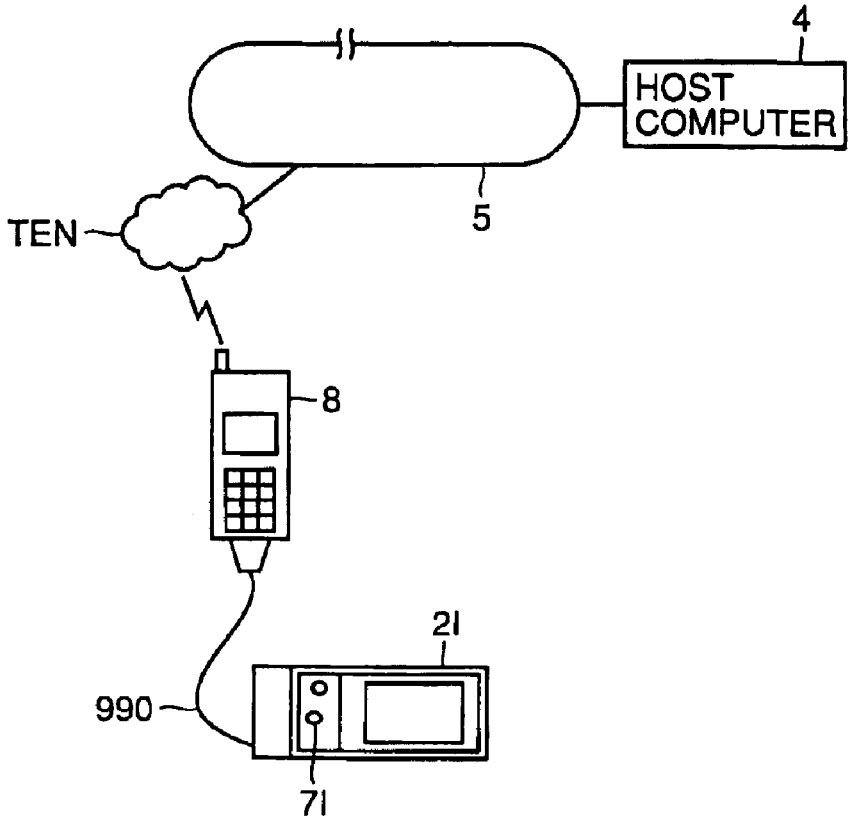
FIGS. 63A and 63B represent the state of communication between the mobile equipment and the microwave oven through IrDA, in accordance with the eighteenth embodiment of the present invention.
Figure 63B:
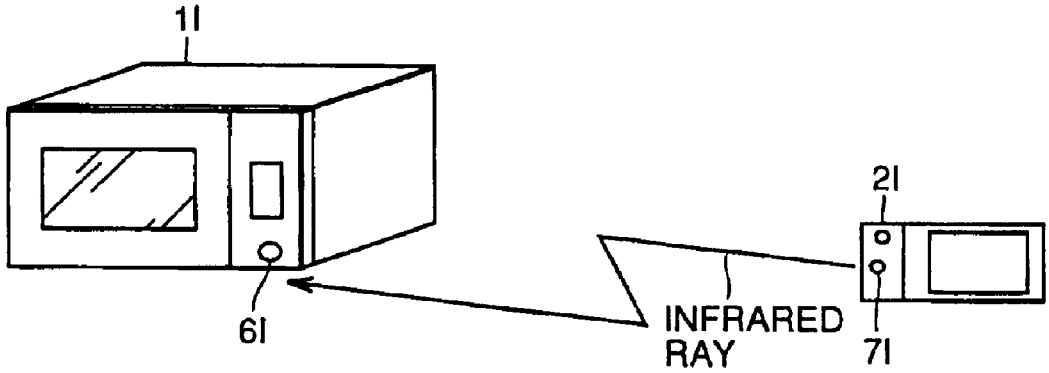
Figure 64:
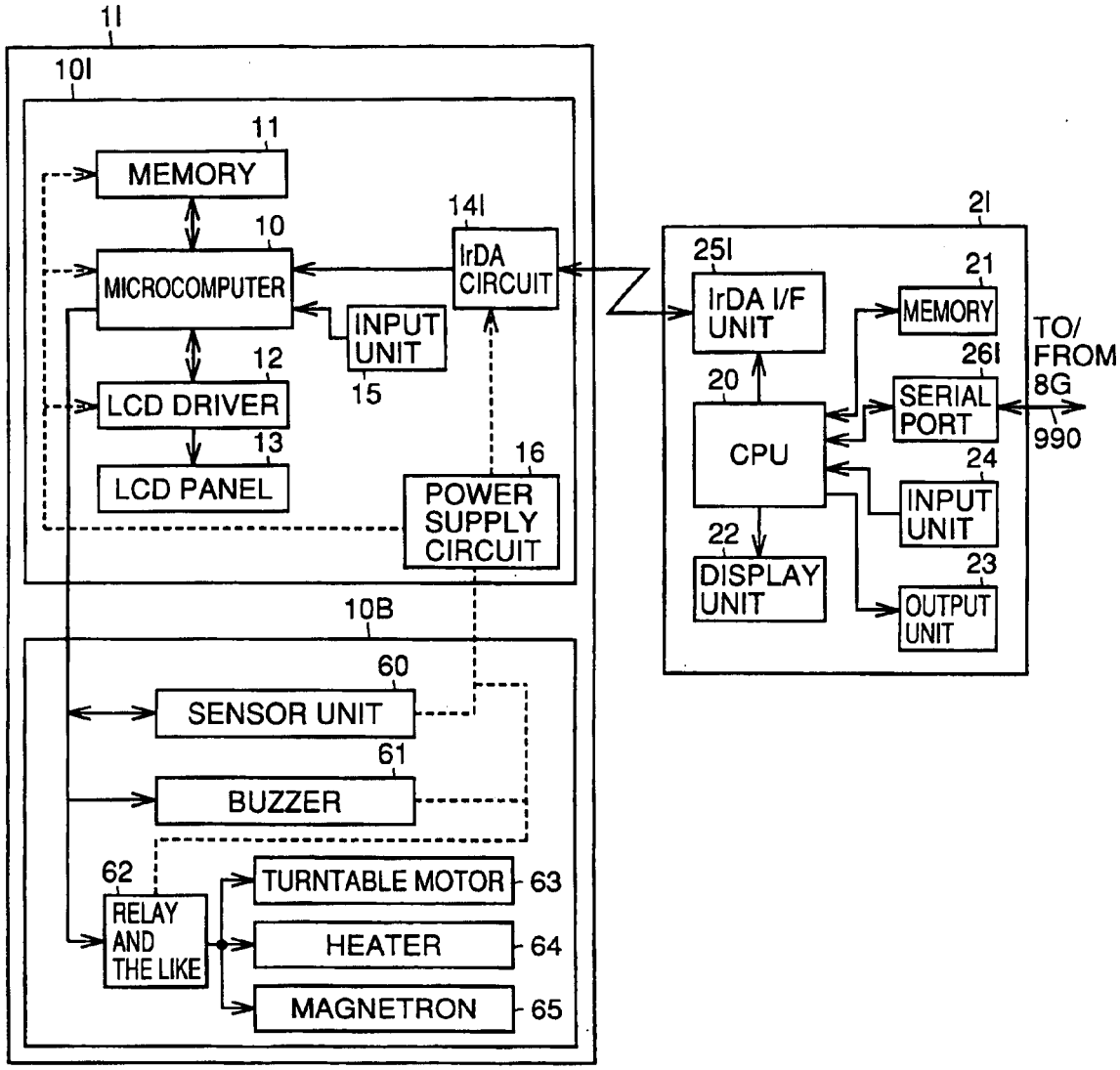
FIG. 64 is a block diagram representing configurations of the microwave oven and the mobile equipment of FIG. 63B.

FIGS. 63A and 63B represent the state of communication between the mobile equipment and the microwave oven through IrDA (nfrared Data Association) in accordance with the eighteenth embodiment of the present invention. FIG. 64 shows the configurations of the microwave oven and the mobile equipment shown in FIG. 63B. The configuration of FIG. 64 differs from that of FIG. 50 in that the microwave oven 11 of FIG. 64 has an IrDA circuit 14I for IrDA communication in place of I/F unit 145 of FIG. 50, and that mobile equipment 2I includes an IrDAI/F unit 25I for IrDA communication and a serial port 26I for connection with cable 990, in addition. Except these points, the configuration is the same as that of FIG. 50.

In the eighteenth embodiment, communication between microwave oven 1I and mobile equipment 2I is established by infrared ray. As the infrared ray communication has narrow directivity, it is necessary that an infrared ray receiving/emitting unit 7I of FIG. 63 driven by IrDAI/F unit 25I of mobile equipment 2I is placed in front of and near the infrared ray receiving/emitting unit 6I shown in FIG. 63 provided on the front page of microwave oven 1I. Infrared ray receiving/emitting unit 6I receives and emits infrared ray, driven by IrDA circuit 14I. In accordance with the present invention, connection of dedicated cable 99 to mobile 2I is unnecessary. Use of a PHS telephone 8A in place of portable telephone 8G is also possible, and in that case, the system can be made simpler.

Nineteenth Embodiment

The nineteenth embodiment will be described in the following.

Figure 65A:
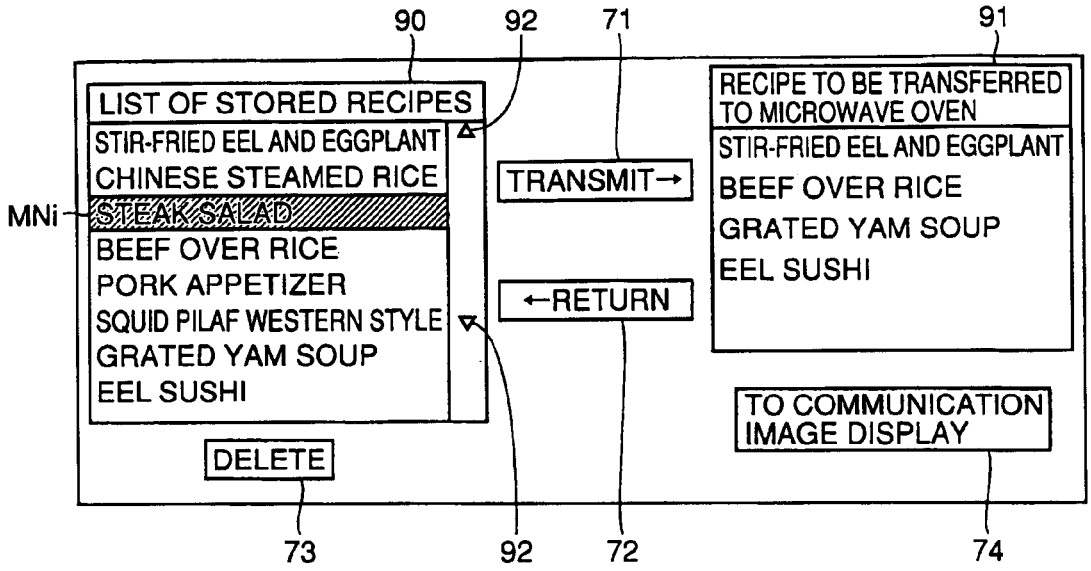
FIGS. 65A and 65B represent examples of the display images for editing, in transferring the cooking recipe information from the mobile equipment to the microwave oven, in accordance with the nineteenth embodiment of the present invention.
Figure 65B:
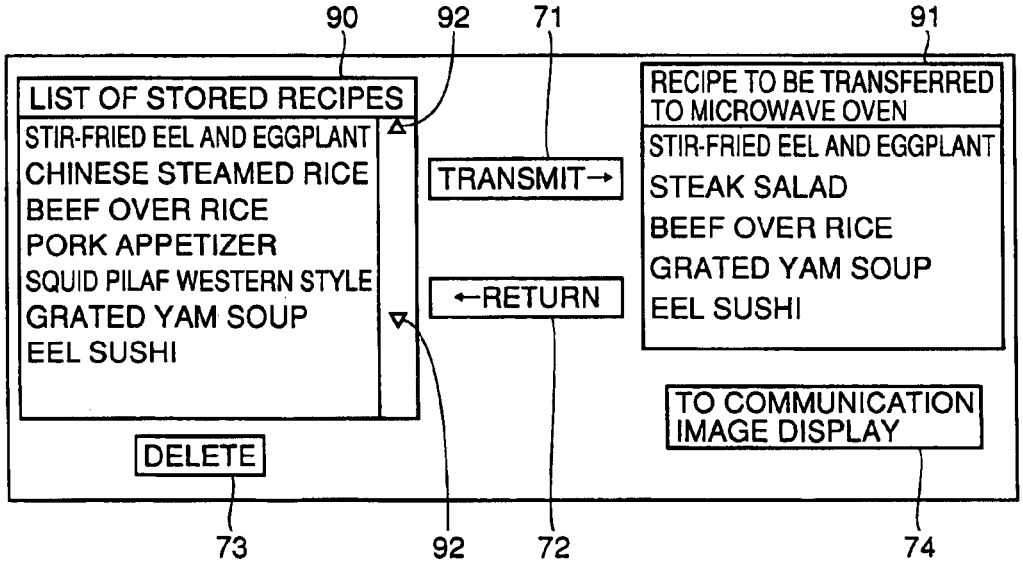
Figure 66A:
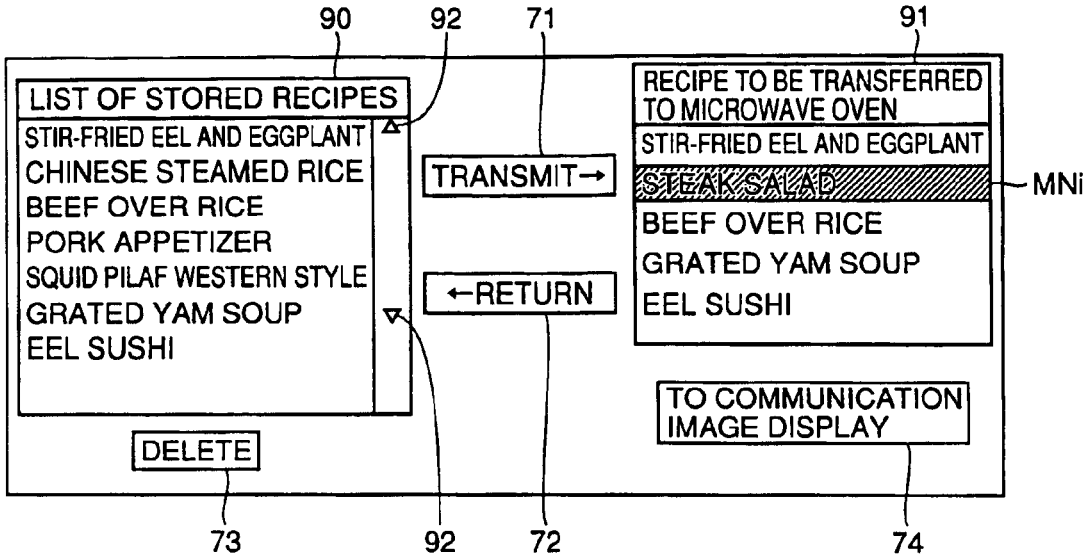
FIGS. 66A and 66B show another example of the display images for editing in transferring the recipe information from the mobile equipment to the microwave oven, in accordance with the nineteenth embodiment of the present invention.
Figure 66B:
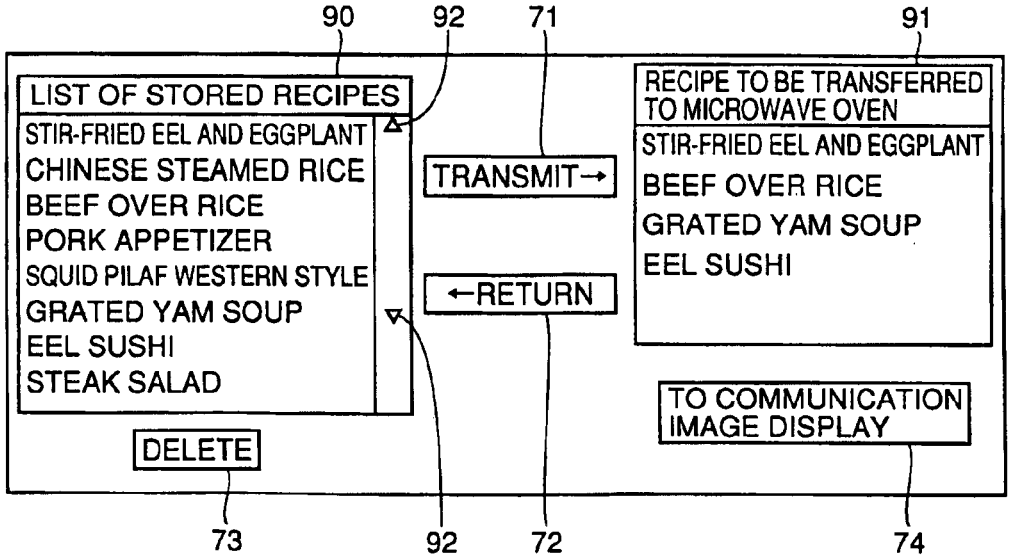

FIGS. 65A and 65B represent examples of the images displayed for editing, in transferring the cooking recipe information from the mobile equipment to the microwave oven, in accordance with the nineteenth embodiment of the present invention. FIGS. 66A and 66B represent other examples of display images for addition, in transferring the cooking recipe information from the mobile equipment to the microwave oven, in accordance with the nineteenth embodiment.

Here, by using any of mobile equipments 2G to 2I, it is possible to obtain up to the full capacity of memory 21, the recipe information MI obtained by accessing the home page "smart cooking", regardless of the capacity limit of memory 11 of microwave ovens 1G to 1I. Mobile equipments 2G to 21 each having a liquid crystal display panel of about 240×320 dots, for example, is provided as a display unit 22, and the recipes downloaded to mobile equipments 2G to 2I can be freely edited on the display screen. The manner of edition is shown in FIGS. 65A and 65B. For simplicity of description, the process between mobile equipment 2G and microwave oven 1G will be described as an example.

The recipe names MNi of respective pieces of recipe information MI downloaded through the Internet 5 to mobile equipment 2G are displayed on the display area 90 of "list of stored recipes" of FIG. 65A. What is displayed on display area 90 is the recipe names MNi of respective ones of all the pieces of recipe information MI downloaded from the home page "smart cooking" to the memory 21 of mobile equipment 2G.

The number of recipe names MNi which can be displayed at one time is limited, because of the limit of display area 90. Therefore, cursors 92 (Δ,▽) of display area 90 is pressed by a pen, so that the recipe names MNi of all pieces of recipe information MI stored in memory 21 of mobile equipment 2G are scrolled. On the display area 91 of "recipe to be transferred to microwave oven", all the recipe names MNi that can be displayed on LCD panel 13 and stored in memory 11 of microwave oven 1G, for example, recipe names MNi of five recipes, are displayed. Therefore, it is necessary on the side of the mobile equipment 2G to select in advance five recipes that can be stored in the memory 11 of microwave oven 1G.

The recipe name MNi which should be transferred from mobile equipment 2G to microwave oven 1G is first selected from the display area 90 of FIG. 65A. For example, when the recipe name MNi "beef steak salad" is to be transferred to microwave oven 1G, "beef steak salad" on display area 90 is pressed by a pen of input unit 24. When the state allows registration in display area 9 i, that is, when the number of recipes MNi displayed on display area 91 is four or less, the display "beef steak salad" of display area 90 is highlighted.

Then, when the "transmission→" button 71 is pressed by the pen, the display "beef steak salad" in display area 90 disappears as can be seen from FIG. 65B, and "beef steak salad" appears in "recipe to be transferred to microwave oven" in display area 91. In this manner, it is possible to transmit the recipe name MNi from display area 90 to display area 91, until five recipe names MNi are displayed on display area 91. Further, by pressing "←return" button 72 by the pen, the reverse operation can be attained.

When five recipe names MNi are already displayed on display area 91, it is not possible to transfer an additional new recipe name MNi to display area 91. In that case, it is necessary to pick up and delete an unnecessary recipe name MNi from the recipe names MNi displayed on display area 91. As an example of this method, the method of deleting recipe name MNi "beef steak salad" will be described with reference to FIGS. 66A and 66B.

First, when the recipe name MNi "beef steak salad" in display area 91 of FIG. 66A is selected by pressing by a pen, the selected display "beef steak salad" is highlighted.

Thereafter, when "←return" button 72 is pressed by the pen, the display "beef steak salad" in display area 91 disappears and the display "beef steak salad" appears in display area 90. As a result, there is one free area for displaying the recipe name MNi in display area 91. Therefore, by the method shown in FIGS. 65A and 65B, a new recipe name MNi can be transmitted from display area 90 to the free area.

Twentieth Embodiment Twentieth embodiment will be described in the following.

Figure 67A:
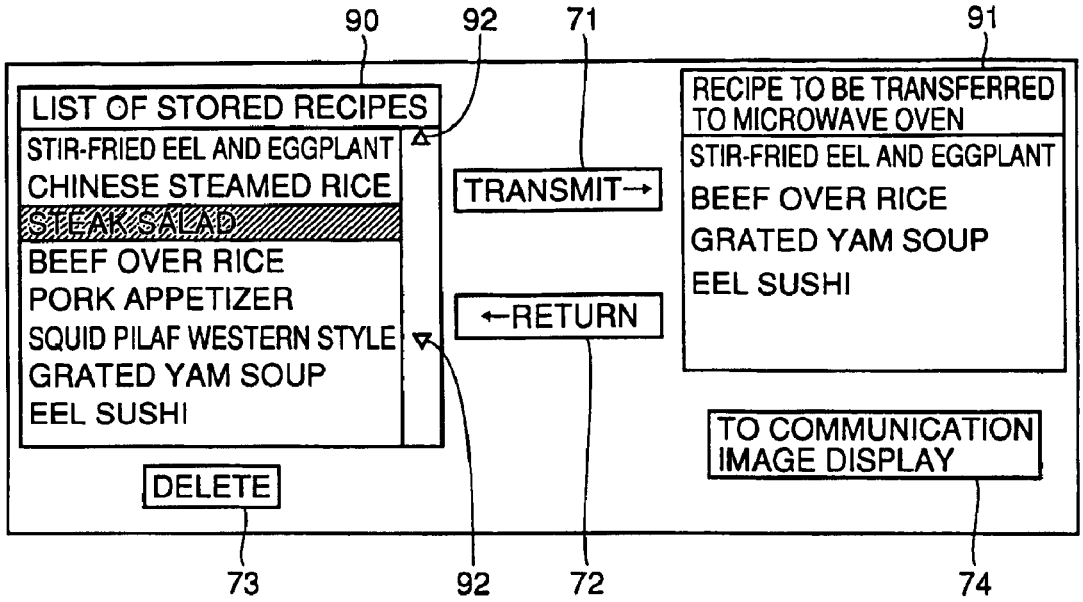
FIGS. 67A and 67B represent examples of image display when the data of a cooking recipe is to be deleted from the memory of the mobile equipment in accordance with the twentieth embodiment of the present invention.
Figure 67B:
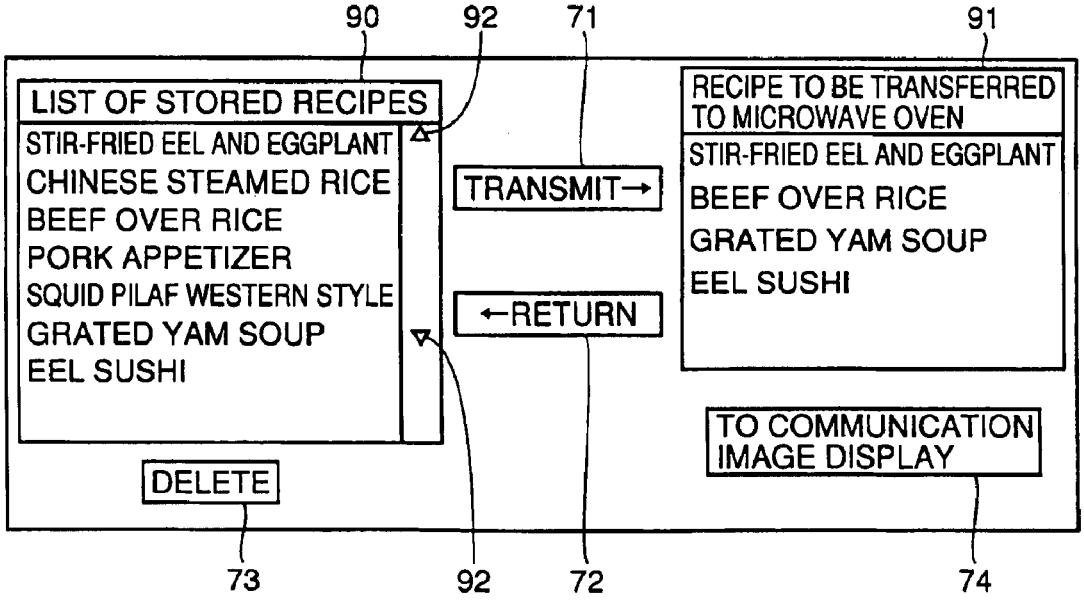

FIGS. 67A and 67B represent examples of the displays when data of the cooking recipe is to be deleted from the memory of the mobile equipment in accordance with the twentieth embodiment. For simplicity of description, process between the mobile equipment 2G and microwave oven 1G will be described here as an example. The processes between mobile equipments 2H and 2I and microwave ovens 1H and 1I are the same.

In order to organize the data of cooking recipes stored in memory 21 or to store other program for data in memory 21 of mobile equipment 2G, it may be necessary to delete recipe information MI of unnecessary cooking recipe from memory 21. The procedure of deleting the recipe information MI will be described with reference to FIGS. 67A and 67B, taking deletion of recipe information MI of recipe name MNi "beef steak salad" as an example.

When the recipe name MNi "beef steak salad" to be deleted is pressed by a pen on display area 90 of FIG. 67A, the display "beef steak salad" is highlighted, and the user presses "delete" button 73 by the pen. Thus, the display of "beef steak salad" is deleted from the display area 90, as can be seen from FIG. 67B.

When the recipe name MNi to be deleted is in the display area 91, what is necessary is to return the unnecessary recipe name MNi from display area 91 to display area 90 by using "←return" button 72 in accordance with the method described with reference to the nineteenth embodiment, and perform the procedure of deletion using "delete" button 73 as described above.

By the above described series of operations for deletion, the recipe information MI which has been down-loaded in memory 21 corresponding to the recipe name MNi deleted from display area 90 is deleted, and corresponding free area is provided in memory 21.

Twenty-First Embodiment

The twenty-first embodiment will be described in the following.

Figure 68A:
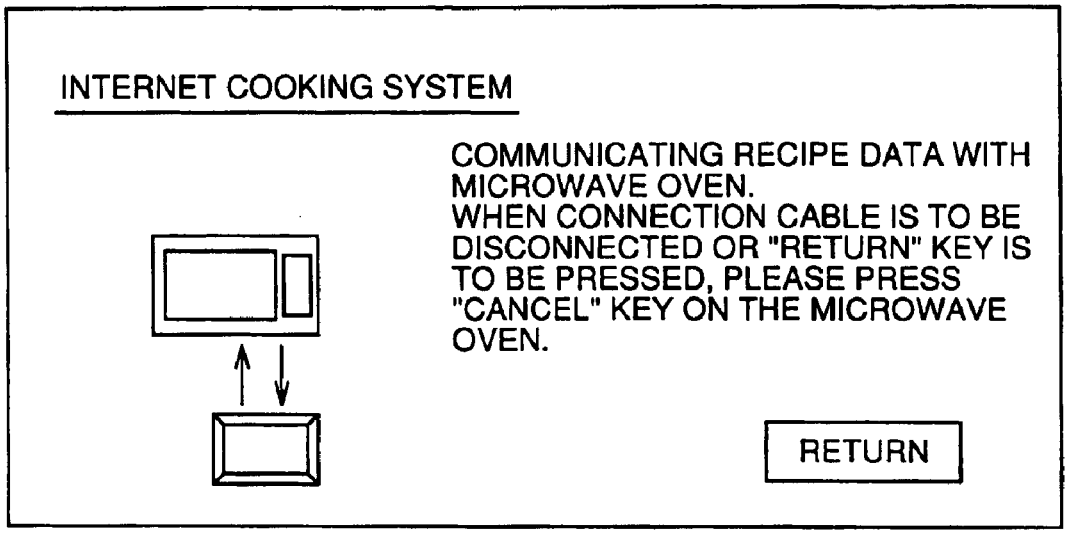
FIGS. 68A and 68B represent examples of images displayed for communication standby in accordance with the twenty-first embodiment of the present invention.
Figure 68B:
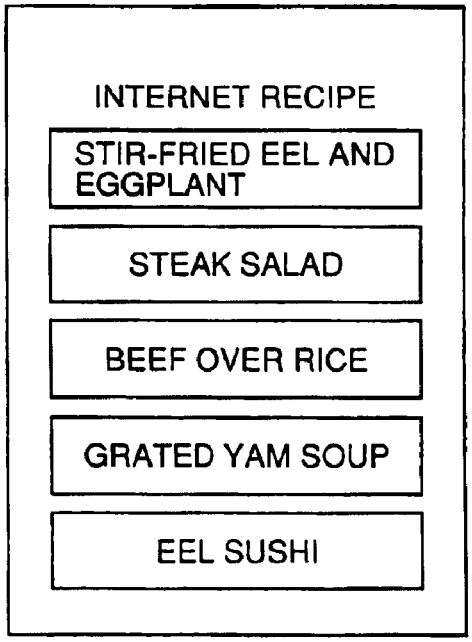

In mobile equipment 2G, where there are a request of recipe name editing process and a request for communication from microwave oven 1G at one time, a display for communication standby appears on mobile equipment 2G in the present embodiment, in order to prevent any malfunction caused by multiple processing of programs. FIGS. 68A and 68B as well as 69A and 69B represent examples of images displayed for communication standby, in accordance with the twenty-first embodiment of the present invention.

Though a process between mobile equipment 2G and microwave oven 1G will be described for simplicity of description, the process is the same between mobile equipment 2H and 2I and microwave ovens 1H and 11.

After the edition of recipe names MNi shown in FIG. 59 is completed and "to communication image display" button 74 is pressed by the pen, the communication standby display shown in FIG. 60 appears. Here, the image display is maintained until there is a communication request from microwave oven 1G. In this display, a message is given urging the user that the portable telephone 8G used for accessing the Internet 5 is removed from mobile equipment 2G and microwave oven 1G is to be connected using dedicated cable 99.

When the display of FIG. 60 is displayed on mobile equipment 2G and the user presses the internet key "i" (not shown) at input unit 15 of microwave oven 1G, at most five recipe names MNi to be displayed on microwave oven 1G are requested from microwave oven 1G to mobile equipment 2G. Upon reception of the request, mobile equipment 2G transmits at most five recipe names MNi displayed on display area 91 of FIG. 59 to microwave oven 1G. The display screen of FIG. 2G is switched to the image of FIG. 68A, and the display of microwave oven 1G is switched to the image of FIG. 68B.

Figure 69A:
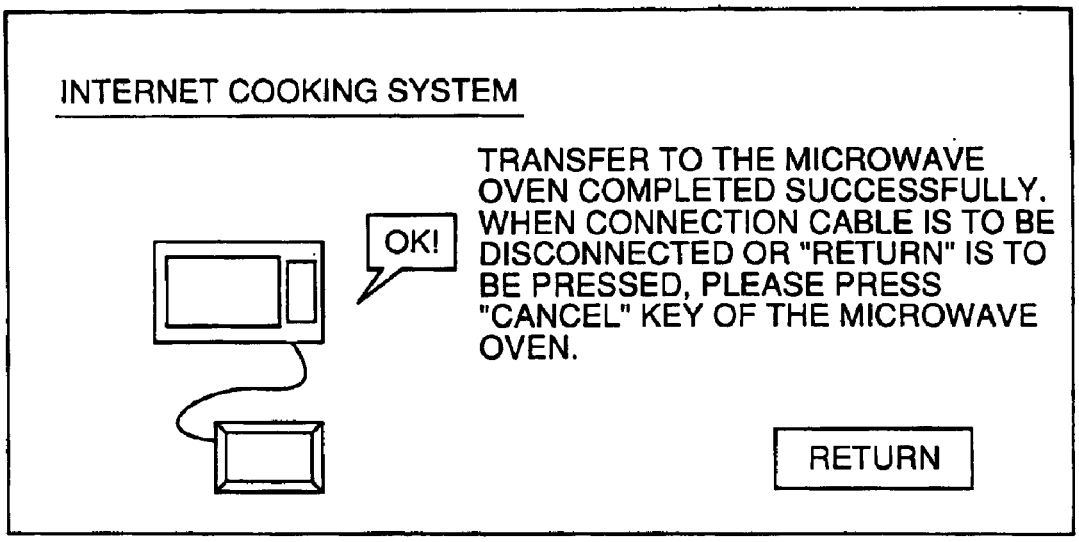
FIGS. 69A and 69B represent examples of images displayed for communication standby in accordance with the twenty-first embodiment of the present invention.

When the user presses the desired recipe name MNi on the display of FIG. 68B displayed on microwave oven 1G, for example, "stir-fried eel and eggplant", the display of mobile equipment 2G is switched to the image of FIG. 69A, and microwave oven IG requests recipe information MI of "stir-fried eel and eggplant" to mobile equipment 2G.

Figure 69B:
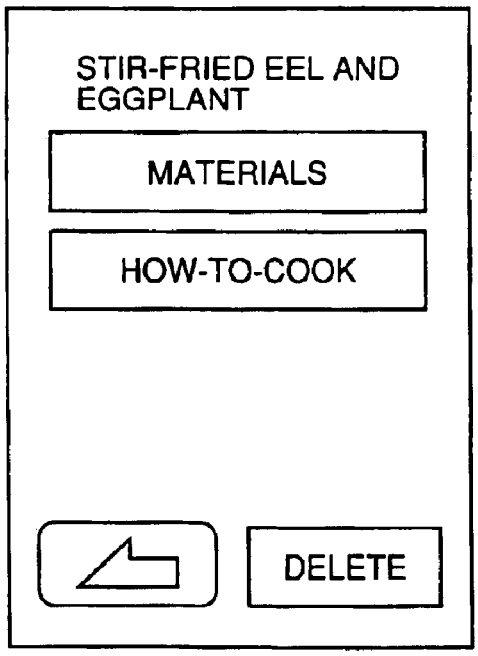

In accordance with the request of menu information MI from microwave oven 1G, recipe information MI of "stir-fried eel and eggplant" is read from memory 11 of mobile equipment 2G and transmitted to the microwave oven 1G. Upon reception of the recipe information MI, the image of FIG. 69B is displayed on microwave oven 1G, based on the received recipe information MI. In the image of FIG. 69B, the material data IIDi and the how-to-cook data JDi representing the procedure of arrangement and the like of "stir-fried eel and eggplant" are displayed, based on display data DS13 of the received recipe information MI. Thereafter, cooking operation by the microwave oven IG takes place, based on the heating data DS14 of the received recipe information MI.

Twenty Second Embodiment

The twenty-second embodiment will be described in the following.

Figures 70A, 70B:
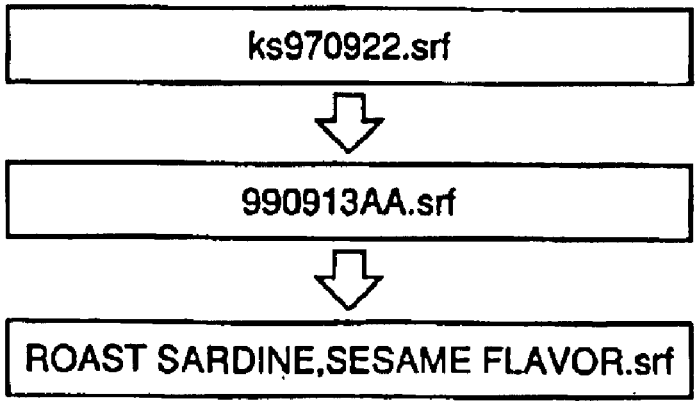
FIGS. 70A and 70B are illustrations related to an example of recipe information downloaded to the mobile equipment and file names allotted thereto in accordance with the twenty-second embodiment of the present invention.
Figure 71:
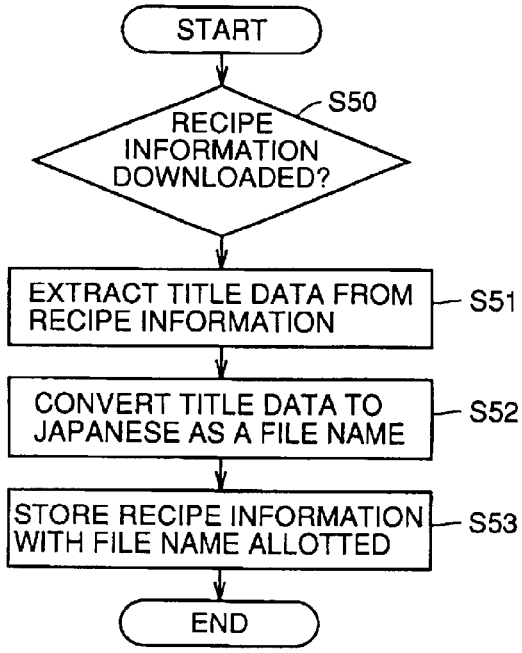
FIG. 71 is a process flow chart in accordance with the twenty-second embodiment of the present invention.

FIGS. 70A and 70B represent examples of the recipe information MI down-loaded to the mobile equipment and file names allotted thereto, in accordance with the twenty-second embodiment of the present invention. FIG. 71 is a flow chart of the process in accordance with the twenty-second embodiment. For simplicity of description, the process between the mobile equipment 2G and microwave oven 1G will be described as an example. The process between mobile equipments 2H and 2I and microwave ovens 1H and 1I are the same.

The mobile equipment 2G of which characteristics are small size, light weight and low cost, is inferior to a general personal computer in the memory capacity and the processing speed. Therefore, in memory 21 of mobile equipment 2G, hierarchical storage of data does not take place. Therefore, the data down-loaded to memory 21 are all stored in the same level. At this time, when a recipe information MI of a certain cooking recipe is to be down-loaded from the Internet 5 to mobile equipment 2G in the manner as described with reference to the sixteenth embodiment and the data having the same name as the recipe information MI already exists on the memory 21 of mobile equipment 2G, as is commonly experienced in a personal computer, is not possible. Therefore, in mobile equipment 2G, when the recipe information MI is down-loaded to the memory 21, generally, the date of downloading is automatically allotted as the name of the recipe information MI.

FIG. 70A shows an example of recipe information MI. The recipe information MI is for the cooking recipe "sardine grilled with salt and sesame". The recipe information MI includes an extension code 81 representing format number and information of the last address of the data, address information 82, title data 83 for giving a display of recipe name MNi of the cooking recipe on microwave oven 1G, heating data 84 and control data 85.

Address information 82 represents an address of title data 83, address of heating data 84, and head and last addresses of control data 85 and heating data 84.

The heating data 84 includes data of the number of stages of heating, heating information, heating mode, power code, and time of heating (minutes, seconds).

The heating data 84 and the control data 85 correspond to the heating data DS14 for controlling the operation of heating and cooking by the heating unit 10B of microwave oven 1G.

The display data 86 is the data to be displayed on LCD panel 13 of microwave oven 1G, which corresponds to display data DS13.

Referring to FIGS. 70A, 70B and 71, the process in the mobile equipment 2G will be described.

Assume that the file name of recipe information MI of FIG. 70A is "ks970922.srf" in the home page "smart cooking". When the recipe information MI is down-loaded to mobile equipment 2, the file name is changed to "990913AA.srf" as can be seen from FIG. 70B. Therefore, the user cannot recognize what recipe information of what cooking recipe it is, from the file name. Further, the file name "ks970922.srf" on the home page does not give any information as to what cooking recipe, to the user.

Therefore, the CPU 20 of mobile equipment 2G performs the following process. First, when recipe information MI is down-loaded (S50 of FIG. 71), title data 83 corresponding to the recipe name MNi is extracted from the recipe information MI, and converts the data to the character sequence data of Japanese "IWASHI NO GOMAYAKI, srf" (sardine grilled with salt and sesame), as can be seen from FIG. 70B (S51, S52). The character sequence data is allotted to recipe information MI as the file name, and the recipe information MI is stored in memory 21 (S53).

Therefore, the recipe name MNi displayed as "sardine grilled with salt and sesame" on the home page is displayed by the recipe name of Japanese character sequence on the display image of display unit 22 of the mobile equipment 2G. Therefore, it is possible for the user to readily acknowledge that the recipe information M of the cooking recipe selected on the home page is surely stored in memory 21 of mobile equipment 2G.

Twenty-Third Embodiment

The twenty-third embodiment will be described in the following.

In the present embodiment, a method will be described in which recipe information MI of a plurality of cooking recipes downloaded from the Internet 5 to the mobile equipment 2G is classified into a plurality of groups of cooking recipes by the users preference, a name for specifying the group of the cooking recipes is allotted for each group of the cooking recipes, and as a result, extraction of the desired cooking recipe is facilitated.

Figure 73A:
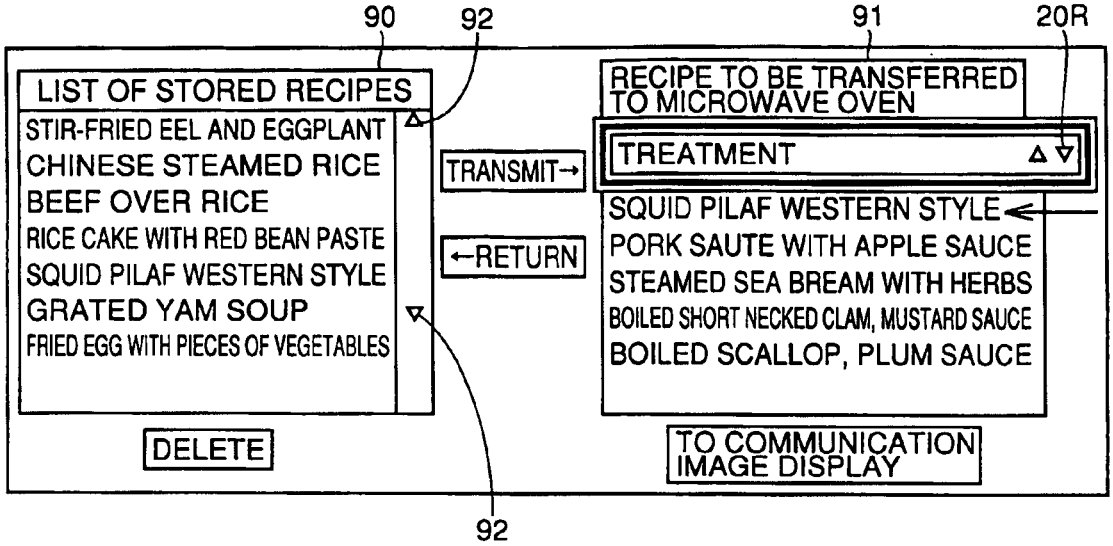
FIGS. 73A to 73D represent examples of display images in which the name of classified group and the corresponding registered recipe names are displayed, in accordance with the twenty-third embodiment of the present invention.
Figure 73B:
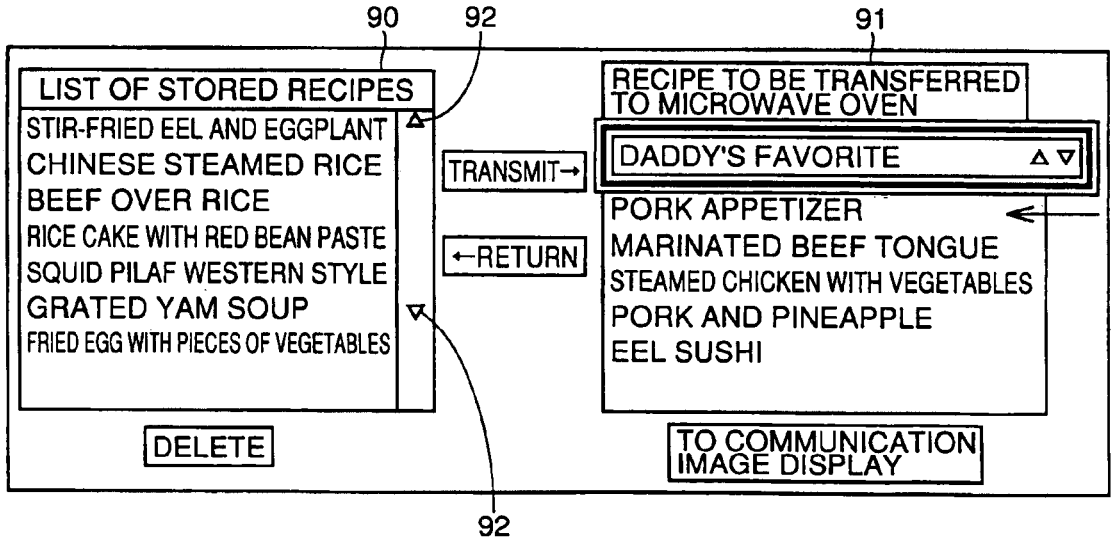
Figure 73C:
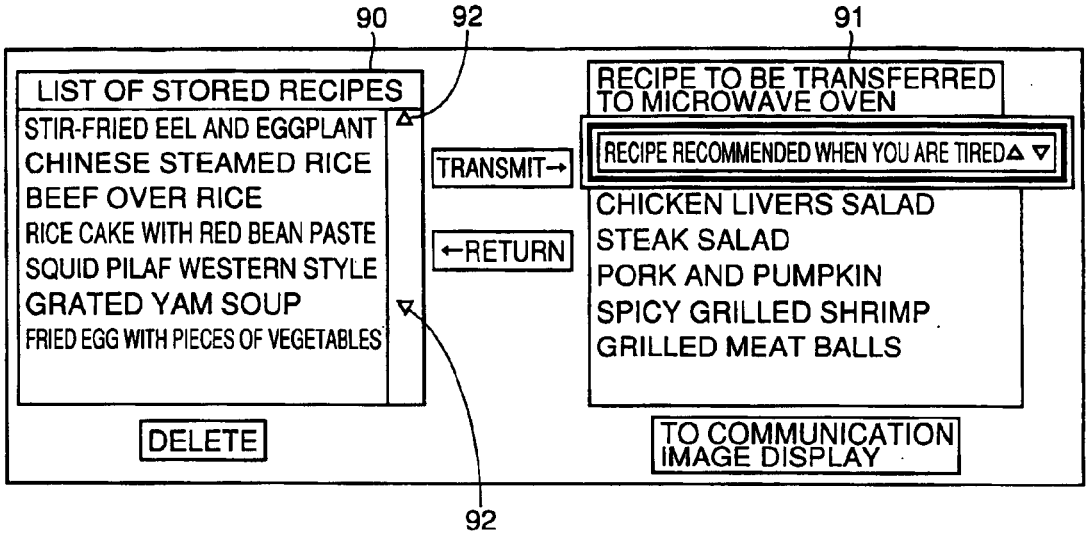
Figure 73D:
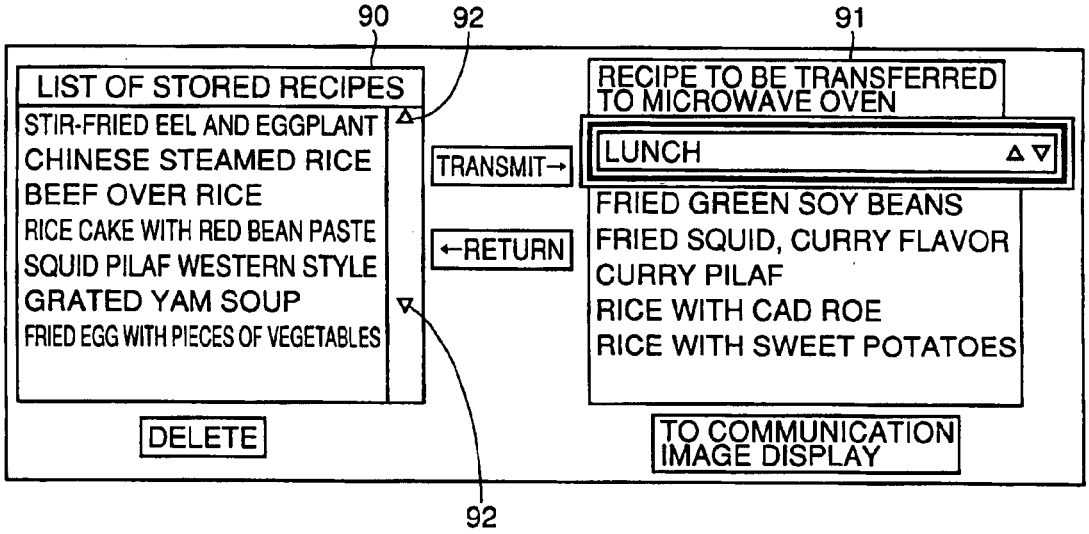
Figure 74:
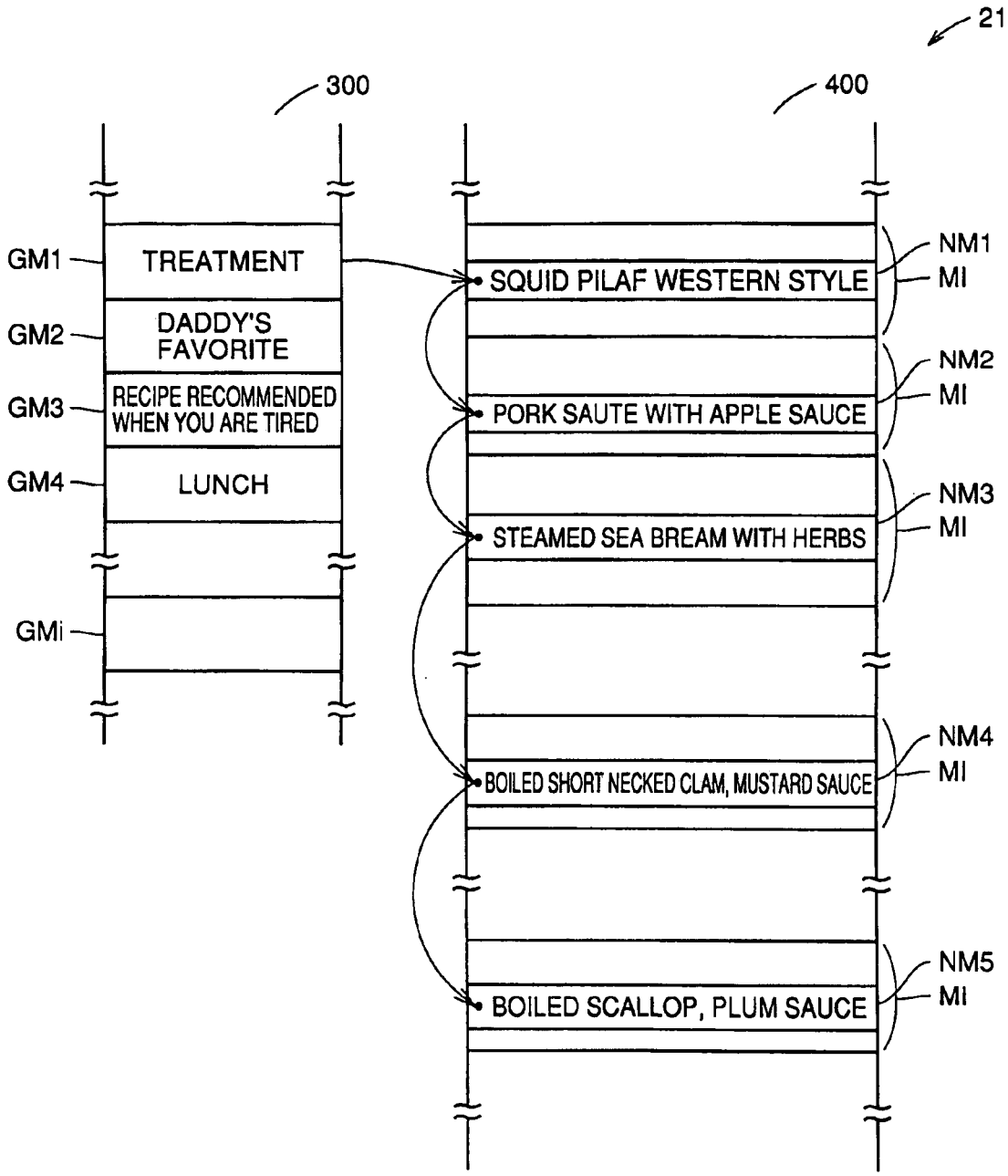
FIG. 74 represents correspondence between the classified groups and the recipe names in the memory of the mobile equipment in accordance with the twenty-third embodiment of the present invention.

FIGS. 72A to 72D represent examples of the images displayed on the display unit of the mobile equipment in accordance with the twenty-third embodiment of the present invention. FIGS. 73A to 73D represent examples of images where respective names of groups and the recipe names MNi registered correspondingly are displayed, in accordance with the present embodiment. FIG. 74 represents a correspondence between the name of groups and the recipe names in the memory of the mobile equipment, in accordance with the twenty third embodiment.

Though a process between mobile equipment 2G and microwave oven 1G will be described for simplicity of description, the process is the same between mobile equipment 2H and 2I and microwave ovens 1H and 1I.

Figure 72A:
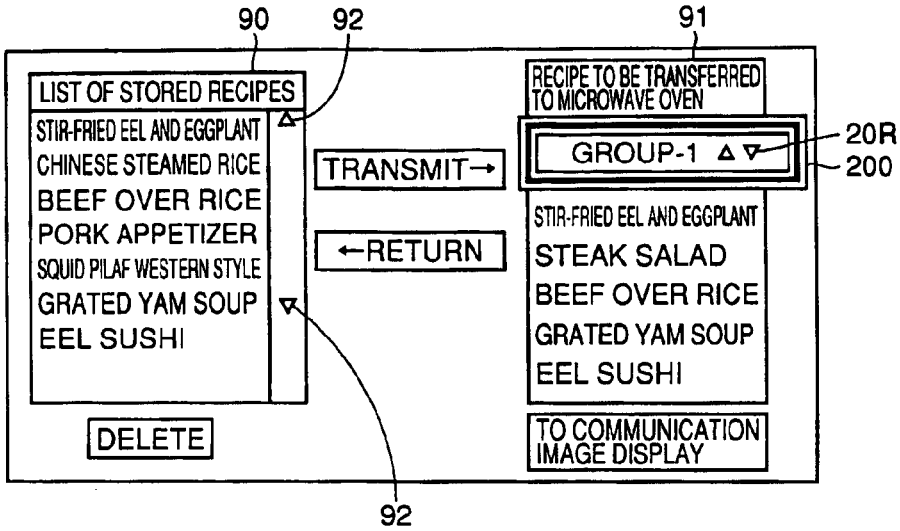
FIGS. 72A to 72D represent examples of images displayed at the display unit of the mobile equipment in accordance with the twenty-third embodiment of the present invention.
Figure 72B:
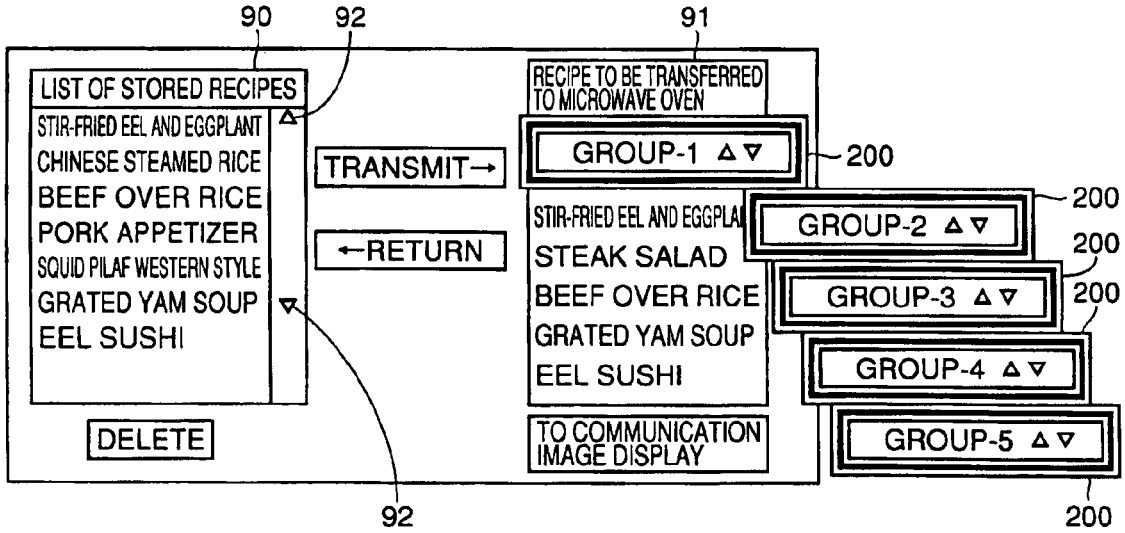

FIG. 72A shows an example of the image displayed after the recipe names MNi are edited in accordance with the procedure described above.

In FIG. 72A, in display area 90, recipe names MNi for respective ones of all the recipe information MI downloaded from the Internet 5 are displayed, and in display area 91, at most five recipe names MNi that can be transferred to microwave oven 1G are displayed.

When the user to pick up a desired cooking recipe on display area 90, it is necessary for the user to press the cursors 92 and search the recipe while the display is scrolled upward/downward. Therefore, when the number of recipes registered in memory 21 is large, it is troublesome to find the desired recipe name. Therefore, in FIG. 72A, a display area 200 for the group name is displayed, associated with the display area 91.

In the display area 200 of the group name, "group-1 Δ▽" is displayed. At this time, every time the cursor "Δ" 20R of display area 200 is pressed, "group-2 Δ▽", "group-3 Δ▽", "group-4 Δ▽" and "group-5 Δ▽ " are switched and displayed in order, in the group name display area 200, as can be seen from FIG. 72B.

Though "group-i Δ▽" to "group-5 Δ▽" are displayed simultaneously for convenience of description, actually, any one of "group-1 Δ▽" to "group-5 Δ▽" is displayed.

Figure 72C:
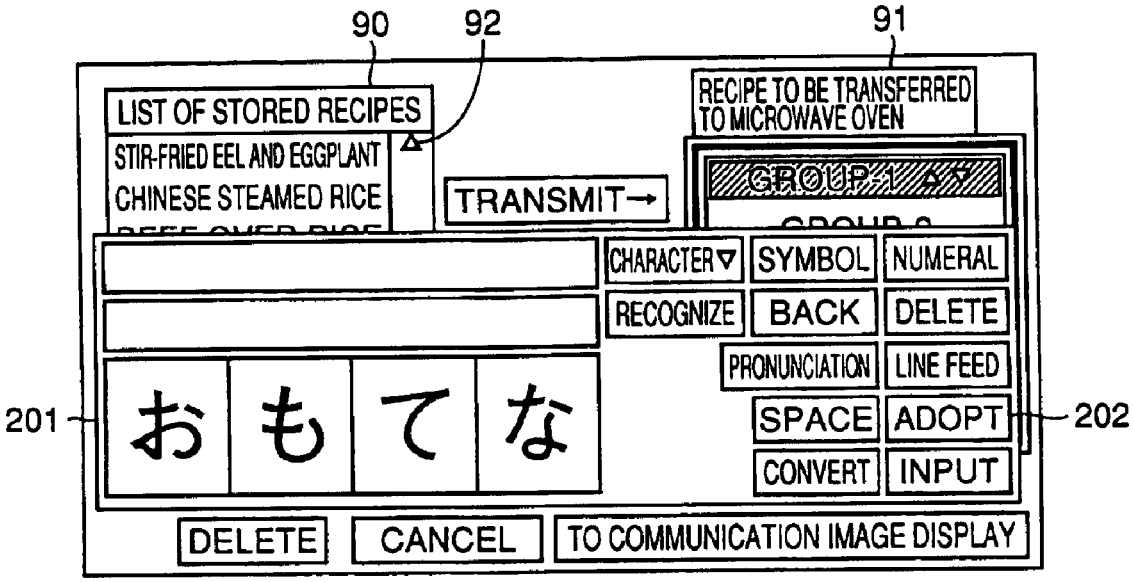

When "group-1 Δ▽" in group name display area 200 of FIG. 72A is to be changed to "おもてなし" (treatment), the user presses the display "group-1" on display area 200 by the pen, and the display image is switched to an image allowing character input of the group name as shown in FIG. 72C, so that the user can input characters for specifying the group name.

The method of character input for the group name on the image display of FIG. 72C utilizes the unique function of mobile equipment 2G itself. In FIG. 72C, the characters "おもてなし" (treatment) are directly written to the character area 201 by the pen. When writing of the characters for the group name is completed and the user presses "adoption" button 202 by the pen, the image is switched to FIG. 72D, and thus registration of the group name is completed. It can be seen from the image of FIG. 72C that the displayed content in display area 200 of the group name related to display area 91 has been updated from "group-1 Δ▽" to "おもてなし" (treatment).

Figure 72D:
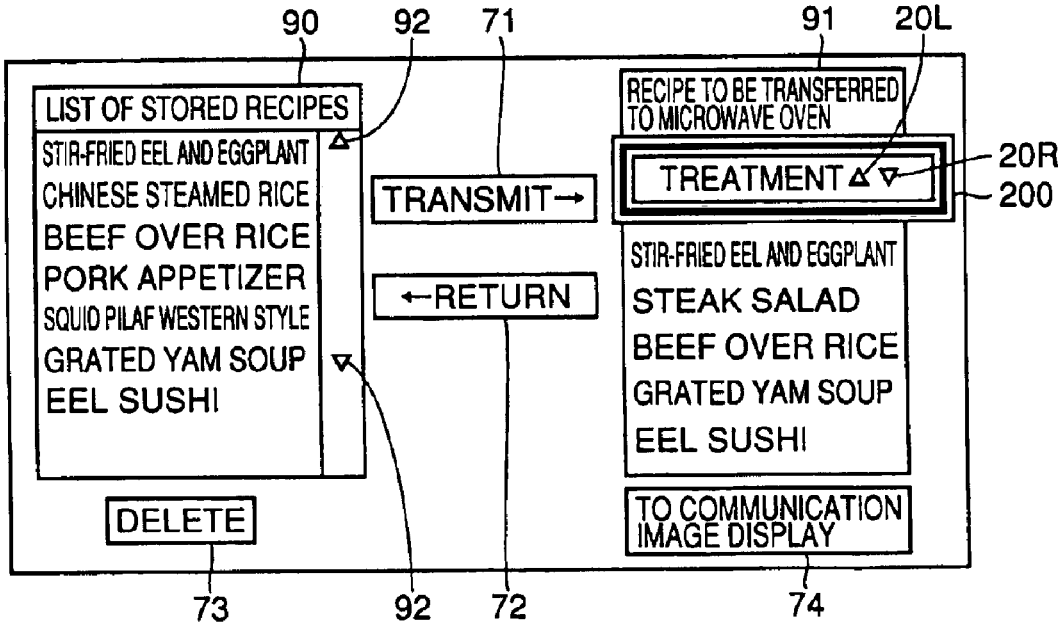

In order to register a recipe name MNi corresponding to the registered group name, the group name "treatment" is displayed in the display area 200 of FIG. 72D, the cursors 92 is operated to select a desired recipe name MNi from the display area 90, and the "transmission→" button 71 is pressed by the pen. In this manner, the recipe name MNi desired by the user is registered, in association with the group name "treatment" in display area 91.

FIGS. 73A to 73D represent examples of images where the desired recipe names MNi are registered for respective group names, in accordance with the procedure described above.

In accordance with the present embodiment, the plurality of recipe names MNi downloaded to the mobile equipment 2G are classified with group names allotted in advance, and therefore, it becomes easier to pick up the frequently cooked recipe or a desired cooking recipe.

More specifically, when the frequently cooked recipes are registered group by group in advance, the desired recipe names MNi will be displayed on the display area 91 simply by switching the group names, and therefore, convenience in operation is remarkably improved. For example, when the recipe name MNi "pork appetizer" denoted by the arrow in FIG. 73B is to be cooked following the recipe name MNi "pilaf squid, Western style" denoted by the arrow in FIG. 73A, what is necessary on the side of the mobile equipment 2G is to simply press the cursor 20R once by the pen to switch the group name on the display area 200 from "treatment" to "Daddy's favorite", so that the recipe information MI of "pork appetizer" is called in microwave oven 1G.

Even if the microwave oven 1G has the capacity of receiving only five pieces of recipe information MI of the cooking recipes, the substantial number of cooking recipes which can be called by the microwave oven 1G can be increased up to the number of cooking recipes which can be stored on the side of the mobile equipment 2G, by switching the group names. Therefore, a very convenient microwave system is obtained.

FIG. 74 shows the correspondence between the recipe names MNi and the group names in memory 21. In the figure, memory 21 includes an area 300 storing the group name data GMi representing the group names, and an area 400 storing all the pieces of downloaded recipe information MI. As can be seen from the figure, the recipe information MI includes the recipe name MNi. By the above described series of operations of classification, the group data GMi in area 300 are associated by the pointer (represented by the arrow in the figure) to the corresponding five recipe names MNi in the area 400, thus providing a list.

As the above described list structure is adopted, reading of the recipe name MNi corresponding to the group name data GMi is facilitated, and change in correspondence of the group name data GMi and the recipe name MNi is also facilitated.

Twenty-Fourth Embodiment

The twenty-fourth embodiment will be described in the following.

In the present embodiment, in order to select a recipe information MI of a cooking recipe which is to be transmitted to and heated and cooked by microwave oven 1G from the plurality of pieces of recipe information MI of the cooking recipes downloaded from the Internet 5 to mobile equipment 2G, a check box is utilized.

Though a process between mobile equipment 2G and microwave oven 1G will be described for simplicity of description, the process is the same between mobile equipment 2H and 21 and microwave ovens 1H and 1I.

Figure 75A:
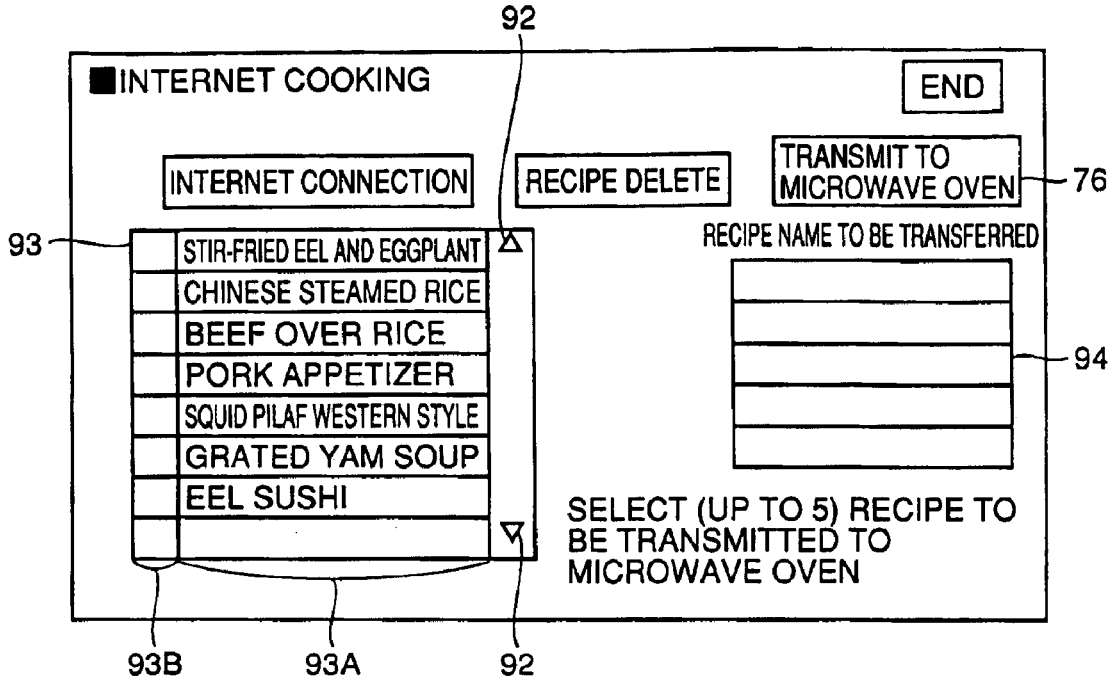
FIGS. 75A to 75C represent examples of display images for selecting a recipe name to be transferred to the microwave oven, in the mobile equipment in accordance with the twenty-fourth embodiment of the present invention.
Figure 75B:
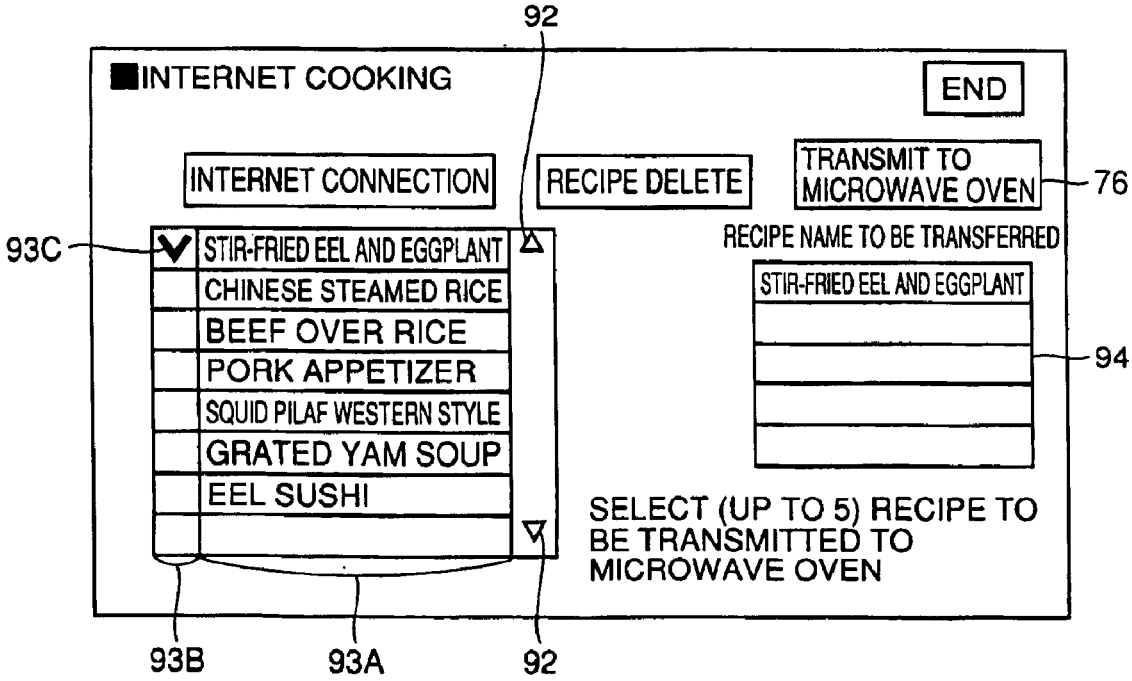
Figure 75C:
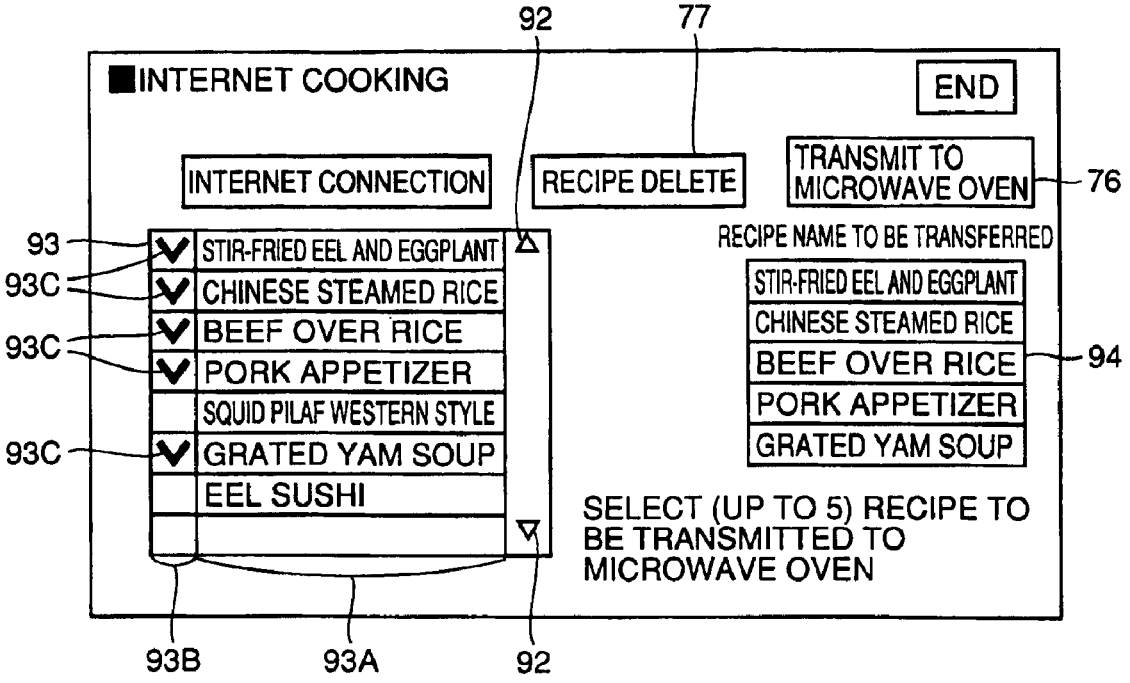

FIGS. 75A to 75C represent examples of the display images for selecting the recipe name to be transmitted to the microwave oven, in the mobile equipment in accordance with the twenty-fourth embodiment of the present invention.

FIG. 75A shows an example of the display on mobile equipment 2G, when a plurality of pieces of recipe information MI are downloaded from the Internet 5 to the mobile equipment 2G. In the figure, the display includes the display area 93B displaying the recipe names MNi of the plurality of pieces of recipe information MI downloaded from the Internet 5 to mobile equipment 2G, a display area 94 displaying five recipe names MNi to be transferred from mobile equipment 2G to microwave oven 1G, and buttons 76 and 77. Here, the recipe name MNi is not at all displayed in display area 94, and therefore data transfer from mobile equipment 2G to microwave oven 1G is not possible.

The display area 93 includes a display area 93A on which all the recipe names MNi downloaded to mobile equipment 2G are displayed, and a display area 93B displaying a check box corresponding to each of the recipe names MNi displayed on display area 93A. In display area 93A, cursors 92 are displayed, which are operated for scrolling the plurality of recipe names MNi.

Here, when the recipe information MI of "stir-fried eel and eggplant" on display area 93*a* is to be transmitted to microwave oven 1G, the check box corresponding to the recipe name MNi "stir-fried eel and eggplant" on FIG. 75B is pressed by the pen of input unit 24. At this time, the check mark "✓" appears in the check box, and the recipe name MNi "stir-fried eel and eggplant" appears on the display area 94. When the same check box is again pressed by the pen, the check mark "✓" is deleted, and the recipe name MNi "stir-fried eel and eggplant" on display area 94 also disappears.

When the recipe names MNi of the cooking recipes of which heating and cooking by the microwave oven IG are selected one after another, the image display will be as shown in FIG. 75C. Though not shown here, it is possible at the timing of switching the images, to rearrange the recipe names such that the recipe names MNi having the check mark "✓" in the corresponding check boxes are positioned continuously from the top, in display area 93A.

Thereafter, when the button 76 for transmitting all the recipe names MNi displayed on the display area 94 on the screen to the microwave oven 1G is pressed, the above described communication standby display appears. The subsequent operation is the same as described above, and therefore, the description is not repeated.

FIGS. 76A to 76C and 77A and 77B represent examples of the images displayed when the desired recipe information MI is deleted from the memory 21 of mobile equipment 2G in accordance with the twenty-fourth embodiment. When the desired recipe information MI is to be deleted from memory 21 of mobile equipment 2G, the user presses the button 77 instructing deletion of recipe information MI from memory 21 in the image display of FIG. 75C by the pen of input unit 24, and the display is switched to the image of FIG. 76A.

Figure 76A:
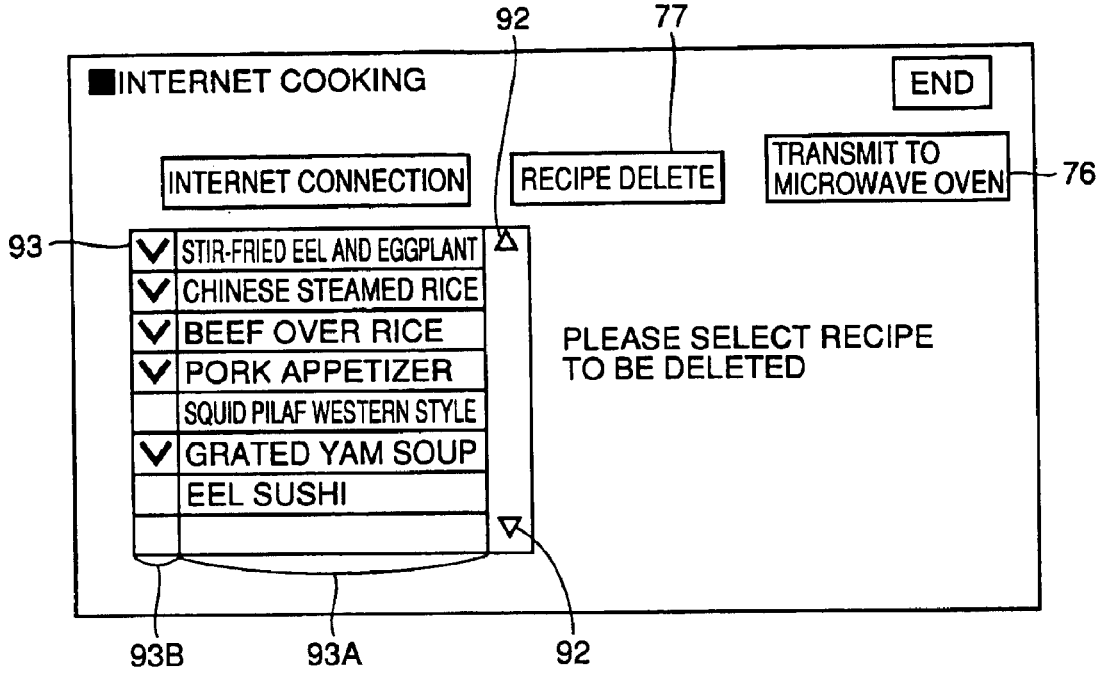
FIGS. 76A to 76C represent examples of display images when a desired recipe information is to be deleted from the memory of the mobile equipment, in accordance with the twenty-fourth embodiment of the present invention.
Figure 76B:
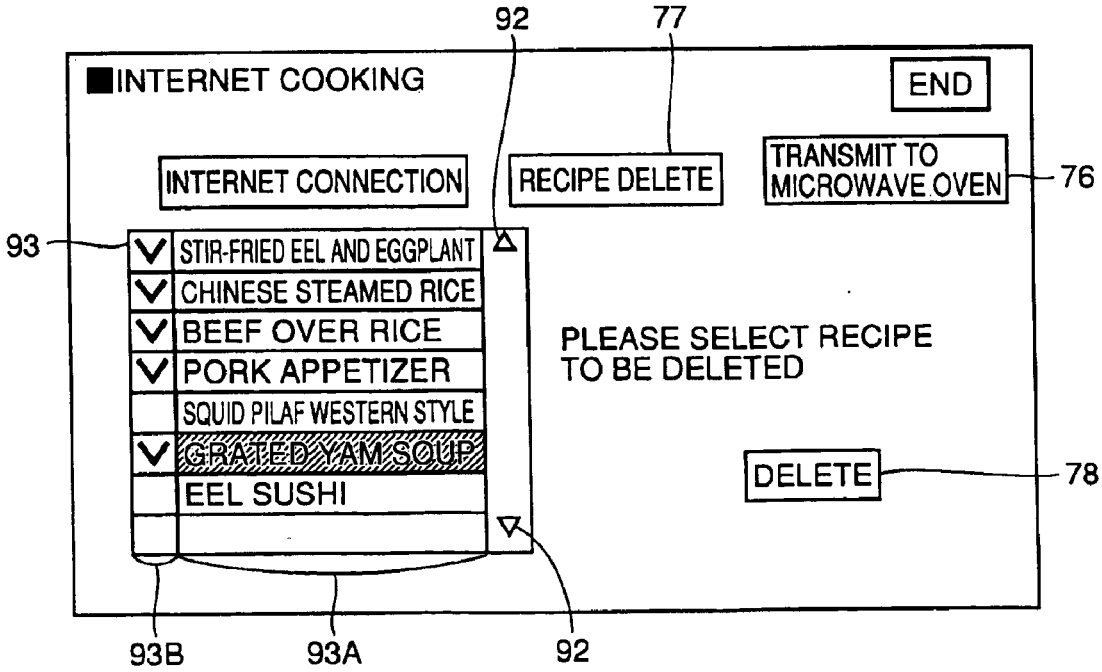

Here, when it is desired to delete the recipe information MI of the recipe name MNi "grated yam soup" from the memory 21 of mobile equipment 2G, the recipe name MNi "grated yam soup" on display area 93A is pressed by the pen for selection. Thus, the recipe name MNi "grated yam soup" is highlighted as shown in FIG. 76B, and a delete key 78 together with a comment appear.

Figure 76C:
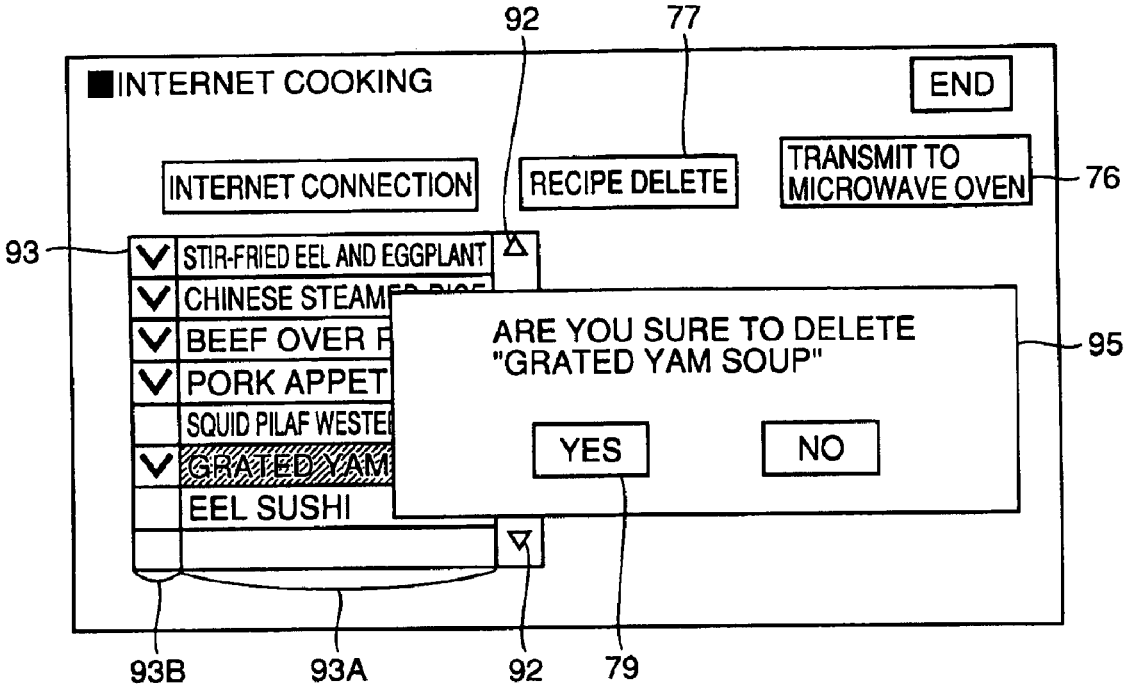

When the delete key 78 is pressed by the pen, the display is switched to the image of FIG. 76C. On the display of FIG. 76C, a message asking whether the recipe information MI of the selected and highlighted recipe name MNi "grated yam soup" is to be deleted or not is given. Here, the user presses the button 79 by the pen, instructing execution of deletion of area 95, and hence the corresponding recipe information MI is deleted from memory 21. When the deletion completes, the display is switched to the image of FIG. 77A, in which a message of deletion complete is given on area 95.

Figure 77A:
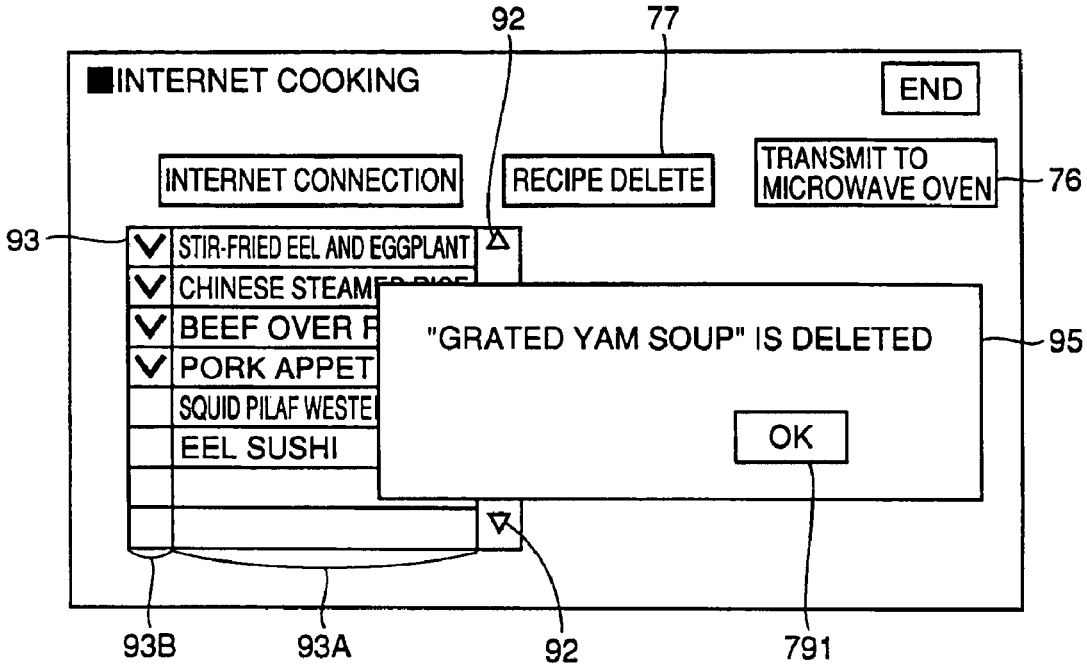
FIGS. 77A and 77B represent examples of the display images when the desired recipe information is deleted from the memory of the mobile equipment in accordance with the twenty-fourth embodiment of the present invention.
Figure 77B:
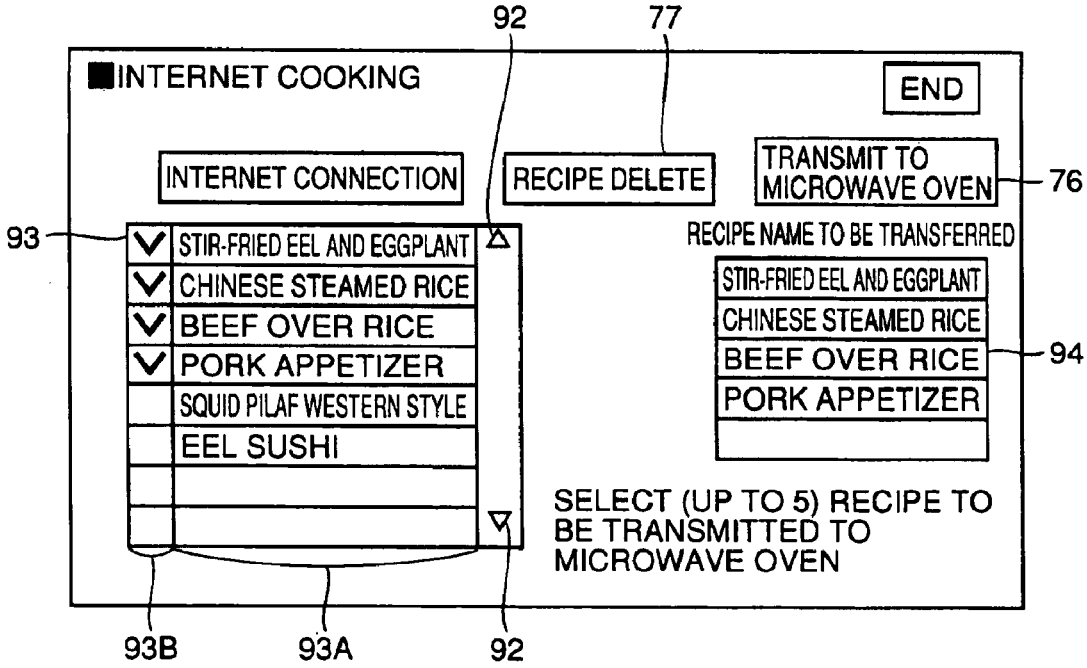

Here, when the button 791 is pressed by the pen, acknowledging completion of deletion, the display is switched to the image of FIG. 77B, and in display areas 93 and 94, the display of recipe name MNi "grated yam soup" disappears. In display area 93 to fill the free area generated by the deletion (the display area of recipe name MNi "grated yam soup"), the recipe names MNi are displayed moved one by one upward.

In this manner, by using check boxes, the recipe name MNi which is to be transmitted to microwave oven 1G can be selected easily.

Twenty-Fifth Embodiment

The twenty-fifth embodiment will be described in the following.

In accordance with the present embodiment, recipe names MNi of all the pieces of recipe information MI downloaded from the Internet to the mobile equipment 2G are displayed at one time on the image display, and by simply selecting the desired recipe name MNi from the displayed all recipe names MNi by pressing with a pen, the recipe name MNi to be transferred from the mobile equipment 2G to microwave oven 1G can be selected.

FIGS. 78A and 78B are examples of the images displayed for selecting the recipe name to be transferred to the microwave oven 1G, given on mobile equipment 2G in accordance with the twenty-fifth embodiment of the present invention.

FIG. 78A shows an example of images displayed on mobile equipment 2G after a plurality of pieces of recipe information MI are downloaded to the mobile equipment 2G from the Internet 5.

Though a process between mobile equipment 2G and microwave oven 1G will be described for simplicity of description, the process is the same between mobile equipment 2H and 2I and microwave ovens 1H and 1I.

Here, it is assumed that the number of pieces of recipe information MI that can be stored in memory 21 of mobile equipment 2G is limited to 30. FIG. 78A shows a state where 27 pieces of recipe information MI are stored in memory 21 of mobile equipment 2G. On the image of FIG. 78A, an area 96 and buttons 76 and 771 are displayed In area 96, all the downloaded recipe names MNi are displayed at one time. When the recipe name MNi to be transmitted to microwave oven 1G is selected by pressing with a pen at input unit 24 among all the recipe names MNi displayed in area 96, the selected recipe name MNi is highlighted, and the display is switched to the image of FIG. 78B, for example.

When the button 76 is pressed by the pen to transmit the selected recipe names MNi to the microwave oven 1G, the above described communication standby image appears. The following processes are the same as those described above, and hence, description is not repeated.

FIGS. 79A to 79D represent examples of images displayed when the desired recipe information MI is to be deleted from the plurality of pieces of recipe information MI downloaded to the mobile equipment 2G, in accordance with the twenty-fifth embodiment.

Figure 79A:
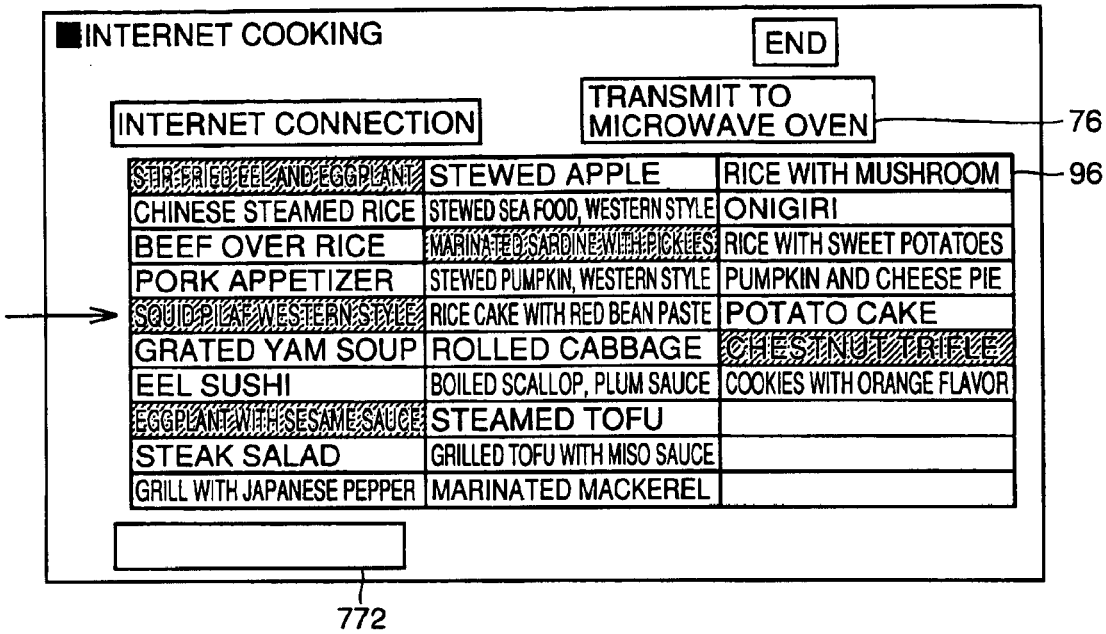
FIGS. 79A to 79D represent examples of the images displayed when a desired recipe information is to be deleted from a plurality of recipe informations downloaded to the mobile equipment, in accordance with the twenty-fifth embodiment of the present invention.

When the desired recipe information MI is to be deleted from memory 21, the button 771 of FIG. 78B is pressed by the pen, so that the display is switched to the image of FIG. 79A. On the image of FIG. 79A, area 96 and buttons 76 and 772 are displayed. Button 772 is pressed when the process of deleting recipe information MI is to be stopped.

When the recipe information MI is to be deleted from memory 21, selection of the recipe name MNi corresponding to the recipe information MI to be deleted can be performed regardless of the highlighted display, in area 96.

Figure 79B:
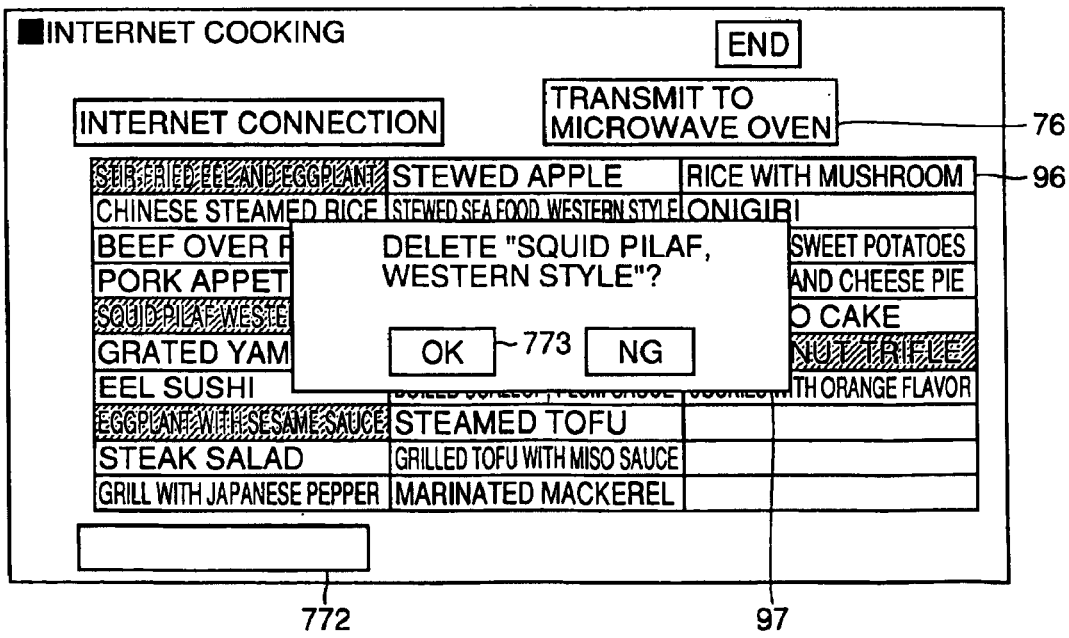
Figure 79C:
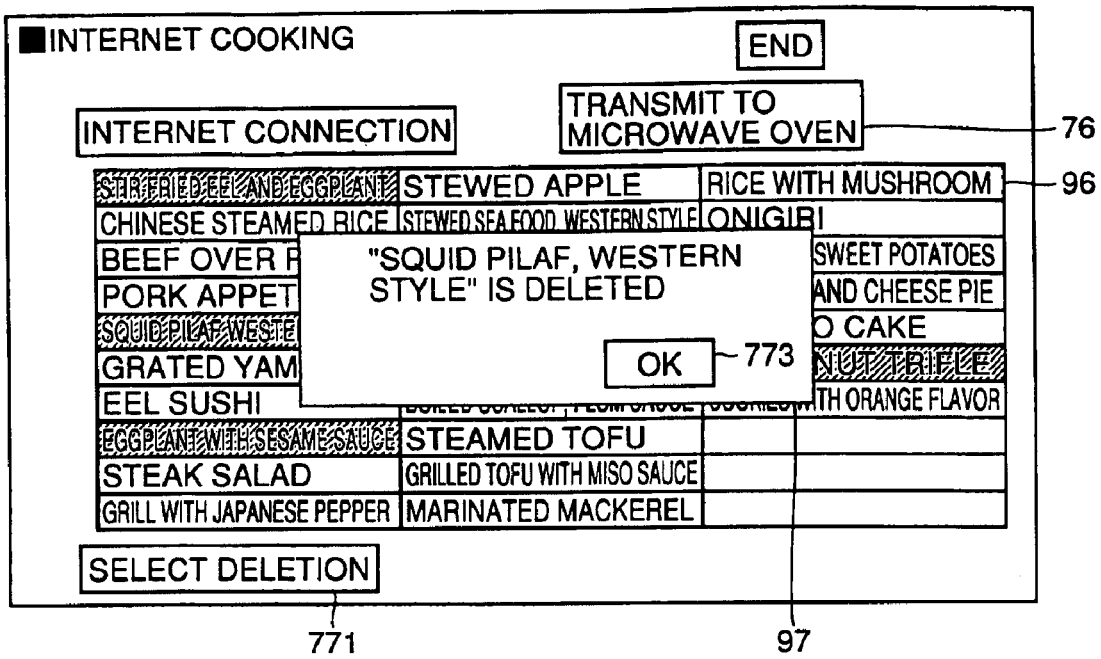
Figure 79D:
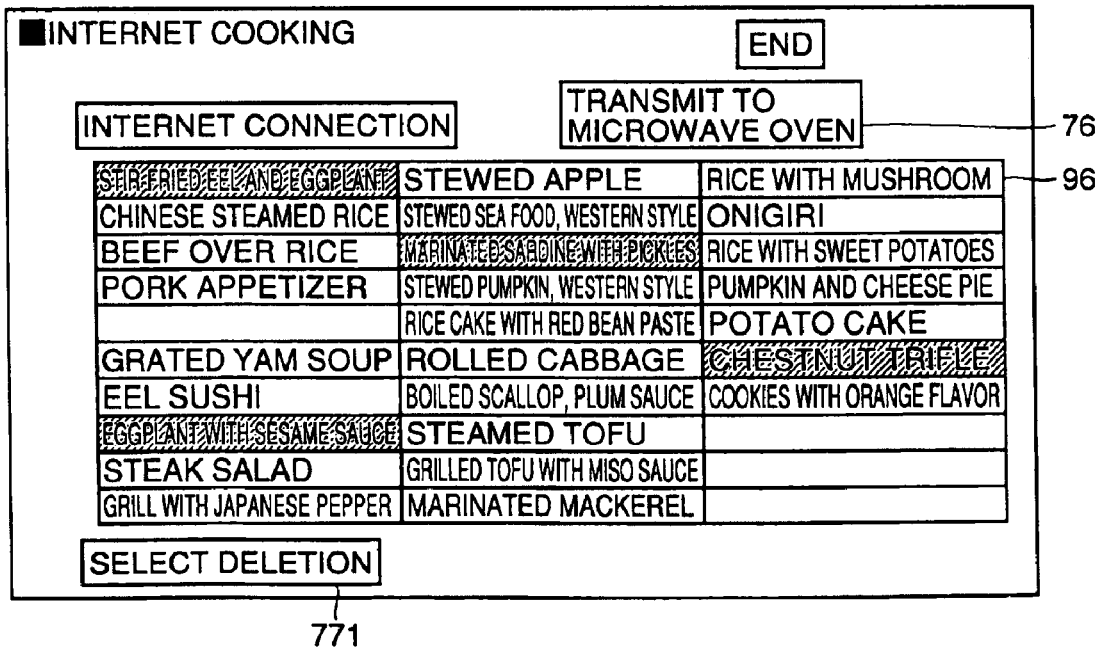

When the recipe name MNi "squid pilaf, Western style" denoted by the arrow is to be deleted and the recipe name MNi "squid pilaf, Western style" is pressed by the pen and selected, the display is switched to the image of FIG. 79B. Here, an area 97 appears, in which area 97, a message is given, asking whether deletion of the recipe information MI corresponding to the selected recipe name MNi is to be executed. The user, confirming the message, presses the button 773 by the pen, instructing execution of deletion, and the recipe information MI corresponding to the recipe name MNi "squid pilaf, Western style" is deleted from memory 21. At this time, the display is switched to the image of FIG. 79C, in which the message notifying completion of deletion appears in area 97. Confirming the message, the user presses the button 773 acknowledging completion of deletion, and the display is switched to the image of FIG. 79D. It can be seen from this image that the recipe name MNi "squid pilaf, Western style" is deleted from area 96.

In the present embodiment, recipe names MNi of all pieces of recipe information MI stored in the memory 21 of mobile equipment 2G can be confirmed at one time on one screen, and therefore it is not necessary to search for the desired recipe name MNi while scrolling the images. Further, selection and canceling of the recipe name MNi responding to the recipe information MI to be transmitted to microwave oven 1G can be done simply by pressing the recipe name MNi with the pen, which is very convenient. Further, the operation of deleting the recipe information MI from the memory 21 of mobile 2G can be done in the similar operation, which is also very convenient.

Twenty-Sixth Embodiment

Figure 80:
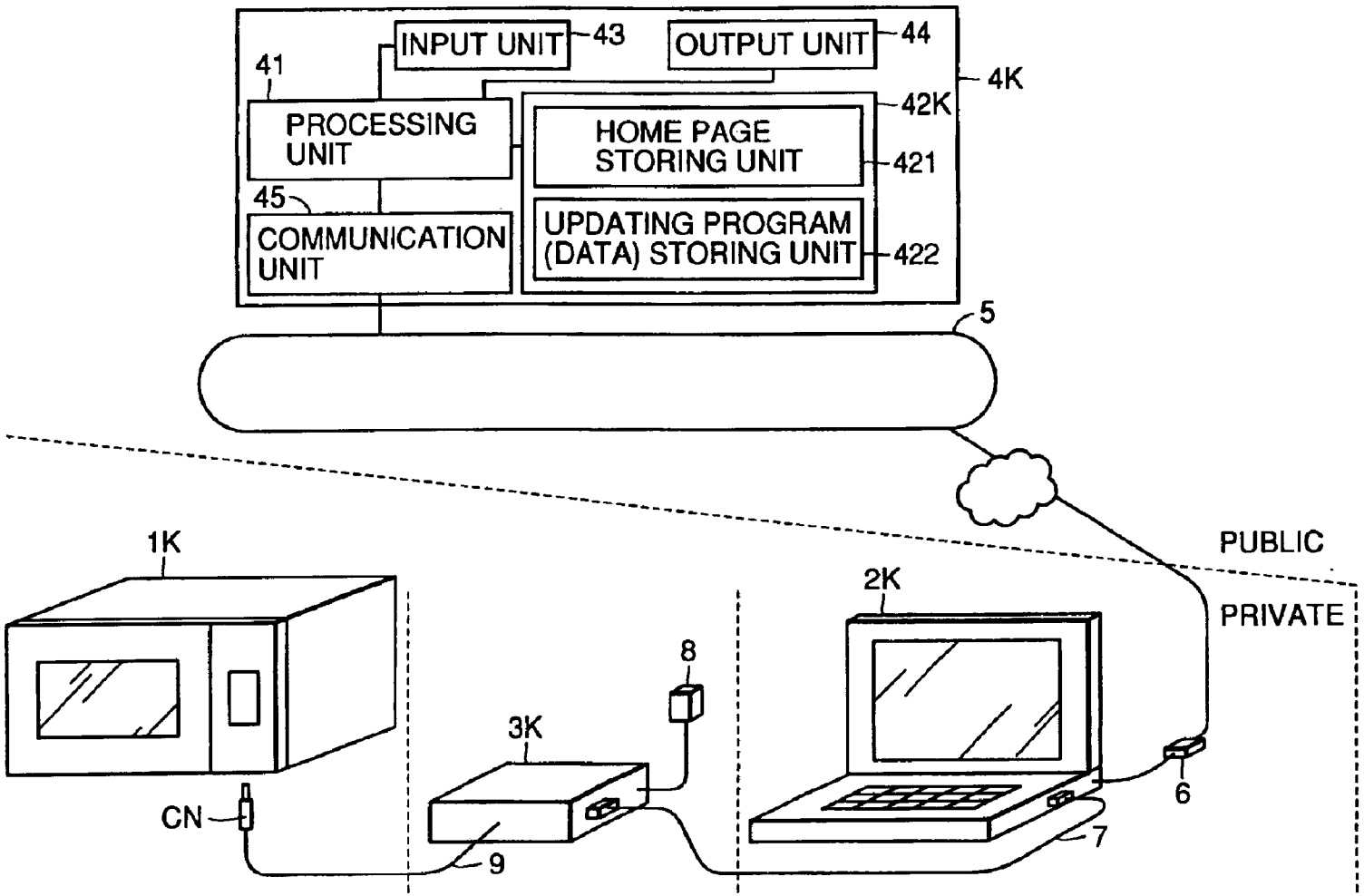
FIG. 80 is a schematic diagram representing a configuration of the microwave oven system in accordance with the twenty-sixth embodiment of the present invention.
Figure 81:
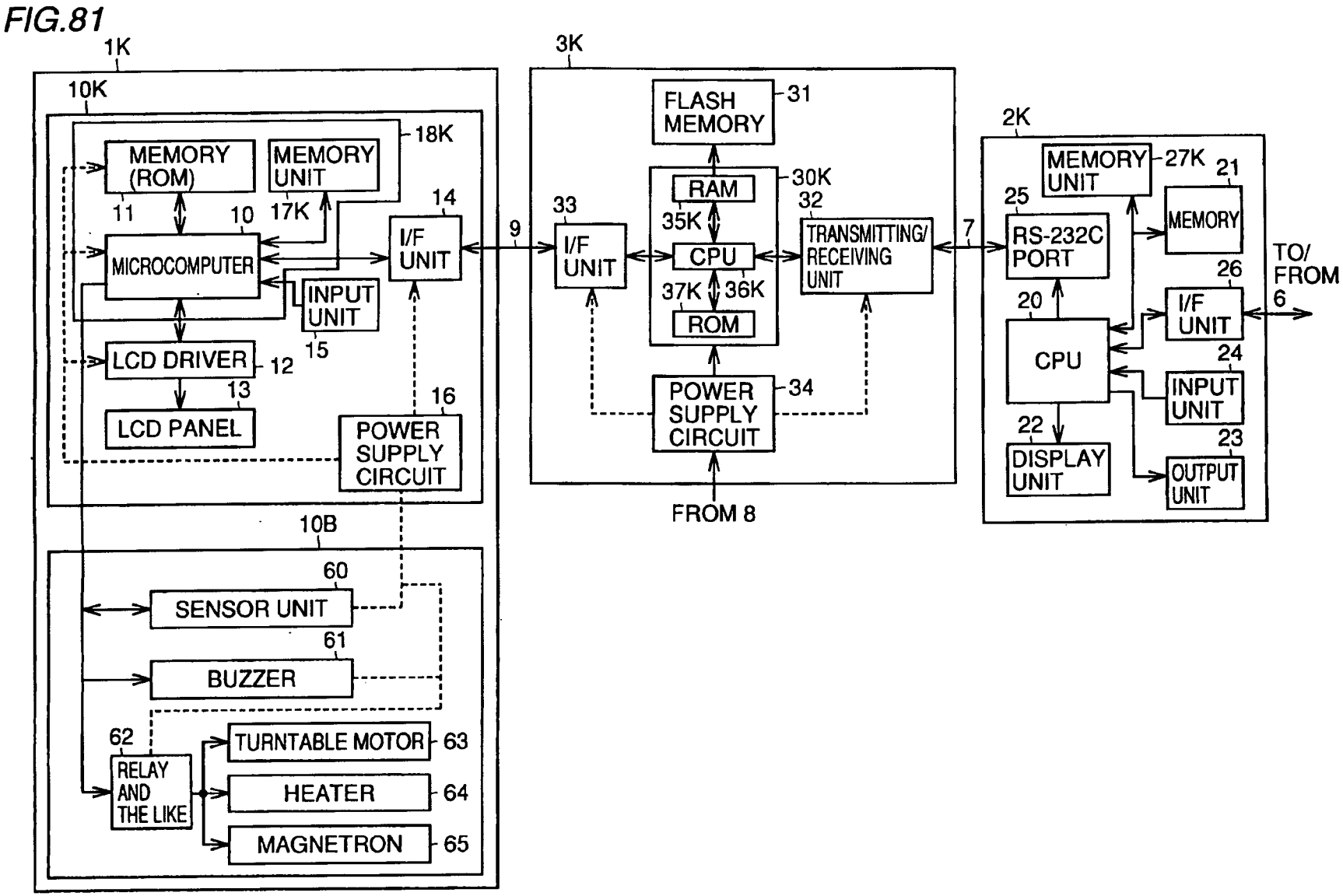
FIG. 81 is a block diagram representing configurations of various units of FIG. 80.

FIG. 80 is a schematic diagram representing configuration of the microwave oven system in accordance with the twenty-sixth embodiment of the present invention. FIG. 81 is a block diagram representing configurations of respective unit of FIG. 80.

Referring to FIG. 80, the microwave oven system includes, in public, the Internet 5 and a host computer 4K connected thereto, and in private, a microwave oven 1K, a personal computer 2K connected through a modem 6 to the Internet 5, and a relay box 3K fed from an AC adapter 8, as a relay apparatus for connecting personal computer 2K and microwave oven 1K, converting and communicating signals therebetween. In private, microwave oven 1K and relay box 3K are connected by a three-line cable 9. For this connection, a connector CN at one end of the three-line cable 9 is connected to an input/output terminal, not shown, of microwave oven 1. In private, personal computer 2K and relay box 3K are connected by an RS-232C cable 7 for communication in accordance with RS-232C.

In the public host computer 4K, information related to various home pages to be accessed through the Internet 5 are registered. Host computer 4K includes a processing unit 41 for centralized control and management of host computer 4K itself, a memory 42K having an updating program (data) storing unit 422 and a home page storing unit 421 as a memory area storing information including information for constructing home page screen (hereinafter referred to as home page information), an input unit 43, an output unit 44, and a communication unit 45 for communication and connection between the Internet 5 and host computer 4K.

Referring to FIG. 81, microwave oven 1K includes a control unit 10K and a heating unit 10B. Control unit 10K includes a microcomputer 10, a microcomputer 18K including a memory (ROM) 11 and a memory unit 17K, an LCD (Liquid Crystal Display) panel 13 as a display unit, an LCD driver 12 for driving LCD panel 13, an I/F (Interface) unit 14 including an input/output terminal to which connector CN is connected, an externally operable input unit 15, and a power supply circuit 16 for supplying power to respective units of microwave oven 1. Input unit 15 and LCD panel 13 are provided integrally, as a touch panel.

Heating unit 10B has the same configuration as described above.

Personal computer 2K includes a CPU 20, a memory 21 and a memory unit 27K storing various information, display unit 22, output unit 23, an externally operable input unit 24, an RS-232C port 25 for connecting an RS-232C cable 7 and the CPU 20, and an I/F unit 26 for connecting a modem 6 and the CPU 20.

Relay box 3K includes a microcomputer 30K including an RAM 35K, CPU 36K and an ROM 37K, a flash memory 31 as a nonvolatile storing element, a transmitting/receiving unit 32 for connecting RS-232C cable 7 with the microcomputer 30, an I/F unit 33 for connecting a three-line cable 9 with microcomputer 30, and a power supply circuit 34 for filling power to respective portions.

For the communication through the three-line cable 9, UART (Universal Asynchronous Receiver Transmitter) is adopted.

The procedure of cooking by a private microwave oven 1K using cooking information publicly available through the Internet 5 from the host computer 4K as a home page server will be described in the following. The twenty sixth embodiment will be described. In the present embodiment, even when a piece of information corresponding to a new cooking recipe is added to the home page, no change is required to accommodate the addition, in each of the microwave oven system described above. FIG. 82 shows an example of the home page screen displayed in accordance with the home page information stored in home page storing unit 421 of host computer 4K shown in FIG. 80. FIGS. 3, 4 and 82 represent examples of home page screen images provided on the Internet by the applicant. When the user operates personal computer 2K and accesses a prescribed address corresponding to the host computer 4K through the Internet 5, the home page screen of FIG. 3 appears at the output unit 23 of personal computer 2K as described above, and when the user clicks the item "microwave oven" represented by the arrow A on the home page screen by the input unit 24, the home page image of FIG. 4 appears.

When the user clicks the cooking recipe denoted by the arrow A on the home page image display of FIG. 4, the home page screen image of FIG. 82 appears in the present embodiment, showing an image (not shown) of the finished state of the designated cooking recipe, information of materials and the how-to-cook information. Though a home page screen example of FIG. 82 only is shown, the display image is not limited. More specifically, the home page information for the home page image display of FIG. 82 is prepared in advance in the home page storing unit 421 for each of the recipes for one year represented in the home page screen image of FIG. 4.

When the user viewing the home page image display of FIG. 82 designates and clicks the displayed item "download of cooking data" denoted by the arrow A, the data to be displayed to the user on the microwave oven 1K and the heating data used for heating and cooking by the heating unit 10B of microwave oven 1K, related to the cooking recipe shown in FIG. 82 are down-loaded from the host computer 4K through the Internet 5, in response.

In memory 21 of personal computer 2K, a dedicated program for enabling the function responsive to the click of the item denoted by the arrow A has been installed in advance.

As can be seen from FIG. 82, in the present embodiment, there are a material description A1 describing the materials of the desired cooking recipe in the form of text data and a how-to-cook description B11 describing how-to-cook the desired cooking recipe in the form of the text data, for the desired cooking recipe on the home page. In the how-to-cook description B11, colors in which the characters are displayed in the description are used as the key words, to be converted to a data format recognizable by the microcomputer for controlling the microwave oven.

More specifically, character colors are allotted in accordance with the heating mode of microwave oven 1K. For example, in the how-to-cook description B11, "microwave oven, output level (500W and so on), heating time (10 min. and the like)" are displayed in blue, "oven, output level (200° C. and the like), heating time (20 min. and the like)" are displayed in red, "grill, heating time (15 min. and the like)" are displayed in brown, and "toast, heating time (8 min.)" are displayed in yellow. Other characters are displayed in black.

Personal computer 2K receives the description related to the how-to-cook from the home page such as shown in FIG. 82, from the host computer 4K, converts the received description to the data recognizable by the microcomputer 10 of microwave oven 1K using the character color as a key word, and transmits the converted data to microwave oven 1K through relay box 3K. The description related to how-to-cook is supplied as the text data, and the key word in association therewith is provided as appendix data. The key word is not limited to the character color described here. For example, font (gothic, mincho and the like), character size, attached symbol, frame and the like may be used as the key word.

Figure 83:
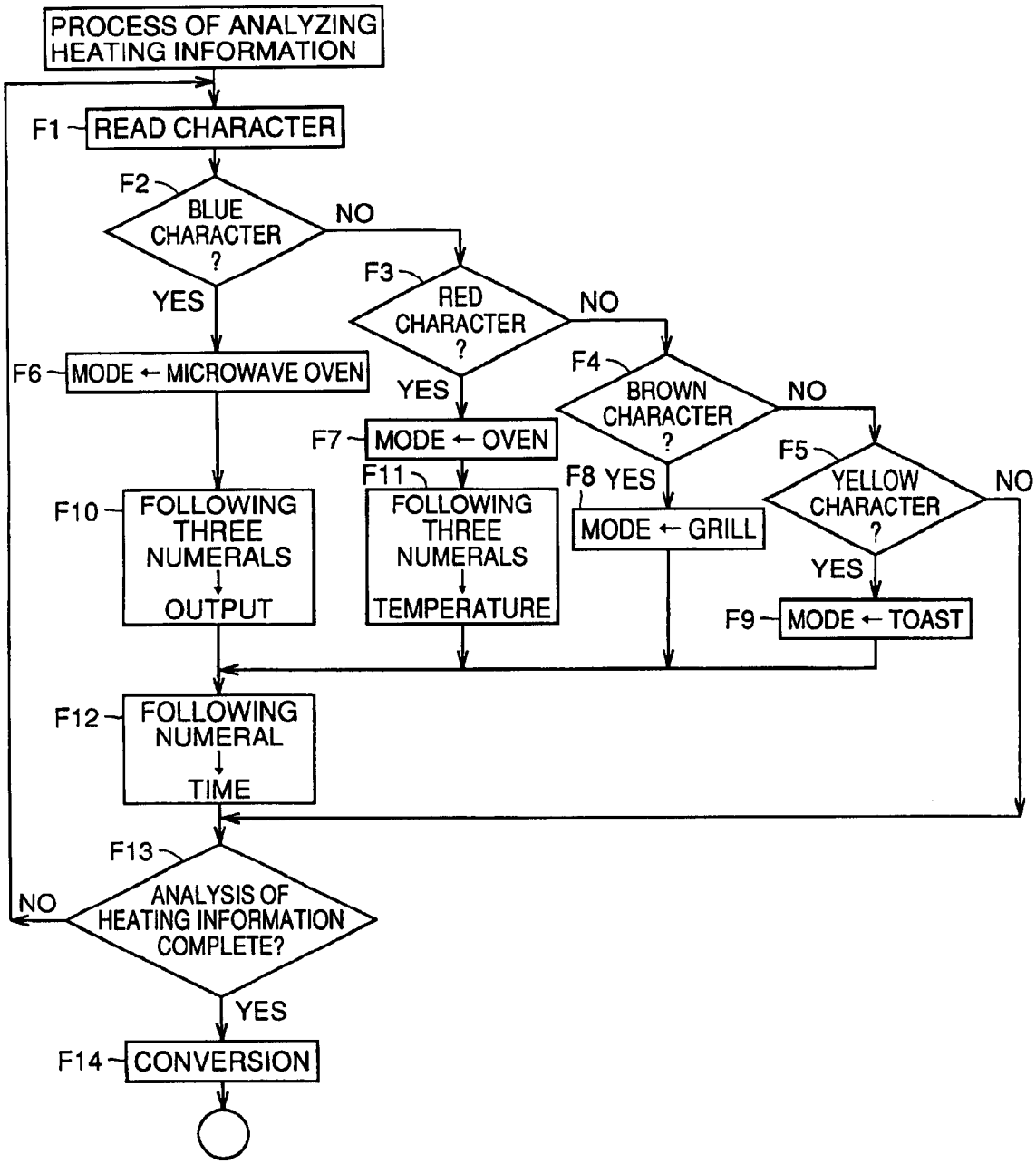
FIG. 83 is a flow chart of the process of analyzing heating information in accordance with the twenty-sixth embodiment of the present invention.
Figure 84:
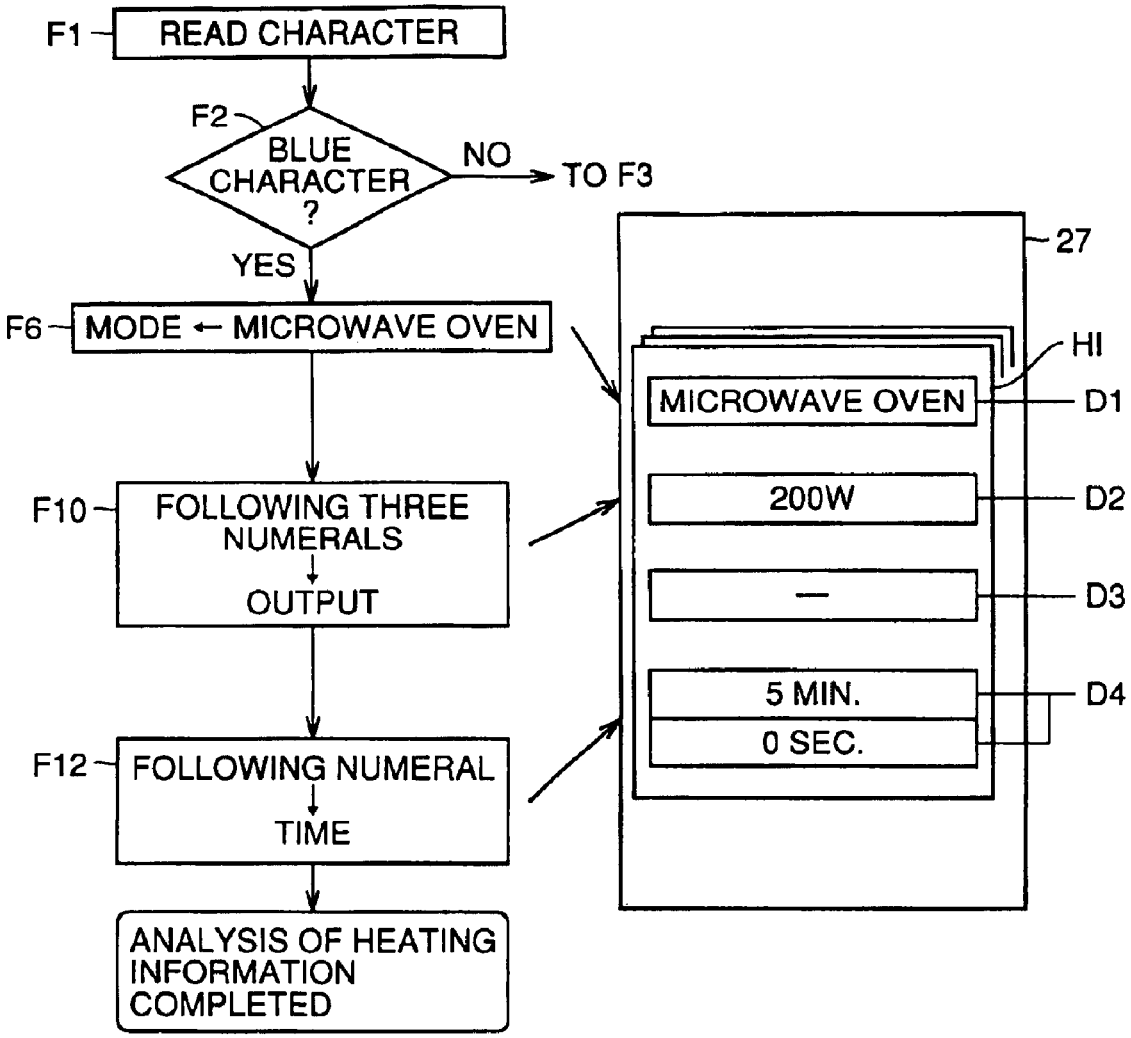
FIG. 84 shows the heating information stored in the memory unit in accordance with the flow chart of FIG. 83.

FIG. 83 is a flow chart of the process of analyzing heating information in accordance with the twenty-sixth embodiment of the present invention. FIG. 84 represents the heating information stored in the memory unit in accordance with the process of analyzing heating information shown in FIG. 38. Referring to FIG. 81, one or more pieces of heating information HI are stored in each of the memory unit 27K, flash memory 31 and memory unit 17K. The heating information HI represents the procedure of heating of a cooking recipe by the microwave oven 1K, and the information represents a mode (MODE) data D1, output data D2, temperature data D3 and time (minutes and seconds) data D4. Details of respective data will be described later. The heating information is directly recognized (without the necessity of decoding process and the like) by a microcomputer 18K of microwave oven 1K and can be used for controlling the microwave oven.

The process of analyzing data on the home page image of FIG. 82 down-loaded from the host computer 4K and generating the heating information HI for heating and cooking, in personal computer 2K will be described in accordance with the flow chart of FIG. 83. The data related to the cooking recipe of FIG. 82 down-loaded in accordance with the above described procedure from host computer 4K are temporarily stored in memory 21 of personal computer 2K. The CPU 20 of personal computer 2K reads the characters (text data) from the head of the how-to-cook description B11 shown in FIG. 82, stored in memory 21 (F1). Referring to the appendix data for the read characters, the character color is determined (F2 to F4).

At this time, when the character is determined to be blue, "microwave oven" is set as the MODE data D1, when the character is determined to be yellow, "oven" is set as the MODE data D1, when the character is determined to be brown, "grill" is set as the MODE data D1, and when the character is determined to be yellow, "toast" is set as the MODE data D1, representing the heating operation mode of microwave oven 1K (F6 to F9).

Three numerals following the how-to-cook description B11 is set as the output data D2 representing the output level of the microwave oven if the mode is determined to be the microwave oven mode (F10), and set as temperature data D3 representing the temperature at the time of heating of the oven when the mode is determined to be the oven mode (F11). Still further three numerals that follows are set as time data D4 representing the heating time in each mode (F12).

The process described above is repeated in the similar manner until the last character of the how-to-cook description B11 is read, and the heating information HI including data D1 to D4 such as shown in FIG. 84 are converted to the data format readily recognizable (without decoding) by the microcomputer 18K of microwave oven 1K (F14) and stored in the memory unit 27K.

When one or more pieces of heating information HI are stored in memory unit 27K in accordance with the procedure described above, the personal computer 2K transmits the screen information of the desired cooking recipe of FIG. 82 stored in memory 21 and the corresponding one or more pieces of heating information HI in memory unit 27K to relay box 3K through the RS-232C cable 7.

Relay box 3K receives and temporarily stores in RAM 35K the data transmitted from personal computer 2K. Thereafter, in response to a request from the microwave oven 1K, the data is read from RAM 35K and transmitted to microwave oven 1K through the three-line cable 9. The CPU 10 of microwave oven 1K receives the data transmitted from relay box 3K through the I/F unit 14, and stores in the memory unit 17K. Based on the screen information of the desired cooking recipe of FIG. 82 stored in memory unit 17K, the material data and the how-to-cook data are displayed on LCD panel 13 based on the screen information of the desired cooking recipe, and based on the one or more pieces of heating information HI stored correspondingly in memory unit 17K, parts of heating unit 10B are controlled to perform the heating operation for heating and cooking.

In the above described embodiment, the process of analyzing and converting the heating information HI is performed in personal computer 2K. The process may be performed in the similar manner in relay box 3K or microwave oven 1K.

An example in which the process of analyzing heating information HI in accordance with the flow chart of FIG. 83 takes place in relay box 3K will be described.

When the user clicks the download button of the cooking data denoted by the arrow A in FIG. 82, which is the home page screen displayed when the user access the host computer 4K, the information represented in FIG. 82 is transmitted from host computer 4K to the personal computer 2K of the user's residence. The personal computer 2K of the users residence transmits the received data as it is to relay box 3K.

Microcomputer 30K of relay box 3K temporarily stores the received data in RAM 35K, performs the process of analyzing and converting the heating information in accordance with the flow chart of FIG. 83, using the program of ROM 37K, and stores the heating information HI shown in FIG. 84 in flash memory 31. Thereafter, in accordance with the request from microwave oven 1K, the display information shown in FIG. 82 and the corresponding one or more pieces of heating information HI in flash memory 31 of the desired cooking recipe are transmitted to the control microcomputer 18K of microwave oven 1K. Thereafter, by microcomputer 18K, heating and cooking of the desired cooking recipe are controlled in the similar manner as described above.

An example in which the process of analyzing and converting the heating information HI in accordance with the flow chart of FIG. 83 takes place in the microwave oven 1K will be described. When the user clicks the "download of cooking data" button denoted by the arrow A of FIG. 82, which is the home page screen displayed when the user access the host computer 4K, the information represented in FIG. 82 is transmitted from host computer 4K to personal computer 2K. Personal computer 2K transmits the transmitted information as it is to relay box 3K. Microcomputer 30K of relay box 3K receives the data transmitted from personal computer 2K as it is, and transmits all the data related to the cooking recipe designated by the microcomputer 18K for controlling microwave oven 1K to microcomputer 18K of microwave oven 1K intact. Microcomputer 18K of microwave oven 1K analyzes the data in accordance with the flow of FIG. 83, in accordance with the program stored in a memory (ROM) 11, displays the data representing the materials, given by the material description Al of FIG. 82, and controls the heating unit 10B in accordance with one or more pieces of heating information HI stored in the memory unit 17, so that heating and cooking of the desired cooking recipe take place.

Figure 85:
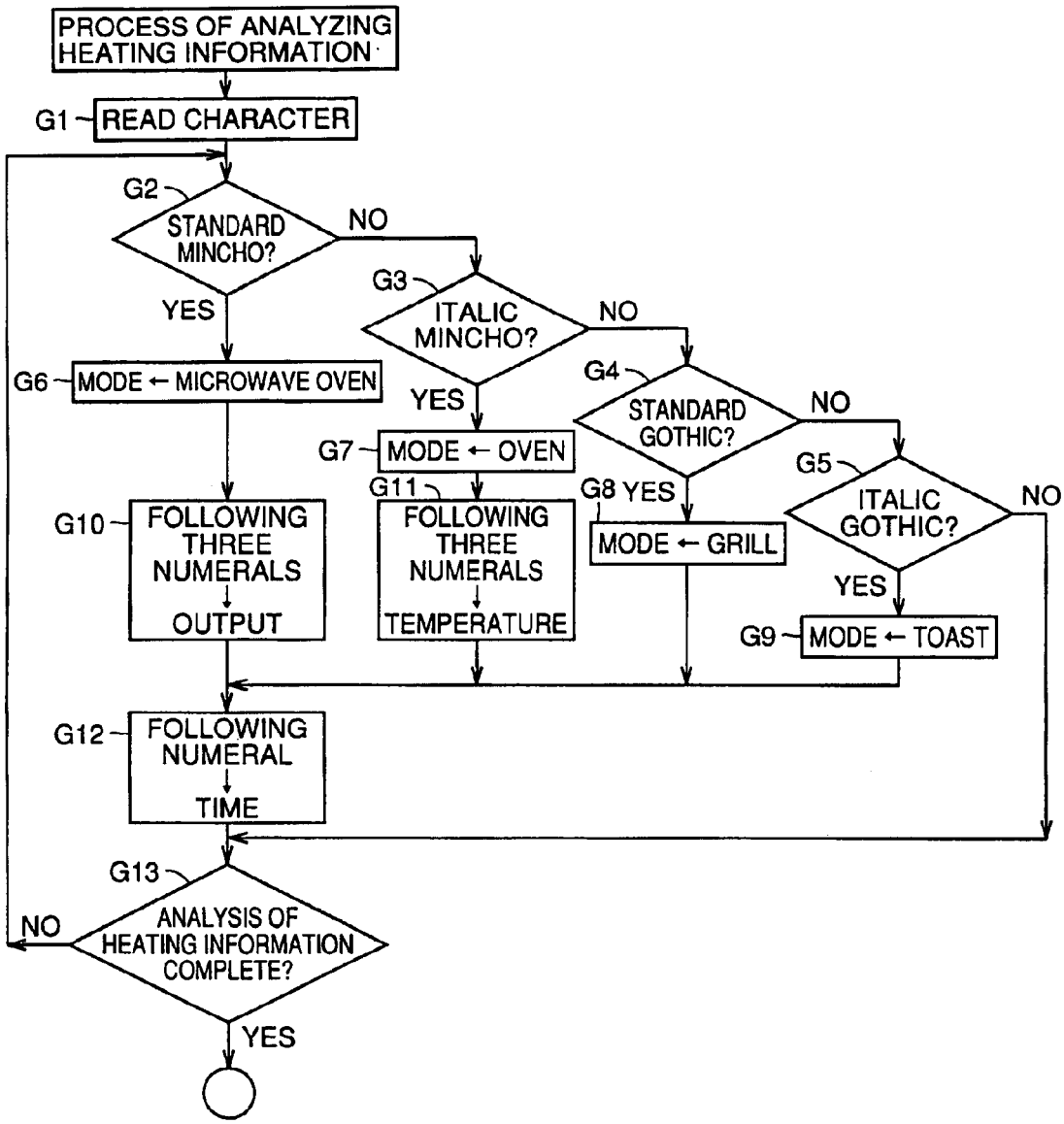
FIG. 85 shows another flow chart of the process of analyzing heating information in accordance with the twenty-sixth embodiment of the present invention.

FIG. 85 is a flow chart of another process of analyzing the heating information in accordance with the twenty-sixth embodiment of the present invention. The process of analyzing heating information described above is based on the character color of the how-to-cook description B11. The process may be based on the font of the characters, in accordance with the flow chart of FIG. 85. In the flow chart of FIG. 85, when the font of the character read from the how-to-cook description B11 is standard mincho, italic mincho, standard gothic and italic gothic, respectively, the operation mode of microwave oven 1K, that is, MODE data D1 is determined to be microwave oven, oven, grill and toast, respectively. Except this point, the process is the same as described with reference to FIG. 83, and therefore, description is not repeated. The data registered as heating information HI is not limited to data D1 to D4 of FIG. 84. For example, when there are heaters 64 provided at the top and bottom of a heating chamber of microwave oven 1K, data related to the power of the heaters 64 (low, middle, high), and data related to the height of the heaters 64 in the heating chamber may be included.

In this manner, when a new cooking recipe is presented on the home page, what is necessary is simply to prepare the image data such as shown in FIG. 82 which can be viewed by the user on private personal computer 2K, in a general home page markup language without the necessity of considering or regardless of the configuration of the microwave oven system shown in FIG. 80. Further, not only the data on the home page but also general cooking program can be accommodated in accordance with the present embodiment, without any additional processing, when a recipe in compliance with simple key words is presented.

Twenty-Seventh Embodiment

The twenty-seventh embodiment will be described in the following. In the present embodiment, various functions registered in the relay box and the microwave oven, respectively, are updated by the host computer through the personal computer, in the microwave oven system, as needed. The updating of various functions is performed by updating the corresponding program or data. In the present embodiment, the system configuration shown in FIG. 80 and configurations of respective units of FIG. 81 are adopted. The system configuration to which the present embodiment is applicable is not limited to this.

The data to be updated in accordance with the present invention may include, for example, the data defining the maximum number of recipe data storable in flash memory 31 in relay box 3K, and data defining the maximum number of recipe data storably in memory 11 in microwave oven 1K. The program to be updated may include the program defining the method of communication with the personal computer 2K or with the microwave oven 1K, or the program of the process of analyzing heating information, in relay box 3K and the program defining the method of communication with the relay box 3K, the program defining the display layout and the associated display illustration on LCD panel 13 of the cooking recipe information received from the host computer 4K through personal computer 2K and relay box 3K or the program of the process of analyzing heating information described above, in microwave oven 1K.

Figure 86A:
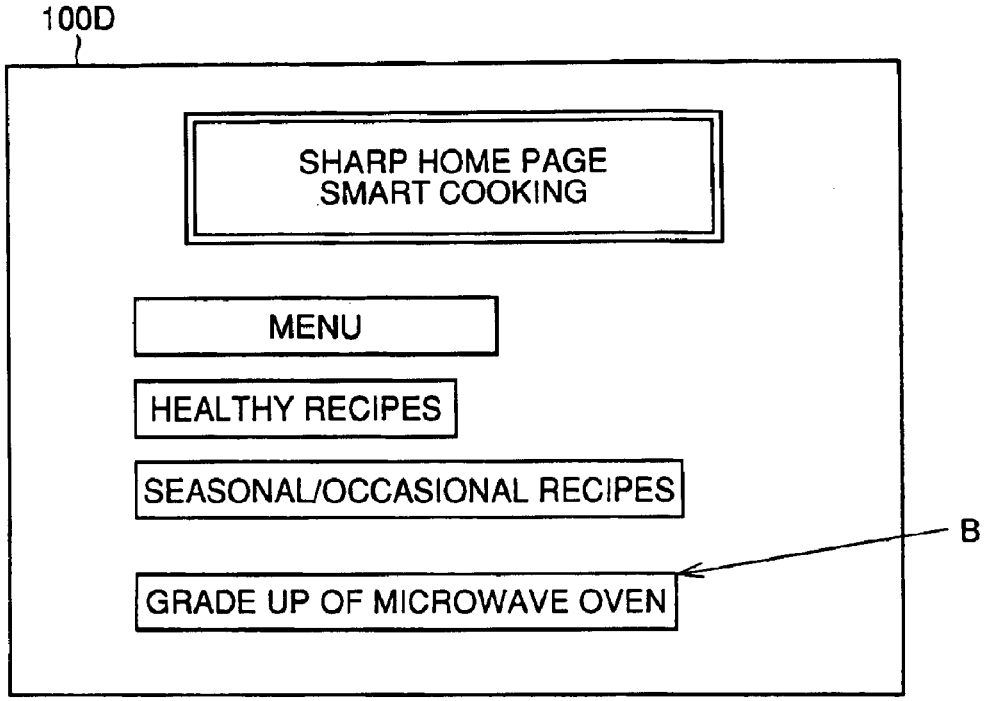
FIGS. 86A and 86B show examples of the home page screen displayed when the function is updated, applied to the twenty-seventh embodiment of the present invention.
Figure 86B:
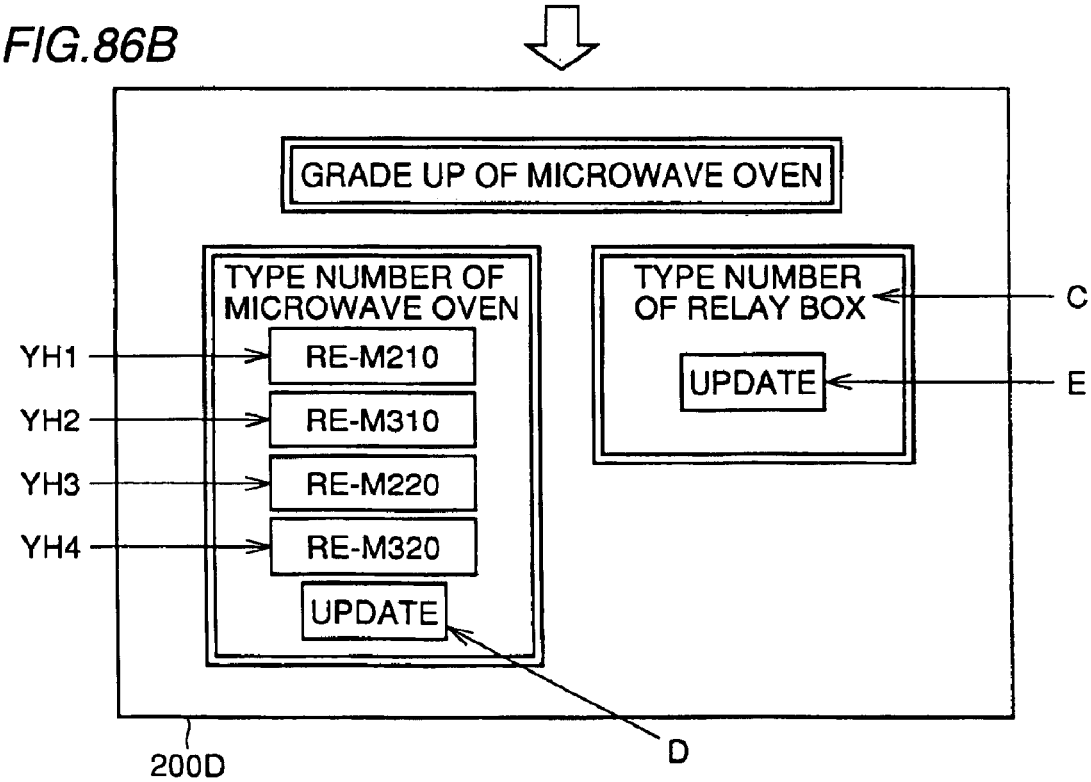
Figure 87:
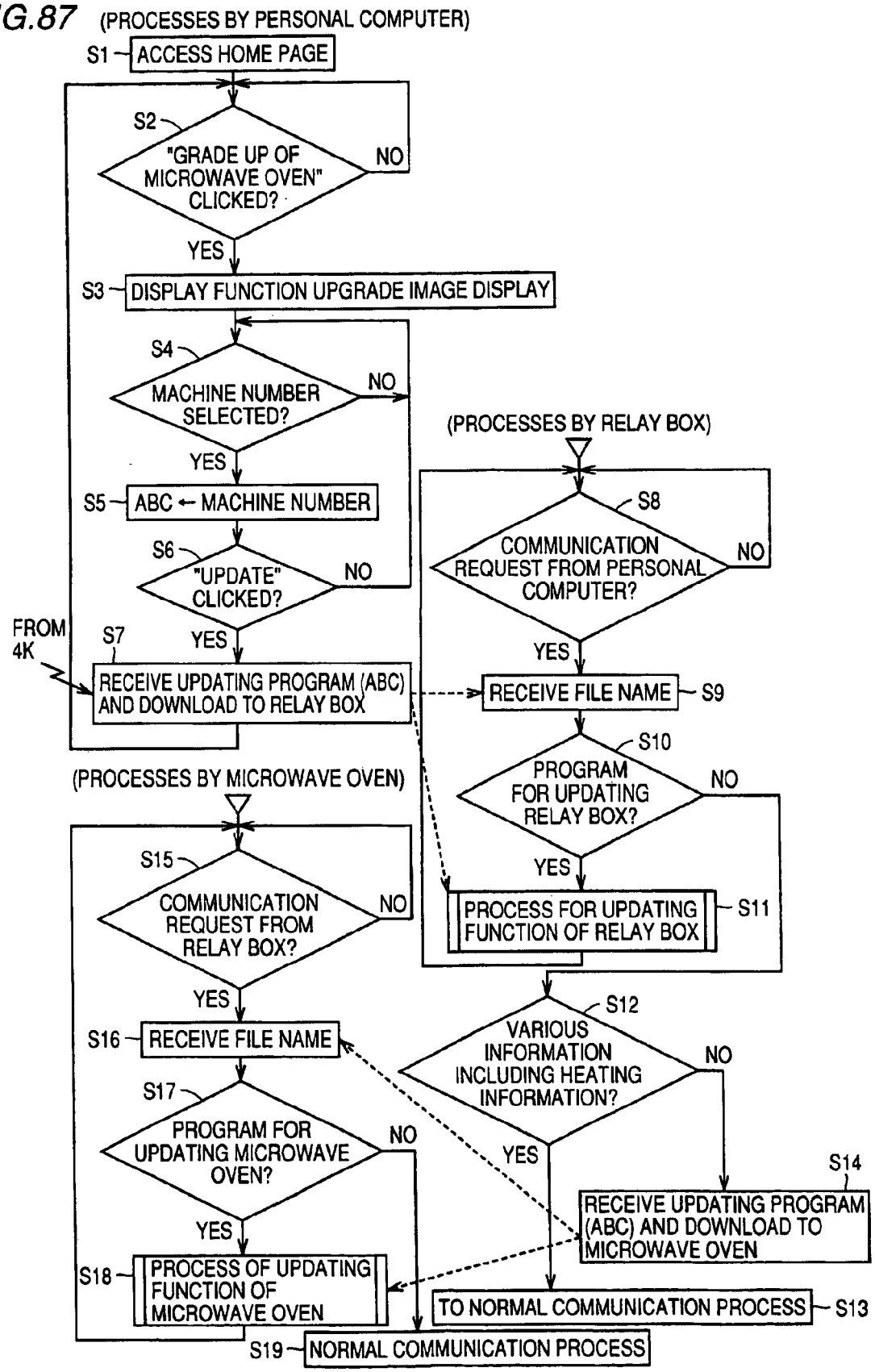
FIG. 87 is a process flow chart of data transfer for updating, at the time of function update, applied to the twenty-seventh embodiment of the present invention.
Figure 88:
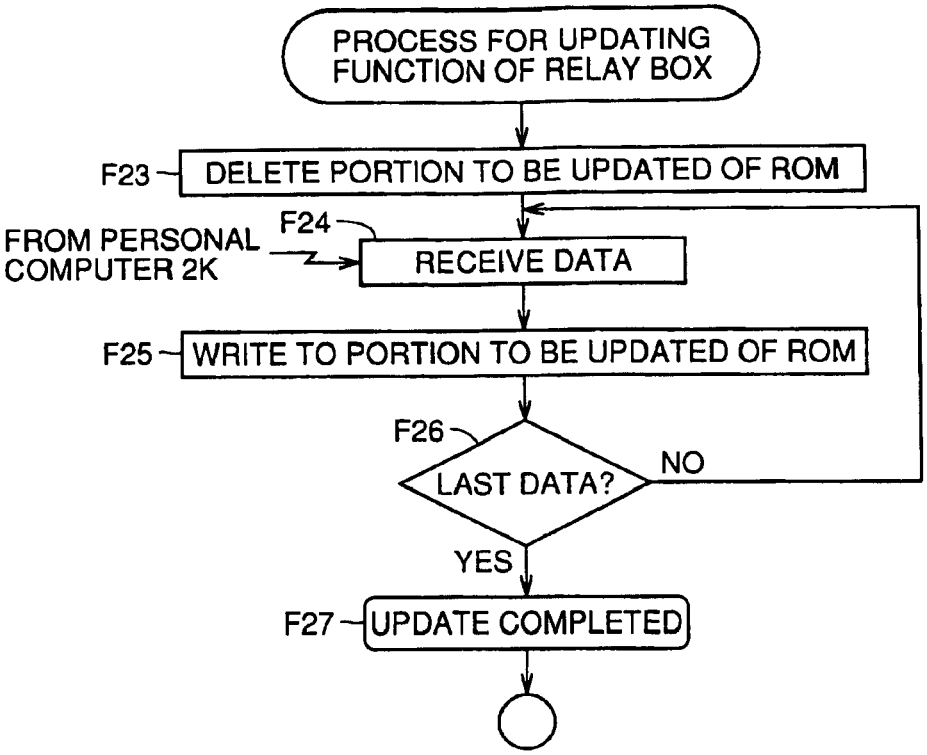
FIG. 88 is a flow chart of the process of updating function in the relay box of FIG. 87.
Figure 89:
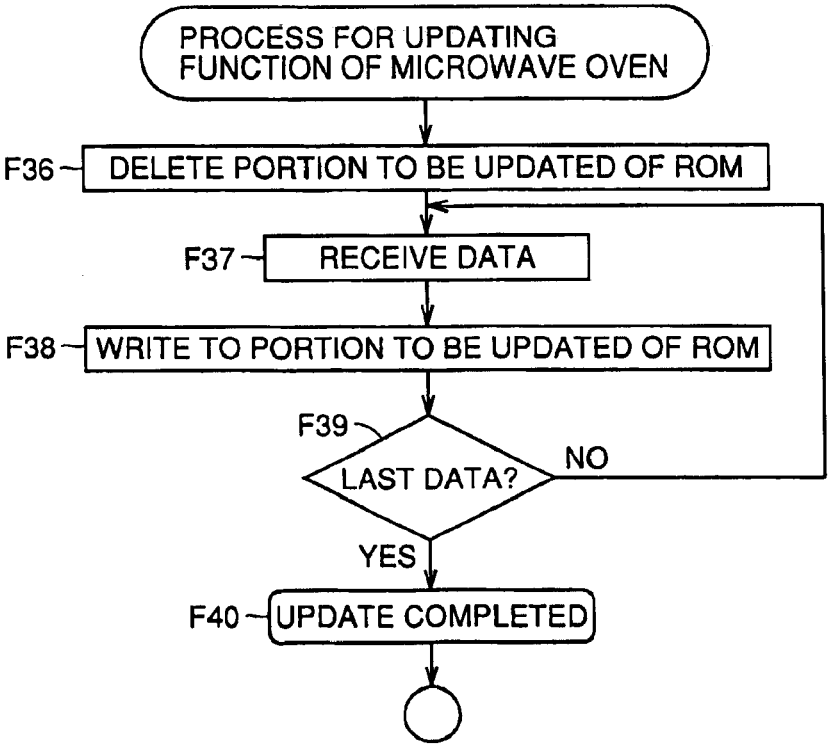
FIG. 89 is a flow chart of the process of updating function in the microwave oven of FIG. 87.

FIGS. 86A and 86B represent examples of the home page image display which appears when the function is updated, in accordance with the twenty-seventh embodiment of the present invention. FIG. 87 is a flow chart representing the process of transferring data for updating the function, in accordance with the twenty-seventh embodiment of the present invention. FIGS. 88 and 89 are flow charts of the function up-dating process in relay box 3K and microwave oven 1K of FIG. 87, respectively.

Referring to FIGS. 86A to 89, the process of updating the function will be described. First, when the home page storing unit 421 of host computer 4K is accessed by personal computer 2K, a top screen display 100D of the home page shown in FIG. 86A appears on display unit 22 of personal computer 2K (S1). When the user clicks the item "grade up of the microwave oven" denoted by the arrow B in FIG. 86A by operating the input unit 24 to update the function of microwave oven 1K or relay box 3K (S2), the display 200D of function update of FIG. 86B appears, showing details of the process of updating functions of microwave oven 1K or relay box 3K (S3).

In the system of FIG. 80, it is assumed that the microwave oven 1K of the type number "RE-M210", "RE-M310", "RE-M220" or "RE-M320" may be used and that the type number of relay box 3K is fixed in advance.

The user, using the function update display 200D of FIG. 86B, clicks the type number which corresponds to the type number of microwave oven 1K of the system shown in FIG. 80 among the type numbers denoted by the arrows YH1 to YH4 on display 200D when the function of microwave oven 1K is to be updated, and thereafter, clicks the update button denoted by the arrow D. When the function of relay box 3K is to be updated, the item "relay box type number" denoted by the arrow C on display 200D is clicked to designate the previously fixed type number for relay box 3K, and then the update button denoted by the arrow E is clicked (S4 to S6).

The CPU 20 of personal computer 2K sets the type number designated by the click to the variable "ABC" and requests an updating program (ABC) to the host computer 4K. The updating program (ABC) received from the host computer 4K in response to the request is downloaded to relay box 3K by a communication request, through RS232C port 25 and cable 7 (S7).

When CPU 36K of relay box 3K receives the file name of the updating program (ABC) upon reception of the communication request from personal computer 2K through the transmitting/receiving unit 32 (S8, S9) and the received file name represents the updating program for updating the function of relay box 3K (YES in S10), the process of updating the function of relay box 3K shown in FIG. 88 is executed.

When the received file name does not represent the updating program for updating the function of relay box 3K (NO in S10), whether the received file name represents information including the heating information HI in accordance with the twenty-sixth embodiment or not is determined. If it represents the information including the heating information HI (YES in S12), the process proceeds to the normal communication with the personal computer 2K or microwave oven 1K, and the information is received (S13). If it is not the information including the heating information HI, the data designated by the received file name is the updating program for microwave oven 1K, and therefore the updating program (ABC) is received and downloaded to microwave oven 1K through cable 9 (S14).

After receiving the communication request from relay box 3K, CPU 10 of microwave oven 1K receives the file name of the data which is to be transferred from relay box 3K (S16). If the received file name represents the updating program for updating the function of microwave oven 1K (YES in S17), the process proceeds to updating of the function of the microwave oven shown in FIG. 89 (S18), which will be described later, and otherwise (NO in S17), the data to be transferred from relay box 3K is the information including the heating information HI, and therefore, the normal communication with the relay box 3 starts (S19).

Referring to FIG. 88, CPU 36K of relay box 3K clears that area in which the program implementing the function of the updating program (ABC) has been stored of ROM 37K, in order to update the function by using the updating program (ABC) received from personal computer 2K (S23). Thereafter, the process of successively receiving and writing to the cleared memory area of ROM 37K, the data of the updating program (ABC) from personal computer 2K through cable 7 and transmitting/receiving unit 32 is repeated until the last data is received, and using the updating program (ABC) updating of the function (program update) is completed (S24 to S27).

Referring to FIG. 89, CPU 10 of microwave oven 1K clears that area of memory (ROM) 11 in which the program implementing the function corresponding to the updating program (ABC) has been stored, in order to update the function by using the updating program (ABC) received from relay box 3K (S36). Thereafter, the process of successively receiving and writing to the cleared area of memory (ROM) 11 the data of the updating program (ABC) from relay box 3K through cable 9 and I/F unit 14 is repeated until the last data is received, and by using the updating program (ABC), updating of the function (program update) is completed (S37 to S40).

The twenty-seventh embodiment facilitates adaptation to expected changes in the future, so as to be ready for the rapid development of technology. In other words, as the updating of the function (program update) of microwave oven 1K or relay box 3K is possible through the home page of host computer 4K, the function can be updated without the necessity of disassembling or changing the relay box 3K or microwave oven 1K, and without any troublesome operations by the user. Therefore, the system shown in FIG. 80 can readily be switched to the new system.

Twenty-Eighth Embodiment

The twenty-eighth embodiment will be described in the following.

In the microwave oven in accordance with the twenty-eighth embodiment, information related to the desired cooking recipe is provided by a voice.

Figure 90:
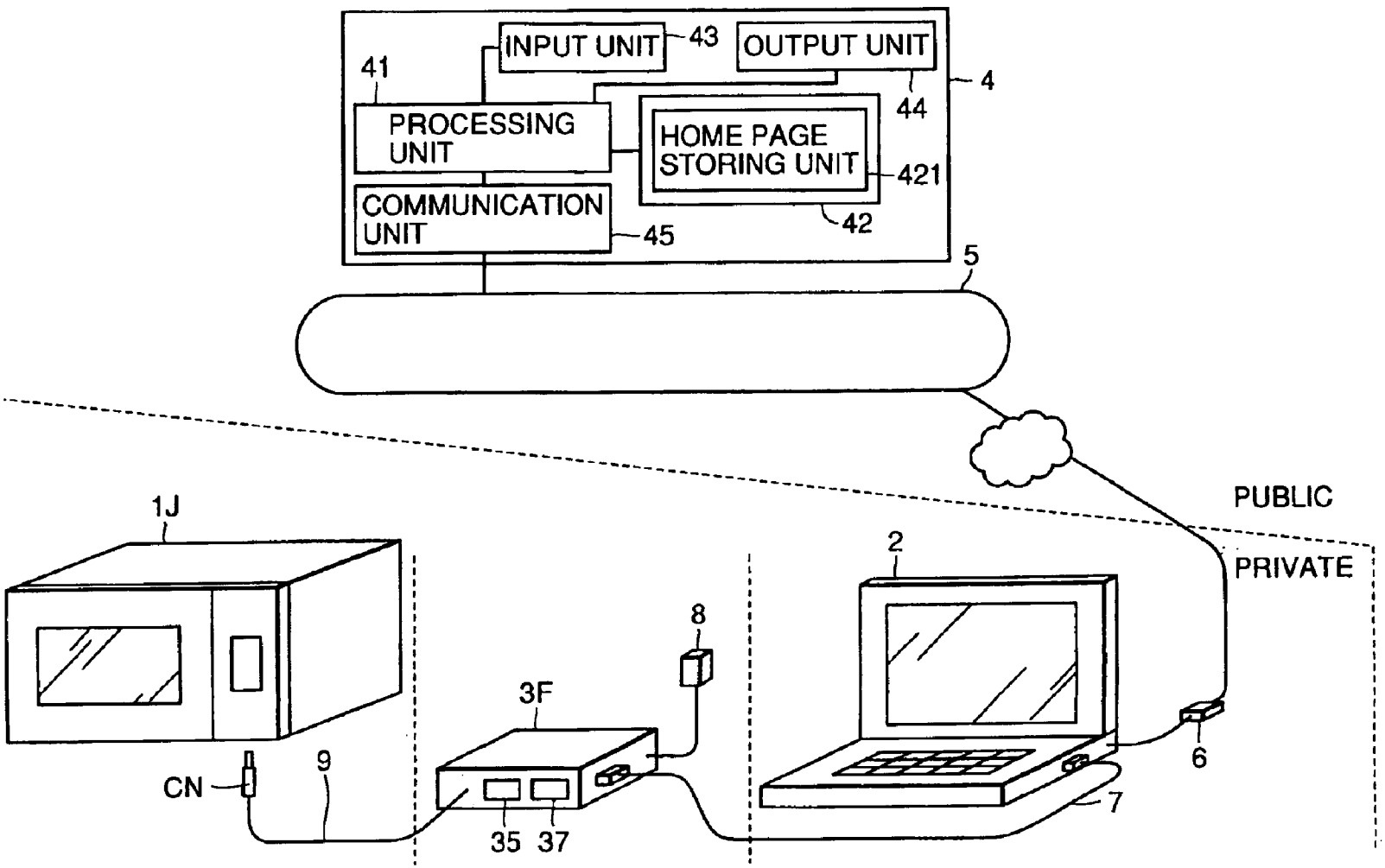
FIG. 90 is a schematic diagram representing a configuration of the microwave oven system in accordance with the twenty-eighth embodiment of the present invention.
Figure 91:
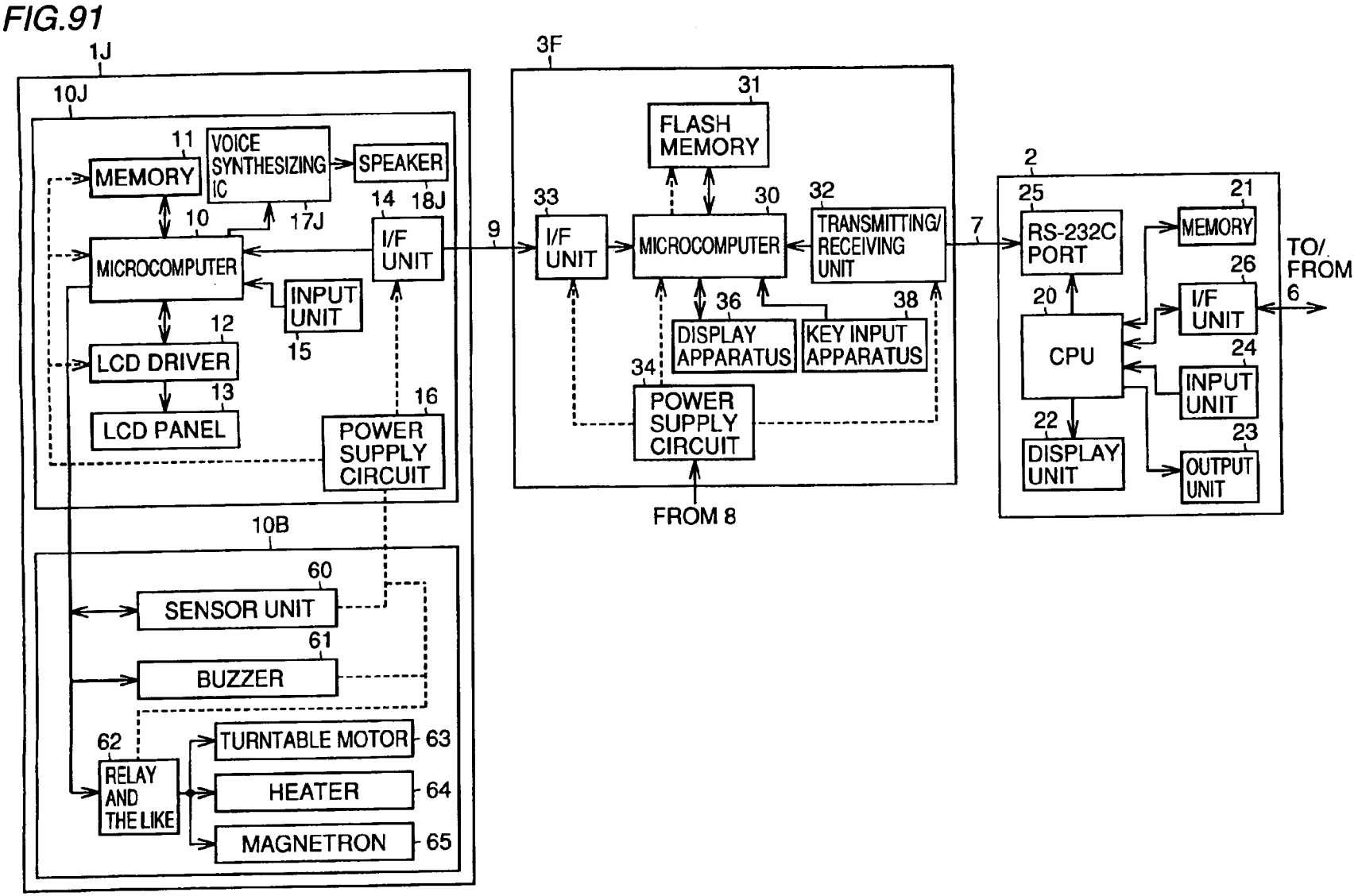
FIG. 91 is a block diagram representing configurations of respective portions of FIG. 90.

FIG. 90 schematically shows the configuration of the microwave oven system in accordance with the twenty-eighth embodiment. FIG. 91 is a block diagram representing configurations of respective units of FIG. 90. The configuration of FIG. 90 is similar to the configuration of FIG. 45 except that microwave oven 1 is replaced by a microwave oven 1J. Therefore, only the configuration of microwave oven 1J will be described with reference to FIGS. 90 and 91. Description of other portions will not be repeated.

Referring to FIG. 91, microwave oven 1J includes a control unit 10J and the above described heating unit 10B. Control unit 10J includes a voice synthesizing IC 17J for synthesizing and outputting audio data based on given data, and a speaker 18J for providing audio output based on the audio data applied from IC 17J, in addition to the configuration of control unit 10J described above.

In the twenty-eighth embodiment, when relay box 3F is not provided, microwave oven 1J is directly connected to personal computer 2 for communication.

The procedure of cooking by the private microwave oven 1J using the cooking information provided to the public on the Internet 5 by a host computer 4 as a home page server will be described in the following.

Processes in accordance with the procedure described above are performed while the screen images of FIGS. 3, 4 and 5 are successively displayed.

The home page information including the recipe information of each recipe prepared by host computer 4 shown in FIG. 90 is the same as that shown in FIG. 10.

Therefore, when the item "download of cooking data" denoted by the arrow A of FIG. 5 is denoted and clicked by the user, the transfer button B1 of FIG. 6 is clicked, and the processing unit 41 of host computer 4 down-loads the recipe information MI including the corresponding display data DS13 and heating data DS14 to personal computer 2 through communication unit 45 and the Internet 5.

The operation related to down-loading of recipe information by personal computer 2 is the same as the operation described with reference to FIG. 12, and therefore, description is not repeated.

Figure 92:
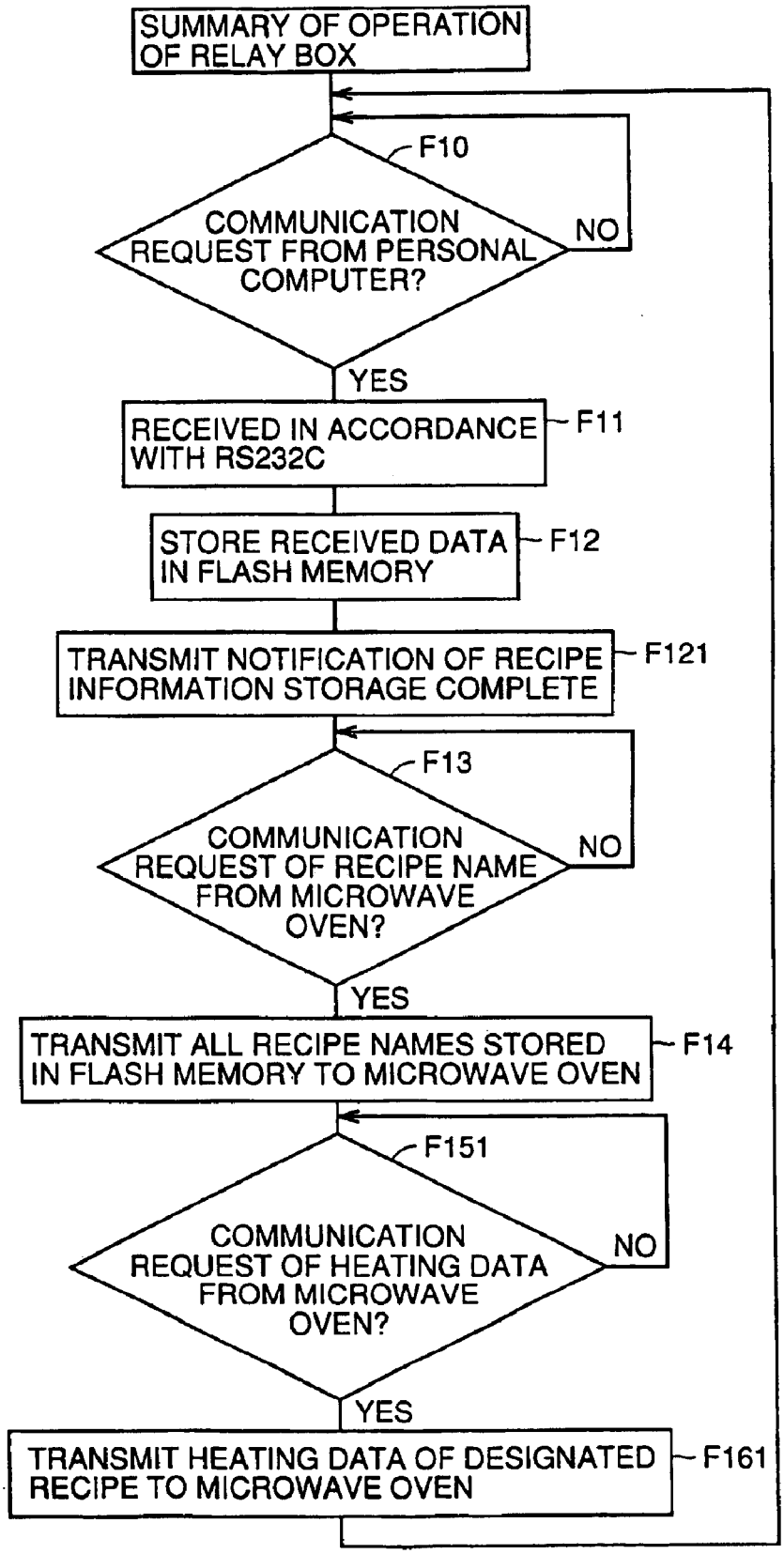
FIG. 92 is a flow chart schematically representing the operation of the relay box of FIG. 90.

FIG. 92 is a flow chart schematically representing the operation of relay box 3F.

When there is a download request of recipe information MI on the side of personal computer 2 as described above, a communication request is transmitted from personal computer 2 to relay box 3F, the recipe information MI including the display data DS13 and heating data DS14 is transmitted in accordance with RS-232C standard, and stored in flash memory 31 through transmitting/receiving unit 32 and microcomputer 30 of relay box 3F (F10 to F12 of FIG. 92.

Thereafter, microcomputer 30 transmits the notification of recipe information storage complete, acknowledging completion of the storage of the recipe information to microwave oven 1J (F121).

Flash memory 31 is capable of storing recipe information MI of a plurality of cooking recipes.

Upon request from the microcomputer 10 of microwave oven 1J, microcomputer 30 of relay box 3F transmits all the recipe names MNi stored in flash memory 31 to microcomputer 10 of microwave oven 1J through cable 9 (F13 and F14).

Thereafter, in response to an instruction from microcomputer 10 of microwave oven 1J, microcomputer 30 of relay box 3F transmits that heating data DS14 which corresponds to the designated recipe name MNi among one or more pieces of recipe information MI stored in flash memory 31 to microcomputer 10 of microwave oven 1J (FI51, F161).

Figure 93:
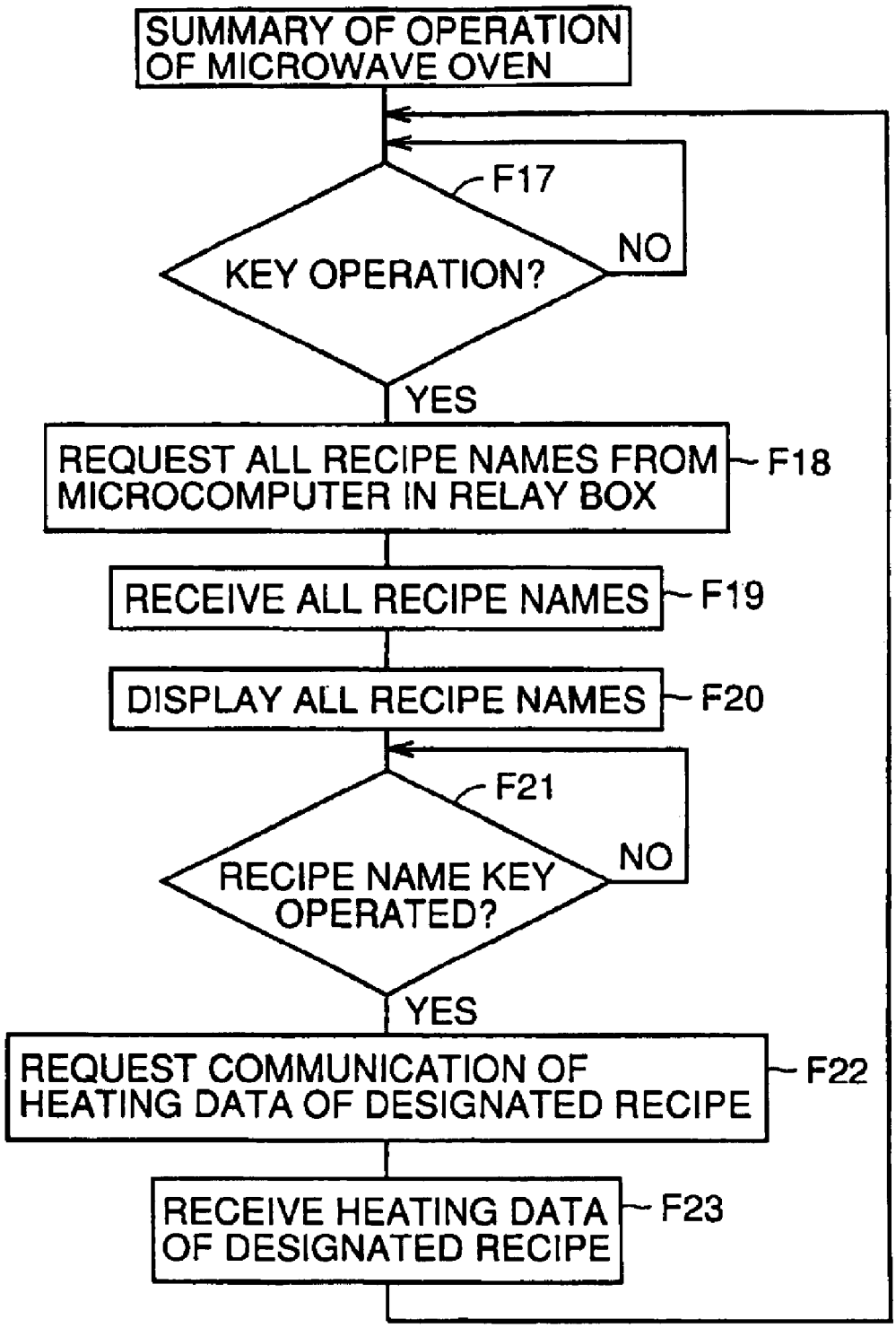
FIG. 93 is a flow chart schematically representing the operation of the microwave oven of FIG. 90.
Figures 94, 95:
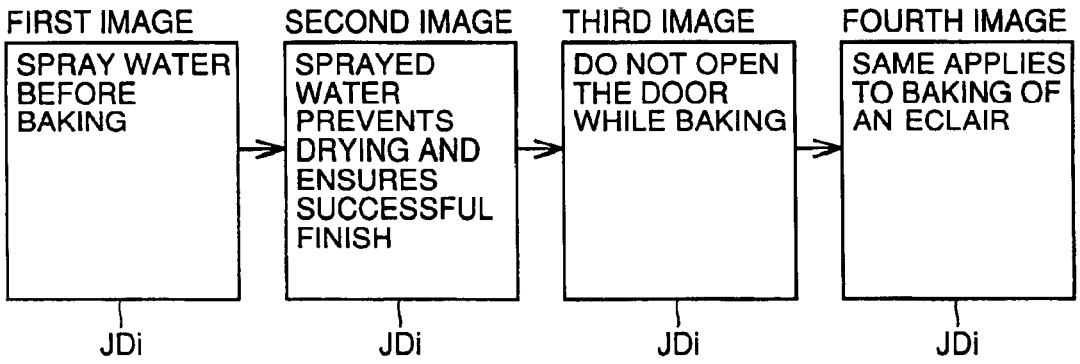
FIG. 94 shows an example of contents stored in a flash memory on the side of the relay box, in accordance with the flow chart of FIG. 90.
FIG. 95 represents an example of image outputs of the how-to-cook data in the microwave oven 1J.

FIG. 93 is a flow chart schematically representing the operation of the microwave oven shown in FIG. 90. FIG. 94 shows examples of the contents stored in flash memory 31 of the relay box, in the flow chart of FIG. 92.

Flash memory 31 is capable of storing up to five pieces of recipe information MI, for example, and five pieces of recipe information MI received from the host computer 4 of the home page through the Internet 5 and personal computer 2 are stored in the example of FIG. 94. Each piece of recipe information MI includes recipe name MNi (i: 1, 2, 3 . . . ), material data IDi, how-to-cook data JDi and heating data KDi.

The operation of microwave oven 1J of FIG. 93 will be described with reference to FIG. 94. It is assumed that the contents shown in FIG. 94 are stored in advance in flash memory 31 of relay box 3F.

First, as the recipe information MI has been already stored in flash memory 31 of relay box 3F, the user instructs to microcomputer 10 to request all the recipe names MNi from microcomputer 30 of relay box 3F, by a key operation (F17, F18).

Microcomputer 30 reads all the recipe names MNi from flash memory 31 of FIG. 94 in response to the request of all the recipe names MNi and transmits the read recipe names to microwave oven 1J through cable 9. Thus, the microcomputer 10 of microwave oven 1J receives all the recipe names MNi and displays the names on LCD panel 13 (F19 to F20).

Of the displayed recipe names MNi, when the name "cream puff" is touched and designated by the user, microcomputer 10 requests the heating data KD3 corresponding to the designated recipe name MN3 "cream puff") to relay box 3F through cable 9 (F21 and F22).

In response to the data request corresponding to the recipe name MN3 ("cream puff") from microwave oven 1J, microcomputer 30 of relay box 3F reads and transmits the heating data KD3 corresponding to the recipe name MN3 ("cream puff"), so that microcomputer 10 of microwave oven 1J receives and temporarily writes and stores in memory 11 the heating data KD3 (F22 and F23).

The above described series of operations is repeated in the similar manner for all the desired recipes, and thus heating data KDi of all the desired recipes come to be stored in memory 11.

The audio output of the display data DS13 of the desired recipe in place of the image output by microwave oven 1J will be described. Audio output of the how-to-cook data JDi among the display data DS13 will be described as an example, not as a limitation. The material data IDi may be provided by audio output, or both data may be provided as audio outputs.

FIG. 95 shows an example of the image output of the how-to-cook data JDi given on microwave oven 1J. When the data JDi includes one or more pieces of information and a plurality of images to be displayed on LCD panel 13 of microwave oven 1J, the data is displayed by successively feeding the images, as shown in FIG. 95. In order to confirm all the pieces of how-to-cook data JDi, it is necessary to operate an image feed key, not shown, at the input unit 15. If it is considered troublesome by the user, the user may obtain all the pieces of how-to-cook data JDi as the audio output by voice synthesizing IC 17J and speaker 18J, in place of the image display. This operation will be described in the following. It is assumed that the information of the contents shown in FIG. 94 is stored in relay box 3F and personal computer 2, respectively, and that all the recipe names MNi of FIG. 94 and the corresponding heating data KDi are stored in accordance with the above described method, in memory 11 of microwave oven 1J. Microwave oven 1J obtains by communication the data for audio output from relay box 3F when relay box 3F is connected, and from personal computer 2 when relay box 3F is not connected.

Figure 96:
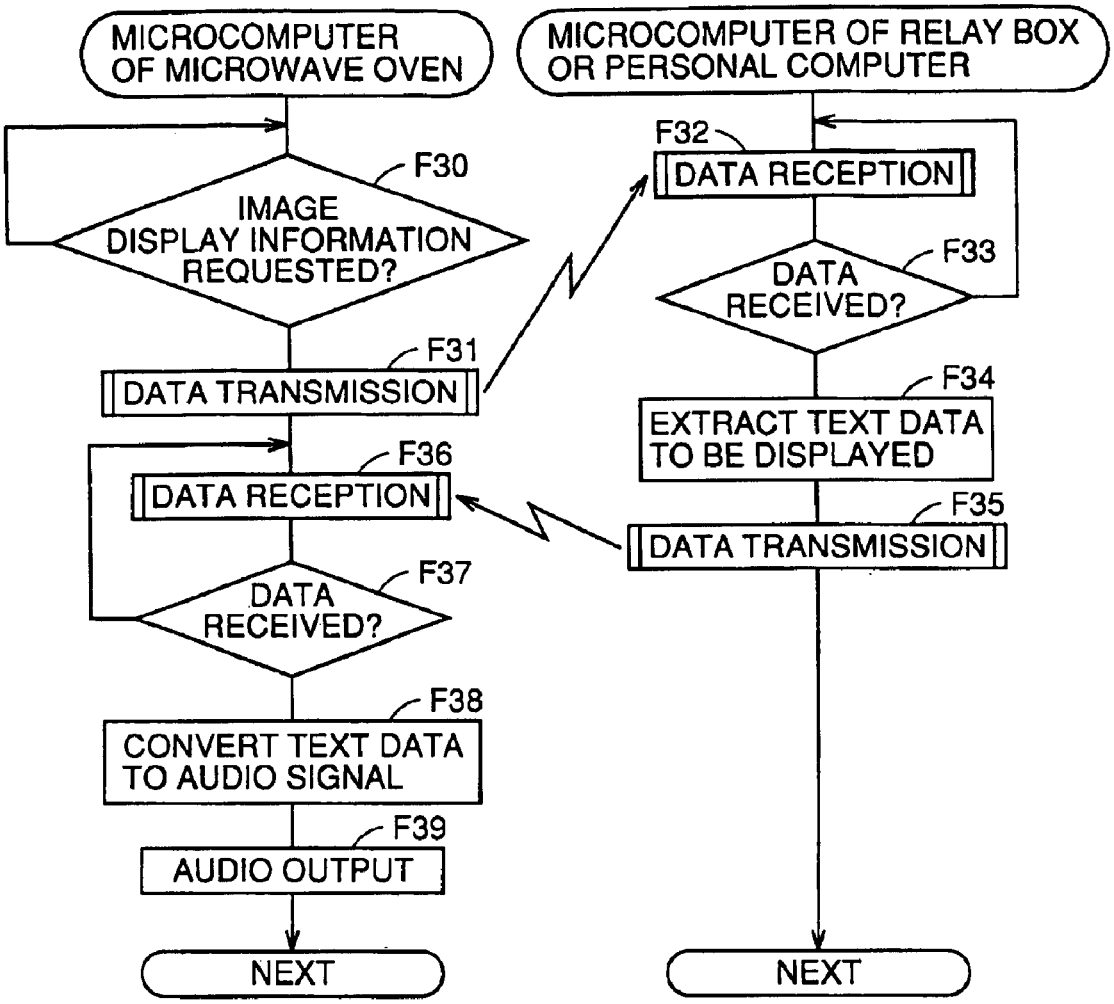
FIG. 96 is a flow chart of the audio output process of the how-to-cook data in accordance with the twenty-eighth embodiment of the present invention.
Figure 97A:
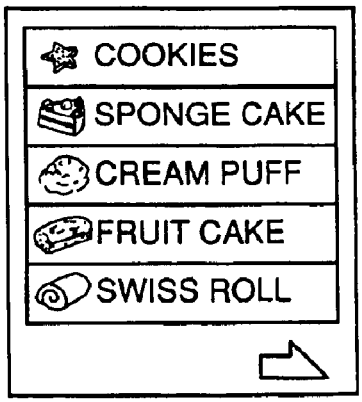
FIGS. 97A and 97B represent examples of images displayed on the microwave oven, in accordance with the process flow chart of FIG. 96.
Figure 97B:
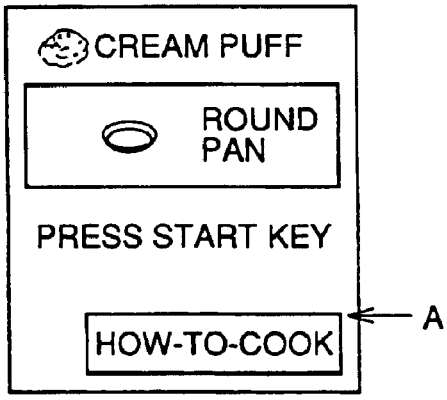

FIG. 96 is a flow chart of the audio output process of the how-to-cook data JDi in accordance with the twenty-eighth embodiment of the present invention. FIGS. 97A and 97B represent examples of the images displayed on microwave oven 1J in accordance with the process flow chart of FIG. 96.

When the user desires audio output in place of the image display of FIG. 95, the image display information request is transmitted from microcomputer 10 of microwave oven 1J to microcomputer 30 of relay box 3F or CPU 20 of personal computer 2 (F30, F31).

More specifically, a display for recipe selection of FIG. 97A is displayed on LCD panel 13 of microwave oven 1J, using all the recipe names MNi stored in advance in memory 11. Therefore, the user selects the desired recipe name on the image of FIG. 97A, by operating the input unit 15. When "cream puff" is selected, for example, the display of FIG. 97B appears on LCD panel 13.

When the user, viewing the image display, operates a start key, not shown, of input unit 15, microcomputer 10 reads the corresponding heating data KDi from memory 11 and controls heating and cooking accordingly. When the user desires audio output of the how-to-cook data JDi of the cream puff, the "how-to-cook" key denoted by the arrow A of FIG. 97B is pressed, and in response to this operation, microcomputer 10 transmits the image display information request. The image display information request includes codes representing the machine type specifying the machine type of microwave oven 1J, recipe name MNi (MN3: cream puff) of which information is requested and the type of the requested information (material data IDi of how-to-cook data JDi).

When microcomputer 30 of relay box 3F or CPU 20 of personal computer 2 receives the image display information request transmitted from the microwave oven 1J (F32, F33), the material data ID3 or the how-to-cook data JD3 corresponding to the recipe name MN3 represented by the image display information request is read from flash memory 31 or memory 21 and transmitted to microcomputer 10 of microwave oven 1J (F34, F35).

Microcomputer 10 of microwave oven 1J receives the transmitted material data ID3 or how-to-cook data JD3 (F36, F37) and performs the process of applying the data to voice synthesizing IC 17J where the data is converted to an audio signal and the voice is output from speaker 18J using the converted audio signal (F38, F39). The series of operations of converting the text data to audio signals and providing as audio outputs by using the voice synthesizing IC 17J and speaker 18J are performed in accordance with the known technique. Therefore, detailed description thereof is not given here.

Therefore, the how-to-cook data or the material data of the cream puff can be provided by voice, and hence it is unnecessary for the user to feed the images as shown in FIG. 95.

Twenty-Ninth Embodiment

The twenty-ninth embodiment will be described in the following. In the present embodiment, the configurations of FIGS. 90 and 91 are adopted. Self diagnosis information of a sensor unit 60 of the microwave oven 1J, information of frequently cooked recipes and time of use for each heating mode are transmitted as needed from microwave oven 1J of FIG. 90 and provided to the outside through relay box 3F or personal computer 2. Details will be described with reference to the figures.

FIG. 98 shows pieces of information stored in memory 11 of microwave oven 1J in accordance with the twenty-ninth embodiment of the present invention. Memory 11 stores, as shown in FIG. 98, sensor self diagnosis information 100J, cooking and heating recipe frequency information 200J, high frequency information 300J and time of use information 400J. The self diagnosis information 100J of sensor unit 60 of microwave oven 1J is stored in accordance with the format shown in FIG. 8, by microcomputer 10, into memory 11. The sensor self diagnosis information 100J consists of 8 bits of data, and by using each bit of data, self diagnosis information of each of the sensors in the sensor unit 60 is given. When the sensor unit 60 includes a temperature sensor and a moisture sensor detecting temperature and moisture in the heating chamber as well as a weight sensor detecting the weight of the food placed on a turntable, for example, 0th and 1st bits of sensor self diagnosis information 100J are allotted to temperature sensor, the 2nd and 3rd bits are allotted to the moisture sensor and the 4th bit is allotted to the weight sensor. By the states of respective bits allotted to the sensor, the self diagnosis information of the corresponding sensors (normal, abnormal and the like) is set.

The cooking recipe frequency information 200J includes one or more heating and cooking recipe names 201J, and frequency data 202J and recipe code 203J corresponding to each of the recipe names 201J. The heating and cooking recipe name 201J includes the recipe names obtained from the home page described above and the name of functions provided inherently as basic functions of heating and cooking of the microwave oven 1J, for example, "warm" representing the function of warming general food, "milk" representing the function of heating milk, and "sake" representing the function of heating sake. The frequency data 202J represent the number of times the heating operation is executed by the microwave oven 1J based on the heating data corresponding to the heating and cooking recipe name 201J. The recipe code 203J is used for uniquely specifying the corresponding heating and cooking recipe name 201J by the system.

High frequency information 300J is prepared by microcomputer 10 and stored in memory 11. More specifically, among the pieces of heating and cooking recipe frequency information 200J, those having high values of frequency data 202J, for example, three pieces having the highest values are extracted, and from the one having the highest value, the corresponding recipe codes 203J are registered as highly frequently cooked recipe codes 301J.

The time of use information 400J represents the total time of use of the heating unit 10B (the time driven) for each heating mode in the microwave oven 1J shown in FIG. 90. The time of use information 400J includes one or more heat source data 401J specifying the heat source driven for heating, and the time of use data 402J representing the total time of use of the heat source for heating, for each of the heat source data 401J. The time of use data 402J is set counted up minutes by minutes by microcomputer 10.

In this manner, in the twenty-ninth embodiment of the present invention, information representing the history of use of the microwave oven 1J and information representing normality of the microwave oven in accordance with the self diagnosis information from the sensor unit are registered in memory 11.

Figure 99:
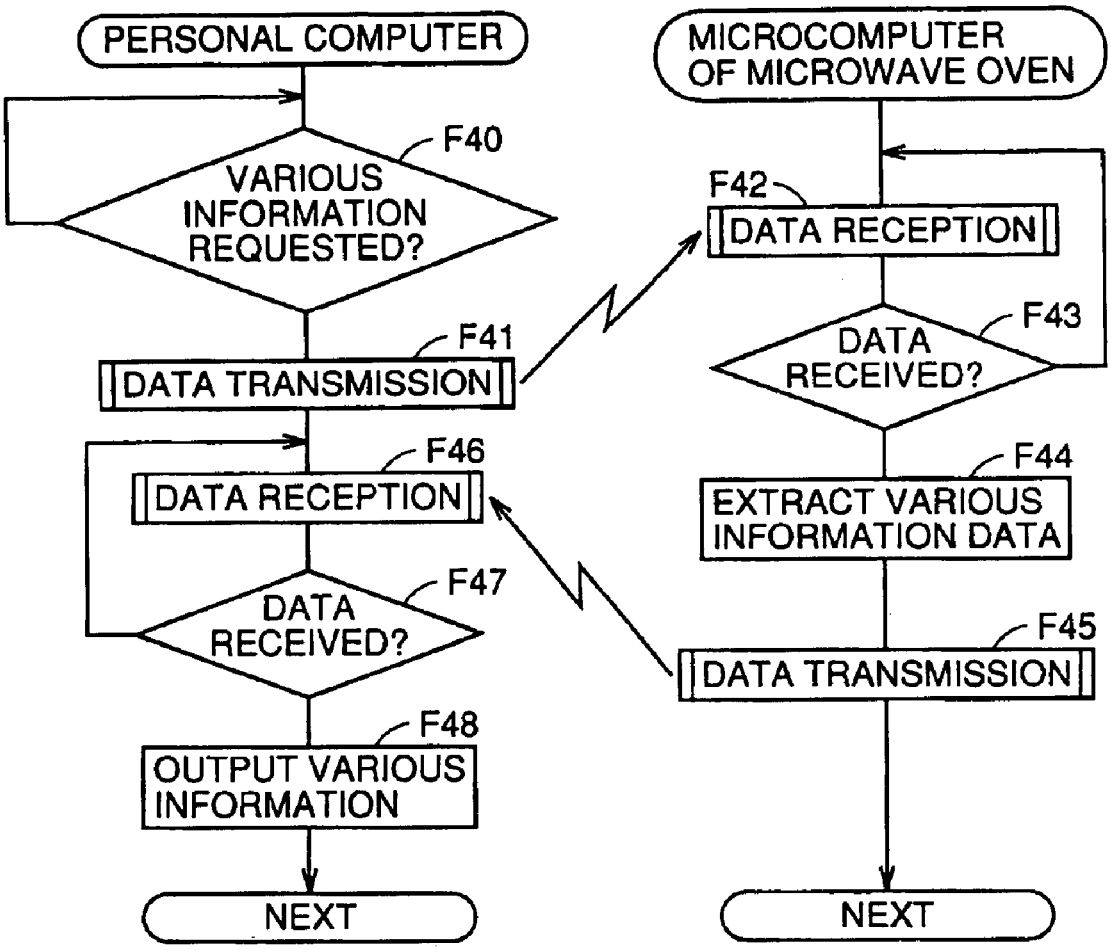
FIG. 99 is a process flow chart of receiving and outputting by a personal computer, information registered on the side of the microwave oven in association with the use of the microwave oven, in accordance with the twenty-ninth embodiment of the present invention.

FIG. 99 is a process flow chart of receiving and outputting the registered information as the microwave oven is used on the side of microwave oven 1J, by personal computer 2 in accordance with the twenty-ninth embodiment. According to the flow chart, based on the information 100J to 400J shown in FIG. 98, in response to a request from personal computer 2, information related to the history of use of the microwave oven 1J and the information as to whether the microwave oven 1J is normally operable without any defect are provided to the outside (externally output) through the personal computer 2. The process will be described in the following.

First, by the operation of the input unit 24 of personal computer 2, the user inputs a request of a desired information among various pieces of information such as shown in FIG. 98, on the side of microwave oven 1J, and the input request is transmitted to microcomputer 10 of microwave oven 1J through relay box 3F (F40, F41).

Microcomputer 10 receives the request, reads the requested information from memory 11 and transmits the information to CPU 20 of personal computer 2 through relay box 3F (F42–F45).

CPU 20 receives the transmitted information and provides the information as a printed output through output unit 23 or an image display through display unit 22 (F46–F48).

Though the process of communication passes through relay box 3F, the above described process may be performed through direct communication with personal computer 2 and microwave oven 1J, if relay box 3F is not provided.

Even when the information such as shown in FIG. 98 cannot be displayed on the side of microwave oven 1J, such information can be output and notified on the side of personal computer 2. Therefore, it is possible for the user to generally recognize the history of use and the normality (presence/absence of malfunction, contents of trouble) of microwave oven 1J and to immediately take necessary procedure such as analysis of the malfunction.

Thirtieth Embodiment

The thirtieth embodiment will be described in the following. In the embodiments described above, heating and cooking takes place in the microwave oven in accordance with the cooking recipe information MI provided on the home page of the host computer 4. In the thirtieth embodiment, a recipe originally prepared by the user is registered, and in accordance with the registered original recipe of the user, heating and cooking is automatically performed in the microwave oven. This operation will be described in the following. Though the present embodiment is applied to the system shown in FIGS. 90 and 91, the system configuration applicable is not limited.

Figure 100:
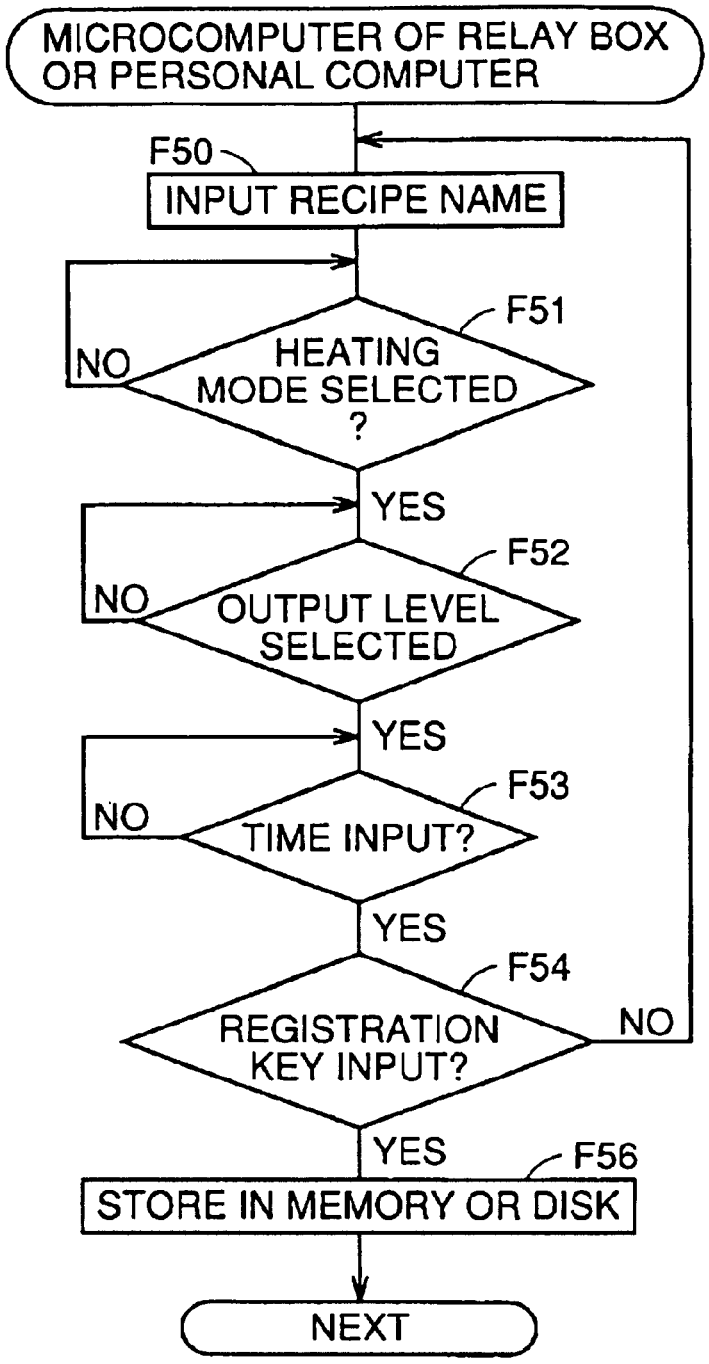
FIG. 100 is a process flow chart for the recipe registering operation in accordance with the thirtieth embodiment of the present invention.

FIG. 100 is a flow chart representing the operation of registering a recipe in accordance with the thirtieth embodiment of the present invention. The user operates the key input unit 38 or input unit 24 of relay box 3F or personal computer 2 in the following manner.

First, a recipe name representing the name of the original recipe of which registration is desired is input (F50). Thereafter, the heating mode of microwave oven 1J (microwave oven mode, oven mode, grill mode and the like) for heating and cooking the food of the input recipe is selected and input, output level (microwave output (W), Set temperature of the oven (° C.), duty ratio of the heater and the like) of the selected heating mode is selected and input, the heating time (minutes, seconds) is input and finally, the user presses the registration key (F51 to F54).

When the registration key is pressed, the series of data input so far are stored as the recipe name MNi and heating data KDi, in addition to the data shown in FIG. 94, in memory 31 or memory 21 (F56). When the data is stored, the input data are converted in advance to the format which can be readily recognized without decoding by microcomputer 10 and allows execution and control of heating unit 10B of microwave oven 1J, and stored as heating data KDi.

Though the heating data KDi is set in accordance with the original recipe of the user, it is possible to input and prepare the corresponding material and how-to-cook data IDi and JDi and to register in the similar manner.

As the data for heating and cooking in accordance with the originally prepared recipe by the user can be registered in the personal computer 2 or the relay box 3F in the similar manner as the cooking recipe data provided on the home page screen described above, it is possible for the user to automatically heat and cook the original recipe by the microwave oven 1J.

Figure 101:
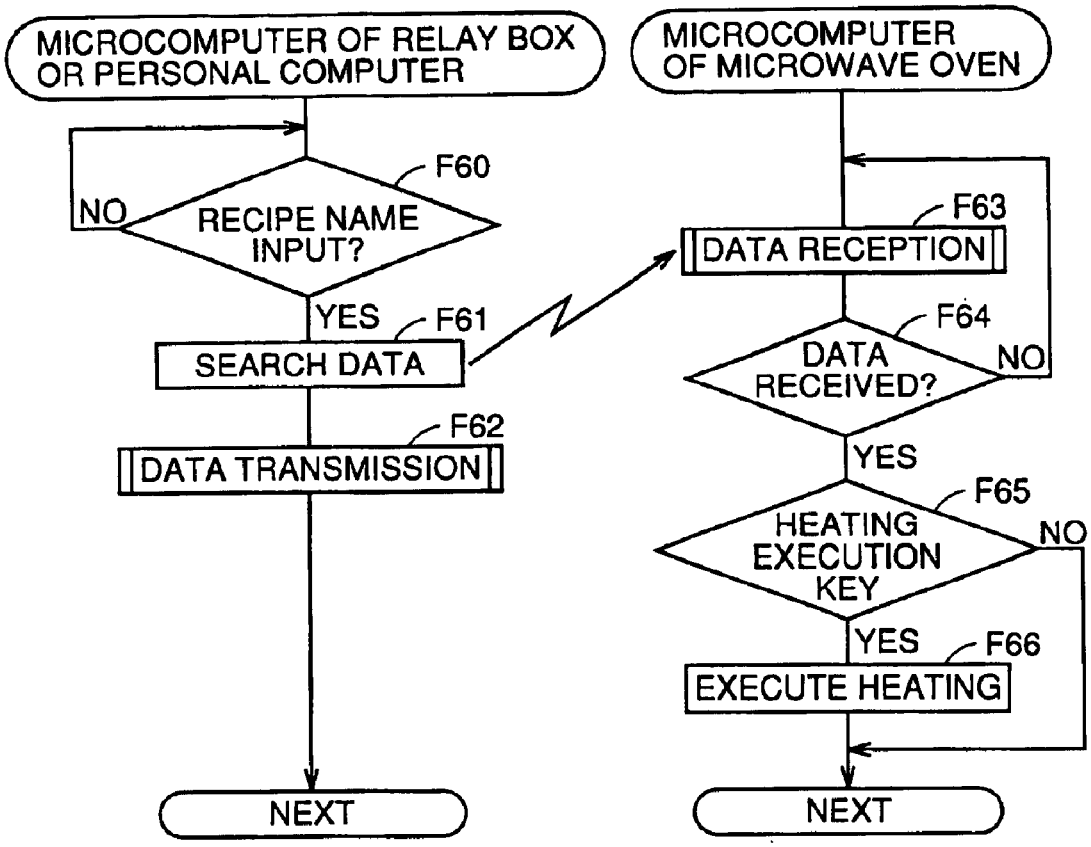
FIG. 101 represents a procedure for executing the heating and cooking operation in the microwave oven, based on the data prepared in accordance with the flow chart of FIG. 100.

FIG. 101 represents the procedure of executing heating and cooking by the microwave oven 1J based on the data prepared in accordance with the flow of FIG. 100. When the user inputs the recipe name by operating the key input unit 38 or input unit 24 of relay box 3F or personal computer 2 after the data of the user's original recipe is registered, the contents such as shown in FIG. 94 of the flash memory 31 or memory 21 are searched based on the input recipe name, and the corresponding heating data KDi is read and transmitted to microcomputer 10 of microwave oven 1J (F60 to F62). Microcomputer 10 receives the transmitted heating data KDi and temporarily stores in memory 11. Thereafter, when the heating start key of input unit 15 is pressed, heating unit 10B is controlled in accordance with the heating data KDi, and the desired cooking recipe of the user is automatically heated and cooked (F63 to F66).

Thirty-First Embodiment

Figure 102:
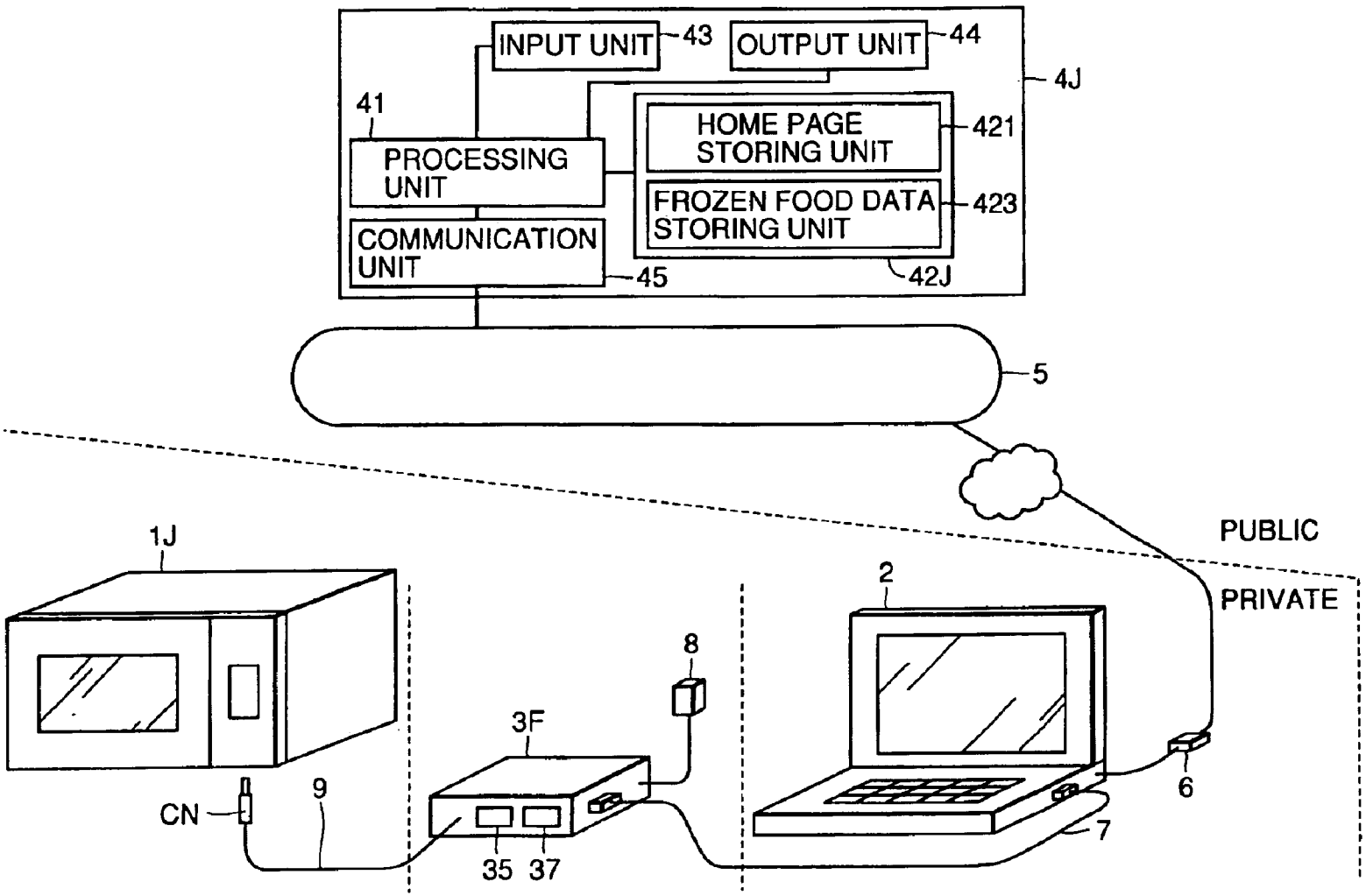
FIG. 102 is a schematic diagram representing a configuration of the microwave oven system applied to the thirty-first embodiment of the present invention.

Thirty-first embodiment of the present invention will be described in the following. FIG. 102 represents the configuration of the microwave oven system applied to the thirty-first embodiment of the present invention. The configuration of FIG. 120 differs from that of FIG. 90 in that the system of FIG. 102 includes a host computer 4J in place of host computer 4 of FIG. 90. The configuration of host computer 4J is different from that of host computer 4 in that host computer 4J includes a memory 42J in place of memory 42 of host computer 4. Memory 42J includes, in addition to the contents of memory 42, a frozen food data storing unit 423. Except this point, the configuration of FIG. 102 is the same as that shown in FIGS. 90 and 91, and therefore, description thereof is not repeated.

In the frozen food data storing unit 423, names of frozen food recipes specifying each of a plurality of commercially available frozen foods which can be heated and cooked by using a general microwave oven, and heating data for controlling the operation of heating of the microwave oven for heating and cooking the corresponding frozen food by the general microwave oven are stored in correspondence with each other.

Figure 103:
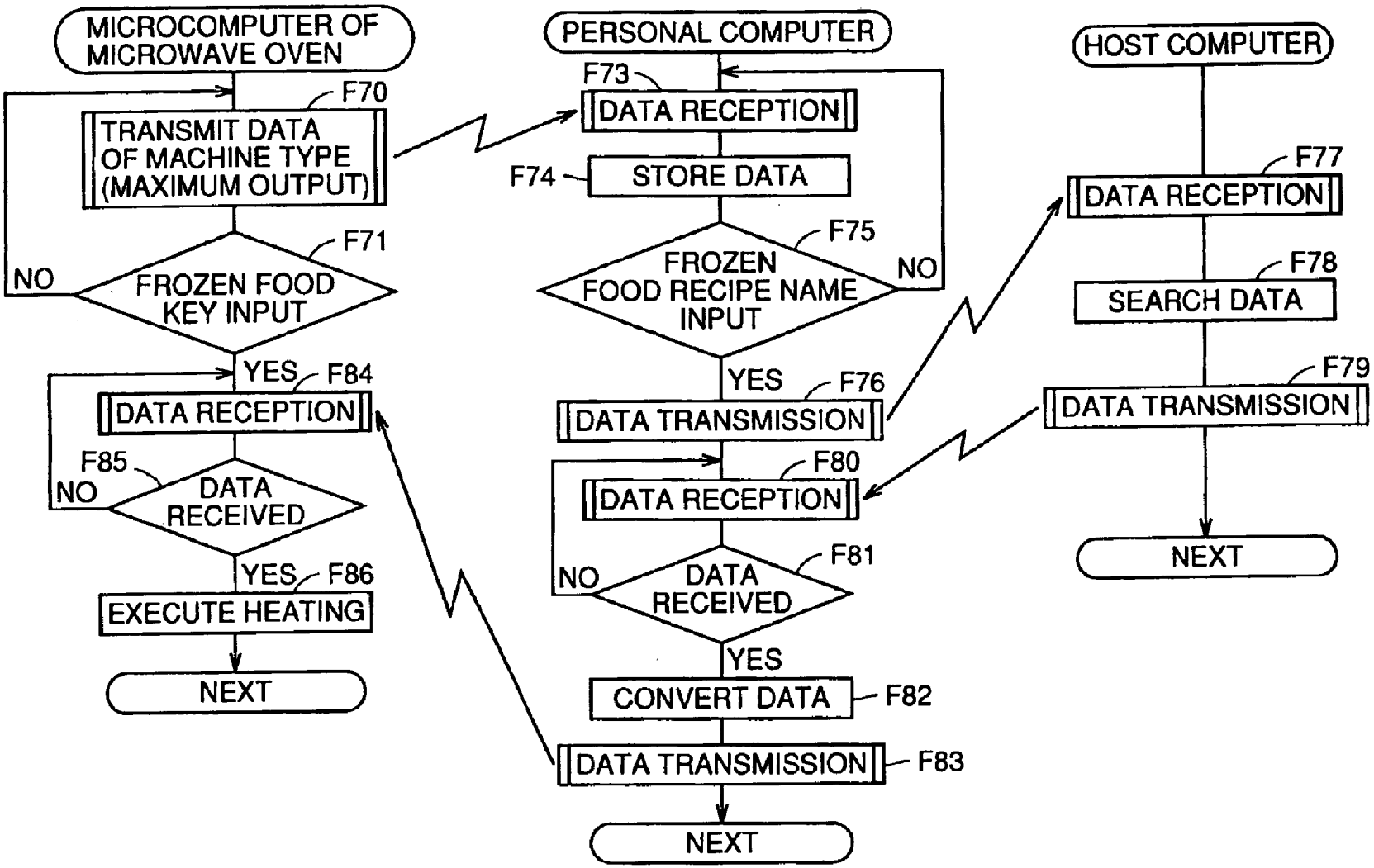
FIG. 103 is a process flow chart showing a series of processes for heating and cooking a frozen food in accordance with the thirty-first embodiment of the present invention.

FIG. 103 is a flow chart showing the procedure of heating and cooking the frozen food in accordance with the thirty-first embodiment of the present invention. When heating and cooking of a frozen food is desired, data representing the machine type or the maximum output level of the microwave oven is transmitted from microcomputer 10 of microwave oven 1J to personal computer 2, and receiving the data, the personal computer 2 stores the received data as the information of the connected microwave oven 1J, in memory 21 (F70 to F74). The recipe name of the commercially available frozen food is input by the user through the input unit 15 on microwave oven 1J (F71), and transmitted to personal computer 2.

Personal computer 2 receives as an input the recipe name of the frozen food transmitted from microwave oven 1J, and transmits to host computer 4J through the Internet 5 (F75, F76).

The processing unit 41 of host computer 4J receives the recipe name of the frozen food through the communication unit 45, searches and reads the corresponding heating data from the frozen food data storing unit 423, and transmits the data to personal computer 2 through the Internet 6 (F77 to F79).

The heating data transmitted from host computer 4J is received by CPU 20 of personal computer 2 (F80, F81) and the received heating data is converted to the heating data allowing optimal cooking by microwave oven 1J (output level, heating time) based on the previously registered machine type data or the maximum output data of the microwave oven 1J, and the converted heating data is transmitted to microcomputer 10 of microwave oven 1J (F82 and F83). The conversion of the heating data is performed, for example, in the following manner. When the information previously received from microwave oven 1J represents the microwave maximum output of 800 W and the heating data received from host computer 4J requires microwave heating for five minutes at the output level of 500 W, the ratio of the microwave outputs is reflected on the heating time, so that the received heating data is converted to the microwave maximum output of 800 W and the heating time of three minutes and eight seconds, and the converted data are transmitted to microwave oven 1J.

Microcomputer 10 of microwave oven 1J proceeds to the operation of heating, in accordance with the received converted heating data (F86).

In this manner, the heating time of the commercially available frozen food is automatically converted to the optimal heating time with the optimal output level of the microwave oven 1J connected to personal computer 2 and the heating can be done by the microwave oven 1J based on the converted data. Therefore, the operation of adjusting output of the microwave oven 1J by the user is unnecessary, and failure of heating and cooking resulting from erroneous input by the user can be avoided.

Thirty-Second Embodiment

The thirty-second embodiment will be described in the following. In the present embodiment, recipe information MI is registered in the host computer, from the outside through the Internet, and the recipe information MI is supplied to users. Here, recipe information MI using an item (material) on sale at a shop, or a recipe information MI originally prepared by a user is described as the example of such recipe information MI, though not limited thereto.

Figure 104:
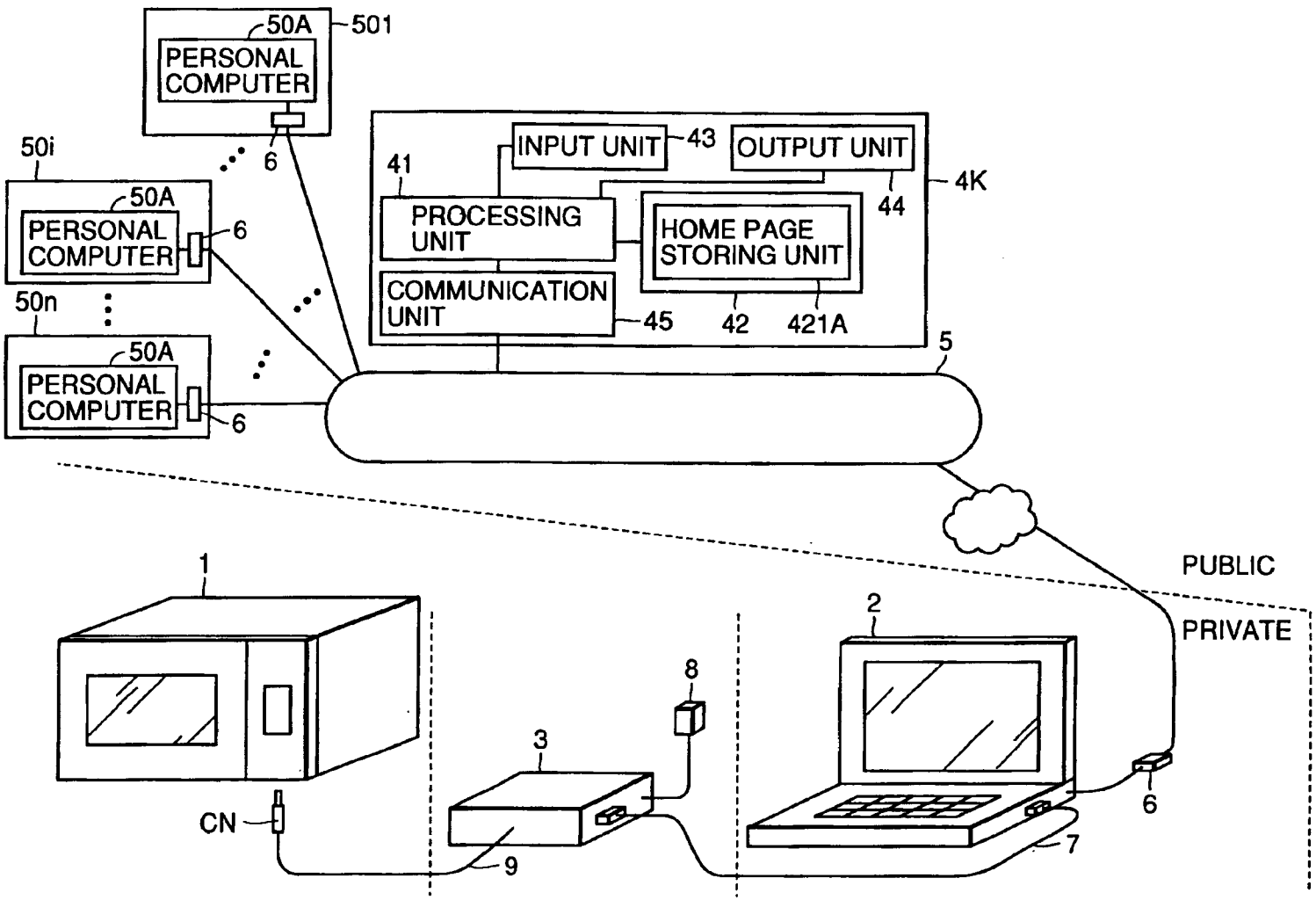
FIG. 104 shows a system configuration for registering and supplying recipe information in accordance with the thirty-second embodiment of the present invention.

FIG. 104 shows a system configuration for registering and supplying the recipe information in accordance with the thirty-second embodiment of the present invention. The system configuration is different from the system configuration shown in FIG. 1 in that in the system configuration of FIG. 104, a host computer 4K is provided in place of the host computer 4 of FIG. 1, and that a personal computer 50A of each of various shops 50*i* (i=1, 2, 3, . . . n) including a supermarket is connected through a modem 6 to the Internet 5. In this manner, a personal computer 2 of a general user's residence, a personal computer 50*i* at a shop and the host computer 4K are connected through the Internet 5. Except these points, the configuration of FIG. 104 is the same as that of FIG. 1, and hence description is not repeated.

Here, the system for registering and supplying recipe information utilizing the microwave oven system shown in FIG. 1 in accordance with the first embodiment is described as an example. The configuration of the microwave oven system utilized is not limited to that of the first embodiment, and configuration in accordance with any of the above described embodiments may be used.

Referring to FIG. 104, host computer 4K includes, in memory 42, a home page storing unit 42 1A in which various pieces of recipe information MI including a piece of recipe information MI based on the information externally received through the Internet 5, is registered as the home page information. Except this point, the configuration of host computer 4K is the same as that of host computer 4, and therefore description is not repeated.

Figure 105:
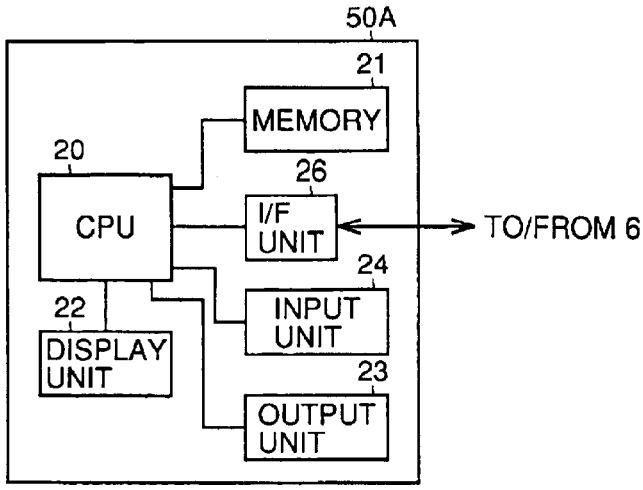
FIG. 105 shows a configuration of a personal computer 60A installed in a shop 50*i* of FIG. 104.

FIG. 105 shows the configuration of a personal computer 50A installed in a shop 50*i* of FIG. 104. As can be seen from the figure, personal computer 60A includes CPU 20, memory 21, display unit 22, output unit 23, input unit 24 and I/F unit 26 of personal computer 2 shown in FIG. 2. The operations of these units are the same as described with reference to FIG. 2, and therefore, description is not repeated. FIGS. 106 to 112 represent examples of home page images displayed in accordance with the home page information stored in home page storing unit 421A of host computer 4K shown in FIG. 104. For simplicity of description, only the portions denoted by the arrows are translated into English.

First, the procedure for registering recipe information MI of a recipe using items including a material on sale (hereinafter referred to as the item on sale) in the home page storing unit 421A by the operation of personal computer 50A at the shop 50*i* will be described.

When a shop clerk of the shop 50*i* operates personal computer 50A and accesses a prescribed address corresponding to the host computer 4K through the Internet 5, the home page display of FIG. 106 appears on the display unit 22 of personal computer 50A, by the process of processing unit 41 of host computer 4K.

Figure 107:
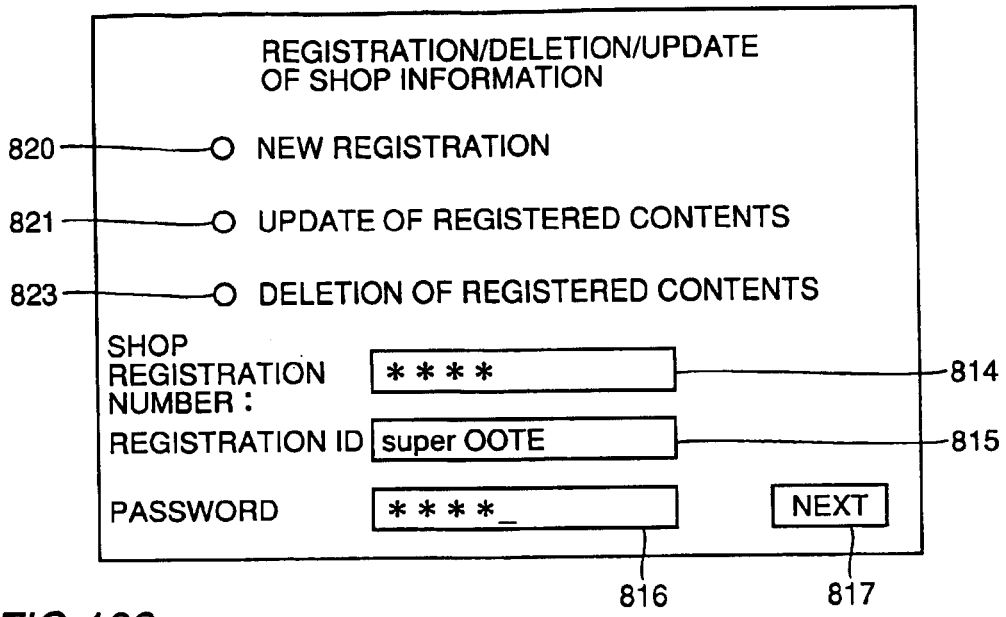

In order to register recipe information MI of the recipe using the item on sale at shop 50*i*, the clerk clicks through the input unit 24 the item "shop information registration" denoted by the arrow A in FIG. 106, and the home page image of FIG. 107 appears. On this home page image display, there are check buttons 820 to 823 corresponding to processes of "new registration", "update of registered contents" and "deletion of registered contents" for the information related to the shop 50*i*, and the shop clerk is asked to select any of the processes. The shop clerk selects the process of "new registration", for example, clicks the check button 820 through the input unit 24, and then clicks the display area of input box 815 to enter a registration ID through the input unit 24. Thereafter, the chop clerk clicks the display area of input box 816, and enters a password through input unit 24. After these operations, the shop clerk clicks the display area of button 817 so as to notify the completion of the series of operations to host computer 4K.

By the series of operations, the input information is applied to the processing unit 41 of host computer 4K, and the processing unit 41 registers the given information as the information corresponding to the shop 50*i*, in a prescribed area (not shown) of memory 42.

Figure 108:
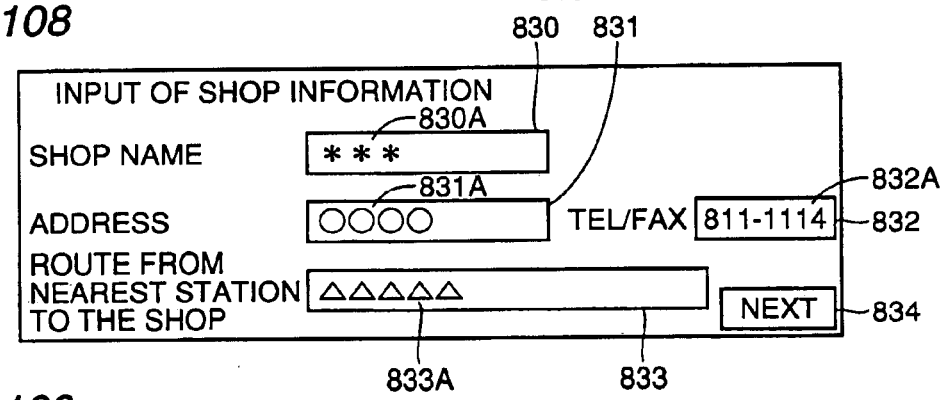

Thereafter, by host computer 4K, the home page image of FIG. 108 is displayed on the display unit 22 of personal computer 50A of the shop 50*i*. The shop clerk operates the input unit 24 to enter the name 830A, an address 831A, telephone/facsimile number 832A, and route information 833A from the nearest station to the shop 50*i*, successively, in input boxes 830 to 833 on the screen of FIG. 108. Thereafter, button 834 is clicked, so that the pieces of information input to input boxes 830 to 833 are transmitted to host computer 4K. The processing unit 41 of host computer 4K receives the pieces of information and registers the pieces of informations in a prescribed area of memory 42, in correspondence with the information input through the process step of FIG. 108.

Figure 109:
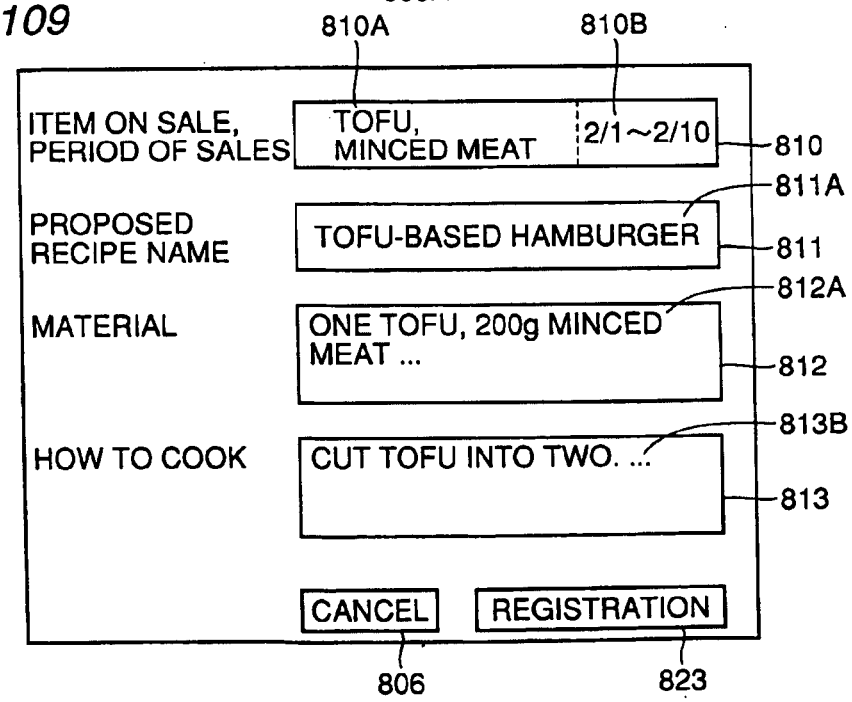

Thereafter, the processing unit 41 of host computer 4K displays the home page image of FIG. 109 on the display unit 22 of personal computer 50A at the shop 50*i*.

Figure 113:
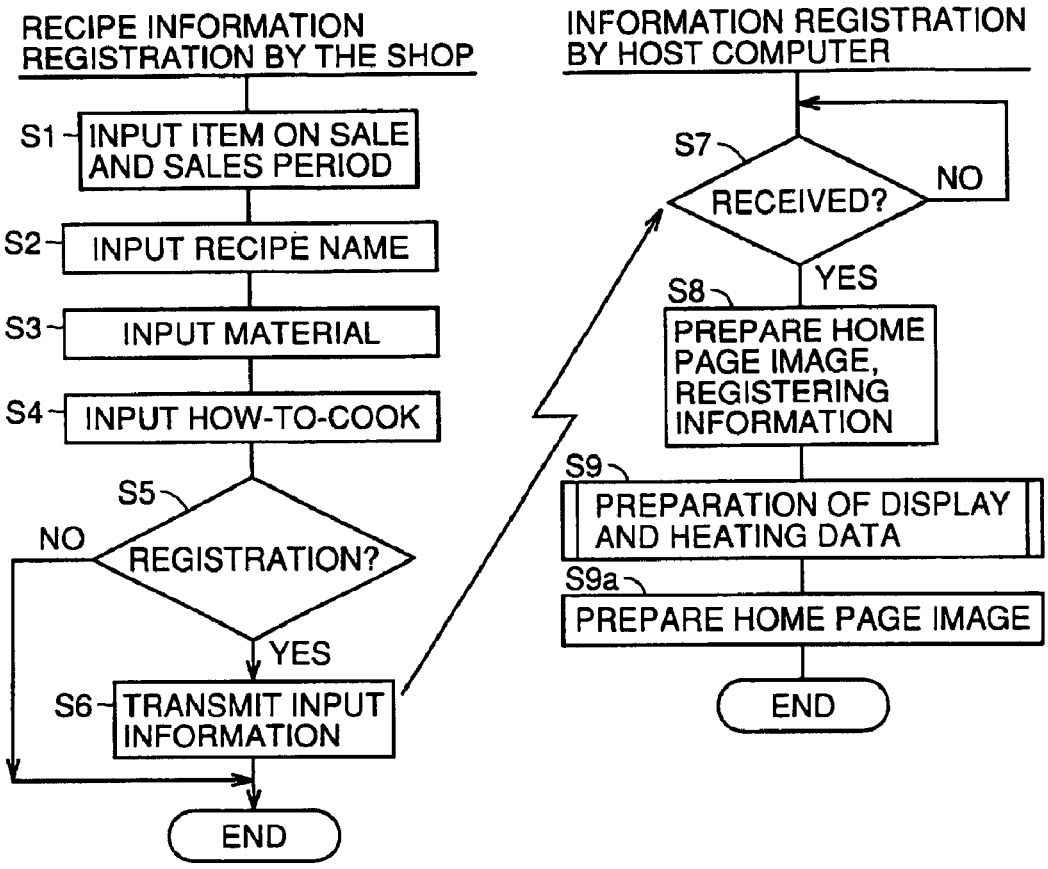
FIG. 113 is a flow chart representing the procedure of registering recipe information MI by the shop 50*i*.

FIG. 113 is a flow chart representing the procedure for registering recipe information MI by the shop 50*i*. When the shop clerk wishes to register in the home page the recipe information MI of the recipe using a specific item on sale at the shop 50*i* to promote sales of the item, the information for the recipe information MI is input through the display of FIG. 109, in accordance with the flow chart of FIG. 113.

First, the shop clerk inputs, through the input unit 24, the name 810A of the item on sale and information 810B representing the period of sales in input box 810 shown in FIG. 109 (S1 of FIG. 113).

Thereafter, the shop clerk successively input the recipe name 81 A of the recipe using the item on sale, the material information 812A and how-to-cook information 813A, in input boxes 811 to 813 through input unit 24 (S2 to S4). When input of these pieces of information is completed, button 823 is clicked (YES in S5), and the pieces of information input to input boxes 810 to 813 are transmitted to host computer 4K (S6). Upon reception of the pieces of information (YES in S7), the processing unit 41 of host computer 4K registers the received information in the prescribed area of memory 42 in correspondence with the shop information received in the process step of FIG. 108, and prepares the home page image of FIG. 110 (S8), which will be described later.

Figure 110:
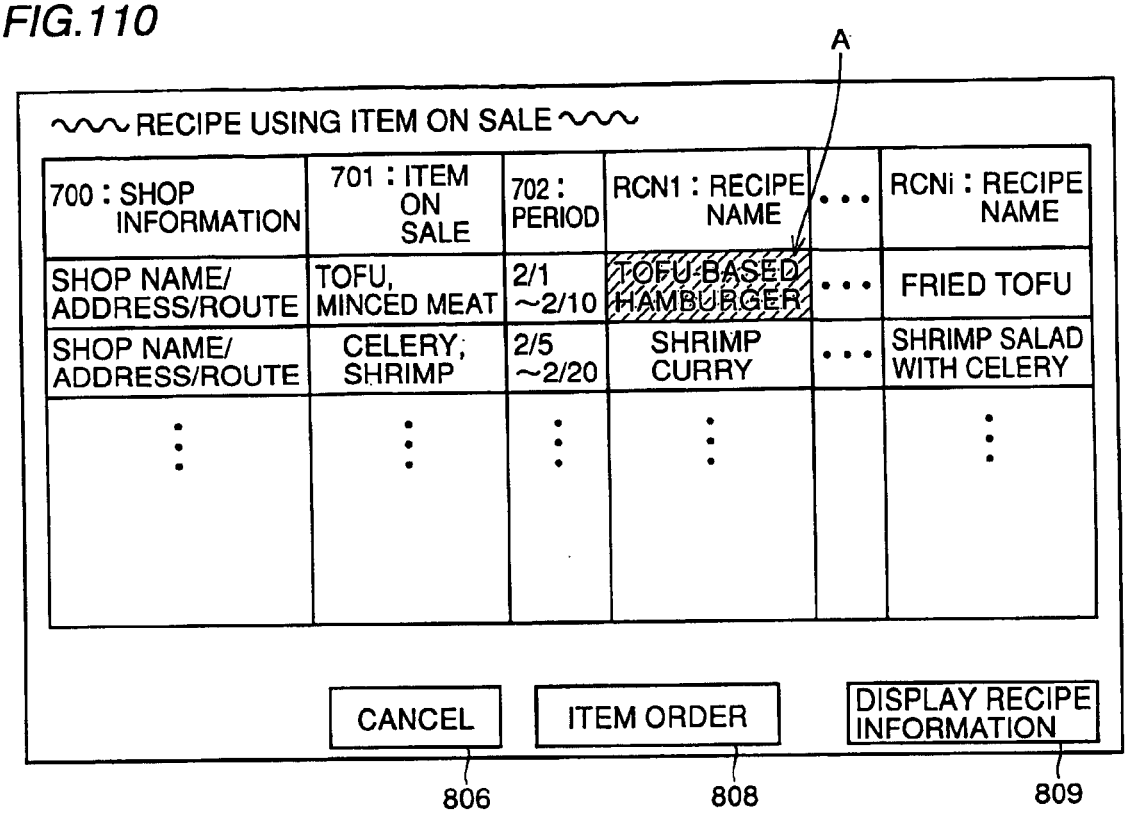

On the home page image of FIG. 110, in correspondence with the shop information 700 (shop name 830A, address 831A, telephone/facsimile number 832A and route information 833A) of the shop 50*i* input through the display of FIG. 108, the name of the item on sale 810A, the period of sales 810B and the proposed recipe name 811A input through display of FIG. 109 are displayed as the item on sale 701, the period of sales 702 and recipe name RCNi (i=1, 2, . . . ).

Thereafter, based on the information received in step S7, the process in accordance with the steps T1 to T2 of FIG. 6 are executed (S9). More specifically, the process for preparing and converting the display data DS13 (material data IDi and how-to-cook data JDi) for the home page information MI and the heating data KDi is executed. Thus, the home page image display of FIG. 112, which will be described later, is prepared, for example (S9*a*).

Figure 114:
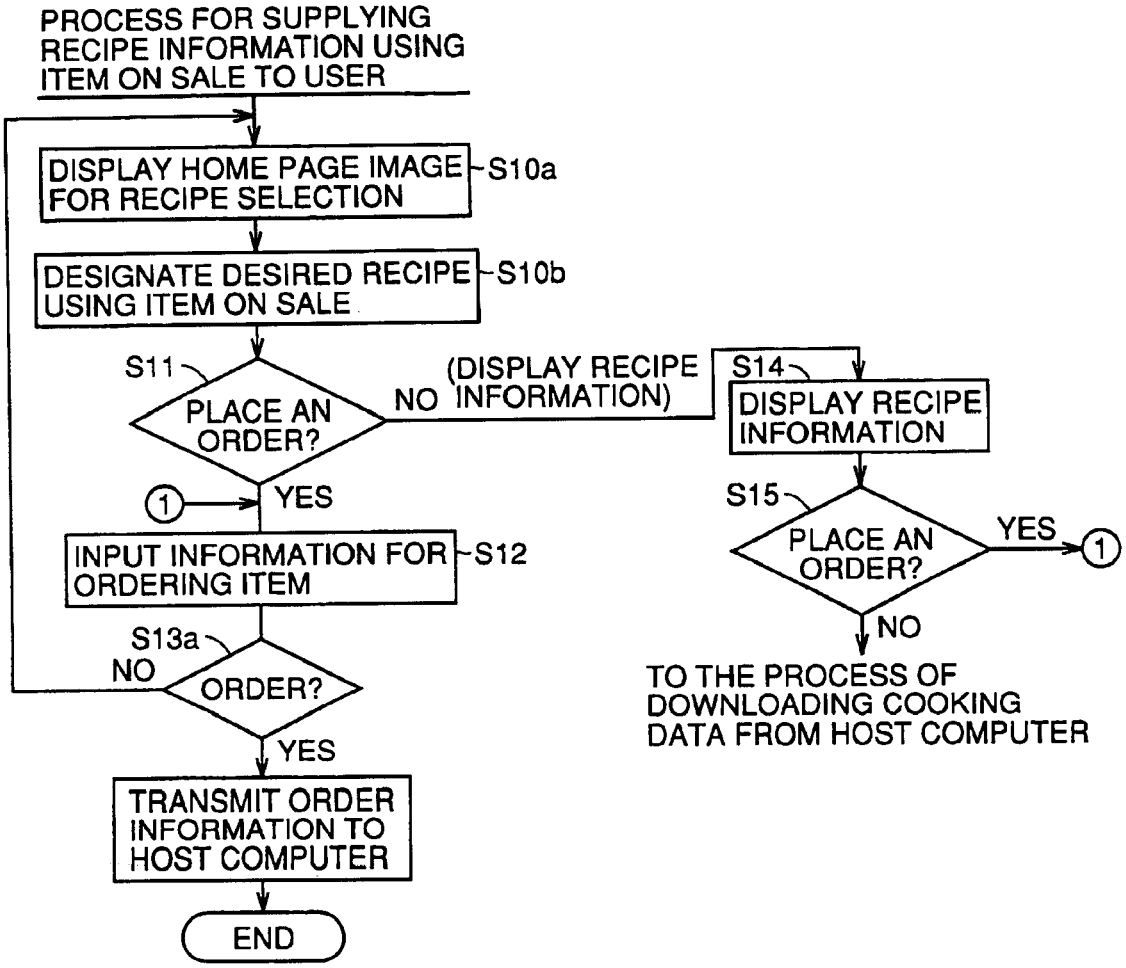
FIG. 114 is a process flow chart for supplying the recipe information MI registered in accordance with the procedure of FIG. 113 to the user.

Through the steps described above, the shop clerk of the shop 50*i* can register the information of the shop 50*i* and the recipe information MI of the recipe using the item on sale at the shop 50*i*, in home page storing unit 421A FIG. 114 is a process flow chart for supplying the recipe information MI registered through the steps of FIG. 113 to the user.

The supply of recipe information MI using the item on sale to the user will be described with reference to the flow chart of FIG. 114.

When a user accesses a prescribed address of host computer 4K through personal computer 2, the home page image of FIG. 106 is displayed on the display unit 22 of personal computer 2.

When the user operates the input unit 24 and clicks "recipe using item on sale" denoted by the arrow B, the home page image of FIG. 110 appears on the display unit 22 of personal computer 2, by the process of the processing unit 41 of host computer 4K (S10*a*).

When the recipe name RCN1 ("tofu-based hamburger") denoted by the arrow A, for example, on the image of FIG. 110 appearing on display unit 22, is clicked designating the recipe as the desired recipe, the recipe name RCN1 is highlighted, indicating that it has been designated as the desired recipe (S10*b*).

Figure 111:
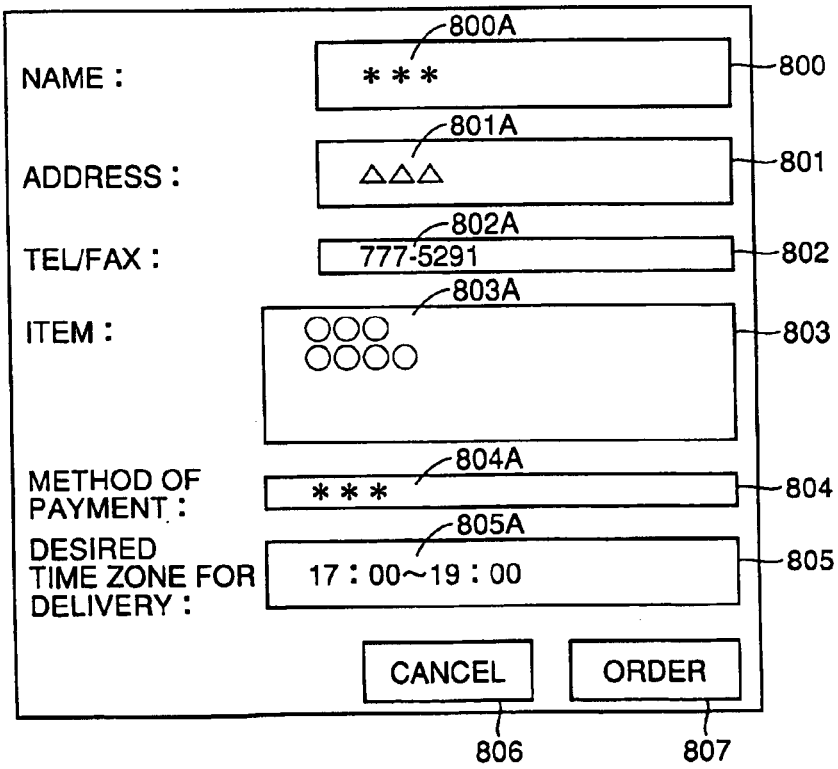

Thereafter, whether the button 808 or 809 is clicked by the user through the operation of input unit 24 is determined (S11). When button 808 is clicked to specify that the item which is the material of the designated recipe name RCN1 ("tofu-based hamburger") is to be ordered with the shop 50*i* presenting the recipe RCN1 (YES in S11), the home page image of FIG. 111 is displayed by host computer 4K on the display unit 22 of personal computer 2, asking the user to input the information necessary for ordering the item. The user operates the input unit 24, and enters in input boxes 800 to 805 of FIG. 111, user name 800A, address 801A, telephone/facsimile number 802A, name of the ordered item 803A, and the information 804 and 805A related to the method of payment and the desired time zone of delivery of the ordered item (S12).

Thereafter, when button 807 is clicked and the order using the information input through the home page display of FIG. 111 is placed (YES in S13*a*), the pieces of information 800A to 805A input in input boxes 800 to 805 are transmitted to host computer 4K (S13*b*). Thereafter, in host computer 4K, processing unit 41 performs necessary processing for ordering.

When button 806 is clicked by the user on the image display of FIG. 111 canceling the order (NO in S13), the flow returns to the step S10*a* described above, and the image of FIG. 110 appears.

When the button 808 of FIG. 110 is not clicked in step S11 and only the button 809 is clicked to ask display of the image of recipe information MI of the desired recipe name RCN1 ("tofu-based hamburger") (NO in S11), the host computer 4K displays the image (see FIG. 112) of the corresponding recipe information MI (S14).

Figure 112:
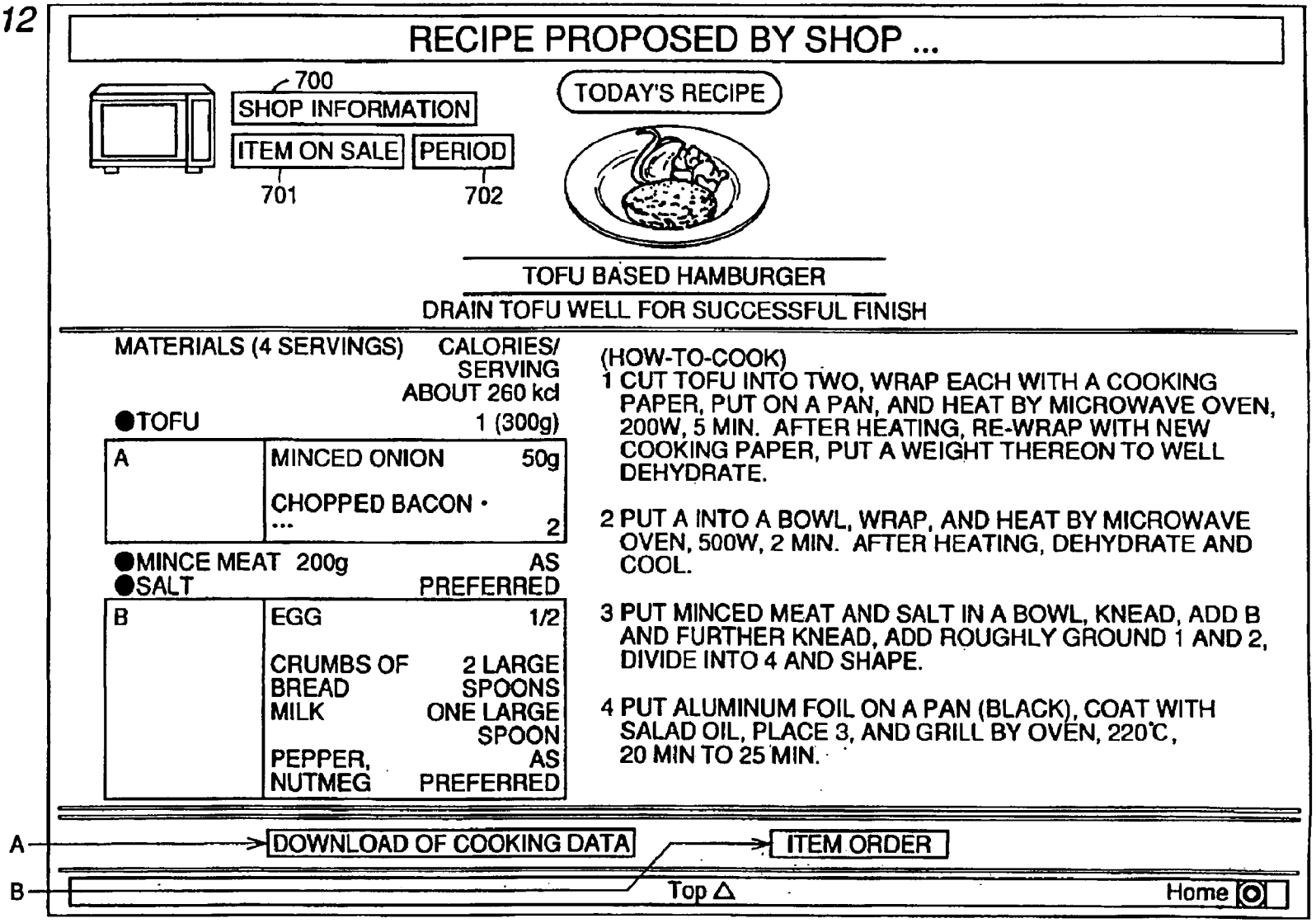

The user, looking at the home page image of FIG. 112, confirms the material and the method of cooking of the desired recipe name RCN1 ("tofu-based hamburger"), and if the user wishes to place an order for the material to prepare, the user clicks the button denoted by the arrow B of FIG. 112 (YES in S15). As a result, the process following the step S12 described above is performed, and the order of the item is placed.

In the display of FIG. 112, when "download of cooking data" denoted by the arrow A is clicked, the recipe information MI (information prepared in step S9 of FIG. 113) of the recipe name RCN1 ("tofu-based hamburger") is downloaded from the host computer 4K to personal computer 2 in the similar manner as described above, and the information is stored in memory 21 of personal computer 2. Thus, in microwave oven 1 connected to personal computer 2, it becomes possible to cook the desired recipe of the recipe name RCN1 ("tofu-based hamburger") using the downloaded recipe information MI.

As the home page display of FIG. 112 includes the shop information 700 proposing the recipe, the name of the item 701 which is on sale at the shop and the period of sale 702, it is possible for the user to confirm these pieces of information without the necessity of returning to the preceding image display (display of FIG. 110). As to the method of preparing the home page display of FIG. 112, the process described with reference to FIG. 6 is adopted.

According to the procedure described above, it is possible for the user to readily obtain the recipe information MI of the desired recipe using the item on sale proposed by the shop 50*i*, and to heat and cook in accordance with the recipe information MI by the microwave oven 1. Further, it is also possible to place an order for the material of the recipe with the shop 50*i* through the Internet 5 and host computer 4K.

Figure 115:
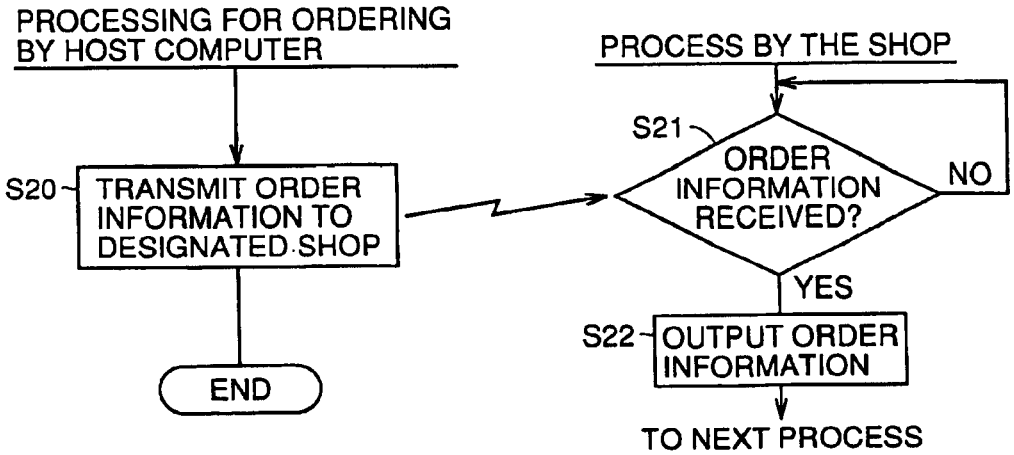
FIG. 115 shows a process flow chart when an order for an item is placed with shop 50*i*, by the click of a button 807 of FIG. 111.

FIG. 115 is a process flow chart when the order for the item is placed with the shop 50*i* by the click of button 807 of FIG. 111.

Referring to FIG. 115, when button 807 is clicked, host computer 4K receives the pieces of information 800A to 805A input to input boxes 800 to 805 of FIG. 111, and transmits the received information to personal computer 50A of the designated shop 50*i*. The designated shop 50*i* represents the shop 50*i* corresponding to the shop information 700 proposing the recipe name RCN1 ("tofu-based hamburger"), when the button 808 is clicked with the recipe name RCN1 ("tofu-based hamburger") denoted by the arrow A is being designated (highlighted) in FIG. 10.

Personal computer 50A of the shop 50*i* receives the pieces of information 800A to 805A transmitted from host computer 4K (S21), and the output through output unit 23 or display unit 22 (S22). Thus, it is possible for the shop clerk of the shop 50*i* to prepare the ordered item, deliver the item in the designated time zone to the user who placed the order, and receive the payment by the method as specified by the user.

In the displays of FIGS. 109 to 11, when button 806 is clicked, the information input through the display is canceled, and the display which was appearing immediately before is displayed again.

As described above, in accordance with the flow chart of FIGS. 114 and 115, it is possible for the user to readily obtain the recipe information MI of the recipe using the item on sale proposed by the shop 50*i*, place an order for the material of the recipe (including the item on sale) with the shop 50*i* so that the material is delivered to the users' home, simply by the operation of the personal computer 2. Therefore, it is possible for the user to readily obtain the material necessary for the desired recipe at a low cost while staying at home, without the necessity of going out shopping, and further, it is possible to cook the desired recipe automatically by the microwave oven 1 in accordance with the corresponding recipe information MI.

Though registration and supply of the recipe information MI proposed by the shop 50*i* has been described for the operation of registering recipe information MI externally through the Internet 5, it is not limiting. For example, it is possible to register recipe information originally prepared by a general user in the home page storing unit 421A of host computer 4K through the information processing terminal and the Internet 5, and to supply the recipe information to other user who wishes to obtain the information, in the similar manner as described above.

As to the method of payment for the item ordered with the shop 50*i*, not only payment by cash but also electric commerce using electronic money may be possible.

Thirty-Third Embodiment

The thirty-third embodiment of the present invention will be described in the following.

According to the present embodiment, in the microwave oven system described above, the mobile equipment and the microwave oven are connected directly with each other for communication, by a connector. More specifically, the mobile equipment and the microwave oven are directly connected to each other without using a cable. More specifically, when the mobile equipment and the microwave oven are connected to each other, these two are integrated.

As to the various functions of the microwave oven system, the microwave oven and the mobile equipment in the present embodiment are the same as those of the embodiments described above, except the function related to the manner of connection for establishing communication between the microwave oven and the mobile equipment. Therefore, only the function related to the manner of communication between the microwave oven and the mobile equipment will be described.

Figure 116A:
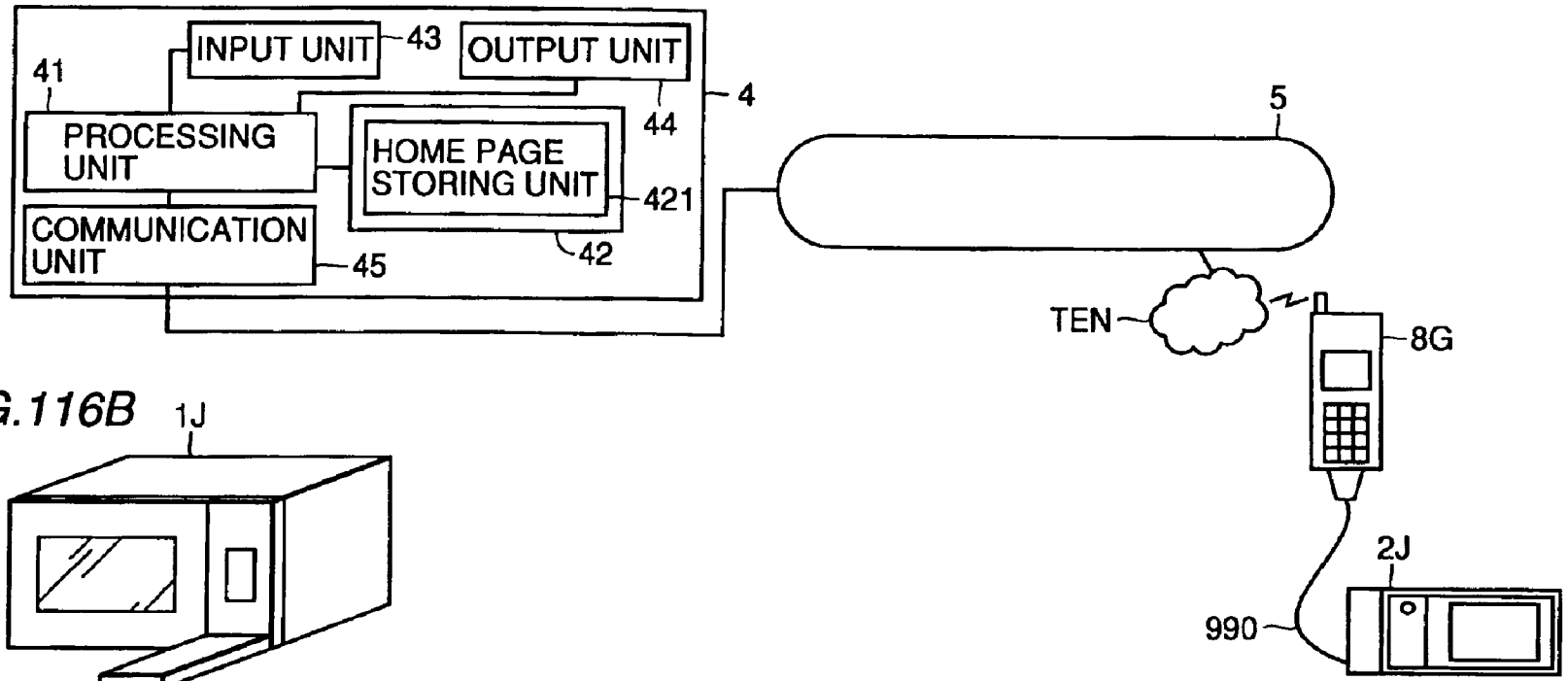
FIGS. 116A and 116B represent schematic configuration of the microwave oven system in accordance with the thirty-third embodiment of the present invention.
Figure 116B:
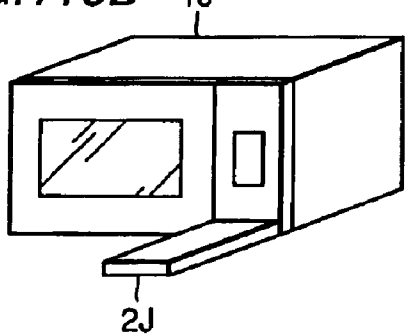
Figure 117B:
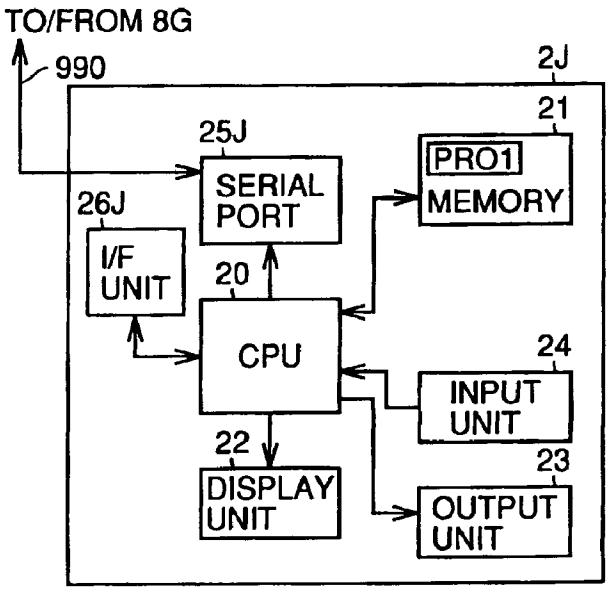
FIGS. 117A and 117B represent block configurations of the microwave oven and the mobile equipment.
Figure 117A:
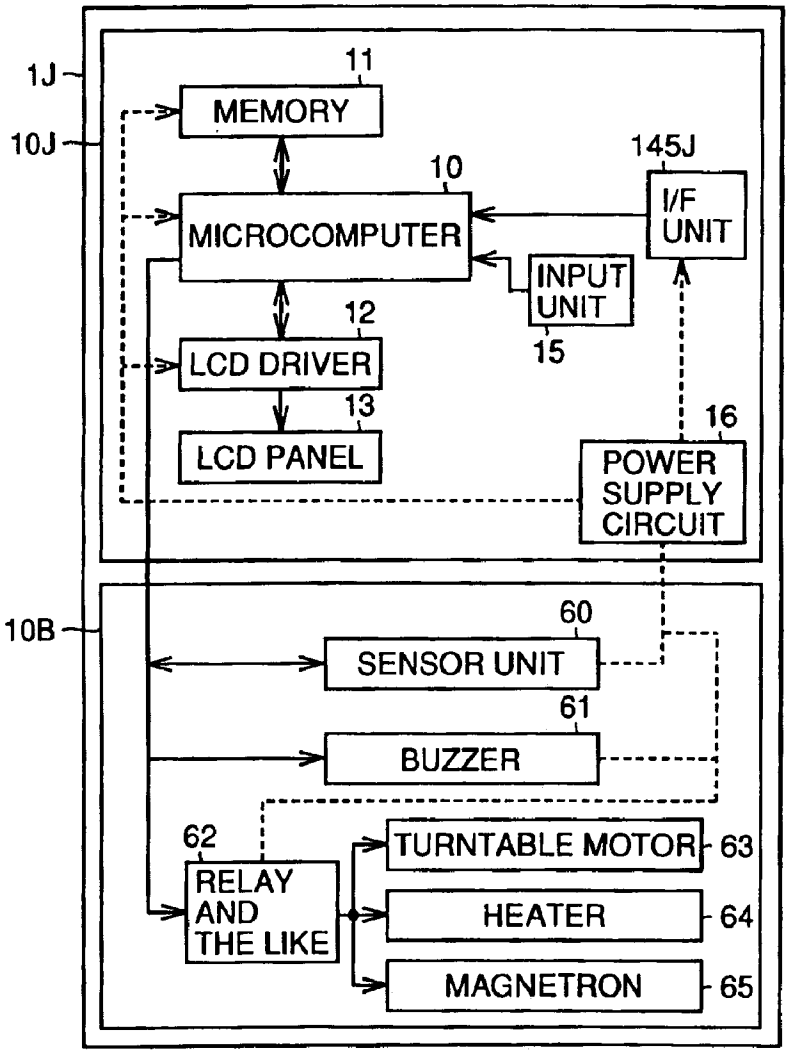

FIGS. 116A and 116B represent schematic configurations of the microwave oven system in accordance with the thirty-third embodiment of the present invention, and FIGS. 117A and 117B represent block configurations of the microwave oven and the mobile equipment in accordance with the thirty-third embodiment.

In FIGS. 116A and 116B, the microwave oven system includes, in public, the Internet 5 and a host computer 4 connected to the Internet 5. On the user's side, the system includes a microwave oven 1J provided in the private kitchen, a mobile equipment 2J connected to microwave oven 1J, and a portable telephone 8G capable of transmitting/receiving digital information for establishing connection for communication between the Internet 5 and mobile equipment 2J through a telephone line TEN.

In the private kitchen, mobile equipment 2J is directly connected to microwave oven 1J, without using a cable or the like.

Referring to FIGS. 117A and 117B, microwave oven 1J includes a control unit 10J and a heating unit 10B similar to that described above. Control unit 10J includes, in place of I/F unit 145 of control unit 10G described above, an I/F unit 145J. Except this point, the configuration of control unit 10J is the same as described above, and therefore, description thereof is not repeated. I/F unit 145J includes, for connecting mobile equipment 2J to microcomputer 10 for establishing communication, a connector CN11 (which will be described later) to which a connector CN12, which will be described later, of mobile equipment 2J is connected.

Mobile equipment 2J includes, in place of the serial port 25G of mobile equipment 2G described above, a serial port 25J, and in addition to the configuration of mobile equipment 2G described above, includes an I/F unit 26J. Except this point, the configuration of mobile equipment 2J is the same as that of mobile equipment 2G described above, and therefore, description is not repeated. Serial port 25J connects for communication the portable telephone 8G to mobile equipment 2J through a dedicated cable 990. I/F unit 26J has a connector CN12 (which will be described later) to which connector CN11, which will be described later, of I/F unit 145J is connected.

Figure 118A:
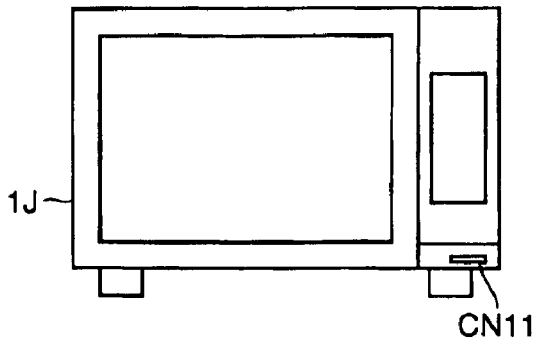
FIGS. 118A to 118C show the manner of connecting a mobile equipment 2J to microwave oven 1J.
Figure 118B:
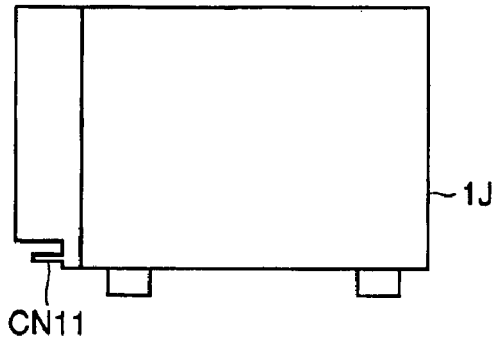
Figure 118C:
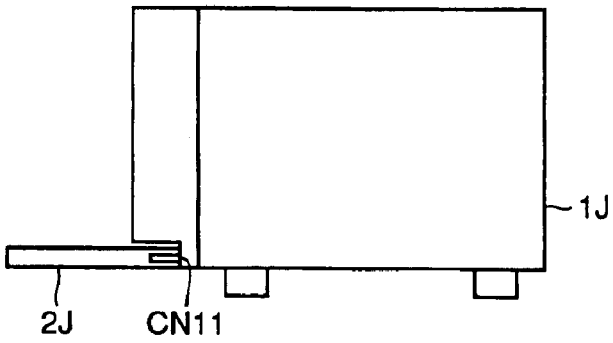
Figure 119:
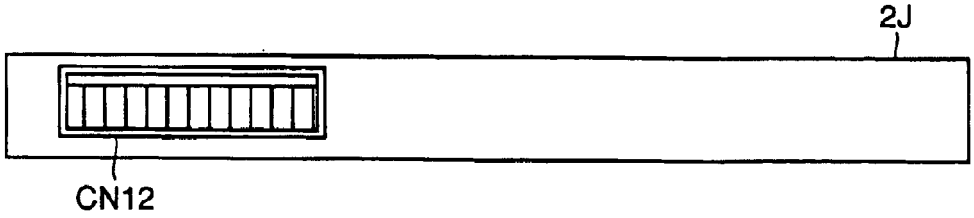
FIG. 119 is a schematic diagram of a connector unit of an I/F unit 26J of mobile equipment 2J shown in FIGS. 116A and 116B.
Figure 120:
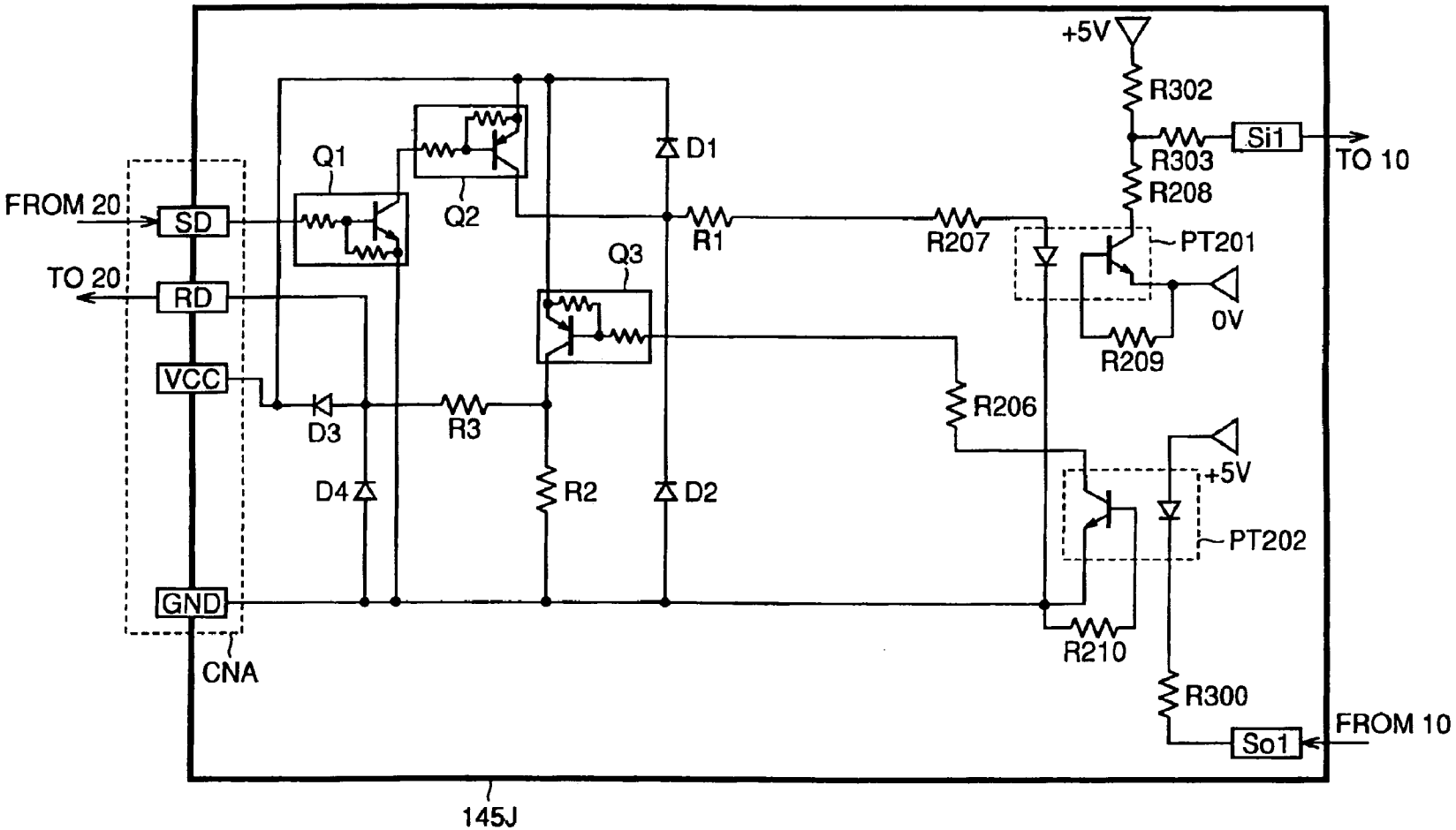
FIG. 120 is a circuit diagram of a portion inside microwave oven 1J, related to the communication with mobile equipment 2J, shown in FIG. 117B.

FIGS. 118A to 118C show the manner of connection of microwave oven 1J and mobile equipment 2J of FIG. 116B. FIG. 119 is a schematic diagram of the connector unit of I/F unit 26J of mobile equipment 2J shown in FIGS. 116A and 116B. FIG. 120 is a circuit diagram of the portion of microwave oven 1J related to communication with mobile equipment 2J, shown in FIG. 117B.

FIG. 118A shows the front face of microwave oven 1J, while FIG. 118B shows a side face of microwave oven 1J. The connector CN11 at I/F unit 145J has a protruded shape, provided at a lower front surface of microwave oven 1J. The place where connector CN11 is provided is not limited thereto. FIG. 118C is a side view of microwave oven 1J, in which connector CN12 (see FIG. 119) of I/F unit 26J of mobile equipment 2J is inserted to connector CN11, so that communication between microwave oven 1J and the mobile equipment 2J is established. Here, connector CN12 has a recessed shape.

Here, it is assumed that the information related to a recipe has been down loaded from the home page to memory 21 of mobile equipment 2J in accordance with the process steps shown in FIG. 58. Here, it is assumed that connector CN12 of I/F unit 26J of mobile equipment 26J is inserted to connector CN11 of I/F unit 145J of microwave oven 1J as shown in FIG. 118C, allowing communication between mobile equipment 2J and microwave oven 1J. FIG. 120 shows the main portion for data communication on the side of I/F unit 145J in this state.

Referring to FIG. 120, I/F unit 145 includes an input terminal Si1 for microcomputer 10 to receive as an input the data transmitted from mobile equipment 2J and an output terminal Sol for outputting data to be transmitted to mobile equipment 2J, a connector unit CNA on the side of I/F unit 26J of mobile equipment 2J, and further, between the input/output terminals Si1 and So1 and the connector unit CNA, digital transistors Q1 to Q3, diodes D1 to D4, resistors R1 to R3, R206 to R210, R300 to R303, and photocouplers PT201 and PT202.

The connector unit CNA shows the portion where connectors CN11 and CN12 are connected. In this figure, at connector portion CNA, a data transmitting terminal SD, a data receiving terminal RD, a power supply terminal VCC and a ground terminal GND on the side of I/F unit 26J are shown. Data transmitting terminal SD is a terminal for transmitting data from mobile equipment 2J to microwave oven 1J, and data receiving terminal RD is a terminal for receiving the data transmitted from microwave oven 1J to mobile equipment 2J.

In operation, as already described, when the user presses a key on a menu list on LCD panel 13 of microwave oven 1J, an L level signal is provided as an output from terminal So1 to mobile equipment 2J by the operation of microcomputer 10 of microwave oven 1J. By this signal, photocoupler PT202 is turned ON and through resistor R206, digital transistor Q3 is turned ON, so that the signal is received by the data receiving terminal RD, and in response, CPU 20 of mobile equipment 2J receives the signal as an input and sets the mobile equipment 2J to the active state.

Thereafter, in accordance with the process steps described with reference to FIG. 58, communication between microwave oven 1J and mobile equipment 2J takes place. When a signal representing a request for inputting recipe name is output from microcomputer 10 of microwave oven 1J, the signal is transmitted and applied to data receiving terminal RD through terminal So1 in the similar manner as described above, CPU 20 of mobile equipment 2J reads the information related to the recipe name downloaded previously in memory 21, and transmits the signal of the information related to the recipe name through the data transmitting terminal SD to I/F unit 145J of microwave oven 1J. The signal is applied to data transmitting terminal SD, digital transistors Q1 and Q2, resistors R1 and R207, photocoupler PT209 to data input terminal Si1. Therefore, it is possible for microcomputer 10 of microwave oven 1J to read the signal of the recipe name applied through data input terminal Si1 and to write it to memory 11.

By the above described process steps, when all the recipe names have been transmitted from mobile equipment 2J to microwave oven 1J, microcomputer 10 of microwave oven 1J outputs a signal indicating termination of reception of the information related to the recipe name through I/F unit 145J. The signal is applied to data receiving terminal RD on the side of mobile equipment 2J through the similar path as described above through terminal So1, and therefore CPU 20 of mobile equipment 2J cancels the activated state of mobile equipment 2J, in response to the application of the signal to terminal RD. Thus, the series of operations for transmitting/receiving recipe names between microwave oven 1J and mobile equipment 2J is terminated.

Though transmission/reception of the information related to recipe name only has been described, transmission/reception of recipe information related to the desired recipe takes place in the similar manner.

Thirty-Fourth Embodiment

The thirty-fourth embodiment will be described in the following.

In the present embodiment, the manner of connection for communication between the microwave oven and the mobile equipment using a dedicated cable for the microwave oven system will be described in detail. Therefore, only the portion related to the manner of connection for communication will be described here. The configurations and functions of the microwave oven system, the microwave oven and the mobile equipment in the present embodiment are similar to those shown in FIGS. 61 and 62, and therefore, description is not repeated.

Figure 121:
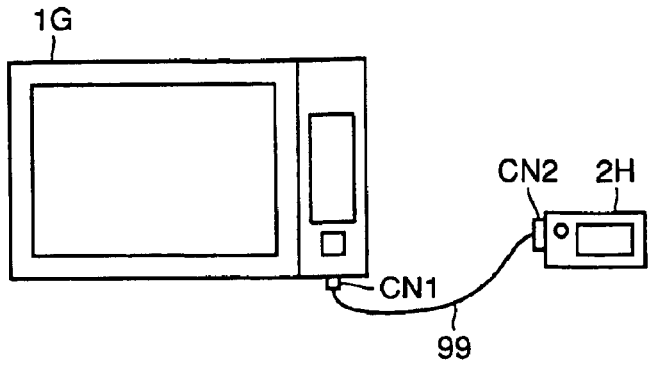
FIG. 121 shows a state of connection where the microwave oven and the mobile equipment are connected by a dedicated cable in accordance with a thirty-fourth embodiment of the present invention.
Figure 122:
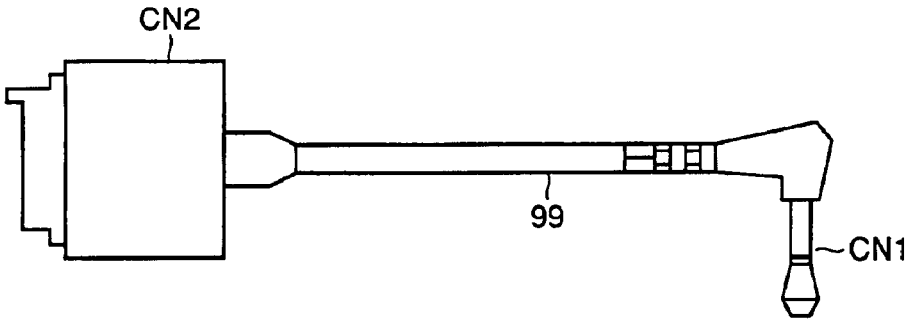
FIG. 122 shows an appearance of the dedicated cable shown in FIG. 121.
Figure 123:
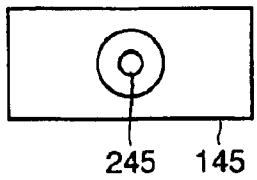
FIG. 123 shows a connector unit provided on the microwave oven of FIG. 121.
Figure 124:
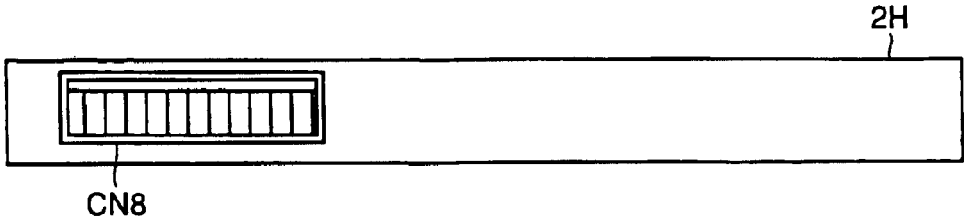
FIG. 124 shows an appearance of the connector unit provided on the mobile equipment shown in FIG. 121.
Figure 125:
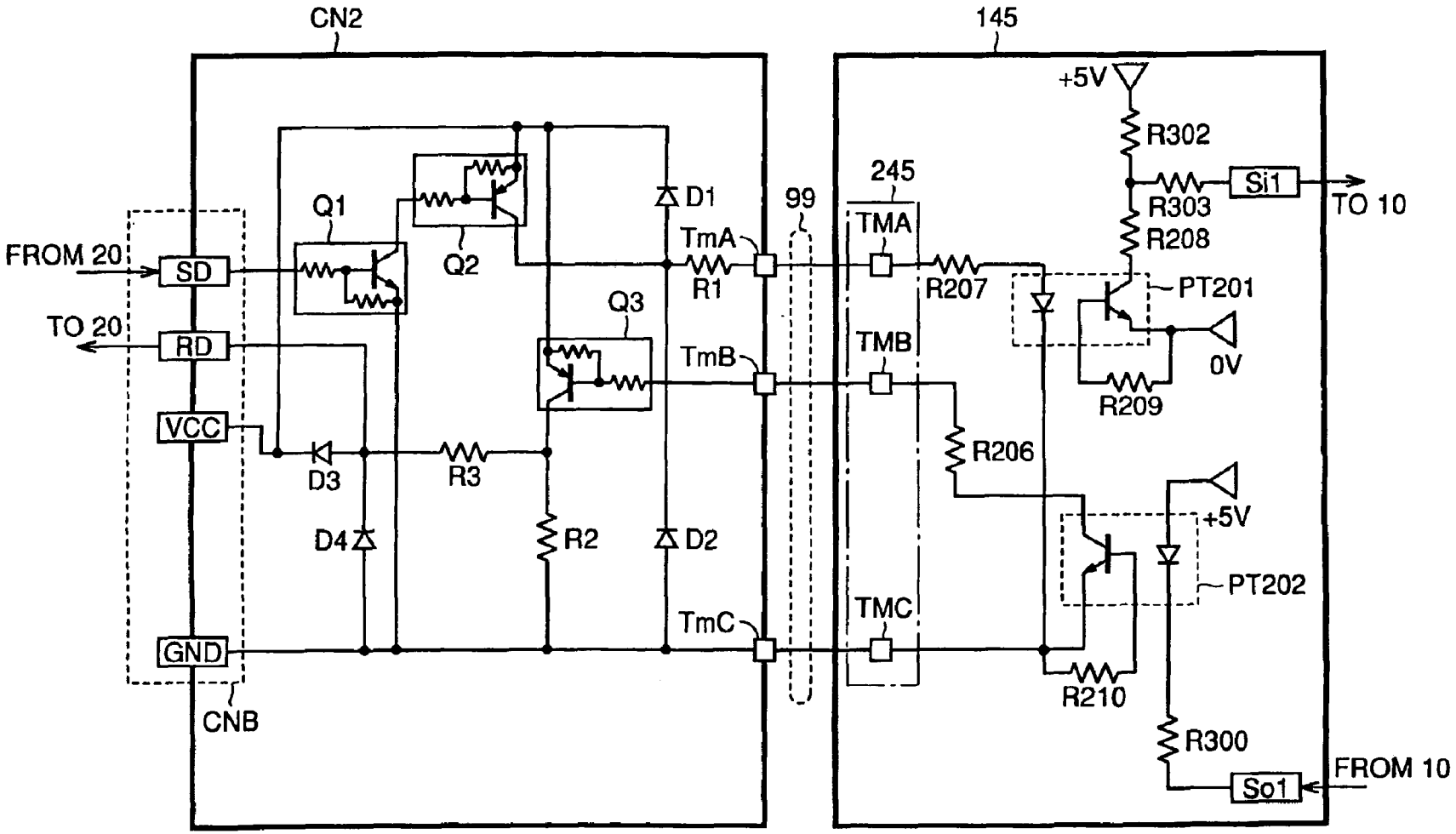
FIG. 125 shows a circuit in a connector unit in accordance with the thirty-fourth embodiment of the present invention.

FIG. 121 shows the microwave oven and the mobile equipment connected by a dedicated cable, in accordance with the thirty-fourth embodiment of the present invention. FIG. 122 shows the appearance of the dedicated cable shown in FIG. 121. FIG. 123 shows the portion of the connector provided on the microwave oven of FIG. 121. FIG. 124 shows the appearance of the connector portion provided at the mobile equipment of FIG. 121. FIG. 125 is a diagram representing the circuit at the connector portion in accordance with the present invention.

Referring to FIG. 121, microwave oven IG and mobile equipment 2H are connected through a dedicated cable 99, allowing communication. On one end of dedicated cable 99, a connector CN1 is provided and on the other hand, a protruded connector CN2 is provided. On an outer bottom surface of microwave oven 1G, there is provided a connector 245 such as shown in FIG. 123. I/F unit 145 of FIG. 62 includes connector 245. On a side surface of mobile equipment 2H, a connector CN8 such as shown in FIG. 124 is provided. Connector CN8 has a recessed shape, and when connector CN2 is inserted, the connectors are connected.

Here, connector CN1 functions as a plug, while connector 245 functions as a jack to which connector CN1 is inserted.

Shapes of connectors CN1, CN2, 245 and CN8 are not limited to those described above.

Further, though connector 245 is provided on the outer bottom surface of microwave oven 1G, the position is not limited thereto.

The circuitry in connector CN2 and 1/F unit 145, when microwave oven 1G and mobile equipment 2H are connected by a dedicated cable 99 as shown in FIG. 121 is shown in FIG. 125.

Referring to FIG. 125, the circuitry constituting I/F unit 145J shown in FIG. 120 is divided into a connector CN2 and I/F unit 145. Therefore, the details of the circuitry shown in FIG. 125 are the same as those of FIG. 120 except that the I/F is divided through cable 99.

Connector CN2 has terminals TmA, TmB and TmC to which one end of cable 99 are collectively connected, at one end, and has a connector unit CNB at the other end. Connector unit CNB is the joint between connector CN2 and serial port 25H of FIG. 62.

I/F unit 145 has, at one end, a connector 245 including terminals TMA, TMB and TMC to which connector CN1 at the other end of cable 99 is collectively connected.

When microwave oven 1G and mobile equipment 2H are connected through dedicated cable 99, terminals TmA, TmB and TmC are connected to terminals TMA, TMB and TMC, respectively.

As described above, the procedure for setting the mobile equipment 2H to the active state when microwave oven 1G and mobile equipment 2H are connected through dedicated cable 99 and the circuit operation of FIG. 125 in accordance with the process steps shown in FIG. 58 are the same as those as described with respect to the thirty-third embodiment, except that the signal pass through the cable 99. Therefore, description thereof is not repeated.

The length of dedicated cable 99 in the present embodiment is adjusted in advance such that it is impossible to place mobile equipment 2H on a top surface of microwave oven 1G, as shown in FIG. 121. Therefore, mobile equipment 2H cannot be placed on the top surface of microwave oven 1G, and therefore damage to mobile equipment 2H caused by the heat radiated from microwave oven 1G can be prevented.

Further, the shape of connector CN1 shown in FIG. 122 is small, and therefore connector 245 to which connector CN1 is inserted can be placed at an arbitrary position on the box of microwave oven 1G.

In the above described embodiments, various pieces of information including recipe information in the home page storing unit are transmitted/received through the Internet. The communication network for transmitting/receiving information, however, is not limited to the Internet. For example, the communication network may be any network such as an LAN (Local Area Network) different from the Internet. In such a case, a computer having a memory unit storing recipe information MI and the like is connected to one or more information processing apparatuses through the LAN. In response to a request from any one of the information processing apparatuses, the computer transmits and supplies the information such as the recipe information stored in the memory unit to the information processing apparatus which issued the request, through the LAN. The information processing apparatus receives the supplied information and may transfer the received information to the microwave oven for heating and cooking.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave oven system, comprising:

the Internet;

an information processing apparatus having an output a unit outputting a home page image display and transmitting/receiving information through said Internet;

a microwave oven including a control unit for controlling a heating operation in accordance with recipe data being received from the information processing unit wherein the recipe data includes descriptive information regarding material and how to cook the desired recipe and further including heating control data; and a host computer connected to said Internet and having an information storing unit storing home page information corresponding to said home page image display including a cooking recipe screen; wherein said home page information includes recipe data corresponding to each of a plurality of cooking recipes and including descriptive information describing at least one of the how-to-cook and materials and said heating control data recognized by said microwave oven for heating and cooking the cooking recipe, and information corresponding to each of a plurality of cooking recipes and used to display a transfer instructing button provided on said cooking recipe screen displaying said descriptive information and operated to transfer said recipe data through said Internet to said information processing apparatus.

2. The microwave oven system according to claim 1, wherein said microwave oven has a display unit, said supply information includes said recipe data, and said recipe data further includes recipe name data, material data and how-to-cook data representing a recipe name, materials and how-to-cook of corresponding said cooking recipe, displayed on said display unit.

3. The microwave oven system according to claim 2, further comprising a relay apparatus having one end detachably connected to said microwave oven and the other end connected to said information processing apparatus for converting a signal transferred between said microwave oven and said information processing apparatus, wherein said microwave oven further has connection notifying means notifying whether said relay apparatus is connected or not through said display unit.

4. The microwave oven system according to claim 3, wherein said connection notifying means has information storage notifying means notifying whether one or more said recipe data have been already stored in said recipe data storing unit of said relay apparatus.

5. The microwave oven system according to claim 1, wherein said information processing unit and said microwave oven communicate said supplied information using infrared ray.

6. The microwave oven system according to claim 1, wherein said information processing apparatus and said microwave oven transmit said supplied information using a recording medium.

7. The microwave oven system according to claim 1, wherein said heating control data includes one or more machine type codes representing machine type of said microwave oven, and first heating control data for controlling said heating operation of said microwave oven identified by said machine type code, corresponding to said one or more machine type codes; and said microwave oven further has machine type specific heating means for performing said heating operation in accordance with said first heating control data corresponding to said machine type code identifying the machine type of the microwave oven, among supplied said heating control data.

8. The microwave oven system according to claim 1, wherein said transfer instructing button on said home page image display effectively functions when a dedicated program is installed in said information processing apparatus.

9. A microwave oven, comprising:

a control unit for controlling operation of the microwave oven;

a display unit, disposed on the exterior of the microwave oven controlled by said control unit;

data receiving unit receiving recipe data directly recognized by said control unit of the microwave oven, said recipe data being transferred from an information processing apparatus receiving said recipe data downloaded by operating a transfer instructing button displayed on a home page image display received via the Internet, said recipe data including data to be displayed on said display unit including a name of a desired cooking recipe previously selected on the home page image display and descriptive information describing materials and how-to-cook of said desired cooking recipe, and heating control data for the desired cooking recipe; and a heating unit of which heating operation is controlled by said control unit of the microwave oven in accordance with said heating control data received by said data receiving unit.

10. The microwave oven according to claim 9, wherein said heating control data includes one or more machine type codes representing machine type of said microwave oven, and first heating control data for controlling said heating operation of said microwave oven identified by said machine type code, corresponding to respective ones of said one or more machine type codes; and said heating unit has a first heating unit of which heating operation is controlled by said first heating control data corresponding to said machine type code identifying the machine type of said microwave oven among said heating control data.

11. The microwave oven according to claim 9, further including a data receiving unit receiving said recipe data transferred by using infrared ray.

12. The microwave oven according to claim 9, further including a data receiving unit receiving said recipe data transferred by using a recording medium.

13. The microwave oven according to claim 9, wherein said recipe data is transmitted from a portable information processing apparatus transmitting/receiving information through said Internet to said microwave oven;

said information processing apparatus has a microwave oven side connector unit for communication with said microwave oven;

said data receiving unit has an apparatus side connector unit for communication with said information processing apparatus; and said recipe data is transmitted from said information processing apparatus to said microwave oven, with said microwave side connector unit being inserted to said device side connector unit.

14. A microwave oven system, comprising:

the Internet;

an information processing apparatus having a unit outputting a home page image display and transmitting/receiving information through said Internet;

a microwave oven comprising:

a control unit for controlling operation of the microwave oven;

a display unit, disposed on the exterior of the microwave oven controlled by said control unit;

data receiving unit receiving recipe data directly recognized by said control unit of the microwave oven, said recipe data being transferred from an information processing apparatus receiving said recipe data downloaded by operating a transfer instructing button displayed on a home page image display received via the Internet, said recipe data including data to be displayed on said display unit including a name of a desired cooking recipe previously selected on the home page image display and descriptive information describing materials and how-to-cook of said desired cooking recipe, and heating control data for the desired cooking recipe; and a heating unit of which heating operation is controlled by said control unit of the microwave oven in accordance with said heating control data received by said data receiving unit; and a host computer connected to said Internet and having an information storing unit storing home page information corresponding to said home page image display including a cooking recipe screen;

wherein said home page information includes recipe data corresponding to each of a plurality of cooking recipes and including descriptive information describing at least one of the how-to-cook and materials and said heating control data recognized by said microwave oven for heating and cooking the cooking recipe, and information corresponding to each of a plurality of cooking recipes and used to display a transfer instructing button provided on said cooking recipe screen displaying said descriptive information and operated to transfer said recipe data through said Internet to said information processing apparatus.

* * * * *

UNITED STATES PATENT AND TRADEMARK OFFICE

CERTIFICATE OF CORRECTION

PATENT NO. : 6,949,729 B1
APPLICATION NO. : 09/538282
DATED : September 27, 2005
INVENTOR(S) : Kazuhiko Ishikawa et al.

It is certified that error appears in the above-identified patent and that said Letters Patent is hereby corrected as shown below:

Title page,
Item [30], Foreign Application Priority Data, "December 9, 1999" should read -- December 3, 1999 --.

Signed and Sealed this

Twenty-seventh Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 6,949,729 B1
APPLICATION NO. : 09/538282
DATED : September 27, 2005
INVENTOR(S) : Kazuhiko Ishikawa et al.

It is certified that error appears in the above-identified patent and that said Letters Patent is hereby corrected as shown below:

On title page under Item (56) References Cited: U.S. PATENTS DOCUMENTS, please add the following references:

| | | | | |
|---|---|---|---|---|
| 6,137,095 | * | 10/2000 | Kashimoto et al. | 219/702 |
| 6,121,593 | * | 9/2000 | Mansbery et al. | 219/720 |
| 6,249,765 | * | 6/2001 | Adler et al. | 704/500 |

On title page under Item (56) FOREIGN PATENT DOCUMENTS, please add the following references:

| | | |
|---|---|---|
| EP | 0965934 | 12/1999 |
| JP | 11-127261 | 10/1998 |
| WO | 98/58210 | 12/1998 |
| WO | 99/21325 | 4/1999 |

Signed and Sealed this

Seventeenth Day of July, 2007

JON W. DUDAS
*Director of the United States Patent and Trademark Office*